US009610479B2

(12) United States Patent
Barelmann et al.

(10) Patent No.: US 9,610,479 B2
(45) **Date of Patent: *Apr. 4, 2017**

(54) GOLF CLUB WITH NON-METALLIC CONNECTION ASSEMBLY

(71) Applicant: Taylor Made Golf Company, Inc., Carlsbad, CA (US)

(72) Inventors: Daniel R. Barelmann, Carlsbad, CA (US); Joseph Yu, Kaohsiung (TW)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/293,323

(22) Filed: Oct. 14, 2016

(65) Prior Publication Data

US 2017/0028267 A1 Feb. 2, 2017

Related U.S. Application Data

(63) Continuation of application No. 14/587,573, filed on Dec. 31, 2014, now Pat. No. 9,468,816.

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01); *A63B 2053/022* (2013.01); *A63B 2053/045* (2013.01); *A63B 2053/0408* (2013.01); *A63B 2053/0412* (2013.01); *A63B 2053/0433* (2013.01); *A63B 2053/0491* (2013.01)

(58) Field of Classification Search
CPC ..... A63B 2053/021; A63B 2053/022
USPC ..... 473/305–307, 309–315
See application file for complete search history.

(56) References Cited

U.S. PATENT DOCUMENTS

| | | | |
|---|---|---|---|
| 1,454,267 | A | 5/1923 | Challis |
| 1,844,812 | A | 2/1932 | Thorpe |
| 2,020,679 | A | 11/1935 | Fitzpatrick |
| 2,067,556 | A | 1/1937 | Wettlaufer |
| 3,524,646 | A | 8/1970 | Wheeler |
| 4,854,583 | A | 8/1989 | Kobayashi |
| 4,943,059 | A | 7/1990 | Morell |
| 4,948,132 | A | 8/1990 | Wharton |
| 5,039,098 | A | 8/1991 | Pelz |
| 5,133,553 | A | 7/1992 | Divnick |
| 5,184,819 | A | 2/1993 | Desbiolles |
| 5,433,442 | A | 7/1995 | Walker |
| 5,496,029 | A | 3/1996 | Heath et al. |
| 5,513,844 | A | 5/1996 | Ashcraft et al. |
| 5,527,034 | A | 6/1996 | Ashcraft et al. |
| 5,588,921 | A | 12/1996 | Parsick |
| 5,702,310 | A | 12/1997 | Wozny |
| 5,722,901 | A | 3/1998 | Barron et al. |
| 5,851,155 | A | 12/1998 | Wood et al. |
| 5,863,260 | A | 1/1999 | Butler et al. |
| 5,885,170 | A | 3/1999 | Takeda |
| 5,951,411 | A | 9/1999 | Wood et al. |
| 6,149,533 | A | 11/2000 | Finn |
| 6,273,828 | B1 | 8/2001 | Wood et al. |

(Continued)

*Primary Examiner* — Aarti B Berdichevsky
*Assistant Examiner* — Rayshun Peng
(74) *Attorney, Agent, or Firm* — Gallagher & Dawsey Co., LPA; David J. Dawsey; Michael J. Gallagher

(57) ABSTRACT

A golf club head having a connection assembly with a non-metallic component possessing unique relationships that offer increased durability, weight sayings, and reduced manufacturing costs.

20 Claims, 73 Drawing Sheets

(56) References Cited

U.S. PATENT DOCUMENTS

| | | | |
|---|---|---|---|
| 6,352,482 | B1 | 3/2002 | Jacobson et al. |
| 6,475,100 | B1 | 11/2002 | Helmstetter et al. |
| 6,514,154 | B1 | 2/2003 | Finn |
| 6,547,673 | B2 | 4/2003 | Roark |
| 6,620,053 | B2 | 9/2003 | Tseng |
| 6,769,994 | B2 | 8/2004 | Boone |
| 6,769,996 | B2 | 8/2004 | Tseng |
| 6,786,834 | B1 | 9/2004 | Matheson et al. |
| 6,890,269 | B2 | 5/2005 | Burrows |
| 6,896,626 | B2 | 5/2005 | Drossos |
| 7,115,046 | B1 | 10/2006 | Evans |
| 7,335,113 | B2 | 2/2008 | Hocknell et al. |
| 7,438,645 | B2 | 10/2008 | Hsu |
| 7,476,160 | B2 | 1/2009 | Hocknell et al. |
| 7,892,105 | B2 | 2/2011 | Galloway |
| 8,226,496 | B2 | 7/2012 | Galloway |
| 2001/0007835 | A1 | 7/2001 | Baron |
| 2002/0037773 | A1 | 3/2002 | Wood et al. |
| 2004/0018886 | A1 | 1/2004 | Burrows |
| 2004/0018887 | A1 | 1/2004 | Burrows |
| 2007/0117645 | A1 | 5/2007 | Nakashima |
| 2012/0122601 | A1 | 5/2012 | Beach et al. |
| 2014/0051527 | A1 | 2/2014 | Sato |

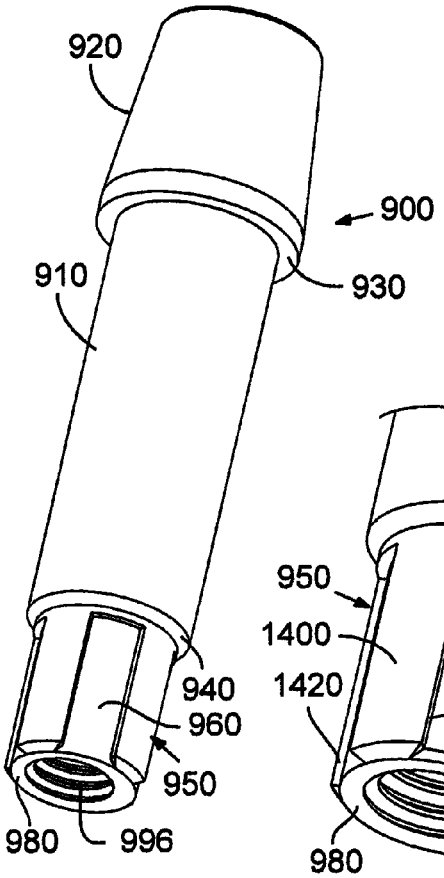
FIG. 21
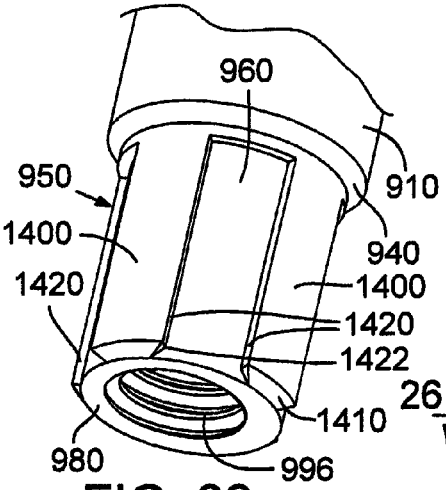
FIG. 22
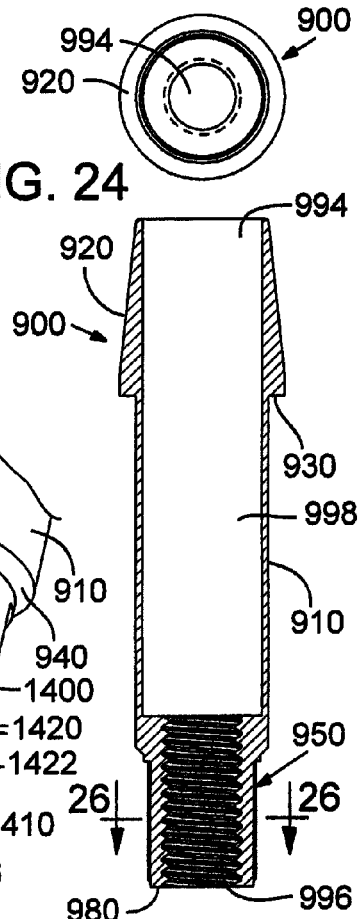
FIG. 23
FIG. 24
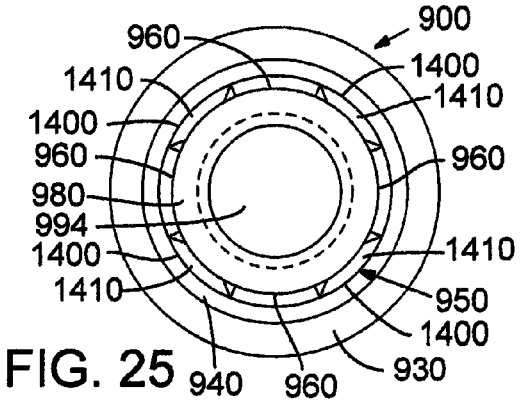
FIG. 25
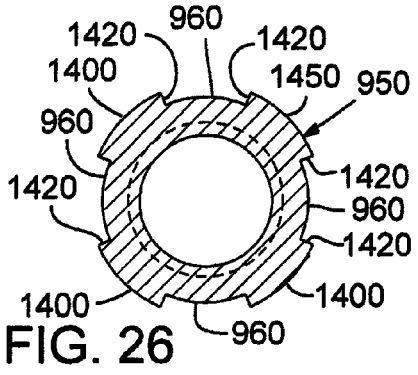
FIG. 26

GOLF CLUB WITH NON-METALLIC CONNECTION ASSEMBLY

CROSS-REFERENCE TO RELATED APPLICATIONS

This application is a continuation of U.S. nonprovisional application Ser. No. 14/587,573, filed on Dec. 31, 2014, all of which is incorporated by reference as if completely written herein. Related applications concerning golf clubs and connection assemblies include U.S. patent application Ser. Nos. 13/686,677, 13/841,325, 13/956,046, 14/074,481, 14/109,739, 14/196,964, and 14/456,927, which are incorporated by reference herein in their entirety.

FIELD

The present application is directed to embodiments of golf club heads, particularly club heads that have adjustable components including connection assemblies having at least one non-metallic component.

BACKGROUND

For a given type of golf club (e.g., driver, iron, putter, wedge), the golfing consumer has a wide variety of variations to choose from. This variety is driven, in part, by the wide range in physical characteristics and golfing skill among golfers and by the broad spectrum of playing conditions that a golfer may encounter. For example, taller golfers require clubs with longer shafts; more powerful golfers or golfers playing in windy conditions or on a course with firm fairways may desire clubs having less shaft flex (greater stiffness); and a golfer may desire a club with certain playing characteristics to overcome a tendency in their swing (e.g., a golfer who has a tendency to hit low-trajectory shots may want to purchase a club with a greater loft angle). Variations in shaft flex, loft angle and handedness (i.e., left or right) alone account for 24 variations of the TaylorMade r7 460 driver.

Having such a large number of variations available for a single golf club, golfing consumers can purchase clubs with club head-shaft combinations that suit their needs. However, shafts and club heads are generally manufactured separately, and once a shaft is attached to a club head, usually by an adhesive, replacing either the club head or shaft is not easily done by the consumer. Motivations for modifying a club include a change in a golfer's physical condition (e.g., a younger golfer has grown taller), an increase the golfer's skill or to adjust to playing conditions. Typically, these modifications must be made by a technician at a pro shop. The attendant cost and time spent without clubs may dissuade golfers from modifying their clubs as often as they would like, resulting in a less-than-optimal golfing experience. Thus, there has been effort to provide golf clubs that are capable of being assembled and disassembled by the golfing consumer.

To that end, golf clubs having club heads that are removably attached to a shaft by a mechanical fastener are known in the art. For example, U.S. Pat. No. 7,083,529 to Cackett et al. (hereinafter, "Cackett") discloses a golf club with interchangeable head-shaft connections. The connection includes a tube, a sleeve and a mechanical fastener. The sleeve is mounted on a tip end of the shaft. The shaft with the sleeve mounted thereon is then inserted in the tube, which is mounted in the club head. The mechanical fastener secures the sleeve to the tube to retain the shaft in connection with the club head. The sleeve has a lower section that includes a keyed portion which has a configuration that is complementary to the keyway defined by a rotation prevention portion of the tube. The keyway has a non-circular cross-section to prevent rotation of the sleeve relative to the tube. The keyway may have a plurality of splines, or a rectangular or hexagonal cross-section.

While removably attachable golf club heads of the type represented by Cackett provide golfers with the ability to disassemble a club head from a shaft, it is necessary that they also provide club head-shaft interconnections that have the integrity and rigidity of conventional club head-shaft interconnection. For example, the manner in which rotational movement between the constituent components of a club head-shaft interconnection is restricted must have sufficient load-bearing areas and resistance to stripping. Consequently, there is room for improvement in the art.

SUMMARY

In a representative embodiment, a golf club shaft assembly for attaching to a club head comprises a shaft having a lower end portion and a sleeve mounted on the lower end portion of the shaft. The sleeve can be configured to be inserted into a hosel opening of the club head. The sleeve has an upper portion defining an upper opening that receives the lower end portion of the shaft and a lower portion having eight, longitudinally extending, angularly spaced external splines located below the shaft and adapted to mate with complimentary splines in the hosel opening. The lower portion defines a longitudinally extending, internally threaded opening adapted to receive a screw for securing the shaft assembly to the club head when the sleeve is inserted in the hosel opening.

In another representative embodiment, a method of assembling a golf club shaft and a golf club head is provided. The method comprises mounting a sleeve onto a tip end portion of the shaft, the sleeve having a lower portion having eight external splines protruding from an external surface and located below a lower end of the shaft, the external splines having a configuration complementary to internal splines located in a hosel opening in the club head. The method further comprises inserting the sleeve into the hosel opening so that the external splines of the sleeve lower portion engage the internal splines of the hosel opening, and inserting a screw through an opening in the sole of the club head and into a threaded opening in the sleeve and tightening the screw to secure the shaft to the club head.

In another representative embodiment, a removable shaft assembly for a golf club having a hosel defining a hosel opening comprises a shaft having a lower end portion. A sleeve can be mounted on the lower end portion of the shaft and can be configured to be inserted into the hosel opening of the club head. The sleeve has an upper portion defining an upper opening that receives the lower end portion of the shaft and a lower portion having a plurality of longitudinally extending, angularly spaced external splines located below the shaft and adapted to mate with complimentary splines in the hosel opening. The lower portion defines a longitudinally extending, internally threaded opening adapted to receive a screw for securing the shaft assembly to the club head when the sleeve is inserted in the hosel opening. The upper portion of the sleeve has an upper thrust surface that is adapted to engage the hosel of the club head when the sleeve is inserted into the hosel opening, and the sleeve and the shaft have a combined axial stiffness from the upper thrust surface to a lower end of the sleeve of less than about $1.87\times10^8$ N/m.

In another representative embodiment, a golf club assembly comprises a club head having a hosel defining an opening having a non-circular inner surface, the hosel defining a longitudinal axis. A removable adapter sleeve is configured to be received in the hosel opening, the sleeve having a non-circular outer surface adapted to mate with the non-circular inner surface of the hosel to restrict relative rotation between the adapter sleeve and the hosel. The adapter sleeve has a longitudinally extending opening and a non-circular inner surface in the opening, the adapter sleeve also having a longitudinal axis that is angled relative to the longitudinal axis of the hosel at a predetermined, non-zero angle. The golf club assembly also comprises a shaft having a lower end portion and a shaft sleeve mounted on the lower end portion of the shaft and adapted to be received in the opening of the adapter sleeve. The shaft sleeve has a noncircular outer surface adapted to mate with the non-circular inner surface of the adapter sleeve to restrict relative rotation between the shaft sleeve and the adapter sleeve. The shaft sleeve defines a longitudinal axis that is aligned with the longitudinal axis of the adapter sleeve such that the shaft sleeve and the shaft are supported at the predetermined angle relative to the longitudinal axis of the hosel.

In another representative embodiment, a golf club assembly comprises a club head having a hosel defining an opening housing a rotation prevention portion, the hosel defining a longitudinal axis. The assembly also comprises a plurality of removable adapter sleeves each configured to be received in the hosel opening, each sleeve having a first rotation prevention portion adapted to mate with the rotation prevention portion of the hosel to restrict relative rotation between the adapter sleeve and the hosel. Each adapter sleeve has a longitudinally extending opening and a second rotation prevention portion in the opening, wherein each adapter sleeve has a longitudinal axis that is angled relative to the longitudinal axis of the hosel at a different predetermined angle. The assembly further comprises a shaft having a lower end portion and a shaft sleeve mounted on the lower end portion of the shaft and adapted to be received in the opening of each adapter sleeve. The shaft sleeve has a respective rotation prevention portion adapted to mate with the second rotation prevention portion of each adapter sleeve to restrict relative rotation between the shaft sleeve and the adapter sleeve in which the shaft sleeve is in inserted. The shaft sleeve defines a longitudinal axis and is adapted to be received in each adapter sleeve such that the longitudinal axis of the shaft sleeve becomes aligned with the longitudinal axis of the adapter sleeve in which it is inserted.

In another representative embodiment, a method of assembling a golf shaft and golf club head having a hosel opening defining a longitudinal axis is provided. The method comprises selecting an adapter sleeve from among a plurality of adapter sleeves, each having an opening adapted to receive a shaft sleeve mounted on the lower end portion of the shaft, wherein each adapter sleeve is configured to support the shaft at a different predetermined orientation relative to the longitudinal axis of the hosel opening. The method further comprises inserting the shaft sleeve into the selected adapter sleeve, inserting the selected adapter sleeve into the hosel opening of the club head, and securing the shaft sleeve, and therefore the shaft, to the club head with the selected adapter sleeve disposed on the shaft sleeve.

In yet another representative embodiment, a golf club head comprises a body having a striking face defining a forward end of the club head, the body also having a read end opposite the forward end. The body also comprises an adjustable sole portion having a rear end and a forward end pivotably connected to the body at a pivot axis, the sole portion being pivotable about the pivot axis to adjust the position of the sole portion relative to the body.

In still another representative embodiment, a golf club assembly comprises a golf club head comprising a body having a striking face defining a forward end of the club head. The body also has a read end opposite the forward end, and a hosel having a hosel opening. The body further comprises an adjustable sole portion having a rear end and a forward end pivotably connected to the body at a pivot axis. The sole portion is pivotable about the pivot axis to adjust the position of the sole portion relative to the body. The assembly further comprises a removable shaft and a removable sleeve adapted to be received in the hosel opening and having a respective opening adapted to receive a lower end portion of the shaft and support the shaft relative to the club head at a desired orientation. A mechanical fastener is adapted to releasably secure the shaft and the sleeve to the club head.

In another representative embodiment, a method of adjusting playing characteristics of a golf club comprises adjusting the square loft of the club by adjusting the orientation of a shaft of the club relative to a club head of the club, and adjusting the face angle of the club by adjusting the position of a sole of the club head relative to the club head body.

In another representative embodiment, a golf club head including a body comprising a face plate positioned at a forward portion of the golf club head, a hosel, a sole positioned at a bottom portion of the golf club head, and a crown positioned at atop portion of the golf club head is described. The body defines an interior cavity and at least 50 percent of the crown has a thickness less than about 0.8 mm. An adjustable loft system is described allowing a maximum loft change of about 0.5 degrees to about 3.0 degrees. At least one weight port is formed in the body and at least one weight is configured to be retained at least partially within at least one of the weight ports.

In still another representative embodiment, a golf club head including a body and an adjustable loft system configured to allow a maximum loft change is described. At least two weight ports are formed in the body having a distance between the at least two weight ports. At least one weight is configured to be retained at least partially within at least one of the weight ports. The at least one weight has a maximum mass and the distance between the at least two weight ports multiplied by the maximum loft change multiplied by the maximum mass of the at least one weight is between about 50 mm·g·degrees and about 6,000 mm·g·degrees.

In yet another representative embodiment, a golf club head including a body and a crown positioned at atop portion of the golf club head is described. The body defines an interior cavity and at least 50 percent of the crown has an areal weight less than 0.4 g/cm$^2$. An adjustable loft system is also described allowing a maximum loft change of about 0.5 degrees to about 3.0 degrees. At least one weight port is formed in the body and at least one weight is configured to be retained at least partially within a weight port. The golf club head can include a composite face insert.

In another representative embodiment, a golf club head including a rotatably adjustable sole piece adapted to be positioned at a plurality of rotational positions with respect to an axis extending through the sole piece is described. This club head includes a releasable locking mechanism configured to lock the sole piece at a selected one of the plurality of rotational positions on the sole.

In another representative embodiment, a golf club head including a generally triangular adjustable sole piece adapted to be positioned at three discrete selectable positions with respect to an axis extending through the sole piece is described. This club head includes a screw adapted to extend through the sole piece and into a threaded opening in the sole of the club head body and configured to lock the sole piece at a selected one of the three positions on the sole.

In another representative embodiment, a golf club head including a rotatably adjustable sole piece adapted to be positioned at a plurality of rotational positions with respect to an axis extending through the sole piece is described. In this embodiment, adjusting the rotational position of the sole piece can change a face angle of the golf club head between about 0.5 and about 12 degrees.

In another representative embodiment, a golf club head is described that includes a recessed cavity in a sole of the golf club head having a platform extending downwardly from a roof of the cavity, and an adjustable sole piece adapted to be at least partially received within the cavity and comprising a body having a plurality of surfaces adapted to contact the platform and being offset from each other along an axis extending through the body. In this embodiment, the sole piece can be positioned at least partially within the cavity at a plurality of rotational and axial positions with respect to the axis. Furthermore, at each rotational position, at least one of the surfaces of the body contacts the platform to set the axial position of the sole piece.

In still another representative embodiment, a golf club is described that includes a club head body comprising hosel and a sole, the sole being positioned at a bottom portion of the club head body and comprising a recessed cavity and a platform extending downwardly from a roof of the cavity. This embodiment also includes an adjustable sole piece adapted to be at least partially received within the cavity and comprising a body having a plurality of surfaces adapted to contact the platform and being offset from each other along an axis extending through the body. In this embodiment, the sole piece can be positioned at least partially within the cavity at a plurality of rotational and axial positions with respect to the axis, wherein at each rotational position, at least one of said surfaces of the body contacts the platform to set the axial position of the sole piece, and whereby adjusting the axial position of the sole piece can thereby change a face angle of the golf club between about 0.5 and about 12 degrees. This embodiment also includes a releasable locking mechanism configured to lock the sole piece at a selected one of the plurality of rotational positions on the sole; a shaft; and a rotatably adjustable sleeve to couple the shaft to the hosel. Rotating the adjustable sleeve relative to the hosel can cause the shaft to extend in a different direction from the hosel, thereby changing a square loft of the golf club. Furthermore, the square loft and the face angle can be adjusted independently of each other.

Some embodiments of a wood-type golf club head comprise a body having a front portion, a rear portion, a toe portion, a heel portion, a sole, and a plurality of ribs positioned on an internal surface of the sole. The plurality of ribs includes a first rib extending from the toe portion in a rearward and heelward direction, a second rib extending from the heel portion in a rearward and toeward direction, and a third rib extending from the rear portion in a frontward direction, wherein the first, second and third ribs converge at a convergence location.

In some embodiments, the body further comprises a first weight port positioned at the toe portion and a second weight port positioned at the heel portion, the first rib being connected to the first weight port and the second rib being connected to the second weight port.

In some embodiments, the plurality of ribs comprises a fourth rib extending from the convergence location in a frontward direction.

In some embodiments, the body further comprises a hosel and the plurality of ribs comprises a fourth rib extending between the hosel and the first weight port.

In some embodiments, the convergence location is rearward and heelward of a center of gravity of the golf club head.

In some embodiments, the sole comprises a convergence zone, such as a pocket, that is recessed with respect to a surrounding sole region and the convergence location is positioned above the convergence zone. In some of these embodiments, the first, second and third ribs extend across an internal surface of the convergence zone and across an internal surface of the surrounding sole region. In some of these embodiments, the first, second and third ribs converge at an aperture in the sole, the aperture being at the center of the convergence zone.

In some embodiments, the club head further comprises an adjustable sole piece coupled to an external surface of a pocket via a fastener that passes through the sole piece and is secured to an aperture in the sole. In some of these embodiments, the adjustable sole piece is configured to be positioned at a plurality of axial positions with respect to an axis extending through the sole piece, the adjustable sole piece being releasably lockable to the sole at a selected one of the plurality of axial positions on the sole. In some of these embodiments, the adjustable sole piece has a generally triangular configuration and is adapted to be positioned at three distinct axial positions with respect to the axis extending through the aperture. In some of these embodiments, the adjustable sole piece is configured to receive at least two projections located on the sole.

Some embodiments of a golf club head comprise a body having a sole portion positioned at a bottom portion of the body, the sole portion having a frequency of a first fundamental sole mode that is greater than 2,500 Hz. The club head also comprises a hosel portion positioned at a heel portion of the body, a crown portion located on an upper portion of the body, and a striking face portion located on a front portion of the body. The sole portion comprises a recessed zone that is configured to receive an adjustable sole piece and a surrounding sole region, and at least one rib that extends along a portion of an internal surface of the sole portion. The adjustable sole piece is configured to provide at least a first position associated with at least a first club head face angle, the adjustable sole piece configured to further provide at least a second position associated with at least a second club head face angle, and the adjustable sole piece is configured to receive at least two projections located on the sole.

In some of these embodiments, the body further comprises a weight port positioned at a toe portion of the body, and the one or more ribs positioned on an internal surface of the sole include a first rib that extends along the interior surface of the sole from the hosel to the weight port. The sole portion further comprises a front sole region configured to contact the ground when the golf club head is in an address position, a recessed sole region that is recessed relative to the front sole region such that the recessed sole region is spaced from the ground, and a sloped sole transition zone extending inward from the front sole region to the recessed sole region. The first rib extends from a first portion of the front sole region adjacent the hosel, across a first portion of the sole transition zone adjacent the hosel, across the recessed sole region, across a second portion of the sole transition zone adjacent the weight port, and across a second portion of the front sole region adjacent the weight port. In some of these embodiments, when the golf club head is in the address position, the first rib extends in a straight line when projected onto an X-Y plane parallel with the ground.

In some of these embodiments, the first rib has a height that varies along its length between the hosel and the weight port, a height adjacent the hosel and a height adjacent the weight port being greater than a height where the first rib extends across the recessed sole region.

In some of these embodiments, the adjustable sole piece is capable of being positioned in three discrete positions to adjust the face angle of the club head.

Some embodiments of a golf club comprise a body, a shaft connected to the body, a grip connected to the shaft, a crown portion located on an upper portion of the body, a striking face located on a front portion of the body, and a sole portion located on a bottom portion of the body. The sole portion comprises a recessed zone configured to receive an adjustable sole piece and a surrounding sole region, and at least one rib that extends along a portion of an internal surface of the sole portion. The adjustable sole piece is configured to provide at least a first position associated with at least a first club head face angle, and the adjustable sole piece is configured to further provide at least a second position associated with at least a second club head face angle.

Some of these embodiments further comprise an adjustable sole piece positioned in the recessed zone and a fastener securing the adjustable sole piece to the recessed zone. A portion of the at least one rib extends along a portion of the internal surface of the recessed zone and is positioned within a region directly above the adjustable sole piece when the golf club is in the address position.

In some of these embodiments, the sole portion includes a frequency of a first fundamental sole mode that is greater than 2,500 Hz. In some of these embodiments, the sole portion includes a frequency of a first fundamental sole mode that is greater than 3,000 Hz.

Some embodiments of a golf club head comprise a rotatably adjustable sole piece configured to be secured to the sole at five or more rotational positions with respect to a central axis extending through the sole piece, wherein the sole piece extends a different axial distance from the sole at each of the rotational positions. The adjustable sole piece can be generally pentagonal and can be secured to the sole at five discrete selectable positions. The adjustable sole piece can include an annular side wall that includes at least five wall segments that are substantially symmetrical with one another relative to the central axis of the sole piece. In some embodiments, adjusting the rotational position of the sole piece changes the face angle of the golf club head independently of the loft angle of the golf club head when the golf club head is in the address position.

The golf club head can further comprise a sole positioned at a bottom portion of the golf club head with a recessed sole port in the sole. The rotatably adjustable sole piece can be adapted to be at least partially received within the sole port. The sole piece can comprise a central body having a plurality of surfaces adapted to contact the sole port, the surfaces being offset from each other along a central axis extending through the central body. The sole piece can be positioned at least partially within the sole port at five or more rotational and axial positions with respect to the central axis. At each rotational position, at least one of the surfaces of the central body contacts the sole port to set the axial position of the sole piece. The sole port and the sole piece can each be generally pentagonal when viewed from the bottom of the golf club head.

Some embodiments of a golf club head comprise a body having a face, a crown and a sole together defining an interior cavity, the body having a channel located on the sole and extending generally from a heel end of the body to a toe end of the body. The distance between a first vertical plane intersecting a center of the face and a second vertical plane bisecting the channel is less than about 50 mm over a full length of the channel A weight member can be movably positioned within the channel such that a position of the weight member within the channel is able to be adjusted.

In some of these embodiments, the distance between the first vertical plane and the second vertical plane is less than about 40 mm over a full length of the channel In still other embodiments, the distance between the first vertical plane and the second vertical plane is less than about 30 mm over a full length of the channel In some of these embodiments, a ledge extends within the channel from the heel end of the body to the toe end of the body. The ledge can include a plurality of locking projections located on an exposed surface of the ledge. In some of these embodiments, the weight member includes an outer member retained within the channel and in contact with the ledge, an inner member retained within the channel, and a fastening bolt that connects the outer member to the inner member. In some of these embodiments, the outer member includes a plurality of locking notches adapted to selectively engage the locking projections located on the exposed surface of the ledge. In some of these embodiments, the outer member has a length L extending generally in the heel to toe direction of the channel, and each adjacent pair of locking projections are separated by a distance D1 along the ledge, with L>D1.

In some of these embodiments, a rotatably adjustable sole piece is secured to the sole at one of a plurality of rotational positions with respect to a central axis extending through the sole piece. The sole piece extends a different axial distance from the sole at each of the rotational positions. Adjusting the sole piece to a different one of the rotational positions changes the face angle of the golf club head independently of the loft angle of the golf club head when the golf club head is in the address position. In some of these embodiments, a releasable locking mechanism is configured to lock the sole piece at a selected one of the rotational positions on the sole. The locking mechanism can include a screw adapted to extend through the sole piece and into a threaded opening in the sole of the club head body. In some of these embodiments, the sole piece has a convex bottom surface, such that when the sole piece is at each rotational position the bottom surface has a heel-to-toe curvature that substantially matches a heel-to-toe curvature of a leading contact surface of the sole.

Some embodiments of a golf club head include a body having a face, a crown and a sole together defining an interior cavity, the body having a channel located on the sole and extending generally from a heel end of the body to a toe end of the body. A weight member can be movably positioned within the channel such that a position of the weight member within the channel is able to be adjusted. The face includes a center face location that defines the origin of a coordinate system in which an x-axis is tangential to the face at the center face location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin. A maximum x-axis position adjustment range of the weight member (Max Δx) is greater than 50 mm and a maximum y-axis position adjustment range of the weight member Max Δy) is less than 40 mm.

In some of these embodiments, the weight member has a mass ($M_{WA}$) and the product of $M_{WA}$ * Max Ax is at least 250 g·mm, such as between about 250 g·mm and about 4950 g·mm.

In some of these embodiments, the product of $M_{WA}$*Max Δy is less than 1800 g·mm, such as between about 0 g·mm and about 1800 g·mm.

In some of these embodiments, a center of gravity of the body has a z-axis coordinate ($CG_z$) that is less than about 0 mm.

Some embodiments of a golf club head include a body having a face, a crown and a sole together defining an interior cavity, the body having a channel located on the sole and extending generally from a heel end of the body to a toe end of the body. A weight member can be movably positioned within the channel such that a position of the weight member within the channel is able to be adjusted, thereby adjusting a location of a center of gravity of the body. The face includes a center face location that defines the origin of a coordinate system in which an x-axis is tangential to the face at the center face location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin. Adjustment of the weight member can provide a maximum x-axis adjustment range of the position of the center of gravity (Max $\Delta CG_x$) that is greater than 2 mm and a maximum y-axis adjustment range of the center of gravity (Max ΔCGy) that is less than 3 mm.

In some of these embodiments, a center of gravity of the body has a z-axis coordinate (CGz) that is less than about 0 mm.

The foregoing and other features and advantages of the invention will become more apparent from the following detailed description, which proceeds with reference to the accompanying figures.

BRIEF DESCRIPTION OF THE DRAWINGS

FIG. 21 is a perspective view of the shaft sleeve of the connection assembly shown in FIG. 18.

FIG. 22 is an enlarged perspective view of the lower portion of the shaft sleeve of FIG. 21.

FIG. 23 is a cross-sectional view of the shaft sleeve of FIG. 21.

FIG. 24 is a top plan view of the shaft sleeve of FIG. 21.

FIG. 25 is a bottom plan view of the shaft sleeve of FIG. 21.

FIG. 26 is a cross-sectional view of the shaft sleeve, taken along line 26-26 of FIG. 23.

Figure 97A:
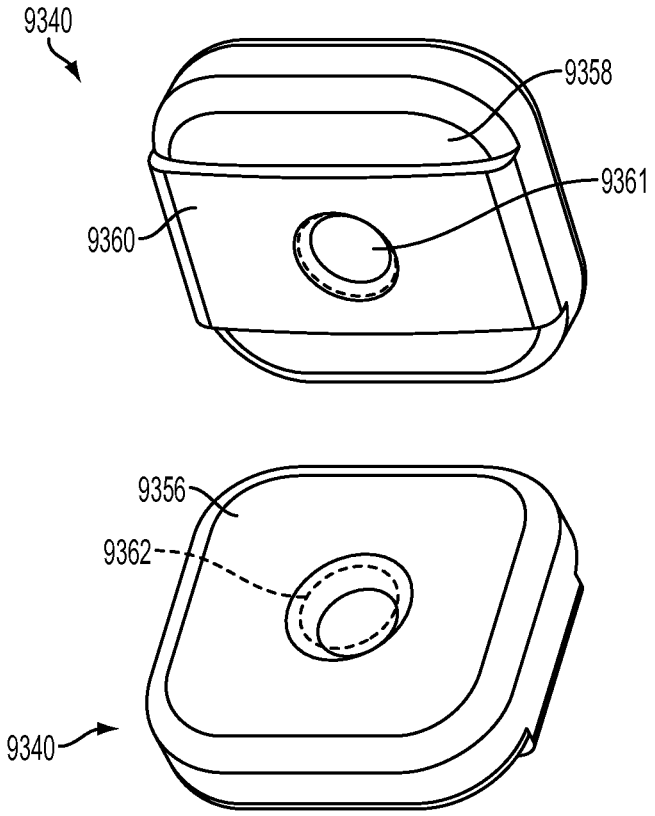
FIG. 97A includes top and bottom perspective views of a mass member of the golf club head of FIGS. 93A-D.
Figure 97B:
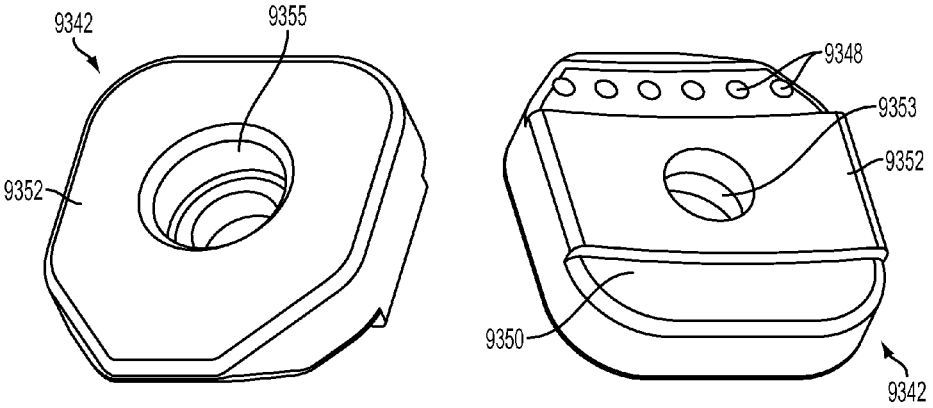
FIG. 97B includes top and bottom perspective views of an embodiment of a washer of the golf club head of FIGS. 93A-D.
Figure 97C:
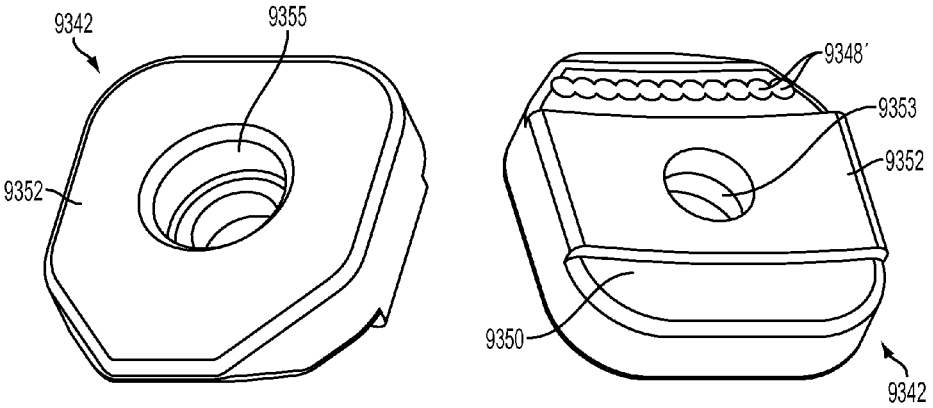

FIG. 97C includes top and bottom perspective view of another embodiment of a washer of the golf club head of FIGS. 93A-D.

Figure 98A:
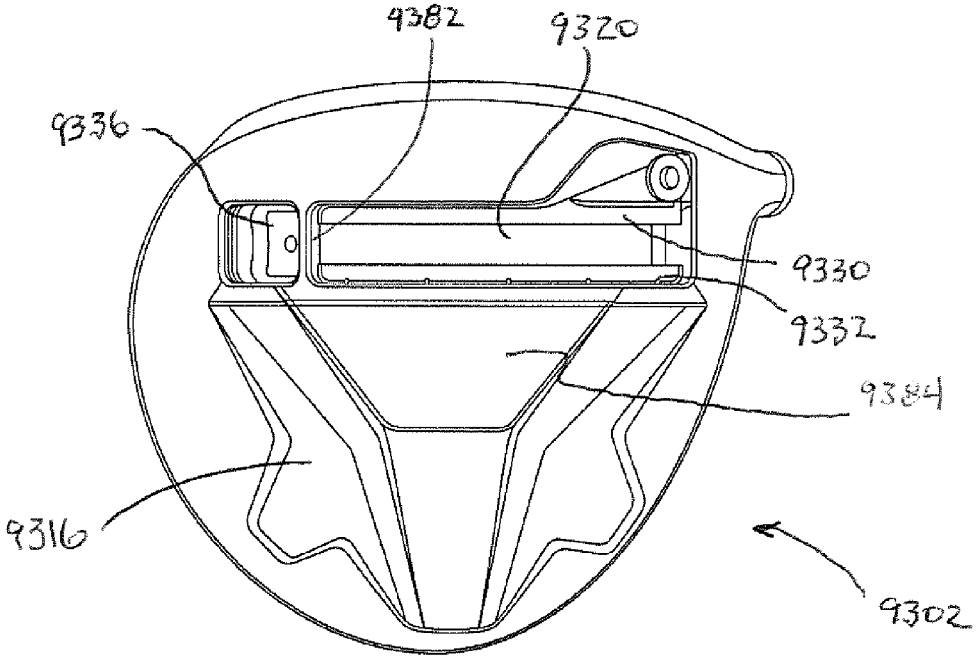
Figure 98B:
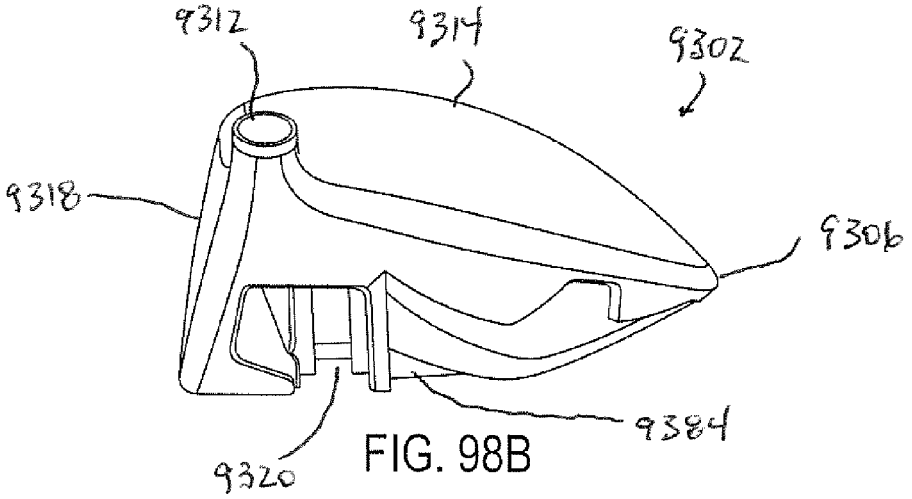

FIGS. 98A-B are bottom and heel side views, respectively, of a golf club head, according to yet another embodiment.

Figure 98C:
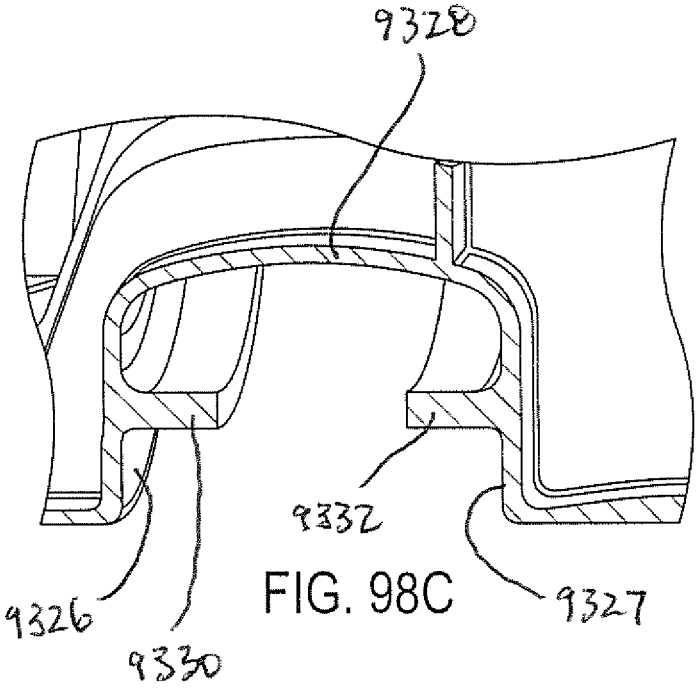

FIG. 98C is a close up view of a portion of the golf club head shown in FIGS. 98A-B.

Figure 99:
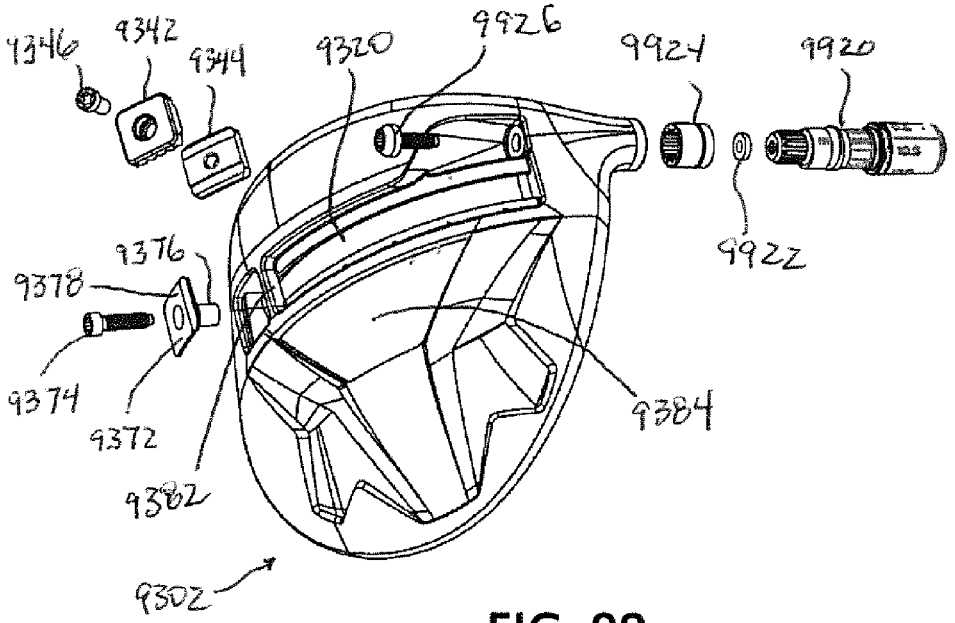

FIG. 99 is an exploded view of a golf club head, according to yet another embodiment.

Figure 100:
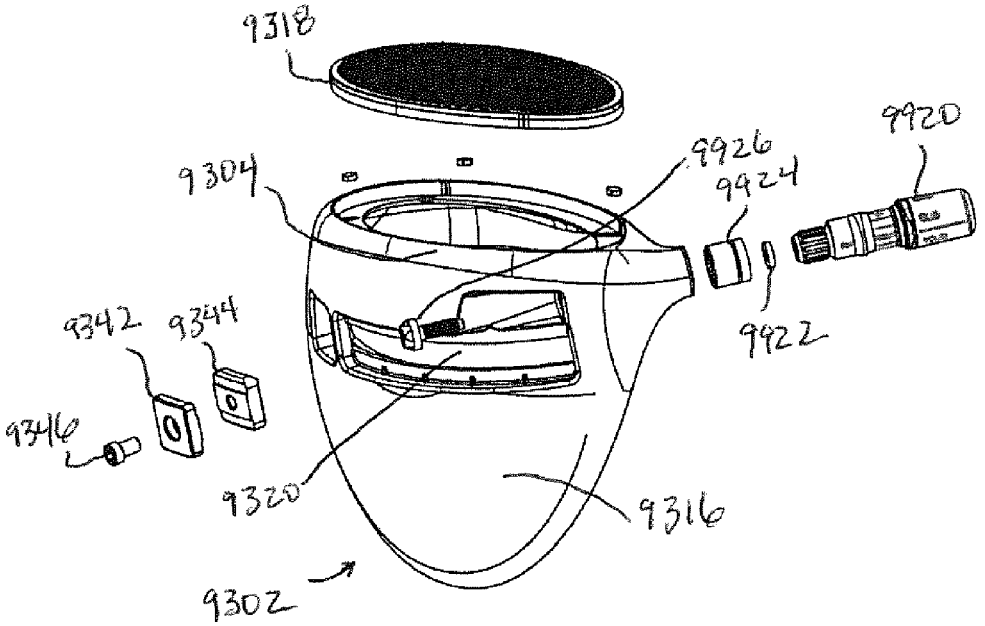

FIG. 100 is an exploded view of a golf club head, according to yet another embodiment.

Figure 101:
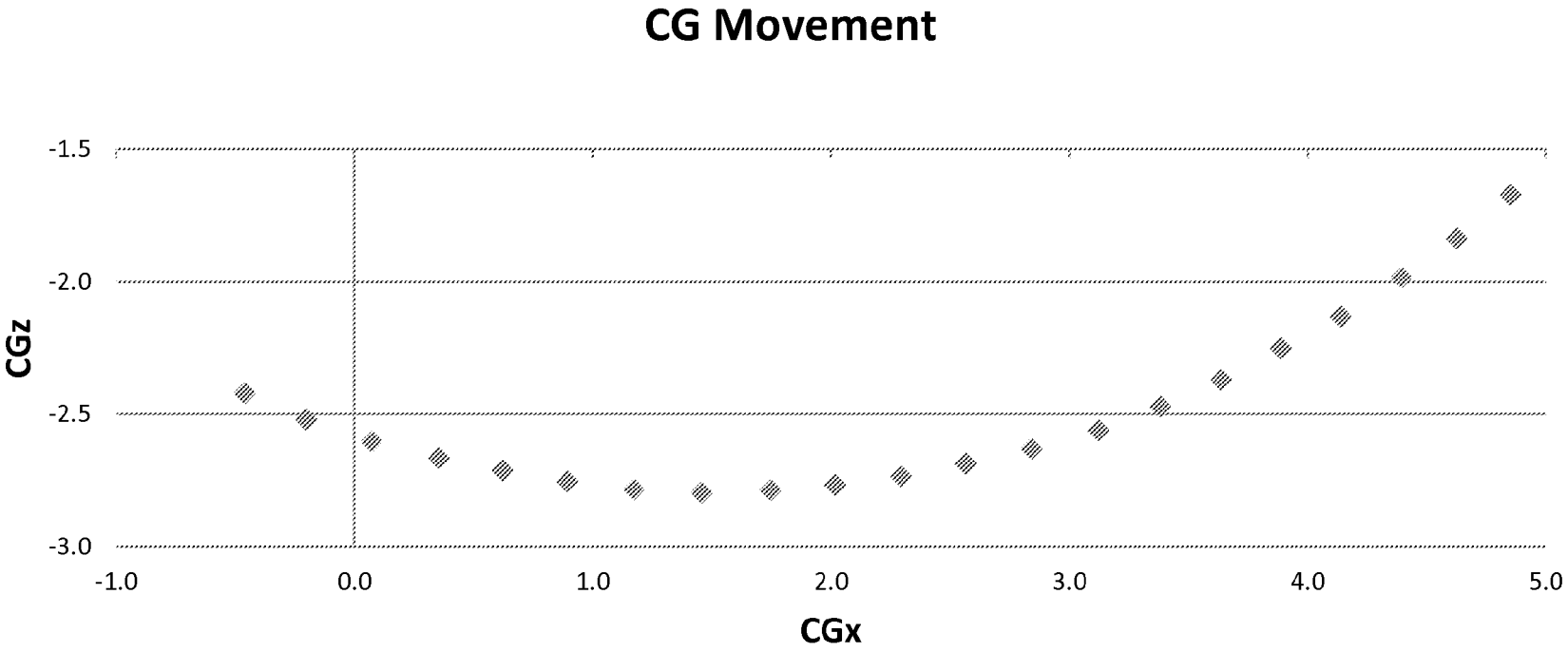

FIG. 101 is a graph showing the $CG_z$ and $CG_x$ values of a golf club head as the location of a weight assembly is changed.

Figure 102:
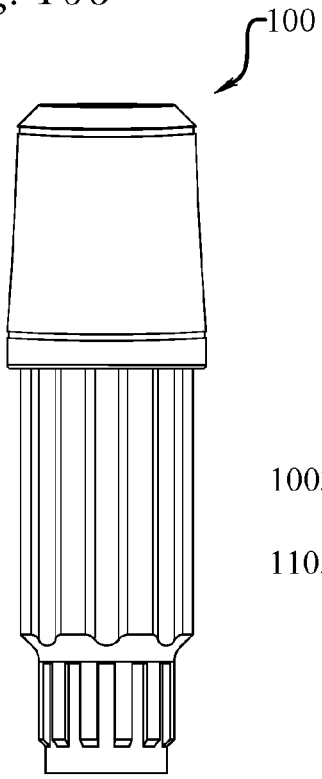

FIG. 102 is an elevation view of an embodiment of a shaft sleeve of a connection assembly.

Figure 103:
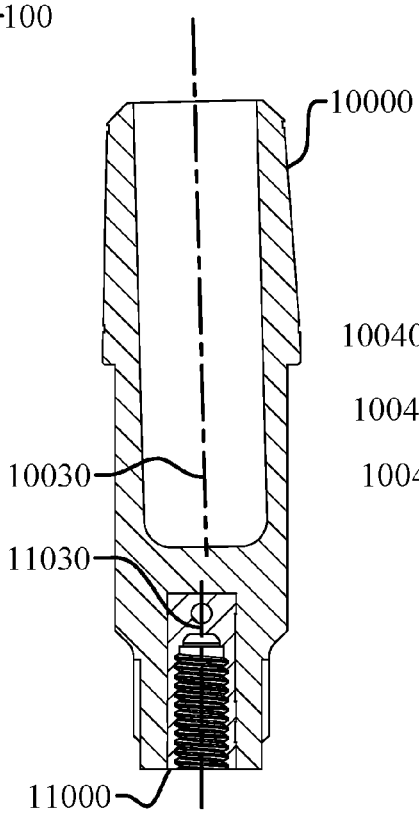
Figure 105:
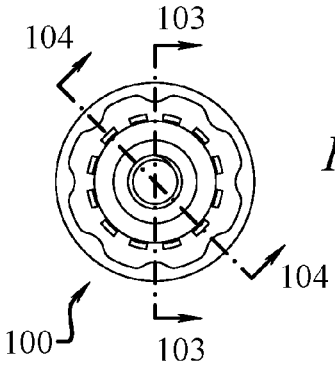

FIG. 103 is a cross-sectional view of an embodiment of a shaft sleeve of a connection assembly taken along section line 103-103 in FIG. 105.

Figure 104:
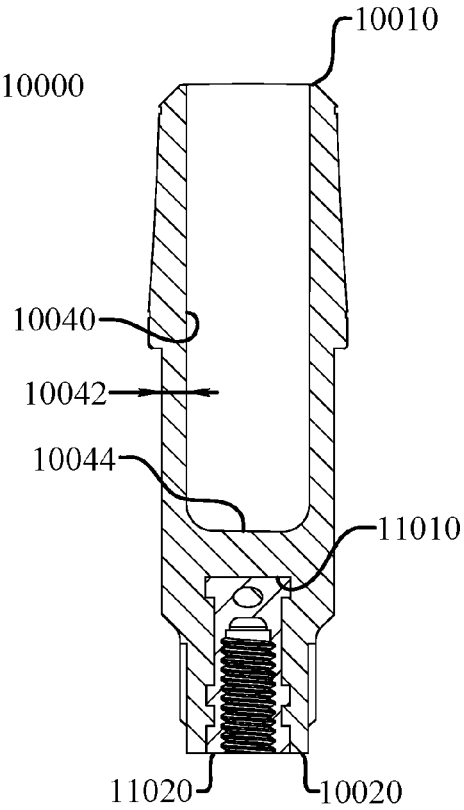

FIG. 104 is a cross-sectional view of an embodiment of a shaft sleeve of a connection assembly taken along section line 104-104 in FIG. 105.

FIG. 105 is a bottom plan view of an embodiment of a shaft sleeve of a connection assembly.

Figure 106:
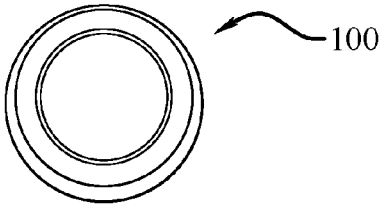

FIG. 106 is a top plan view of an embodiment of a shaft sleeve of a connection assembly.

Figure 107:
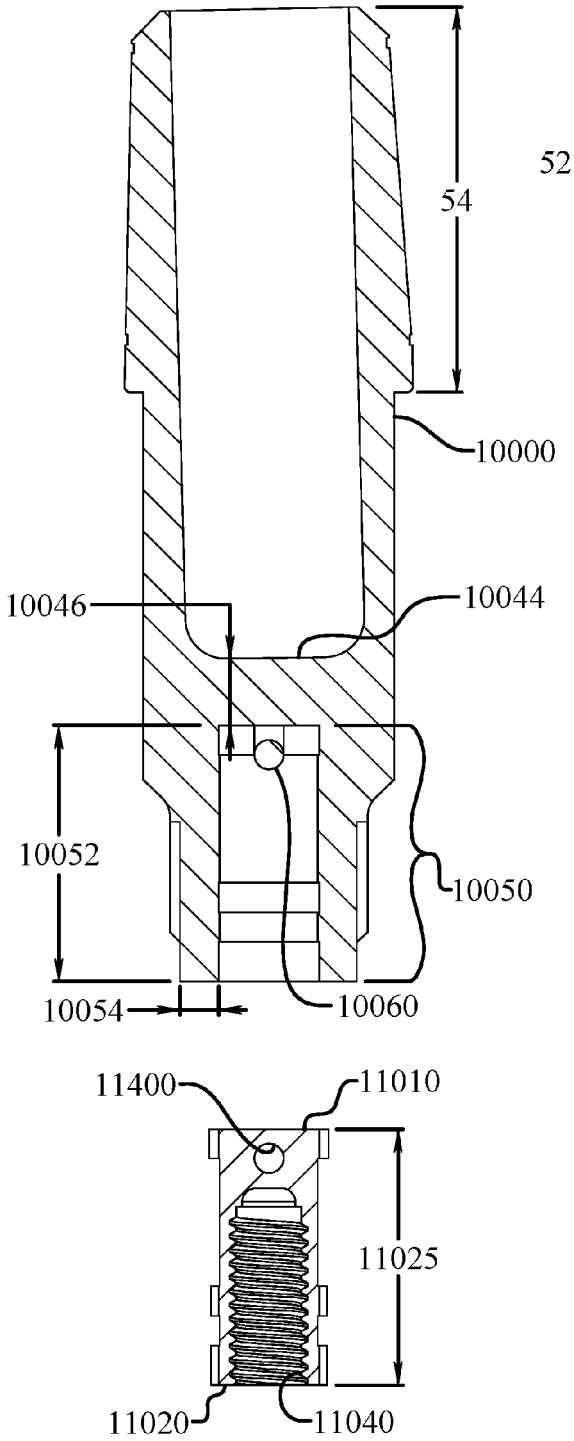

FIG. 107 is an enlarged cross-sectional view of an embodiment of a shaft sleeve of a connection assembly taken along section line 103-103 in FIG. 105 with the secondary portion shown separately for clarity.

Figure 108:
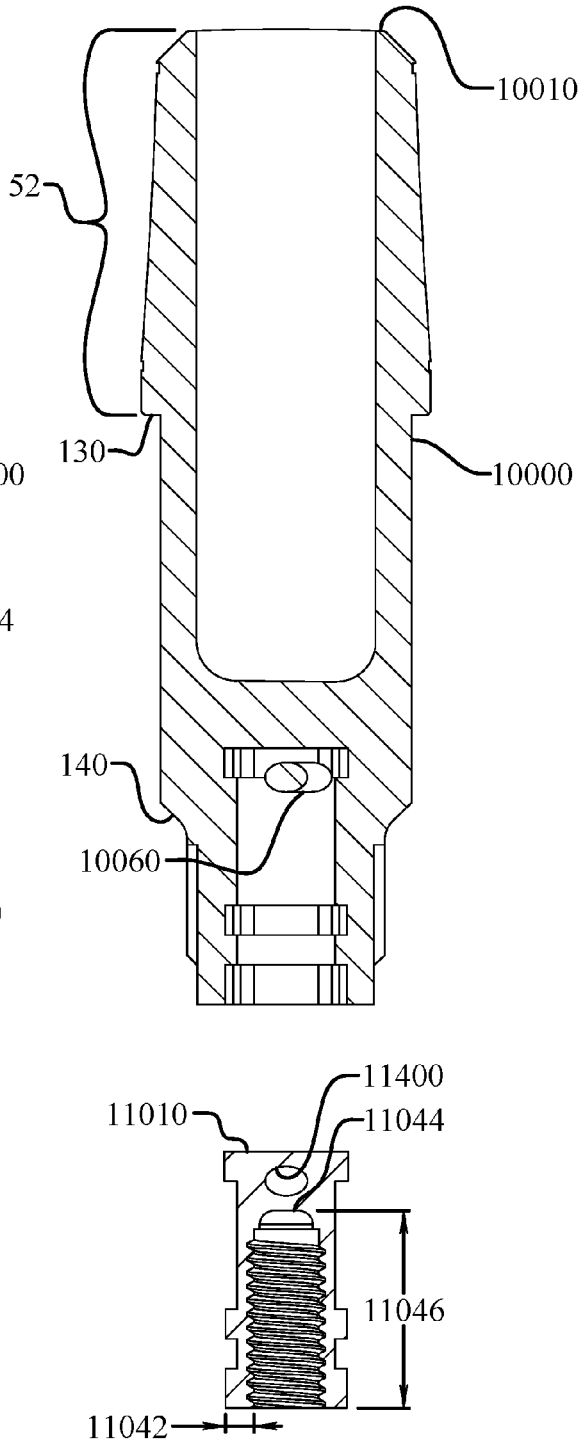

FIG. 108 is a cross-sectional view of an embodiment of a shaft sleeve of a connection assembly taken along section line 104-104 in FIG. 105 with the secondary portion shown separately for clarity.

Figure 109:
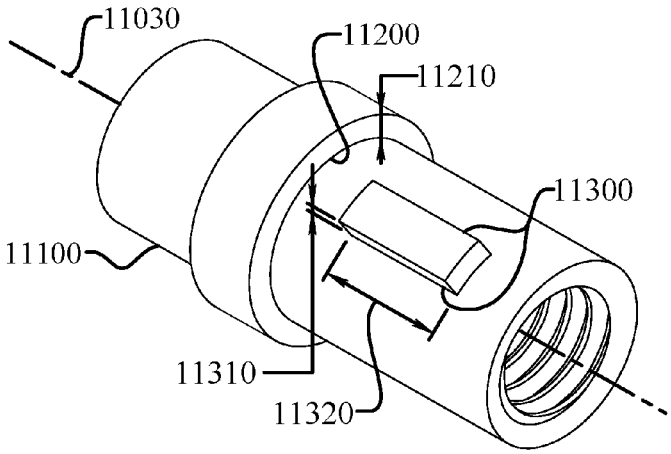

FIG. 109 is a perspective view of an embodiment of the secondary portion of a shaft sleeve of a connection assembly.

Figure 110:
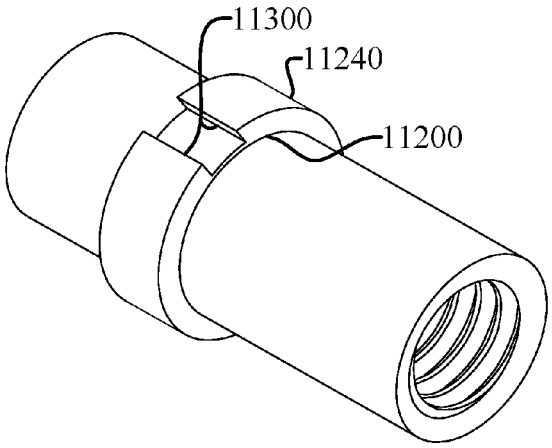

FIG. 110 is a perspective view of an embodiment of the secondary portion of a shaft sleeve of a connection assembly.

Figure 111:
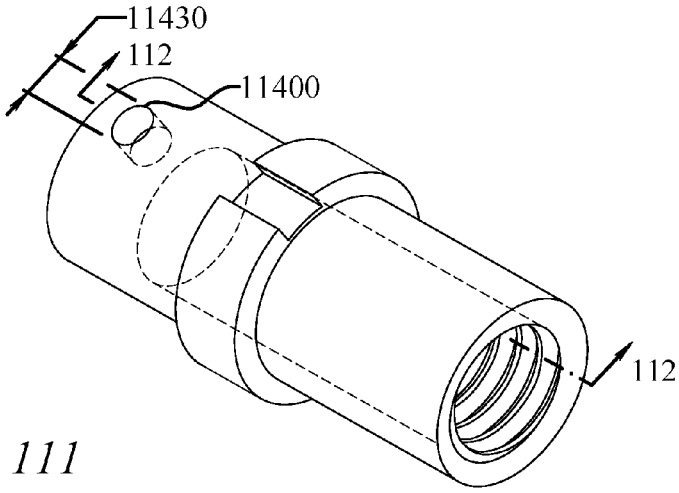

FIG. 111 is a perspective view of an embodiment of the secondary portion of a shaft sleeve of a connection assembly.

Figure 112:
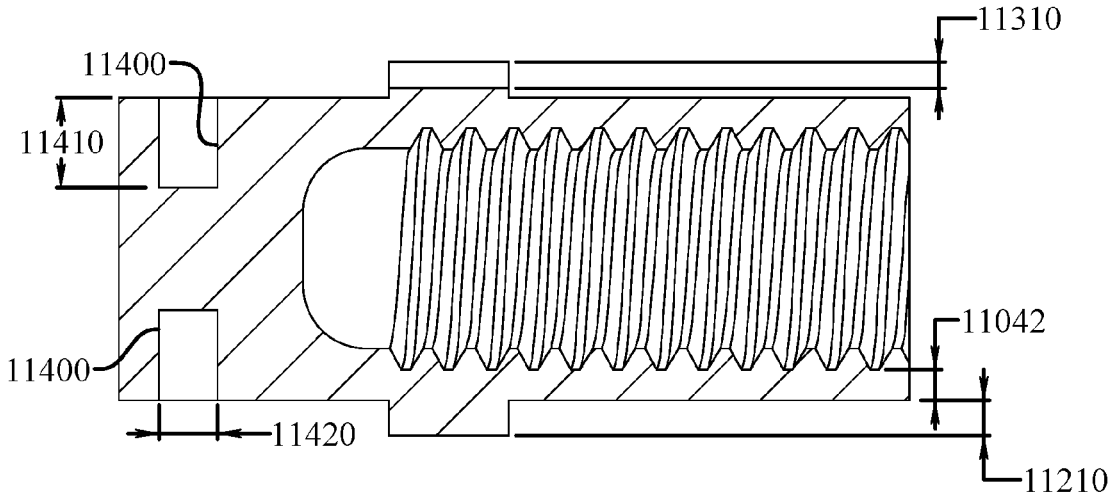

FIG. 112 is a cross-sectional view of an embodiment of a secondary portion of a shaft sleeve taken along section line 112-112 in FIG. 111.

Figure 113:
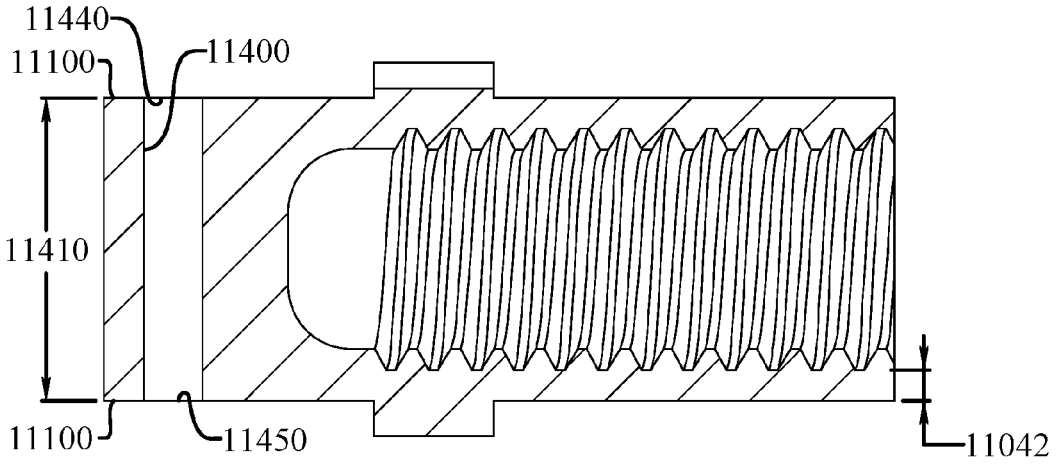

FIG. 113 is a cross-sectional view of an embodiment of a secondary portion of a shaft sleeve taken along section line 112-112 in FIG. 111.

Figure 114:
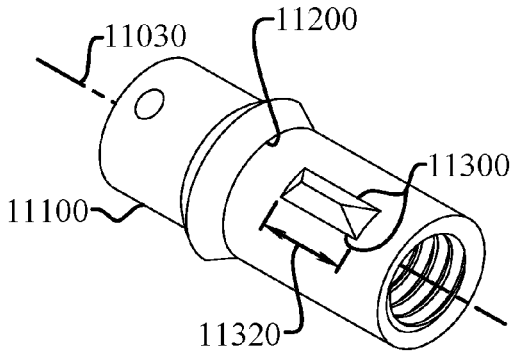

FIG. 114 is a perspective view of an embodiment of the secondary portion of a shaft sleeve of a connection assembly.

Figure 115:
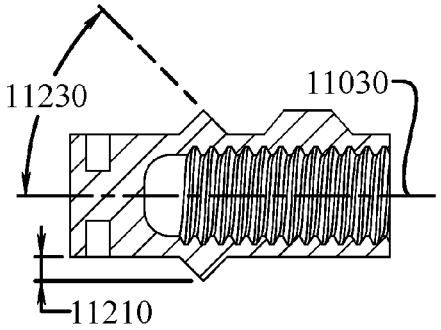

FIG. 115 is a cross-sectional view of the embodiment of a secondary portion seen in FIG. 114.

Figure 116:
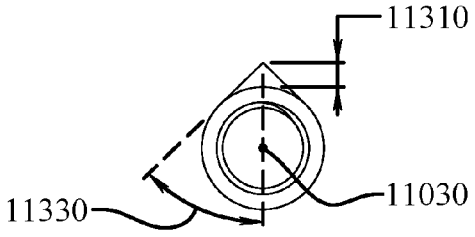

FIG. 116 is a secondary portion distal end plan view of the embodiment of a secondary portion seen in FIG. 114.

Figure 117:
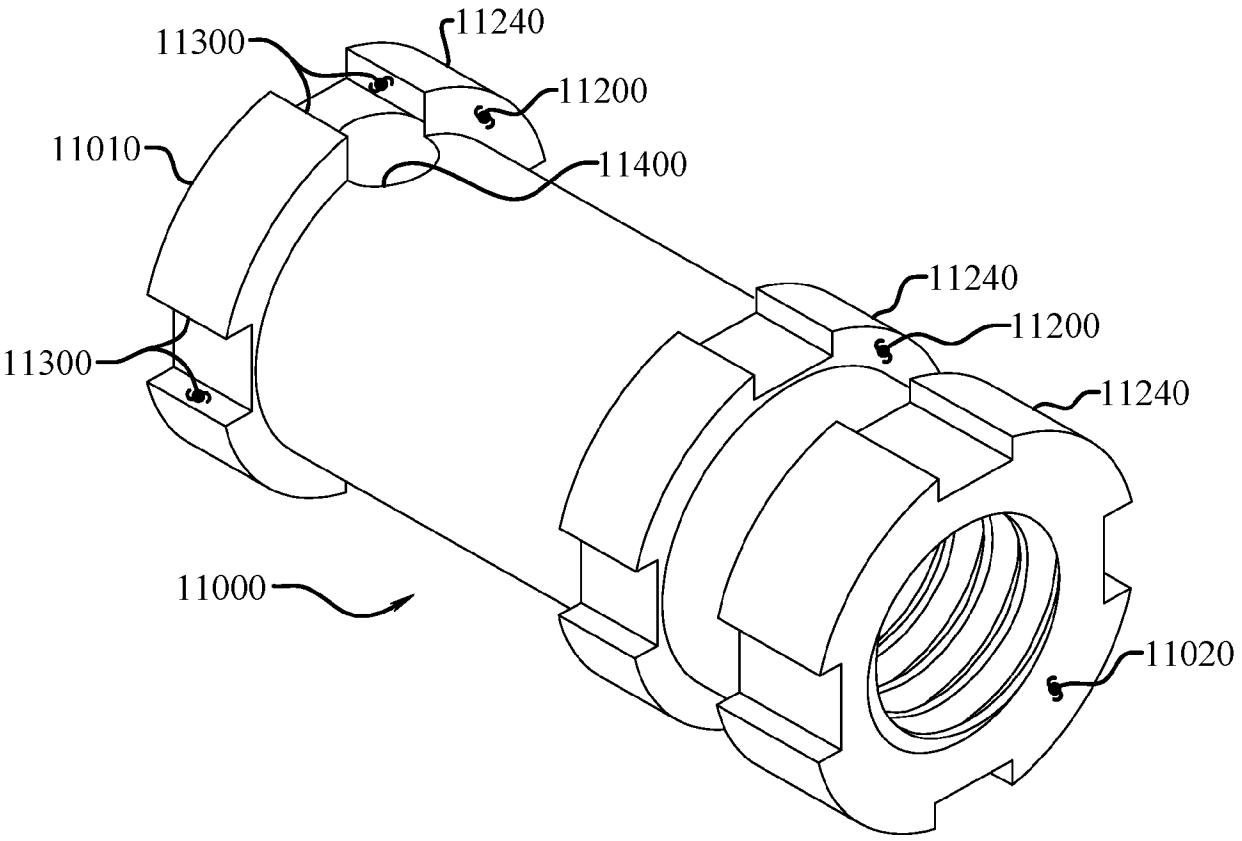

FIG. 117 is an enlarged perspective view of an embodiment of the secondary portion of a shaft sleeve of a connection assembly.

Figure 118:
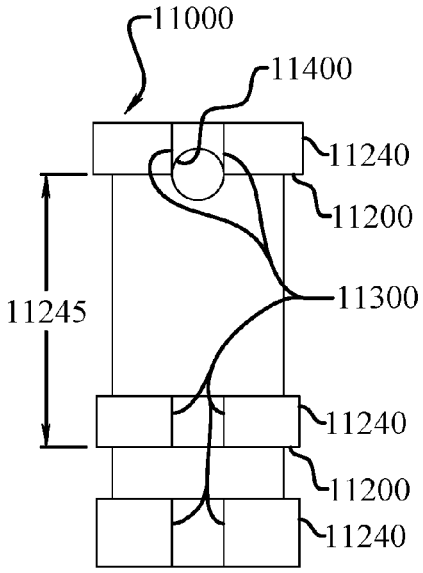

FIG. 118 is a side elevation view of an embodiment of the secondary portion of a shaft sleeve of a connection assembly.

Figure 119:
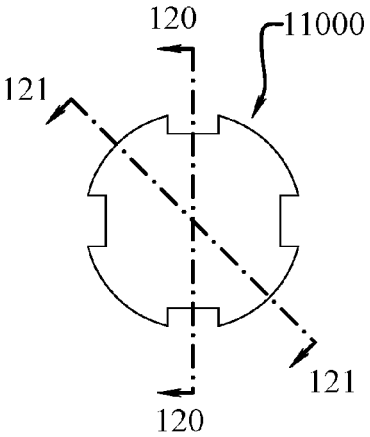

FIG. 119 is a top plan view of an embodiment of the secondary portion of a shaft sleeve of a connection assembly.

Figure 120:
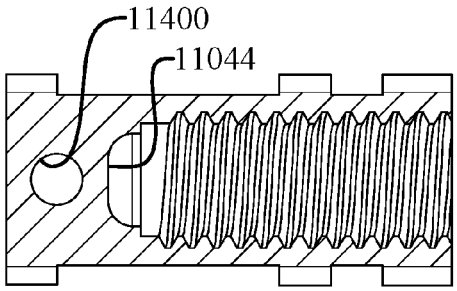

FIG. 120 is a cross-sectional view of an embodiment of a secondary portion of a shaft sleeve taken along section line 120-120 in FIG. 119.

Figure 121:
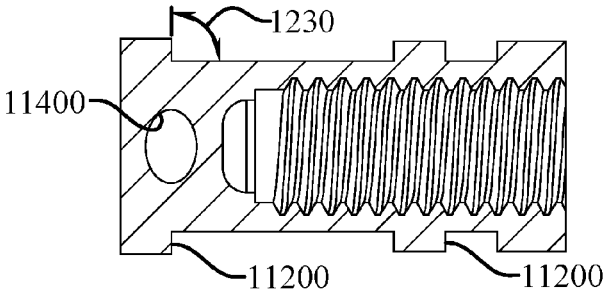

FIG. 121 is a cross-sectional view of an embodiment of a secondary portion of a shaft sleeve taken along section line 121-121 in FIG. 119.

Figure 122:
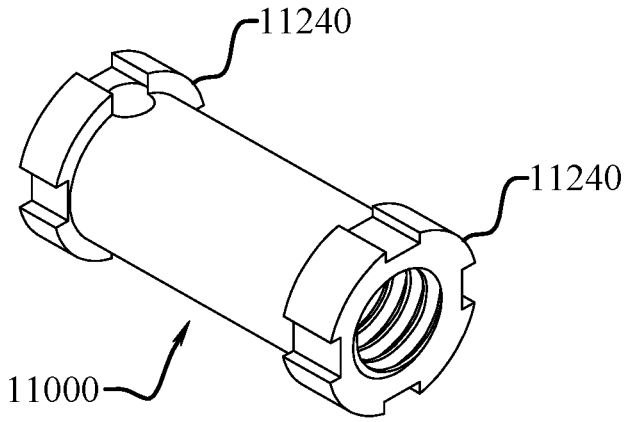

FIG. 122 is a perspective view of an embodiment of the secondary portion of a shaft sleeve of a connection assembly.

Figure 123:
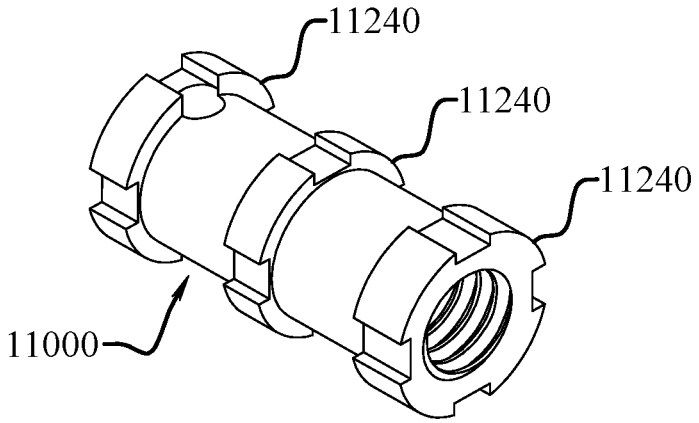

FIG. 123 is a perspective view of an embodiment of the secondary portion of a shaft sleeve of a connection assembly.

Figure 124:
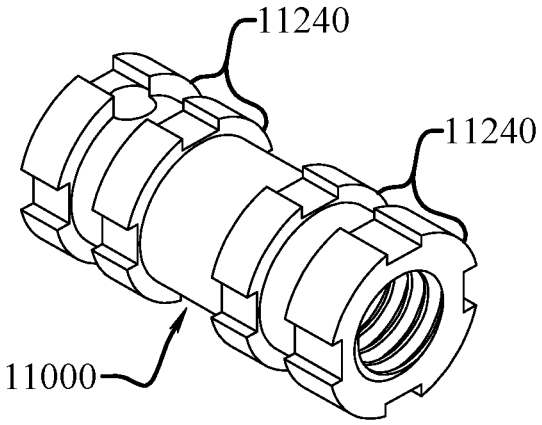

FIG. 124 is a perspective view of an embodiment of the secondary portion of a shaft sleeve of a connection assembly.

Figure 125:
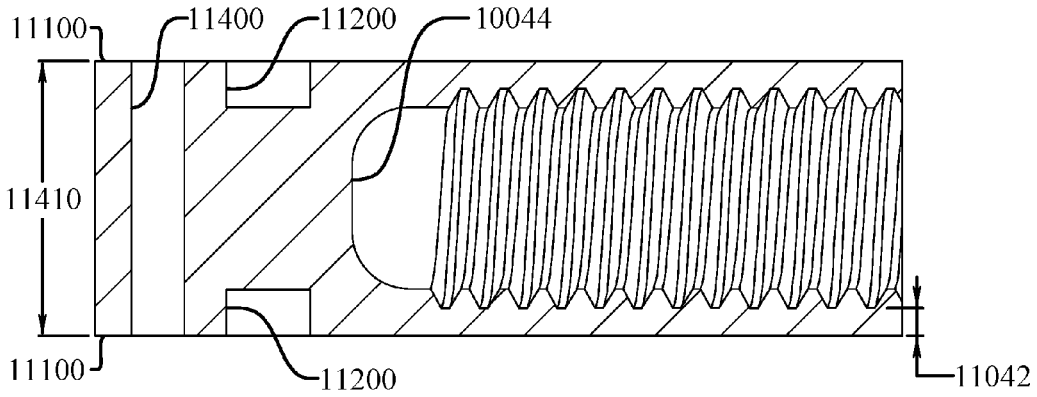

FIG. 125 is a cross-sectional view of an embodiment of a secondary portion of a shaft sleeve of a connection assembly.

Figure 126:
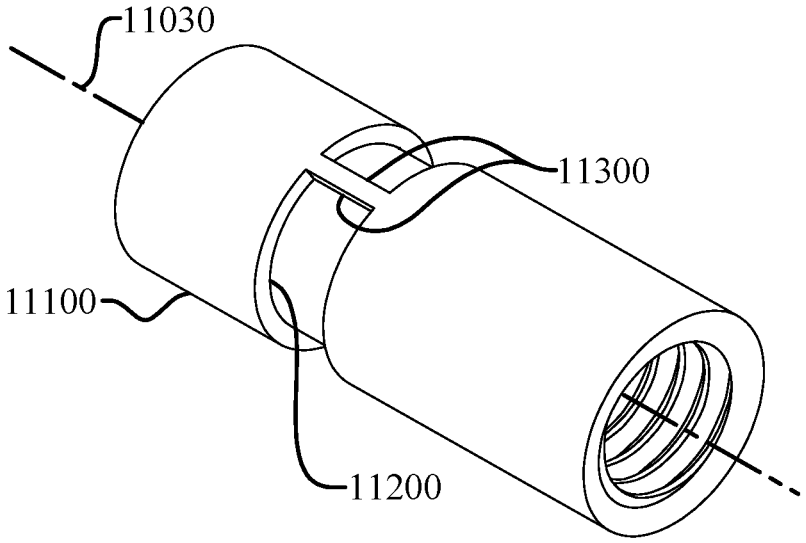

FIG. 126 is a perspective view of an embodiment of a secondary portion of a shaft sleeve of a connection assembly.

DETAILED DESCRIPTION

The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises."

Referring first to FIGS. 1A-1D, there is shown characteristic angles of golf clubs by way of reference to a golf club head 300 having a removable shaft 50, according to one embodiment. The club head 300 comprises a centerface, or striking face, 310, scorelines 320, a hosel 330 having a hosel opening 340, and a sole 350. The hosel 330 has a hosel longitudinal axis 60 and the shaft 50 has a shaft longitudinal axis. In the illustrated embodiment, the ideal impact location 312 of the golf club head 300 is disposed at the geometric center of the striking surface 310 (see FIG. 1A). The ideal impact location 312 is typically defined as the intersection of the midpoints of a height ($H_{SS}$) and width ($W_{SS}$) of the striking surface 310.

Both $H_{SS}$ and $W_{SS}$ are determined using the striking face curve ($S_{SS}$). The striking face curve is bounded on its periphery by all points where the face transitions from a substantially uniform bulge radius (face heel-to-toe radius of curvature) and a substantially uniform roll radius (face crown-to-sole radius of curvature) to the body (see e.g., FIG. 1). In the illustrated example, $H_{SS}$ is the distance from the periphery proximate the sole portion of $S_{SS}$ to the periphery proximate the crown portion of $S_{SS}$ measured in a vertical plane (perpendicular to ground) that extends through the geometric center of the face. Similarly, $W_{SS}$ is the distance from the periphery proximate the heel portion of $S_{SS}$ to the periphery proximate the toe portion of $S_{SS}$ measured in a horizontal plane (e.g., substantially parallel to ground) that extends through the geometric center of the face. See USGA "Procedure for Measuring the Flexibility of a Golf Clubhead," Revision 2.0 for the methodology to measure the geometric center of the striking face.

Figure 1A:
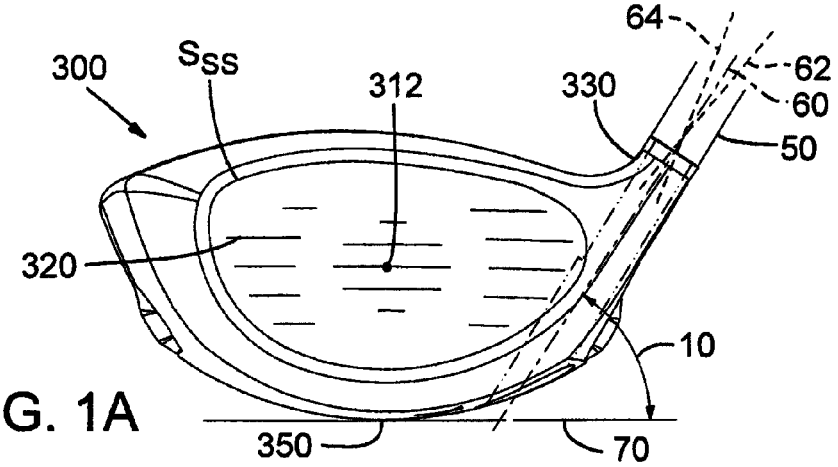
FIG. 1A is a front elevational view of a golf club head in accordance with one embodiment.

As shown in FIG. 1A, a lie angle 10 (also referred to as the "scoreline lie angle") is defined as the angle between the hosel longitudinal axis 60 and a playing surface 70 when the club is in the grounded address position. The grounded address position is defined as the resting position of the head on the playing surface when the shaft is supported at the grip (free to rotate about its axis) and the shaft is held at an angle to the round such that the scorelines 320 are horizontal (if the club does not have scorelines, then the lie shall be set at 60-degrees). The centerface target line vector is defined as a horizontal vector which is perpendicular to the shaft when the club is in the address position and points outward from the centerface point. The target line plane is defined as a vertical plane which contains the centerface target line vector. The square face address position is defined as the head position when the sole is lifted off the ground, and the shaft is held (both positionally and rotationally) such that the scorelines are horizontal and the centerface normal vector completely lies in the target line plane (if the head has no scorelines, then the shaft shall be held at 60-degrees relative to ground and then the head rotated about the shaft axis until the centerface normal vector completely lies in the target line plane). The actual, or measured, lie angle can be defined as the angle 10 between the hosel longitudinal axis 60 and the playing surface 70, whether or not the club is held in the grounded address position with the scorelines horizontal. Studies have shown that most golfers address the ball with actual lie angle that is 10 to 20 degrees less than the intended scoreline lie angle 10 of the club. The studies have also shown that for most golfers the actual lie angle at impact is between 0 and 10 degrees less than the intended scoreline lie angle 10 of the club.

Figure 1B:
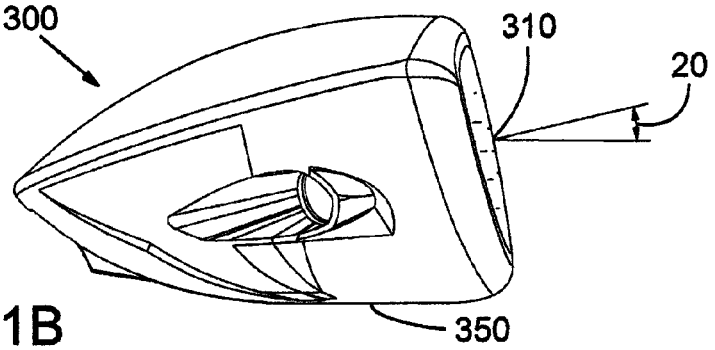
FIG. 1B is a side elevational view of the golf club head of FIG. 1A.

As shown in FIG. 1B, a loft angle 20 of the club head (referred to as "square loft") is defined as the angle between the centerface normal vector and the ground plane when the head is in the square face address position. As shown in FIG. 1D, a hosel loft angle 72 is defined as the angle between the hosel longitudinal axis 60 projected onto the target line plane and a plane 74 that is tangent to the center of the centerface. The shaft loft angle is the angle between plane 74 and the longitudinal axis of the shaft 50 projected onto the target line plane. The "grounded loft" 80 of the club head is the vertical angle of the centerface normal vector when the club is in the grounded address position (i.e., when the sole 350 is resting on the ground), or stated differently, the angle between the plane 74 of the centerface and a vertical plane when the club is in the grounded address position.

Figure 1C:
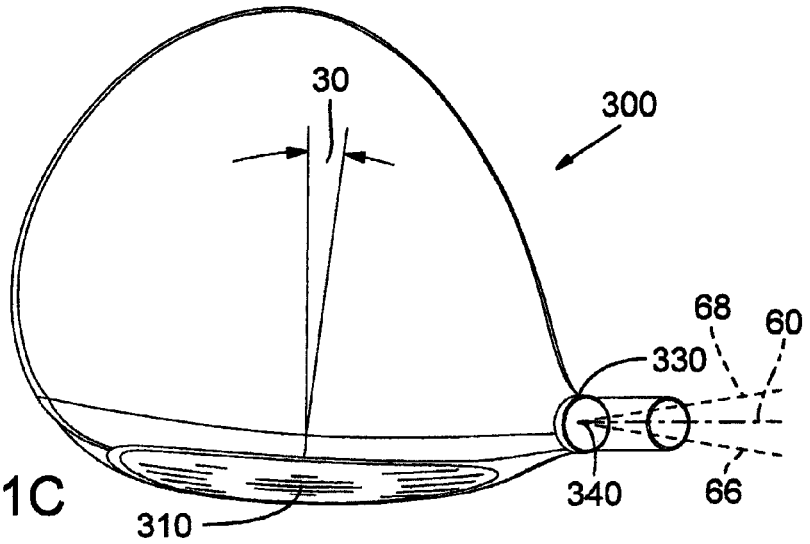
FIG. 1C is atop plan view of the golf club head of FIG. 1A.
Figure 1D:
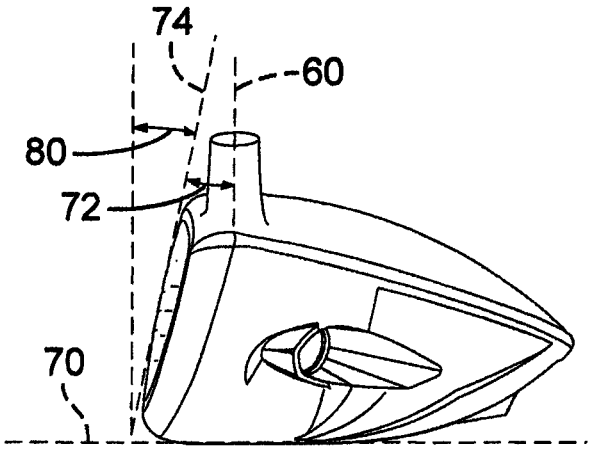
FIG. 1D is a side elevational view of the golf club head of FIG. 1A.

As shown in FIG. 1C, a face angle 30 is defined by the horizontal component of the centerface normal vector and a vertical plane ("target line plane") that is normal to the vertical plane which contains the shaft longitudinal axis when the shaft 50 is in the correct lie (i.e., typically 60 degrees +/−5 degrees) and the sole 350 is resting on the playing surface 70 (the club is in the grounded address position).

The lie angle 10 and/or the shaft loft can be modified by adjusting the position of the shaft 50 relative to the club head. Traditionally, adjusting the position of the shaft has been accomplished by bending the shaft and the hosel relative to the club head. As shown in FIG. 1A, the lie angle 10 can be increased by bending the shaft and the hosel inward toward the club head 300, as depicted by shaft longitudinal axis 64. The lie angle 10 can be decreased by bending the shaft and the hosel outward from the club head 300, as depicted by shaft longitudinal axis 62. As shown in FIG. 1C, bending the shaft and the hosel forward toward the striking face 310, as depicted by shaft longitudinal axis 66, increases the shaft loft. Bending the shaft and the hosel rearward toward the rear of the club head, as depicted by shaft longitudinal axis 68, decreases the shaft loft. It should be noted that in a conventional club the shaft loft typically is the same as the hosel loft because both the shaft and the hosel are bent relative to the club head. In certain embodiments disclosed herein, the position of the shaft can be adjusted relative to the hosel to adjust shaft loft. In such cases, the shaft loft of the club is adjusted while the hosel loft is unchanged.

Adjusting the shaft loft is effective to adjust the square loft of the club by the same amount. Similarly, when shaft loft is adjusted and the club head is placed in the address position, the face angle of the club head increases or decreases in proportion to the change in shaft loft. Hence, shaft loft is adjusted to effect changes in square loft and face angle. In addition, the shaft and the hosel can be bent to adjust the lie angle and the shaft loft (and therefore the square loft and the face angle) by bending the shaft and the hosel in a first direction inward or outward relative to the club head to adjust the lie angle and in a second direction forward or rearward relative to the club head to adjust the shaft loft.

Head-Shaft Connection Assembly

Figure 2:
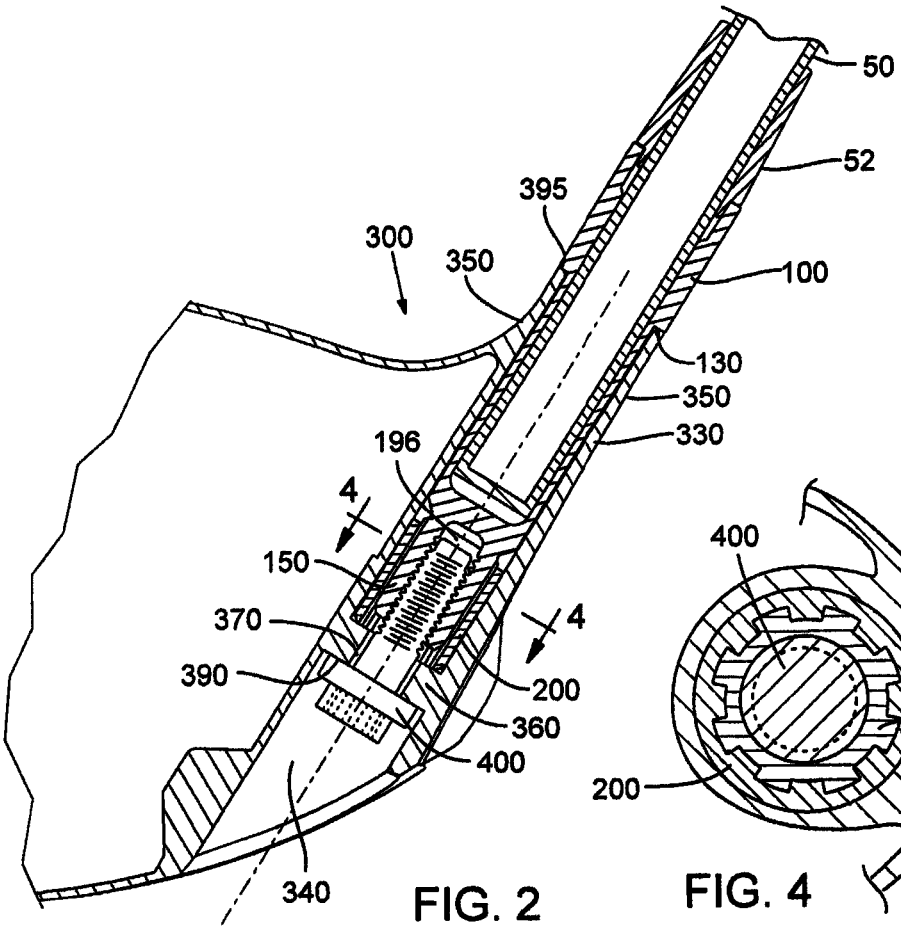
FIG. 2 is a cross-sectional view of a golf club head having a removable shaft, in accordance with one embodiment.
Figure 4:
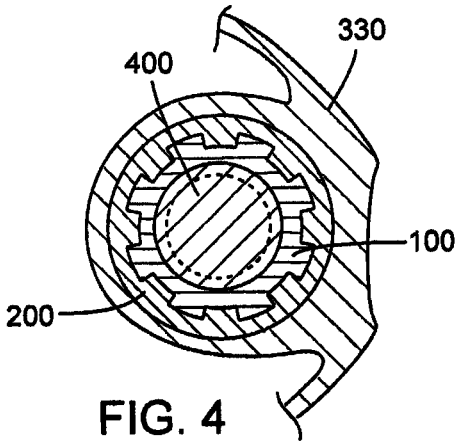
FIG. 4 is a cross-sectional view of the golf club head of FIG. 2, taken along the line 4-4 of FIG. 2.
Figure 3:
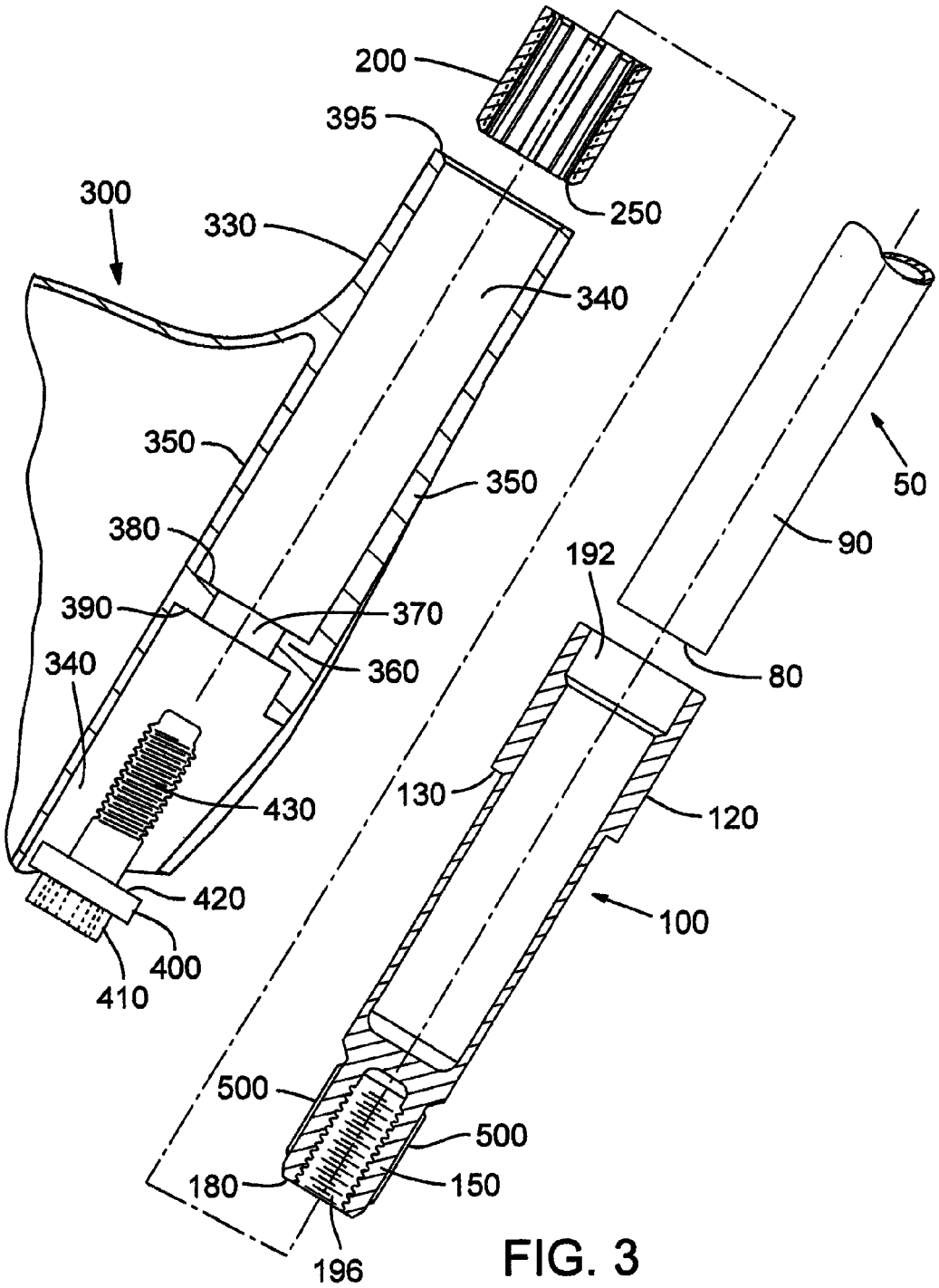
FIG. 3 is an exploded cross-sectional view of the shaft-club head connection assembly of FIG. 2.

Now with reference to FIGS. 2-4, there is shown a golf club comprising a golf club head 300 attached to a golf club shaft 50 via a removable head-shaft connection assembly, which generally comprises in the illustrated embodiment a shaft sleeve 100, a hosel insert 200 and a screw 400. The club head 300 is formed with a hosel opening, or passageway, 340 that extends from the hosel 330 through the club head and opens at the sole, or bottom surface, of the club head. Generally, the club head 300 is removably attached to the shaft 50 by the sleeve 100 (which is mounted to the lower end portion of the shaft 50) by inserting the sleeve 100 into the hosel opening 340 and the hosel insert 200 (which is mounted inside the hosel opening 340), and inserting the screw 400 upwardly through the opening in the sole and tightening the screw into a threaded opening of the sleeve, thereby securing the club head 300 to the sleeve 100.

By way of example, the club head 300 comprises the head of a "wood-type" golf club. All of the embodiments disclosed in the present specification can be implemented in all types of golf clubs, including but not limited to, drivers, fairway woods, utility clubs, putters, irons, wedges, etc.

As used herein, a shaft that is "removably attached" to a club head means that the shaft can be connected to the club head using one or more mechanical fasteners, such as a screw or threaded ferrule, without an adhesive, and the shaft can be disconnected and separated from the head by loosening or removing the one or more mechanical fasteners without the need to break an adhesive bond between two components.

The sleeve 100 is mounted to a lower, or tip end portion 90 of the shaft 50. The sleeve 100 can be adhesively bonded, welded or secured in equivalent fashion to the lower end portion of the shaft 50. In other embodiments, the sleeve 100 may be integrally formed as part of the shaft 50. As shown in FIG. 2, a ferrule 52 can be mounted to the end portion 90 of the shaft just above shaft sleeve 100 to provide a smooth transition between the shaft sleeve and the shaft and to conceal the glue line between the shaft and the sleeve. The ferrule also helps minimize tip breakage of the shaft.

As best shown in FIG. 3, the hosel opening 340 extends through the club head 300 and has hosel sidewalls 350. A flange 360 extends radially inward from the hosel sidewalls 350 and forms the bottom wall of the hosel opening. The flange defines a passageway 370, a flange upper surface 380 and a flange lower surface 390. The hosel insert 200 can be mounted within the hosel opening 340 with a bottom surface 250 of the insert contacting the flange upper surface 380. The hosel insert 200 can be adhesively bonded, welded, brazed or secured in another equivalent fashion to the hosel sidewalls 350 and/or the flange to secure the insert 200 in place. In other embodiments, the hosel insert 200 can be formed integrally with the club head 300 (e.g., the insert can be formed and/or machined directly in the hosel opening).

Figure 5:
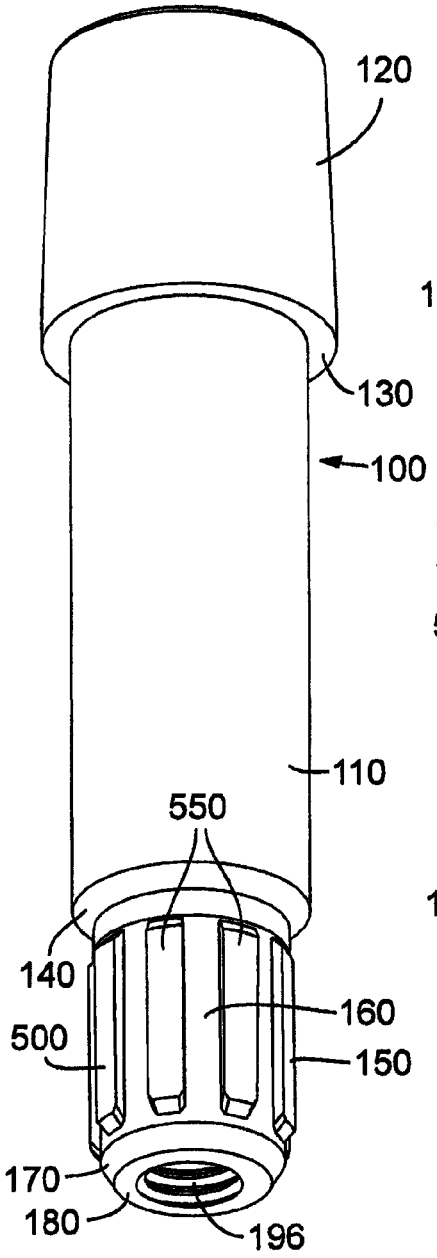
FIG. 5 is a perspective view of the shaft sleeve of the connection assembly shown in FIG. 2.
Figure 6:
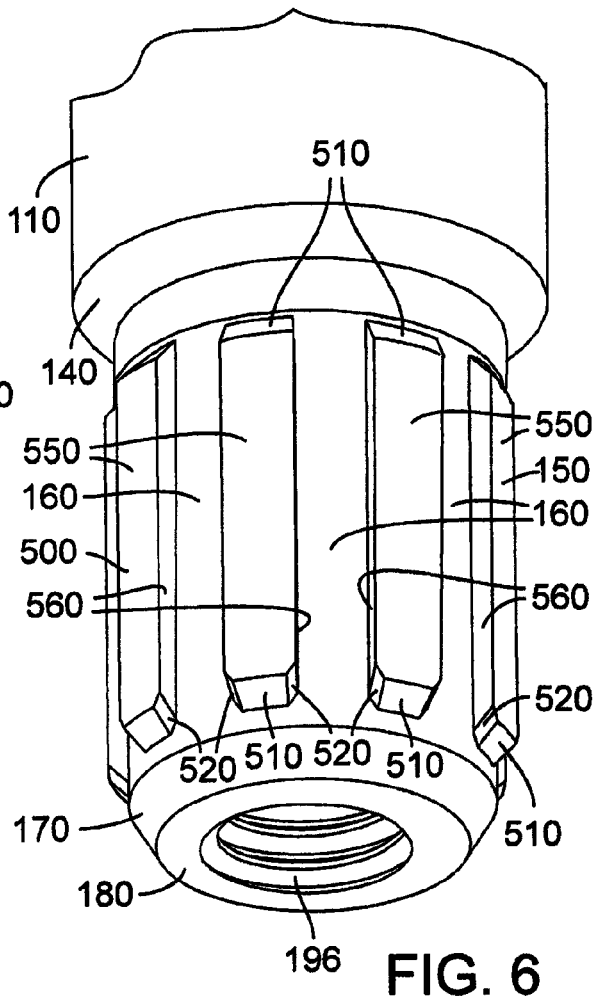
FIG. 6 is an enlarged perspective view of the lower portion of the sleeve of FIG. 5.
Figure 8:
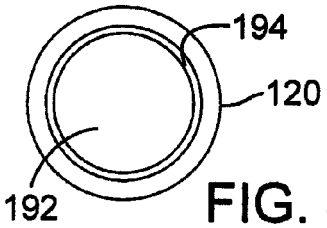
FIG. 8 is atop plan view of the sleeve of FIG. 5.

To restrict rotational movement of the shaft 50 relative to the head 300 when the club head 300 is attached to the shaft 50, the sleeve 100 has a rotation prevention portion that mates with a complementary rotation prevention portion of the insert 200. In the illustrated embodiment, for example, the shaft sleeve has a lower portion 150 having a non-circular configuration complementary to a non-circular configuration of the hosel insert 200. In this way, the sleeve lower portion 150 defines a keyed portion that is received by a keyway defined by the hosel insert 200. In particular embodiments, the rotational prevention portion of the sleeve comprises longitudinally extending external splines 500 formed on an external surface 160 of the sleeve lower portion 150, as illustrated in FIGS. 5-6 and the rotation prevention portion of the insert comprises complementary-configured internal splines 240, formed on an inner surface 250 of the hosel insert 200, as illustrated in FIGS. 11-14. In alternative embodiments, the rotation prevention portions can be elliptical, rectangular, hexagonal or various other non-circular configurations of the sleeve external surface 160 and a complementary non-circular configuration of the hosel insert inner surface 250.

In the illustrated embodiment of FIG. 3, the screw 400 comprises a head 410 having a surface 420, and threads 430. The screw 400 is used to secure the club head 300 to the shaft 50 by inserting the screw through passageway 370 and tightening the screw into a threaded bottom opening 196 in the sleeve 100. In other embodiments, the club head 300 can be secured to the shaft 50 by other mechanical fasteners. When the screw 400 is fully engaged with the sleeve 100, the head surface 420 contacts the flange lower surface 390 and an annular thrust surface 130 of the sleeve 100 contacts a hosel upper surface 395 (FIG. 2). The sleeve 100, the hosel insert 200, the sleeve lower opening 196, the hosel opening 340 and the screw 400 in the illustrated example are co-axially aligned.

It is desirable that a golf club employing a removable club head-shaft connection assembly as described in the present application have substantially similar weight and distribution of mass as an equivalent conventional golf club so that the golf club employing a removable shaft has the same "feel" as the conventional club. Thus, it is desired that the various components of the connection assembly (e.g., the sleeve 100, the hosel insert 200 and the screw 400) are constructed from light-weight, high-strength metals and/or alloys (e.g., T6 temper aluminum alloy 7075, grade 5 6Al-4V titanium alloy, etc.) and designed with an eye towards conserving mass that can be used elsewhere in the golf club to enhance desirable golf club characteristics (e.g., increasing the size of the "sweet spot" of the club head or shifting the center of gravity to optimize launch conditions).

The golf club having an interchangeable shaft and club head as described in the present application provides a golfer with a club that can be easily modified to suit the particular needs or playing style of the golfer. A golfer can replace the club head 300 with another club head having desired characteristics (e.g., different loft angle, larger face area, etc.) by simply unscrewing the screw 400 from the sleeve 100, replacing the club head and then screwing the screw 400 back into the sleeve 100. The shaft 50 similarly can be exchanged. In some embodiments, the sleeve 100 can be removed from the shaft 50 and mounted on the new shaft, or the new shaft can have another sleeve already mounted on or formed integral to the end of the shaft.

In particular embodiments, any number of shafts are provided with the same sleeve and any number of club heads is provided with the same hosel configuration and hosel insert 200 to receive any of the shafts. In this manner, a pro shop or retailer can stock a variety of different shafts and club heads that are interchangeable. A club or a set of clubs that is customized to suit the needs of a consumer can be immediately assembled at the retail location.

With reference now to FIGS. 5-10, there is shown the sleeve 100 of the club head-shaft connection assembly of FIGS. 2-4. The sleeve 100 in the illustrated embodiment is substantially cylindrical and desirably is made from a light-weight, high-strength material (e.g., T6 temper aluminum alloy 7075). The sleeve 100 includes a middle portion 110, an upper portion 120 and a lower portion 150. The upper portion 120 can have a wider thickness than the remainder of the sleeve as shown to provide, for example, additional mechanical integrity to the connection between the shaft 50 and the sleeve 100. In other embodiments, the upper portion 120 may have a flared or frustoconical shape, to provide, for example, a more streamlined transition between the shaft 50 and club head 300. The boundary between the upper portion 120 and the middle portion 110 comprises an upper annular thrust surface 130 and the boundary between the middle portion 110 and the lower portion 150 comprises a lower annular surface 140. In the illustrated embodiment, the annular surface 130 is perpendicular to the external surface of the middle portion 110. In other embodiments, the annular surface 130 may be frustoconical or otherwise taper from the upper portion 120 to the middle portion 110. The annular surface 130 bears against the hosel upper surface 395 when the shaft 50 is secured to the club head 300.

Figure 7:
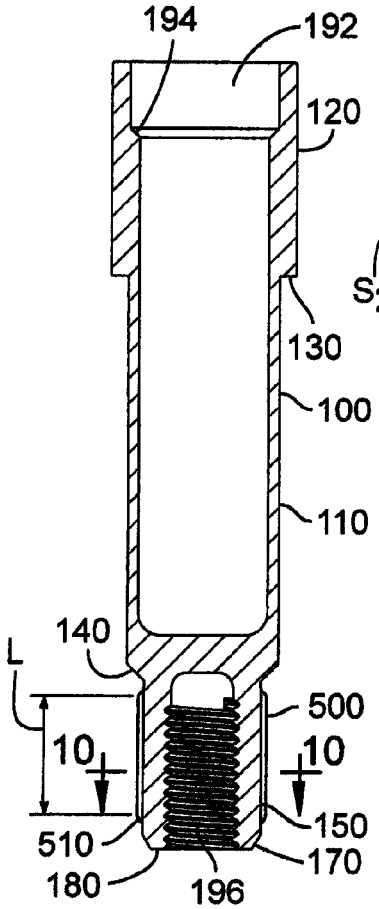
FIG. 7 is a cross-sectional view of the sleeve of FIG. 5.

As shown in FIG. 7, the sleeve 100 further comprises an upper opening 192 for receiving the lower end portion 90 of the shaft 50 and an internally threaded opening 196 in the lower portion 150 for receiving the screw 400. In the illustrated embodiment, the upper opening 192 has an annular surface 194 configured to contact a corresponding surface 70 of the shaft 50 (FIG. 3). In other embodiments, the upper opening 192 can have a configuration adapted to mate with various shaft profiles (e.g., a constant inner diameter, plurality of stepped inner diameters, chamfered and/or perpendicular annular surfaces, etc.). With reference to the illustrated embodiment of FIG. 7, splines 500 are located below opening 192 (and therefore below the lower end of the shaft) to minimize the overall diameter of the sleeve. The threads in the lower opening 196 can be formed using a Spiralock® tap.

Figure 10:
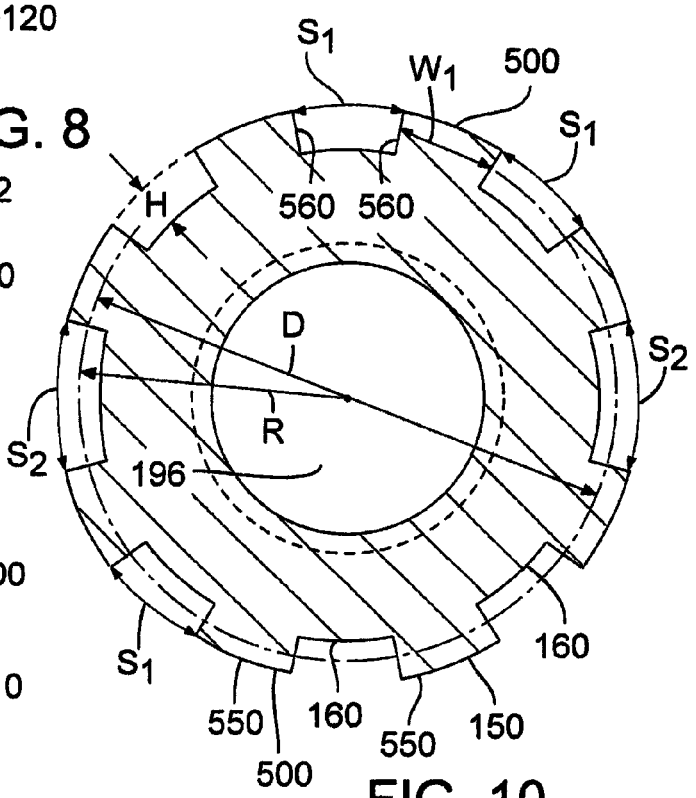
FIG. 10 is a cross-sectional view of the sleeve, taken along the line 10-10 of FIG. 7.
Figure 9:
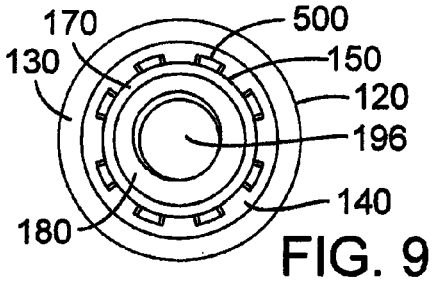
FIG. 9 is a bottom plan view of the sleeve of FIG. 5.

As noted above, the rotation prevention portion of the sleeve 100 for restricting relative rotation between the shaft and the club comprises a plurality of external splines 500 formed on an external surface of the lower portion 150 and gaps, or keyways, between adjacent splines 500. Each keyway has an outer surface 160. In the illustrated embodiment of FIGS. 5-6, 9-10, the sleeve comprises eight angularly spaced splines 500 elongated in a direction parallel to the longitudinal axis of the sleeve 100. Referring to FIGS. 6 and 10, each of the splines 500 in the illustrated configuration has a pair of sidewalls 560 extending radially outwardly from the external surface 160, beveled top and bottom edges 510, bottom chamfered comers 520 and an arcuate outer surface 550. The sidewalls 560 desirably diverge or flair moving in a radially outward direction so that the width of the spline near the outer surface 550 is greater than the width at the base of the spline (near surface 160). With reference to features depicted in FIG. 10, the splines 500 have a height H (the distance the sidewalls 550 extend radially from the external surface 160), and a width $W_1$ at the mid-span of the spline (the straight line distance extending between sidewalls 560 measured at locations of the sidewalls equidistant from the outer surface 550 and the surface 160). In other embodiments, the sleeve comprises more or fewer splines and the splines 500 can have different shapes and sizes.

Embodiments employing the spline configuration depicted in FIGS. 6-10 provide several advantages. For example, a sleeve having fewer, larger splines provides for greater interference between the sleeve and the hosel insert, which enhances resistance to stripping, increases the load-bearing area between the sleeve and the hosel insert and provides for splines that are mechanically stronger. Further, complexity of manufacturing may be reduced by avoiding the need to machine smaller spline features.

For example, various Rosch-manufacturing techniques (e.g., rotary, thru-broach or blind-broach) may not be suitable for manufacturing sleeves or hosel inserts having more, smaller splines. In some embodiments, the splines 500 have a spline height H of between about 0.15 mm to about 1.0 mm with a height H of about 0.5 mm being a specific example and a spline width $W_1$ of between about 0.979 mm to about 2.87 mm, with a width $W_1$ of about 1.367 mm being a specific example.

The non-circular configuration of the sleeve lower portion 150 can be adapted to limit the manner in which the sleeve 100 is positionable within the hosel insert 200. In the illustrated embodiment of FIGS. 9-10, the splines 500 are substantially identical in shape and size. Six of the eight spaces between adjacent splines can have a spline-to-spline spacing $S_1$ and two diametrically-opposed spaces can have a spline-to-spline spacing $S_2$, where $S_2$ is a different than $S_1$ ($S_2$ is greater than $S_1$ in the illustrated embodiment). In the illustrated embodiment, the arc angle of $S_1$ is about 21 degrees and the arc angle of $S_2$ is about 33 degrees. This spline configuration allows the sleeve 100 to be dually positionable within the hosel insert 200 (i.e., the sleeve 100 can be inserted in the insert 200 at two positions, spaced 180 degrees from each other, relative to the insert). Alternatively, the splines can be equally spaced from each other around the longitudinal axis of the sleeve. In other embodiments, different non-circular configurations of the lower portion 150 (e.g., triangular, hexagonal, more of fewer splines) can provide for various degrees of positionability of the shaft sleeve.

The sleeve lower portion 150 can have a generally rougher outer surface relative to the remaining surfaces of the sleeve 100 in order to provide, for example, greater friction between the sleeve 100 and the hosel insert 200 to further restrict rotational movement between the shaft 50 and the club head 300. In particular embodiments, the external surface 160 can be roughened by sandblasting, although alternative methods or techniques can be used.

The general configuration of the sleeve 100 can vary from the configuration illustrated in FIGS. 5-10. In other embodiments, for example, the relative lengths of the upper portion 120, the middle portion 110 and the lower portion 150 can vary (e.g., the lower portion 150 could comprise a greater or lesser proportion of the overall sleeve length). In additional embodiments, additional sleeve surfaces could contact corresponding surfaces in the hosel insert 200 or hosel opening 340 when the club head 300 is attached to the shaft 50. For example, annular surface 140 of the sleeve may contact upper spline surfaces 230 of the hosel insert 200, annular surface 170 of the sleeve may contact a corresponding surface on an inner surface of the hosel insert 200, and/or a bottom face 180 of the sleeve may contact the flange upper surface 360. In additional embodiments, the lower opening 196 of the sleeve can be in communication with the upper opening 192, defining a continuous sleeve opening and reducing the weight of the sleeve 100 by removing the mass of material separating openings 196 and 192.

With reference now to FIGS. 11-14, the hosel insert 200 desirably is substantially tubular or cylindrical and can be made from a light-weight, high-strength material (e.g., grade 5 6Al-4V titanium alloy). The hosel insert 200 comprises an inner surface 250 having a non-circular configuration complementary to the non-circular configuration of the external surface of the sleeve lower portion 150. In the illustrated embodiment, the non-circulation configuration comprises splines 240 complementary in shape and size to the splines 500 of the sleeve 150. That is, there are eight splines 240 elongated in a direction parallel to the longitudinal axis of the hosel insert 200 and the splines 240 have sidewalls 260 extending radially inward from the inner surface 250, chamfered top edges 230 and an inner surface 270. The sidewalls 260 desirably taper or converge toward each other moving in a radially inward direction to mate with the flared splines 500 of the sleeve. The radially inward sidewalls 260 have at least one advantage in that full surface contact occurs between the teeth and the mating teeth of the sleeve insert. In addition, at least one advantage is that the translational movement is more constrained within the assembly compared to other spline geometries having the same tolerance. Furthermore, the radially inward sidewalls 260 promote full sidewall engagement rather than localized contact resulting in higher stresses and lower durability.

Figure 13:
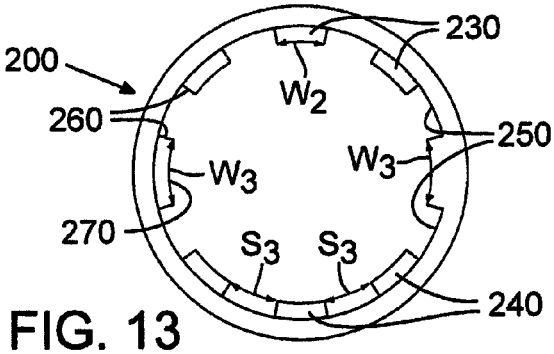
FIG. 13 is a top plan view of the hosel insert of FIG. 11.
Figure 11:
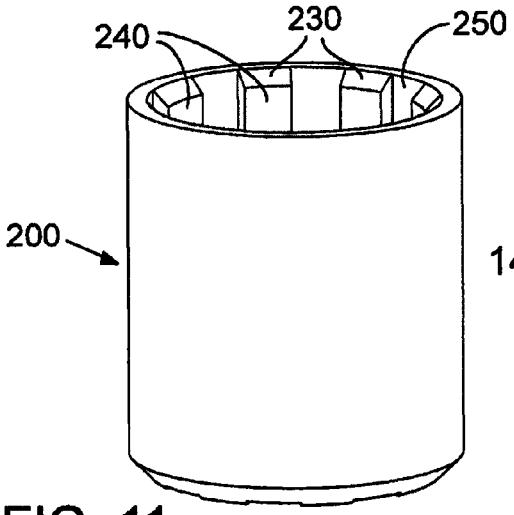
FIG. 11 is a perspective view of the hosel insert of the connection assembly shown in FIG. 2.
Figure 12:
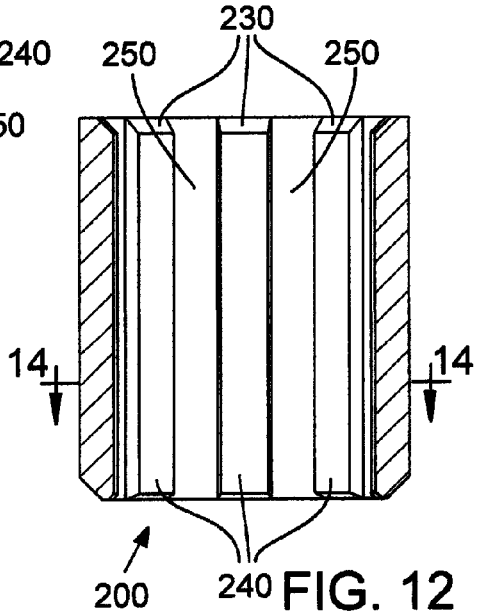
FIG. 12 is a cross-sectional view of the hosel insert of FIG. 2.
Figure 14:
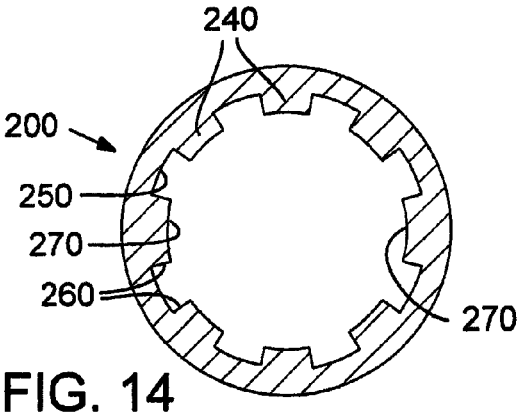
FIG. 14 is a cross-sectional view of the hosel insert of FIG. 2, taken along the line 14-14 of FIG. 12.

With reference to the features of FIG. 13, the spline configuration of the hosel insert is complementary to the spline configuration of the sleeve lower portion 150 and as such, adjacent pairs of splines 240 have a spline-to-spline spacing 53 that is slightly greater than the width of the sleeve splines 500. Six of the splines 240 have a width $W_2$ slightly less than inter-spline spacing $S_1$ of the sleeve splines 500 and two diametrically-opposed splines have a width $W_3$ slightly less than inter-spline spacing $S_2$ of the sleeve splines 500, wherein $W_2$ is less than $W_3$. In additional embodiments, the hosel insert inner surface can have various non-circular configurations complementary to the non-circular configuration of the sleeve lower portion 160.

Selected surfaces of the hosel insert 200 can be roughened in a similar manner to the exterior surface 160 of the shaft. In some embodiments, the entire surface area of the insert can be provided with a roughened surface texture. In other embodiments, only the inner surface 240 of the hosel insert 200 can be roughened.

With reference now to FIGS. 2-4, the screw 400 desirably is made from a light-weight, high-strength material (e.g., T6 temper aluminum alloy 7075). In certain embodiments, the major diameter (i.e., outer diameter) of the threads 430 is less than 6 mm (e.g., ISO screws smaller than M6) and is either about 4 mm or 5 mm (e.g., M4 or M5 screws). In general, reducing the thread diameter increases the ability of the screw to elongate or stretch when placed under a load, resulting in a greater preload for a given torque. The use of relatively smaller diameter screws (e.g., M4 or M5 screws) allows a user to secure the club head to the shaft with less effort and allows the golfer to use the club for longer periods of time before having to retighten the screw.

Figure 15:
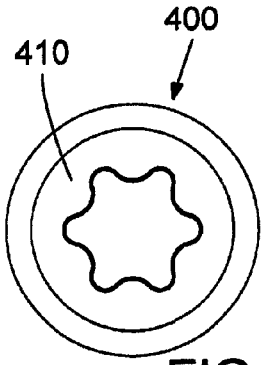
FIG. 15 is a bottom plan view of the screw of the connection assembly shown in FIG. 2.

The head 410 of the screw can be configured to be compatible with a torque wrench or other torque-limiting mechanism. In some embodiments, the screw head comprises a "hexalobular" internal driving feature (e.g., a TORX screw drive) (such as shown in FIG. 15) to facilitate application of a consistent torque to the screw and to resist cam-out of screwdrivers. Securing the club head 300 to the shaft 50 with a torque wrench can ensure that the screw 400 is placed under a substantially similar preload each time the club is assembled, ensuring that the club has substantially consistent playing characteristics each time the club is assembled. In additional embodiments, the screw head 410 can comprise various other drive designs (e.g., Phillips, Pozidriv, hexagonal, TTAP, etc.), and the user can use a conventional screwdriver rather than a torque wrench to tighten the screw.

The club head-shaft connection desirably has a low axial stiffness. The axial stiffness, k, of an element is defined as $$K = \frac{EA}{L} \qquad \text{Eq. 1}$$

where E is the Young's modulus of the material of the element, A is the cross-sectional area of the element and L is the length of the element. The lower the axial stiffness of an element, the greater the element will elongate when placed in tension or shorten when placed in compression. A club head-shaft connection having low axial stiffness is desirable to maximize elongation of the screw 400 and the sleeve, allowing for greater preload to be applied to the screw 400 for better retaining the shaft to the club head. For example, with reference to FIG. 16, when the screw 400 is tightened into the sleeve 15 lower opening 196, various surfaces of the sleeve 100, the hosel insert 200, the flange 360 and the screw 400 contact each other as previously described, which is effective to place the screw, the shaft, and the sleeve in tension and the hosel in compression.

Figure 16:
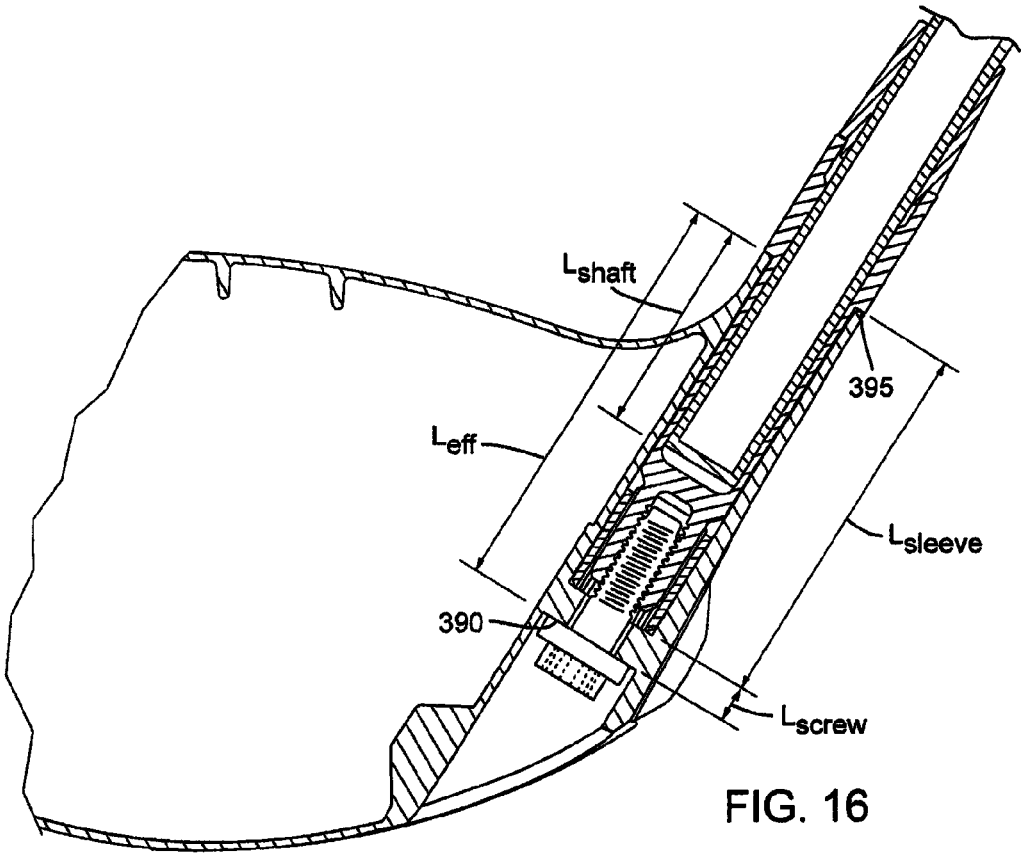
FIG. 16 is a cross-sectional view similar to FIG. 2 identifying lengths used in calculating the stiffness of components of the shaft-head connection assembly.

The axial stiffness of the club head-shaft connection, $k_{eff}$, can be determined by the equation $$\frac{1}{k_{eff}} = \frac{1}{k_{screw}} + \frac{1}{k_{sleeve} + k_{shaft}} \qquad \text{Eq. 2}$$

where $k_{screw}$, $k_{shaft}$ and $k_{sleeve}$ are the stiffnesses of the screw, shaft, and sleeve, respectively, over the portions that have associated lengths $L_{screw}$, $L_{shaft}$, and $L_{sleeve}$, respectively, as shown in FIG. 16. L screw is the length of the portion of the screw placed
in tension (measured from the flange bottom 390 to the bottom end of the shaft sleeve). $L_{shaft}$ is the length of the portion of the shaft 50 extending into the hosel opening 340 (measured from hosel upper surface 395 to the end of the shaft); and $L_{sleeve}$ is the length of the sleeve 100 placed in tension (measured from hosel upper surface 395 to the end of the sleeve), as depicted in FIG. 16.

Accordingly, $k_{screw}$, $k_{shaft}$ and $k_{sleeve}$ can be determined using the lengths in Equation 1. Table 1 shows calculated k values for certain components and combinations thereof for the connection assembly of FIGS. 2-14 and those of other commercially available connection assemblies used with removably attachable golf club heads. Also, the effective hosel stiffness, $K_{hosel}$, is also shown for comparison purposes (calculated over the portion of the hosel that is in compression during screw preload). A low $k_{eff}/k_{hosel}$ ratio indicates a small shaft connection assembly stiffness compared to the hosel stiffness, which is desirable in order to help maintain preload for a given screw torque during dynamic loading of the head. The $k_{eff}$ of the sleeve-shaft-screw combination of the connection assembly of illustrated embodiment is $9.27\times10^7$ N/m, which is the lowest among the compared connection assemblies.

TABLE 1

| Component(s) | Present technology | Nakashima (N/m) | Callaway Opti-Fit (N/m) | Versus Golf (N/m) |
|---|---|---|---|---|
| $k_{sleeve}$ (sleeve) | $5.57 \times 10^7$ | $9.65 \times 10^7$ | $9.64 \times 10^7$ | $4.03 \times 10^7$ |
| $k_{sleeve} + k_{shaft}$ (sleeve + shaft) | $1.86 \times 10^8$ | $1.87 \times 10^8$ | $2.03 \times 10^8$ | $1.24 \times 10^8$ |
| $k_{screw}$ (screw) | $1.85 \times 10^8$ | $5.03 \times 10^8$ | $2.51 \times 10^8$ | $1.88 \times 10^9$ |
| $k_{eff}$ (sleeve + shaft + screw) | $9.27 \times 10^7$ | $1.36 \times 10^8$ | $1.12 \times 10^8$ | $1.24 \times 10^8$ |
| $k_{hosel}$ | $1.27 \times 10^8$ | $1.27 \times 10^8$ | $1.27 \times 10^8$ | $1.27 \times 10^8$ |
| $k_{eff}/k_{hosel}$ (tension/compression ratio) | 0.73 | 1.07 | 0.88 | 1.98 |

Figure 17:
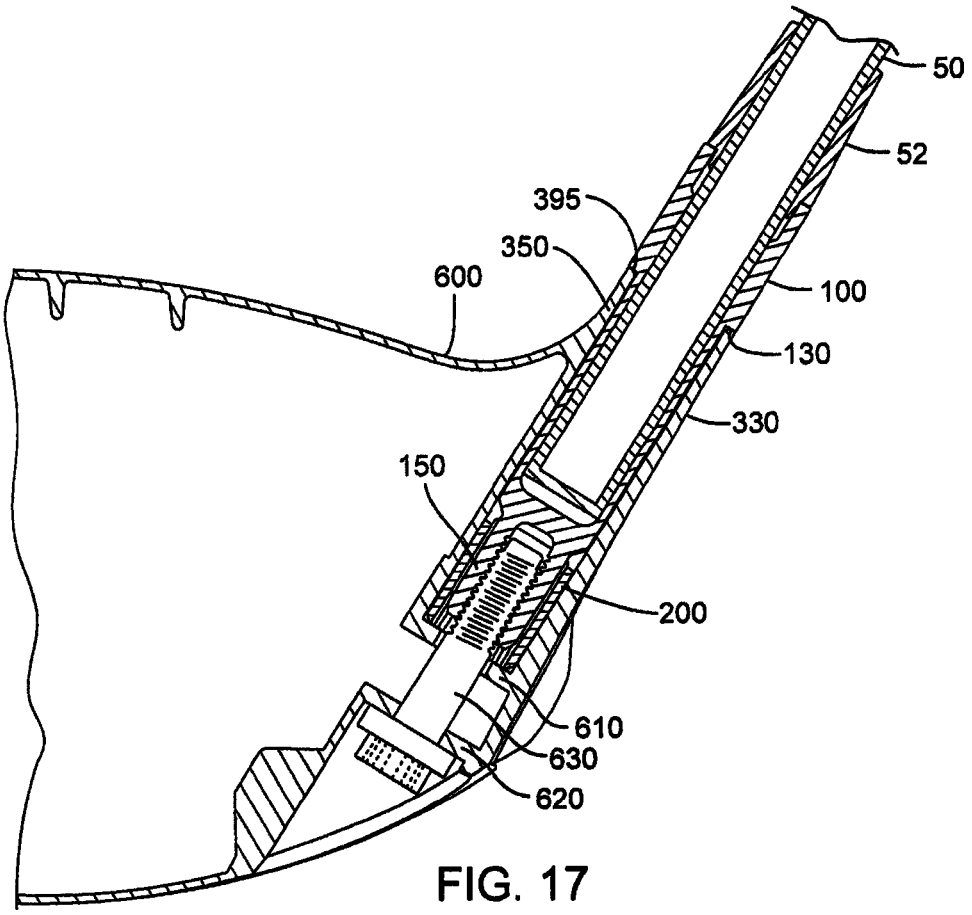
FIG. 17 is a cross-sectional view of a golf club head having a removable shaft, according to another embodiment.

The components of the connection assembly can be modified to achieve different values. For example, the screw 400 can be longer than shown in FIG. 16. In some embodiments, the length of the opening 196 can be increased along with a corresponding increase in the length of the screw 400. In additional embodiments, the construction of the hosel opening 340 can vary to accommodate a longer screw. For example, with reference to FIG. 17, a club head 600 comprises an upper flange 610 defining the bottom wall of the hosel opening and a lower flange 620 spaced from the upper flange 610 to accommodate a longer screw 630. Such a hosel construction can accommodate a longer screw, and thus can achieve a lower $k_{eff}$, while retaining compatibility with the sleeve 100 of FIGS. 5-10.

In the illustrated embodiment of FIGS. 2-10, the cross-sectional area of the sleeve 100 is minimized to minimize $k_{sleeve}$ by placing the splines 500 below the shaft, rather than around the shaft as used in prior art configurations.

EXAMPLES

In certain embodiments, a shaft sleeve can have 4, 6, 8, 10, or 12 splines. The height H of the splines of the shaft sleeve in particular embodiments can range from about 0.15 mm to about 0.95 mm, and more particularly from about 0.25 mm to about 0.75 mm, and even more particularly from about 0.5 mm to about 0.75 mm. The average diameter D of the spline portion of the shaft sleeve can range from about 6 mm to about 12 mm, with 8.45 mm being a specific example. As shown in FIG. 10, the average diameter is the diameter of the spline portion of a shaft sleeve measured between two points located at the mid-spans of two diametrically opposed splines.

The length L of the splines of the shaft sleeve in particular embodiments can range from about 2 mm to about 10 mm. For example, when the connection assembly is implemented in a driver, the splines can be relatively longer, for example, 7.5 mm or 10 mm. When the connection assembly is implemented in a fairway wood, which is typically smaller than a driver, it is desirable to use a relatively shorter shaft sleeve because less space is available inside the club head to receive the shaft sleeve. In that case, the splines can be relatively shorter, for example, 2 mm or 3 mm in length, to reduce the overall length of the shaft sleeve.

The ratio of spline width $W_1$ (at the midspan of the spline) to average diameter of the spline portion of the shaft sleeve in particular embodiments can range from about 0.1 to about 0.5, and more desirably, from about 0.15 to about 0.35, and even more desirably from about 0.16 to about 0.22. The ratio of spline width $W_1$ to spline H in particular embodiments can range from about 1.0 to about 22, and more desirably from about 2 to about 4, and even more desirably from about 2.3 to about 3.1. The ratio of spline length L to average diameter in particular embodiments can range from about 0.15 to about 1.7.

Tables 2-4 below provide dimensions for a plurality of different spline configurations for the sleeve 100 (and other shaft sleeves disclosed herein). In Table 2, the average radius R is the radius of the spline portion of a shaft sleeve measured at the mid-span of a spine, i.e., at a location equidistant from the base of the spline at surface 160 and to the outer surface 550 of the spline (see FIG. 10). The arc length in Tables 2 and 3 is the arc length of a spline at the average radius.

Table 2 shows the spline arc angle, average radius, average diameter, arc length, arc length, arc length/average radius ratio, width at midspan, width (at midspan)/average diameter ratio for different shaft sleeves having 8 splines (with two 33 degree gaps as shown in FIG. 10), 8 equally-spaced splines, 6 equally-spaced splines, 10 equally-spaced splines, 4 equally-spaced splines. Table 3 shows examples of shaft sleeves having different number of splines and spline heights. Table 4 shows examples of different combinations of lengths and average diameters for shaft sleeves apart from the number of splines, spline height H, and spline width $W_1$.

The specific dimensions provided in the present specification for the shaft sleeve 100 (as well as for other components disclosed herein) are given to illustrate the invention and not to limit it. The dimensions provided herein can be modified as needed in different applications or situations.

TABLE 2

| # Splines | Spline arc angel (deg.) | Average radius (mm) | Average diameter (mm) | Arc length (mm) | Arc length/ Average (mm) | Width at midspan (mm) | Width/ Average diameter |
|---|---|---|---|---|---|---|---|
| 8 (w/two 33 deg. gaps) | 21 | 4.225 | 8.45 | 1.549 | 0.367 | 1.540 | 0.182 |
| 8 (equally spaced) | 22.5 | 4.225 | 8.45 | 1.659 | 0.393 | 1.649 | 0.195 |
| 6 (equally spaced) | 30 | 4.225 | 8.45 | 2.212 | 0.524 | 2.187 | 0.259 |
| 10 (equally spaced) | 18 | 4.225 | 8.45 | 1.327 | 0.314 | 1.322 | 0.156 |
| 4 (equally spaced) | 45 | 4.225 | 8.45 | 3.318 | 0.785 | 3.234 | 0.383 |
| 12 (equally spaced) | 15 | 4.225 | 8.45 | 1.106 | 0.262 | 1.103 | 0.131 |

TABLE 3

| # Splines | Spline height (mm) | Arc length (mm) | Width at Midspan (mm) | Arc length/ Height | Width/ Height |
|---|---|---|---|---|---|
| 8 (w/two 33 deg. gaps) | 0.5 | 1.549 | 1.54 | 3.097 | 3.080 |
| 8 (w/two 33 deg. gaps) | 0.25 | 1.549 | 1.540 | 6.194 | 6.160 |
| 8 (w/two 33 deg. gaps) | 0.75 | 1.549 | 1.540 | 2.065 | 2.053 |
| 8 (equally spaced) | 0.5 | 1.659 | 1.649 | 3.318 | 3.297 |
| 6 (equally spaced) | 0.15 | 2.212 | 2.187 | 14.748 | 14.580 |
| 4 (equally spaced) | 0.95 | 1.327 | 1.321 | 1.397 | 1.391 |
| 4 (equally spaced) | 0.15 | 3.318 | 3.234 | 22.122 | 21.558 |
| 12 (equally spaced) | 0.95 | 1.106 | 1.103 | 1.164 | 1.161 |

TABLE 4

| Average sleeve diameter at spline (mm) | Spline length (mm) | Spline length/Average diameter |
|---|---|---|
| 6 | 7.5 | 1.25 |
| 6 | 3 | 0.5 |
| 6 | 10 | 1.667 |
| 6 | 2 | .333 |
| 8.45 | 7.5 | 0.888 |
| 8.45 | 3 | 0.355 |
| 8.45 | 10 | 1.183 |
| 8.45 | 2 | 0.237 |
| 12 | 7.5 | 0.625 |
| 12 | 3 | 0.25 |
| 12 | 10 | 0.833 |
| 12 | 2 | 0.167 |

Adjustable Lie/Loft Connection Assembly

Figure 18:
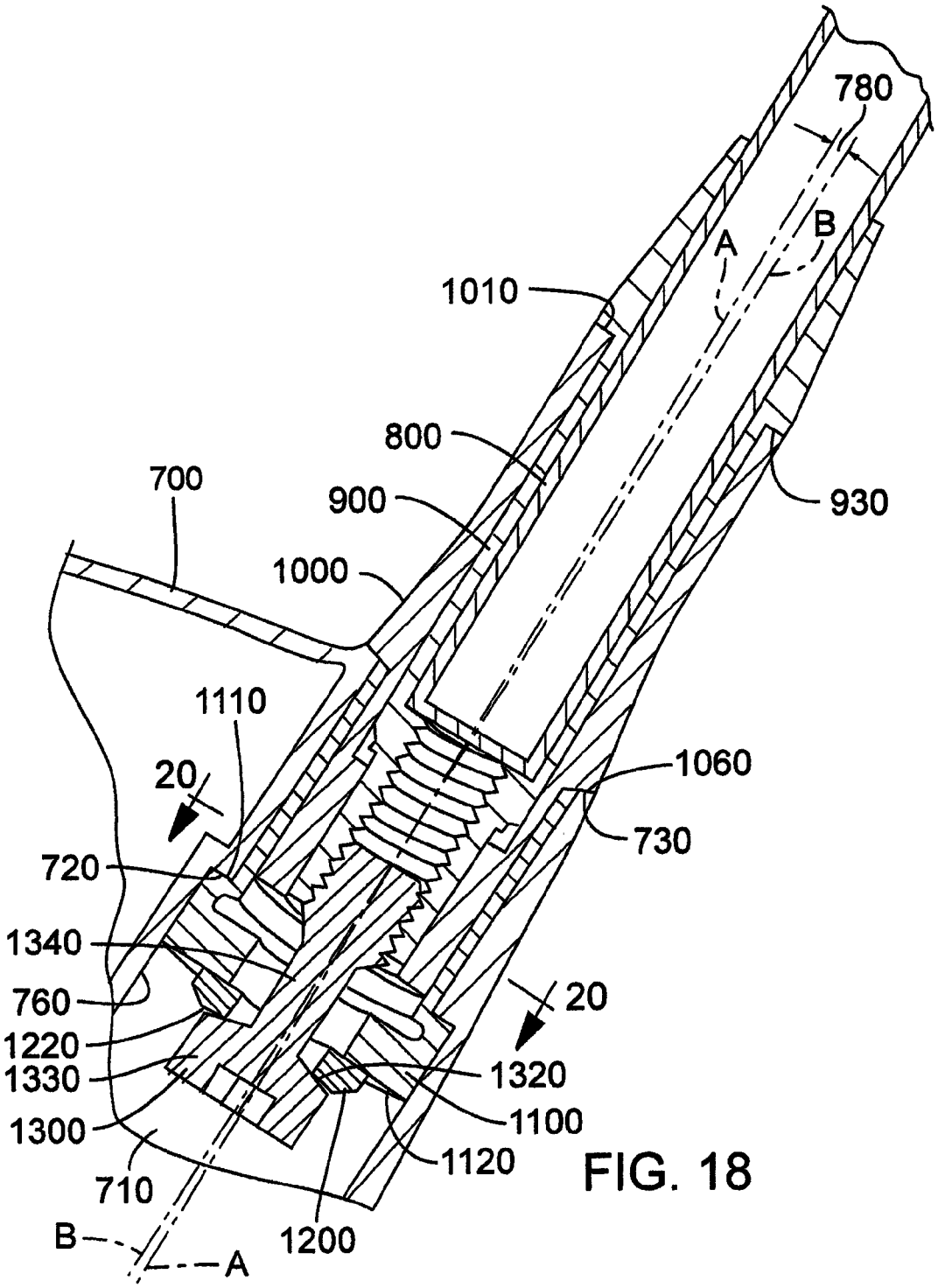
FIG. 18 is an enlarged cross-sectional view of a golf club head having a removable shaft, in accordance with another embodiment.
Figure 19:
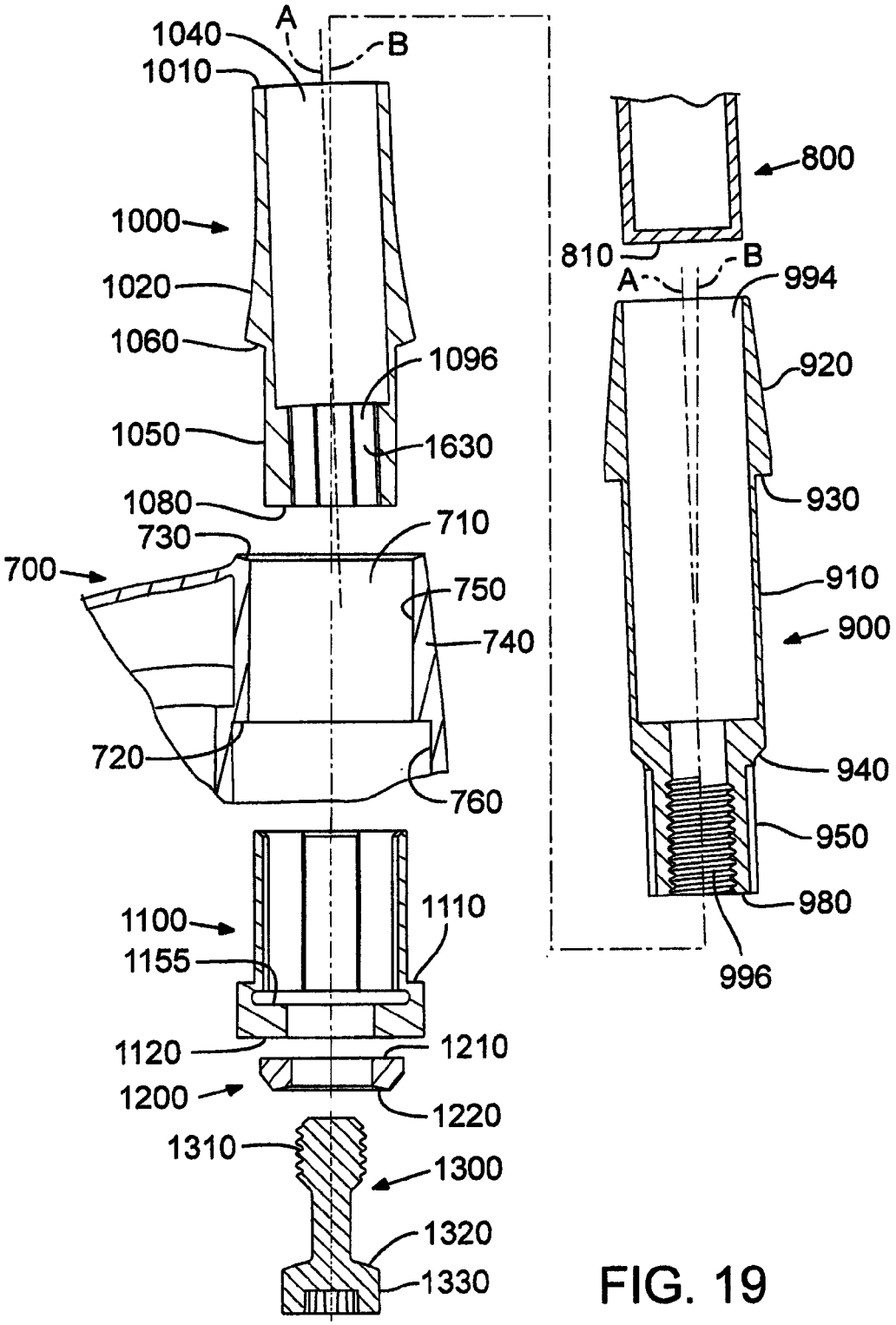
FIG. 19 is an exploded cross-sectional view of the shaft-club head connection assembly of FIG. 18.
Figure 20:
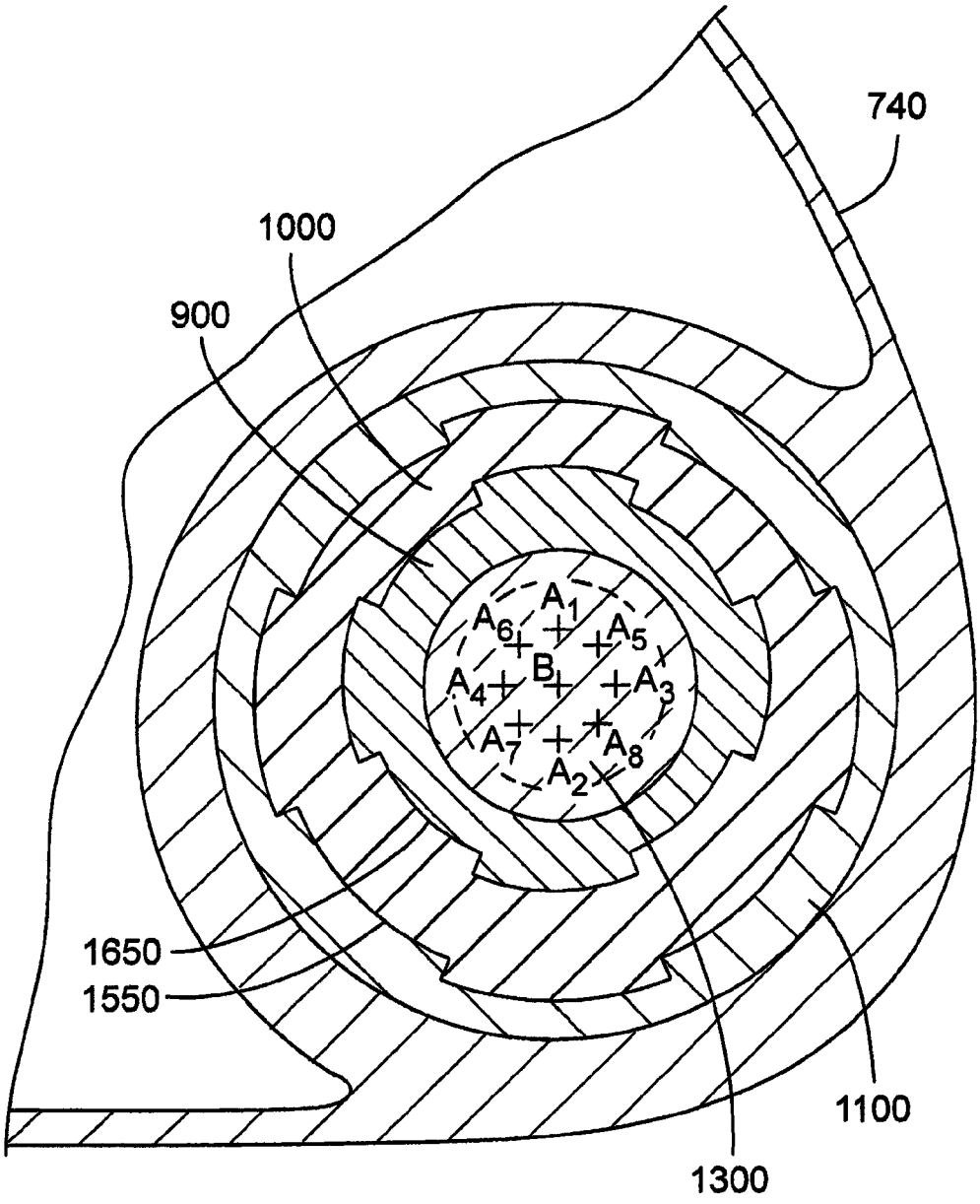
FIG. 20 is an enlarged cross-sectional view of the golf club head of FIG. 18, taken along the line 20-20 of FIG. 18.

Now with reference to FIGS. 18-20, there is shown a golf club comprising a head 700 attached to a removable shaft 800 via a removable head-shaft connection assembly. The connection assembly generally comprises a shaft sleeve 900, a hosel sleeve 1000 (also referred to herein as an adapter sleeve), a hosel insert 1100, a washer 1200 and a screw 1300. The club head 700 comprises a hosel 702 defining a hosel opening, or passageway 710. The passageway 710 in the illustrated embodiment extends through the club head and forms an opening in the sole of the club head to accept the screw 1300. Generally, the club head 700 is removably attached to the shaft 800 by the shaft sleeve 900 (which is mounted to the lower end portion of the shaft 800) being inserted into and engaging the hosel sleeve 1000. The hosel sleeve 1000 is inserted into and engages the hosel insert 1100 (which is mounted inside the hosel opening 710). The screw 1300 is tightened into a threaded opening of the shaft sleeve 900, with the washer 1200 being disposed between the screw 1300 and the hosel insert 1100, to secure the shaft to the club head.

The shaft sleeve 900 can be adhesively bonded, welded or secured in equivalent fashion to the lower end portion of the shaft 800. In other embodiments, the shaft sleeve 900 may be integrally formed with the shaft 800. As best shown in FIG. 19, the hosel opening 710 extends through the club head 700 and has hosel sidewalls 740 defining a first hosel inner surface 750 and a second hosel inner surface 760, the boundary between the first and second hosel inner surfaces defining an inner annular surface 720. The hosel sleeve 1000 is disposed between the shaft sleeve 900 and the hosel insert 1100. The hosel insert 1100 can be mounted within the hosel opening 710. The hosel insert 1100 can have an annular surface 1110 that contacts the hosel annular surface 720. The hosel insert 1100 can be adhesively bonded, welded or secured in equivalent fashion to the first hosel surface 740, the second hosel surface 750 and/or the hosel annular surface 720 to secure the hosel insert 1100 in place. In other embodiments, the hosel insert 1100 can be formed integrally with the club head 700.

Figure 31:
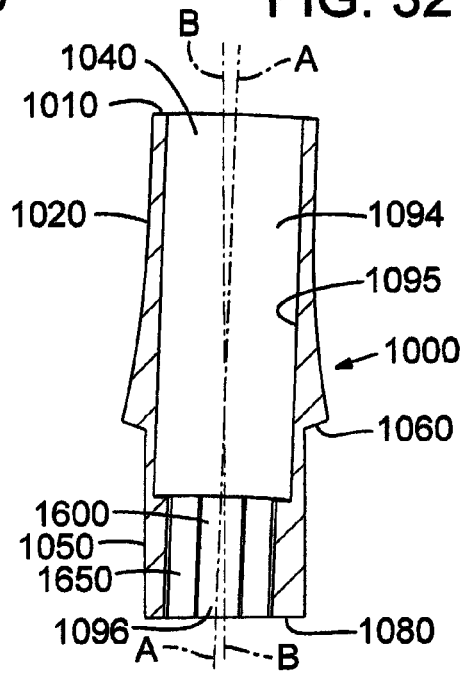
FIG. 31 is a cross-sectional view of the hosel sleeve of FIG. 27.
Figure 30:
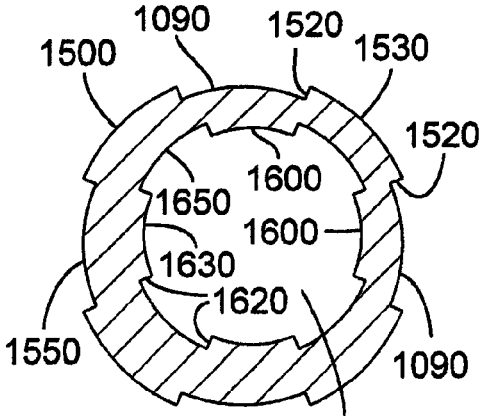
FIG. 30 is a cross-sectional view of the hosel sleeve, taken along line 30-30 of FIG. 27.
Figure 33:
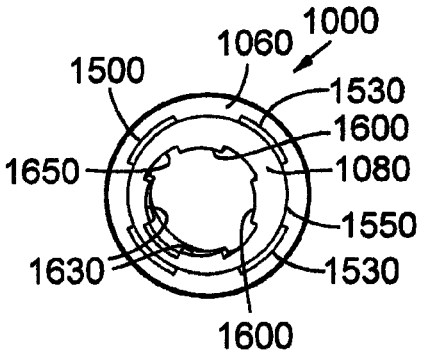
FIG. 33 is a bottom plan view of the hosel sleeve of FIG. 27.

Rotational movement of the shaft 800 relative to the club head 700 can be restricted by restricting rotational movement of the shaft sleeve 900 relative to the hosel sleeve 1000 and by restricting rotational movement of the hosel sleeve 1000 relative to the club head 700. To restrict rotational movement of the shaft sleeve 900 relative to the hosel sleeve 1000, the shaft sleeve has a lower, rotation prevention portion 950 having a non-circular configuration that mates with a complementary, non-circular configuration of a lower, rotation prevention portion 1096 inside the hosel sleeve 1000. The rotation prevention portion of the shaft sleeve 900 can comprise longitudinally extending splines 1400 formed on an external surface 960 of the lower portion 950, as best shown in FIGS. 21-22. The rotation prevention portion of the hosel sleeve can comprise complementary-configured splines 1600 formed on an inner surface 1650 of the lower portion 1096 of the hosel sleeve, as best shown in FIGS. 30-31.

Figure 29:
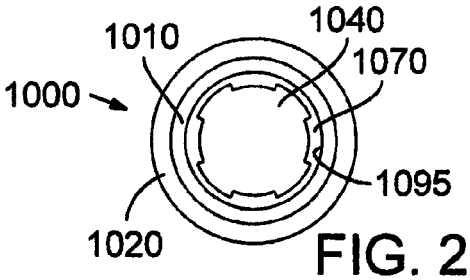
FIG. 29 is a top plan view of the hosel sleeve of FIG. 27, as viewed along longitudinal axis B defined by the outer surface of the lower portion of the hosel sleeve.
Figure 32:
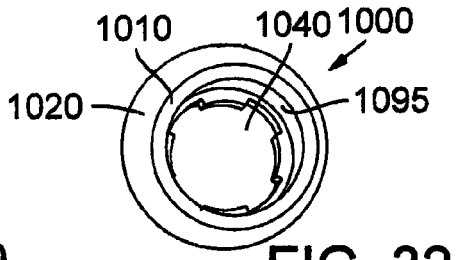
FIG. 32 is atop plan view of the hosel sleeve of FIG. 27.
Figure 27:
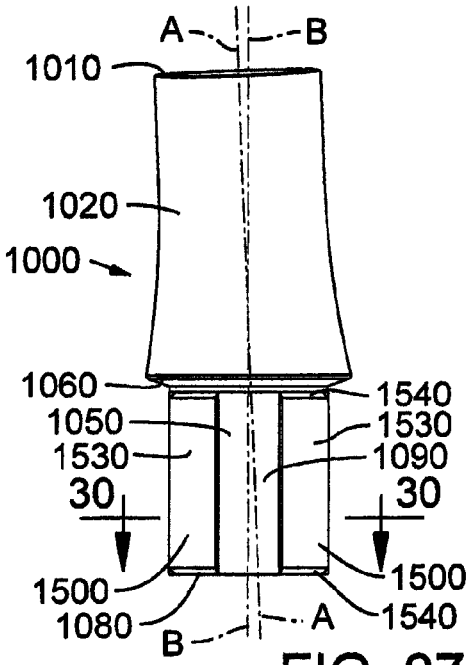
FIG. 27 is a side elevational view of the hosel sleeve of the connection assembly shown in FIG. 18.
Figure 28:
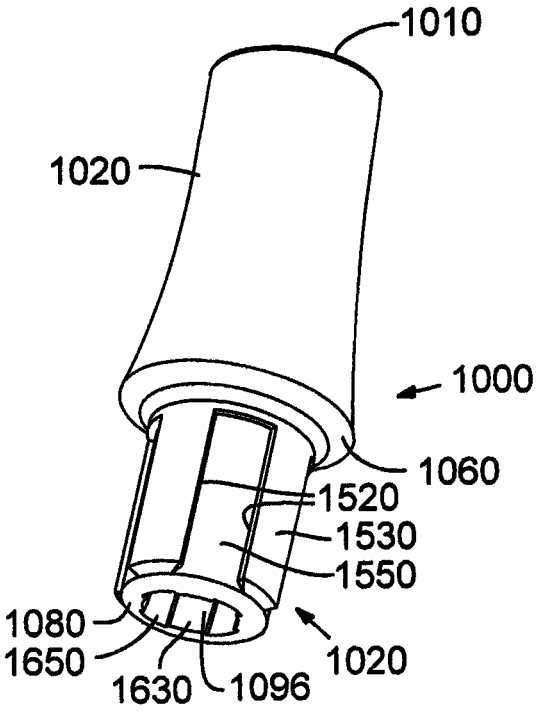
FIG. 28 is a perspective view of the hosel sleeve of FIG. 27.
Figure 36:
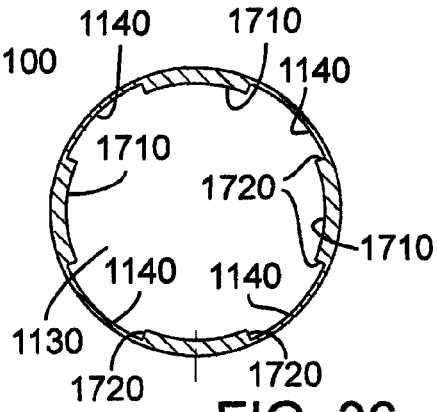
FIG. 36 is a cross-sectional view of the hosel insert, taken along line 36-36 of FIG. 34.
Figure 34:
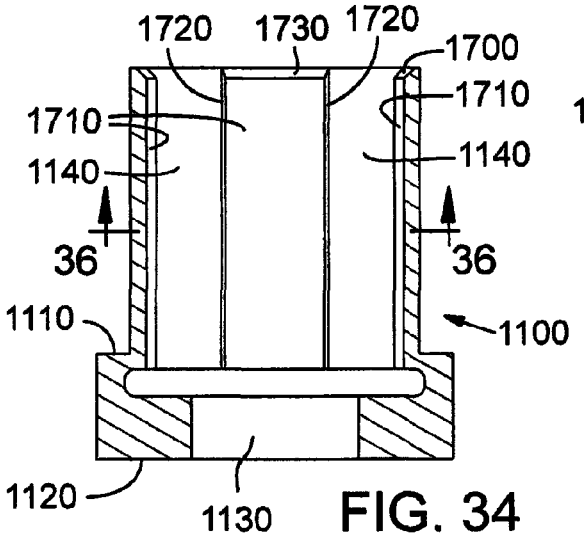
FIG. 34 is a cross-sectional view of the hosel insert of the connection usually shown in FIG. 18.
Figure 38:
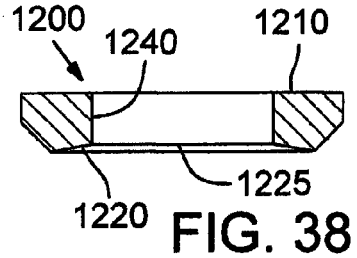
FIG. 38 is a cross-sectional view of the washer of the connection assembly shown in FIG. 18.
Figure 37:
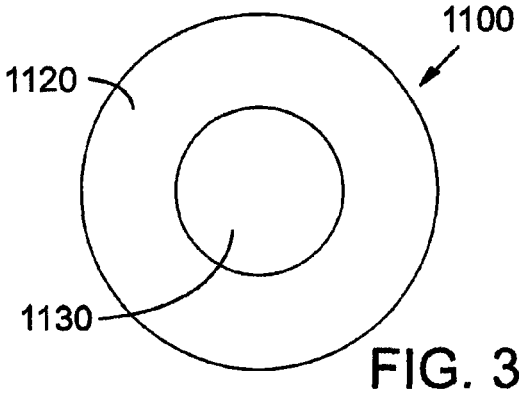
FIG. 37 is a bottom plan view of the hosel insert of FIG. 34.
Figure 39:
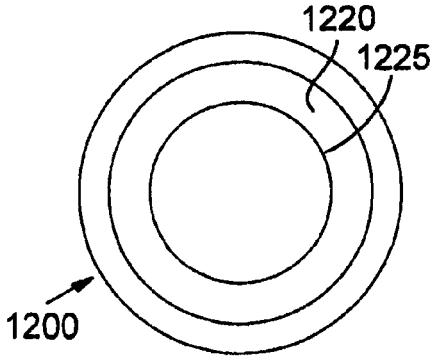
FIG. 39 is a bottom plan view of the washer of FIG. 38.
Figure 40:
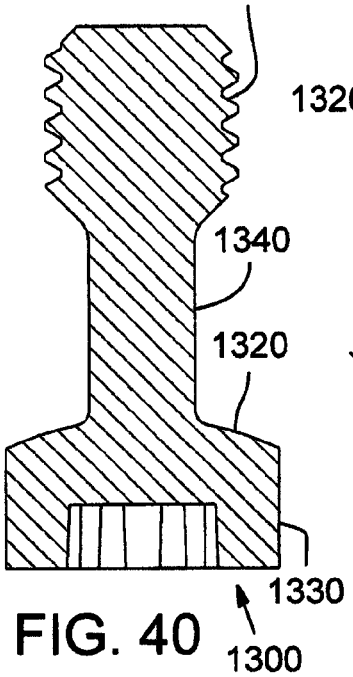
FIG. 40 is a cross-sectional view of the screw of FIG. 18.

To restrict rotational movement of the hosel sleeve 1000 relative to the club head 700, the hosel sleeve 1000 can have a lower, rotation prevention portion 1050 having a non-circular configuration that mates with a complementary, non-circular configuration of a rotation prevention portion of the hosel insert 1100. The rotation prevention portion of the hosel sleeve can comprise longitudinally extending splines 1500 formed on an external surface 1090 of a lower portion 1050 of the hosel sleeve 1000, as best shown in FIGS. 27-28 and 29. The rotation prevention portion of the hosel insert can comprise of complementary-configured splines 1700 formed on an inner surface 1140 of the hosel insert 1100, as best shown in FIGS. 34 and 36.

Accordingly, the shaft sleeve lower portion 950 defines a keyed portion that is received by a keyway defined by the hosel sleeve inner surface 1096, and hosel sleeve outer surface 1050 defines a keyed portion that is received by a keyway defined by the hosel insert inner surface 1140. In alternative embodiments, the rotation prevention portions can be elliptical, rectangular, hexagonal or other non-circular complementary configurations of the shaft sleeve lower portion 950 and the hosel sleeve inner surface 1096, and the hosel sleeve outer surface 1050 and the hosel insert inner surface 1140.

Referring to FIG. 18, the screw 1300 comprises a head 1330 having head, or bearing, surface 1320, a shaft 1340 extending from the head and external threads 1310 formed on a distal end portion of the screw shaft. The screw 1300 is used to secure the club head 700 to the shaft 800 by inserting the screw upwardly into passageway 710 via an opening in the sole of the club head. The screw is further inserted through the washer 1200 and tightened into an internally threaded bottom portion 996 of an opening 994 in the sleeve 900. In other embodiments, the club head 700 can be secured to the shaft 800 by other mechanical fasteners. With reference to FIGS. 18-19, when the screw 1300 is securely tightened into the shaft sleeve 900, the screw head surface 1320 contacts the washer 1200, the washer 1200 contacts a bottom surface 1120 of the hosel insert 1100, an annular surface 1060 of the hosel sleeve 1000 contacts an upper annular surface 730 of the club 700 and an annular surface 930 of the shaft sleeve 900 contacts an upper surface 1010 of the hosel sleeve 1000.

The hosel sleeve 1000 is configured to support the shaft 50 at a desired orientation relative to the club head to achieve a desired shaft loft and/or lie angle for the club. As best shown in FIGS. 27 and 31, the hosel sleeve 1000 comprises an upper portion 1020, a lower portion 1050, and a bore or longitudinal opening 1040 extending therethrough. The upper portion, which extends parallel the opening 1040, extends at an angle with respect to the lower portion 1050 defined as an "offset angle" 780 (FIG. 18). As best shown in FIG. 18, when the hosel insert 1040 is inserted into the hosel opening 710, the outer surface of the lower portion 1050 is co-axially aligned with the hosel insert 1100 and the hosel opening. In this manner, the outer surface of the lower portion 1050 of the hosel sleeve, the hosel insert 1100, and the hosel opening 710 collectively define a longitudinal axis B. When the shaft sleeve 900 is inserted into the hosel sleeve, the shaft sleeve and the shaft are co-axially aligned with the opening 1040 of the hosel sleeve. Accordingly, the shaft sleeve, the shaft, and the opening 1040 collectively define a longitudinal axis A of the assembly. As can be seen in FIG. 18, the hosel sleeve is effective to support the shaft 50 along longitudinal axis A, which is offset from longitudinal axis B by offset angle 780.

Consequently, the hosel sleeve 1000 can be positioned in the hosel insert 1100 in one or more positions to adjust the shaft loft and/or lie angle of the club. For example, FIG. 20 represents a connection assembly embodiment wherein the hosel sleeve can be positioned in four angularly spaced, discrete positions within the hosel insert 1100. As used herein, a sleeve having a plurality of "discrete positions" means that once the sleeve is inserted into the club head, it cannot be rotated about its longitudinal axis to an adjacent position, except for any play or tolerances between mating splines that allows for slight rotational movement of the sleeve prior to tightening the screw or other fastening mechanism that secures the shaft to the club head. In other words, the sleeve is not continuously adjustable and has a fixed number of finite positions and therefore has a fixed number of "discrete positions".

Referring to FIG. 20, crosshairs $A_1$-$A_4$ represent the position of the longitudinal axis A for each position of the hosel sleeve 1000. Positioning the hosel sleeve within the club head such that the shaft is adjusted inward towards the club head (such that the longitudinal axis A passes through crosshair $A_4$ in FIG. 20) increases the lie angle from an initial lie angle defined by longitudinal axis B; positioning the hosel sleeve such that the shaft is adjusted away from the club head (such that axis A passes through crosshair $A_3$) reduces the lie angle from an initial lie angle defined by longitudinal axis B. Similarly, positioning the hosel sleeve such that the shaft is adjusted forward toward the striking face (such that axis A passes through crosshair $A_2$) or rearward toward the rear of the club head (such that axis A passes through the crosshair $A_1$) will increase or decrease the shaft loft, respectively, from an initial shaft loft angle defined by longitudinal axis B. As noted above, adjusting the shaft loft is effective to adjust the square loft by the same amount. Similarly, the face angle is adjusted in proportion to the change in shaft loft. The amount of increase or decrease in shaft loft or lie angle in this example is equal to the offset angle 780.

Similarly, the shaft sleeve 900 can be inserted into the hosel sleeve at various angularly spaced positions around longitudinal axis A. Consequently, if the orientation of the shaft relative to the club head is adjusted by rotating the position of the hosel sleeve 1000, the position of the shaft sleeve within the hosel sleeve can be adjusted to maintain the rotational position of the shaft relative to longitudinal axis A. For example, if the hosel sleeve is rotated 90 degrees with respect to the hosel insert, the shaft sleeve can be rotated 90 degrees in the opposite direction with respect to the hosel sleeve in order to maintain the position of the shaft relative to its longitudinal axis. In this manner, the grip of the shaft and any visual indicia on the shaft can be maintained at the same position relative to the shaft axis as the shaft loft and/or lie angle is adjusted.

In another example, a connection assembly can employ a hosel sleeve that is positionable at eight angularly spaced positions within the hosel insert 1100, as represented by cross hairs $A_1$-$A_8$ in FIG. 20. Crosshairs $A_5$-$A_8$ represent hosel sleeve positions within the hosel insert 1100 that are effective to adjust both the lie angle and the shaft loft (and therefore the square loft and the face angle) relative to an initial lie angle and shaft loft defined by longitudinal axis B by adjusting the orientation of the shaft in a first direction inward or outward relative to the club head to adjust the lie angle and in a second direction forward or rearward relative to the club head to adjust the shaft loft. For example, crosshair $A_5$ represents a hosel sleeve position that adjusts the orientation of the shaft outward and rearward relative to the club head, thereby decreasing the lie angle and decreasing the shaft loft.

The connection assembly embodiment illustrated in FIGS. 18-20 provides advantages in addition to those provided by the illustrated embodiment of FIGS. 2-4 (e.g., ease of exchanging a shaft or club head) and already described above. Because the hosel sleeve can introduce a non-zero angle between the shaft and the hosel, a golfer can easily change the loft, lie and/or face angles of the club by changing the hosel sleeve. For example, the golfer can unscrew the screw 1300 from the shaft sleeve 900, remove the shaft 800 from the hosel sleeve 1000, remove the hosel sleeve 1000 from the hosel insert 1100, select another hosel sleeve having a desired offset angle, insert the shaft sleeve 900 into the replacement hosel sleeve, insert the replacement hosel sleeve into the hosel insert 1000, and tighten the screw 1300 into the shaft sleeve 900.

Thus, the use of a hosel sleeve in the shaft-head connection assembly allows the golfer to adjust the position of the shaft relative to the club head without having to resort to such traditional methods such as bending the shaft relative to the club head as described above. For example, consider a golf club utilizing the club head-shaft connection assembly of FIGS. 18-20 comprising a first hosel sleeve wherein the shaft axis is co-axially aligned with the hosel axis (i.e., the offset angle is zero, or, axis A passes through crosshair B). By exchanging the first hosel sleeve for a second hosel sleeve having a non-zero offset angle, a set of adjustments to the shaft loft, lie and/or face angles are possible, depending, in part, on the position of the hosel sleeve within the hosel insert.

In particular embodiments, the replacement hosel sleeves could be purchased individually from a retailer. In other embodiments, a kit comprising a plurality of hosel sleeves, each having a different offset angle can be provided. The number of hosel sleeves in the kit can vary depending on a desired range of offset angles and/or a desired granularity of angle adjustments. For example, a kit can comprise hosel sleeves providing offset angles from 0 degrees to 3 degrees, in 0.5 degree increments.

In particular embodiments, hosel sleeve kits that are compatible with any number of shafts and any number of club heads having the same hosel configuration and hosel insert 1100 are provided. In this manner, a pro shop or retailer need not necessarily stock a large number of shaft or club head variations with various loft, lie and/or face angles. Rather, any number of variations of club characteristic angles can be achieved by a variety of hosel sleeves, which can take up less retail shelf and storeroom space and provide the consumer with a more economic alternative to adjusting loft, lie or face angles (i.e., the golfer can adjust a loft angle by purchasing a hosel sleeve instead of a new club).

With reference now to FIGS. 21-26, there is shown the shaft sleeve 900 of the head-shaft connection assembly of FIGS. 18-20. The shaft sleeve 900 in the illustrated embodiment is substantially cylindrical and desirably is made from a light-weight, high-strength material (e.g., T6 temper aluminum alloy 7075). The shaft sleeve 900 can include a middle portion 910, an upper portion 920 and a lower portion 950. The upper portion 920 can have a greater thickness than the remainder of the shaft sleeve to provide, for example, additional mechanical integrity to the connection between the shaft 800 and the shaft sleeve 900. The upper portion 920 can have a flared or frustroconical shape as shown, to provide, for example, a more streamlined transition between the shaft 800 and club head 700. The boundary between the upper portion 920 and the middle portion 910 defines an upper annular thrust surface 930 and the boundary between the middle portion 910 and the lower portion 950 defines a lower annular surface 940. The shaft sleeve 900 has a bottom surface 980. In the illustrated embodiment, the annular surface 930 is perpendicular to the external surface of the middle portion 910. In other embodiments, the annular surface 930 may be frustroconical or otherwise taper from the upper portion 920 to the middle portion 910. The annular surface 930 bears against the upper surface 1010 of the hosel insert 1000 when the shaft 800 is secured to the club head 700 (FIG. 18).

The shaft sleeve 900 further comprises an opening 994 extending the length of the shaft sleeve 900, as depicted in FIG. 23. The opening 994 has an upper portion 998 for receiving the shaft 800 and an internally threaded bottom portion 996 for receiving the screw 1300. In the illustrated embodiment, the opening upper portion 998 has an internal sidewall having a constant diameter that is complementary to the configuration of the lower end portion of the shaft 800. In other embodiments, the opening upper portion 998 can have a configuration adapted to mate with various shaft profiles (e.g., the opening upper portion 998 can have more than one inner diameter, chamfered and/or perpendicular annular surfaces, etc.). With reference to the illustrated embodiment of FIG. 23, splines 1400 are located below the opening upper portion 998 and therefore below the shaft to minimize the overall diameter of the shaft sleeve. In certain embodiments, the internal threads of the lower opening 996 are created using a Spiralock® tap.

In particular embodiments, the rotation prevention portion of the shaft sleeve comprises a plurality of splines 1400 on an external surface 960 of the lower portion 950 that are elongated in the direction of the longitudinal axis of the shaft sleeve 900, as shown in FIGS. 21-22 and 26. The splines 1400 have sidewalls 1420 extending radially outwardly from the external surface 960, bottom edges 1410, bottom corners 1422 and arcuate outer surfaces 1450. In other embodiments, the external surface 960 can comprise more splines (such as up to 12) or fewer than four splines and the splines 1400 can have different shapes and sizes.

With reference now to FIGS. 27-33, there is shown the hosel sleeve 1000 of the head-shaft connection assembly of FIGS. 18-20. The hosel sleeve 1000 in the illustrated embodiment is substantially cylindrical and desirably is made from a light-weight, high-strength material (e.g., T6 temper aluminum alloy 7075). As noted above, the hosel sleeve 1000 includes an upper portion 1020 and a lower portion 1050. As shown in the illustrated embodiment of FIG. 27, the upper portion 1020 can have a flared or frustroconical shape, with the boundary between the upper portion 1020 and the lower portion 1050 defining an annular thrust surface 1060. In the illustrated embodiment, the annular surface 1060 tapers from the upper portion 1020 to the lower portion 1050. In other embodiments, the annular surface 1060 can be perpendicular to the external surface 1090 of the lower portion 1050. As best shown in FIG. 18, the annular surface 1060 bears against the upper annular surface 730 of the hosel when the shaft 800 is secured to the club head 700.

The hosel sleeve 1000 further comprises an opening 1040 extending the length of the hosel sleeve 1000. The hosel sleeve opening 1040 has an upper portion 1094 with internal sidewalls 1095 that are complementary configured to the configuration of the shaft sleeve middle portion 910, and a lower portion 1096 defining a rotation prevention portion having a non-circular configuration complementary to the configuration of shaft sleeve lower portion 950.

The non-circular configuration of the hosel sleeve lower portion 1096 comprises a plurality of splines 1600 formed on an inner surface 1650 of the opening lower portion 1096. With reference to FIGS. 30-31, the inner surface 1650 comprises four splines 1600 elongated in the direction of the longitudinal axis (axis A) of the hosel sleeve opening. The splines 1600 in the illustrated embodiment have sidewalls 1620 extending radially inwardly from the inner surface 1650 and arcuate inner surfaces 1630.

The external surface of the lower portion 1050 defines a rotation prevention portion comprising four splines 1500 elongated in the direction of and are parallel to longitudinal axis B defined by the external surface of the lower portion, as depicted in FIGS. 27 and 31. The splines 1500 have sidewalls 1520 extending radially outwardly from the surface 1550, top and bottom edges 1540 and accurate outer surfaces 1530.

The splined configuration of the shaft sleeve 900 dictates the degree to which the shaft sleeve 900 is positionable within the hosel sleeve 1000. In the illustrated embodiment of FIGS. 26 and 30, the splines 1400 and 1600 are substantially identical in shape and size and adjacent pairs of splines 1400 and 1600 have substantially similar spline-to-spline spacings. This spline configuration allows the shaft sleeve 900 to be positioned within the hosel sleeve 1000 at four angularly spaced positions relative to the hosel sleeve 1000. Similarly, the hosel sleeve 1000 can be positioned within the club head 700 at four angularly spaced positions. In other embodiments, different non-circular configurations (e.g., triangular, hexagonal, more or fewer splines, variable spline-to-spline spacings or spline widths) of the shaft sleeve lower portion 950, the hosel opening lower portion 1096, the hosel lower portion 1050 and the hosel insert inner surface 1140 could provide for various degrees of positionability.

The external surface of the shaft sleeve lower portion 950, the internal surface of the hosel sleeve opening lower portion 1096, the external surface of the hosel sleeve lower portion 1050, and the internal surface of the hosel insert can have generally rougher surfaces relative to the remaining surfaces of the shaft sleeve 900, the hosel sleeve 1000 and the hosel insert. The enhanced surface roughness provides, for example, greater friction between the shaft sleeve 900 and the hosel sleeve 1000 and between the hosel sleeve 1000 and the hosel insert 1100 to further restrict relative rotational movement between these components. The contacting surfaces of shaft sleeve, the hosel sleeve and the hosel insert can be roughened by sandblasting, although alternative methods or techniques can be used.

Figure 35:
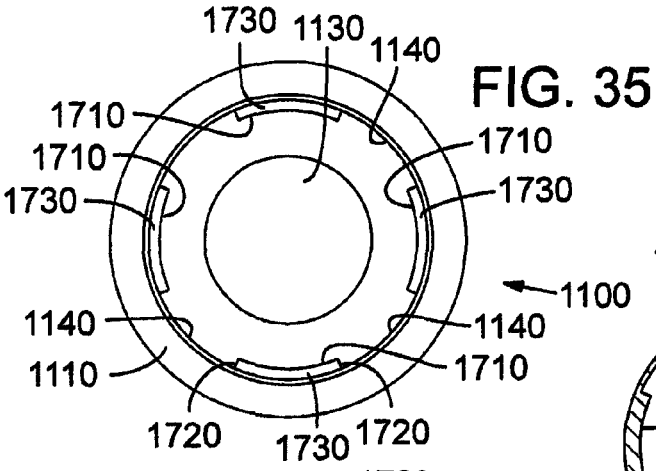
FIG. 35 is atop plan view of the hosel insert of FIG. 34.

With reference now to FIGS. 34-36, the hosel insert 1100 desirably is substantially tubular or cylindrical and can be made from a light-weight, high-strength material (e.g., grade 5 6Al-4V titanium alloy). The hosel insert 1100 comprises an inner surface 1140 defining a rotation prevention portion having a non-circular configuration that is complementary to the non-circular configuration of the hosel sleeve outer surface 1090. In the illustrated embodiment, the non-circulation configuration of inner surface 1140 comprises internal splines 1700 that are complementary in shape and size to the external splines 1500 of the hosel sleeve 1000. That is, there are four splines 1700 elongated in the direction of the longitudinal axis of the hosel insert 1100, and the splines 1700 have sidewalls 1720 extending radially inwardly from the inner surface 1140, chamfered top edges 1730 and inner surfaces 1710. The hosel insert 1100 can comprises an annular surface 1110 that contacts hosel annual surface 720 when the insert 1100 is mounted in the hosel opening 710 as depicted in FIG. 18. Additionally, the hosel opening 710 can have an annular shoulder (similar to shoulder 360 in FIG. 3). The insert 1100 can be welded or otherwise secured to the shoulder.

With reference now to FIGS. 18-20, the screw 1300 desirably is made from a lightweight, high-strength material (e.g., T6 temper aluminum alloy 7075). In certain embodiments, the major diameter (i.e., outer diameter) of the threads 1310 is about 4 mm (e.g., ISO screw size) but may be smaller or larger in alternative embodiments. The benefits of using a screw 1300 having a reduced thread diameter (about 4 mm or less) include the benefits described above with respect to screw 400 (e.g., the ability to place the screw under a greater preload for a given torque).

The head 1330 of the screw 1300 can be similar to the head 410 of the screw 400 (FIG. 15) and can comprise a hexalobular internal driving feature as described above. In additional embodiments, the screw head 1330 can comprise various other drive designs (e.g., Phillips, Pozidriv, hexagonal, TTAP, etc.), and the user can use a conventional screwdriver to tighten the screw.

As best shown in FIGS. 38-42, the screw 1300 desirably has an inclined, spherical bottom surface 1320. The washer 1200 desirably comprises a tapered bottom surface 1220, an upper surface 1210, an inner surface 1240 and an inner circumferential edge 1225 defined by the boundary between the tapered surface 1220 and the inner surface 1240. As discussed above and as shown in FIG. 18, a hosel sleeve 1000 can be selected to support the shaft at a non-zero angle with respect to the longitudinal axis of the hosel opening. In such a case, the shaft sleeve 900 and the screw 1300 extend at a non-zero angle with respect to the longitudinal axis of the hosel insert 1100 and the washer 1200. Because of the inclined surfaces 1320 and 1220 of the screw and the washer, the screw head can make complete contact with the washer through 360 degrees to better secure the shaft sleeve in the hosel insert. In certain embodiments, the screw head can make complete contact with the washer regardless of the position of the screw relative to the longitudinal axis of the hosel opening.

Figure 41:
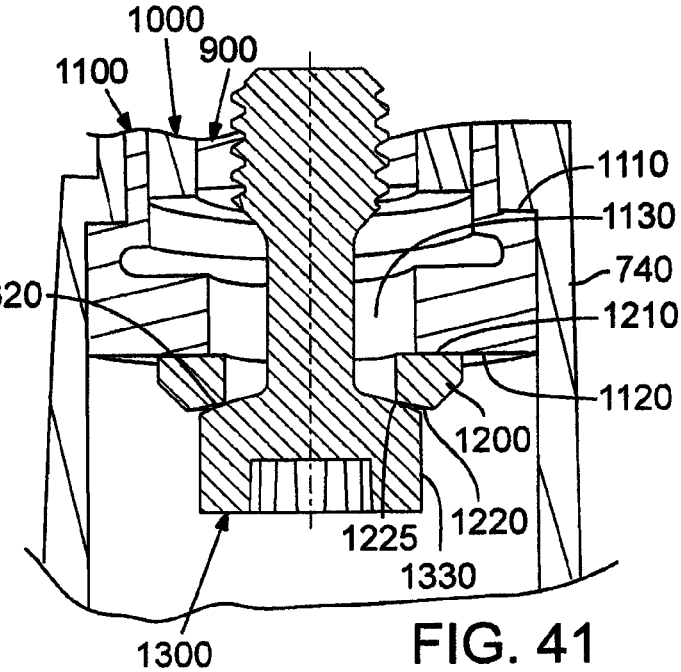
FIG. 41 is a cross-sectional view depicting the screw-washer interface of a connection assembly where the hosel sleeve longitudinal axis is aligned with the longitudinal axis of the hosel opening.
Figure 42:
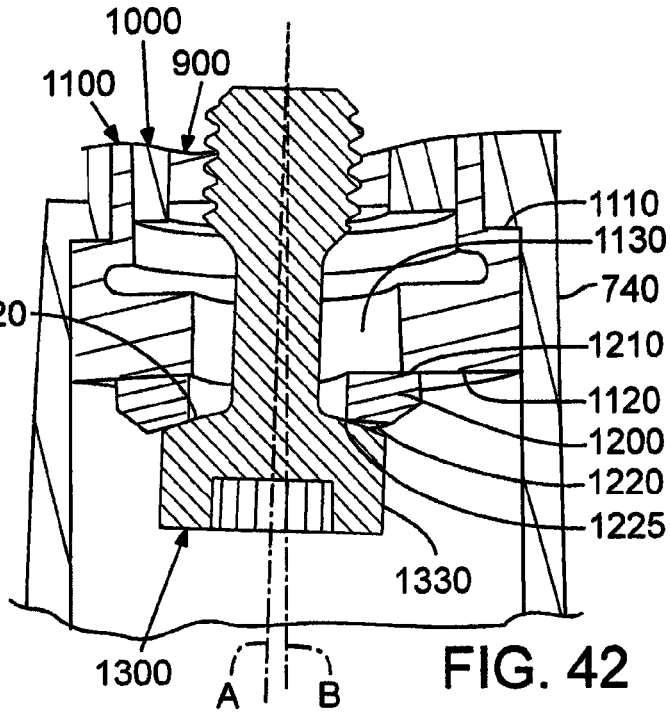
FIG. 42 is a cross-sectional view depicting a screw-washer interface of a connection assembly where the hosel sleeve longitudinal axis is offset from the longitudinal axis of the hosel opening.

For example, in the illustrated embodiment of FIG. 41, the head-shaft connection assembly employs a first hosel sleeve having a longitudinal axis that is co-axially aligned with the hosel sleeve opening longitudinal axis (i.e., the offset angle between the two longitudinal axes A and B is zero). The screw 1300 contacts the washer 1200 along the entire circumferential edge 1225 of the washer 1200. When the first hosel sleeve is exchanged for a second hosel sleeve having a non-zero offset angle, as depicted in FIG. 42, the tapered washer surface 1220 and the tapered screw head surface 1320 allow for the screw 1300 to maintain contact with the entire circumferential edge 1225 of the washer 1200. Such a washer-screw connection allows the bolt to be loaded in pure axial tension without being subjected to any bending moments for a greater preload at a given installation torque, resulting in the club head 700 being more reliably and securely attached to the shaft 800. Additionally, this configuration allows for the compressive force of the screw head to be more evenly distributed across the washer upper surface 1210 and hosel insert bottom surface 1120 interface.

Figure 43A:
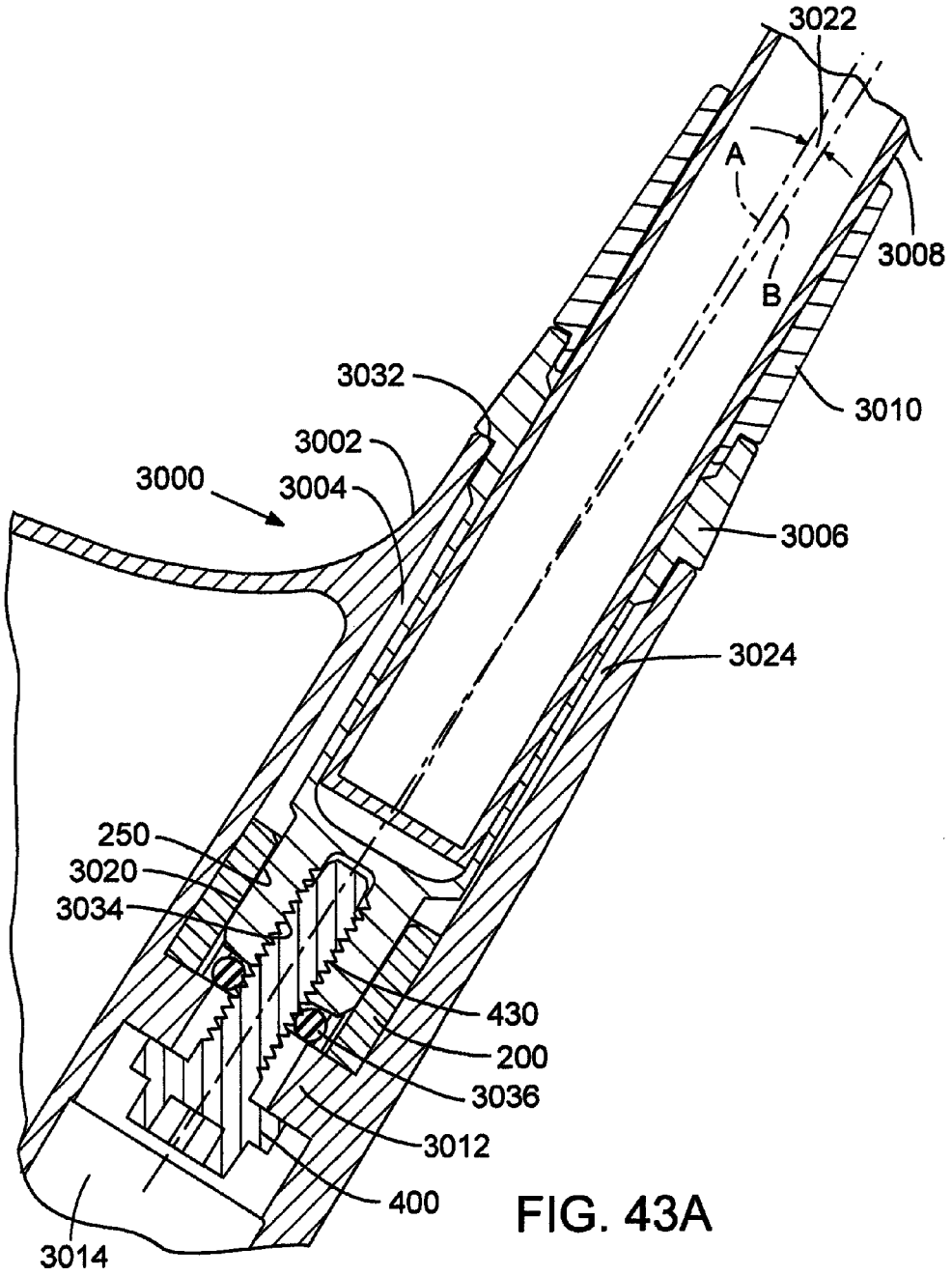
FIG. 43A is an enlarged cross-sectional view of a golf club head having a removable shaft, in accordance with another embodiment.

FIG. 43A shows another embodiment of a gold club assembly that has a removable shaft that can be supported at various positions relative to the head to vary the shaft loft and/or the lie angle of the club. The assembly comprises a club head 3000 having a hosel 3002 defining a hosel opening 3004. The hosel opening 3004 is dimensioned to receive a shaft sleeve 3006, which in turn is secured to the lower end portion of a shaft 3008. The shaft sleeve 3006 can be adhesively bonded, welded or secured in equivalent fashion to the lower end portion of the shaft 3008. In other embodiments, the shaft sleeve 3006 can be integrally formed with the shaft 3008. As shown, a ferrule 3010 can be disposed on the shaft just above the shaft sleeve 3006 to provide a transition piece between the shaft sleeve and the outer surface of the shaft 3008.

The hosel opening 3004 is also adapted to receive a hosel insert 200 (described in detail above), which can be positioned on an annular shoulder 3012 inside the club head. The hosel insert 200 can be secured in place by welding, an adhesive, or other suitable techniques. Alternatively, the insert can be integrally formed in the hosel opening. The club head 3000 further includes an opening 3014 in the bottom or sole of the club head that is sized to receive a screw 400. Much like the embodiment shown in FIG. 2, the screw 400 is inserted into the opening 3014, through the opening in shoulder 3012, and is tightened into the shaft sleeve 3006 to secure the shaft to the club head. However, unlike the embodiment shown in FIG. 2, the shaft sleeve 3006 is configured to support the shaft at different positions relative to the club head to achieve a desired shaft loft and/or lie angle.

Figure 43B:
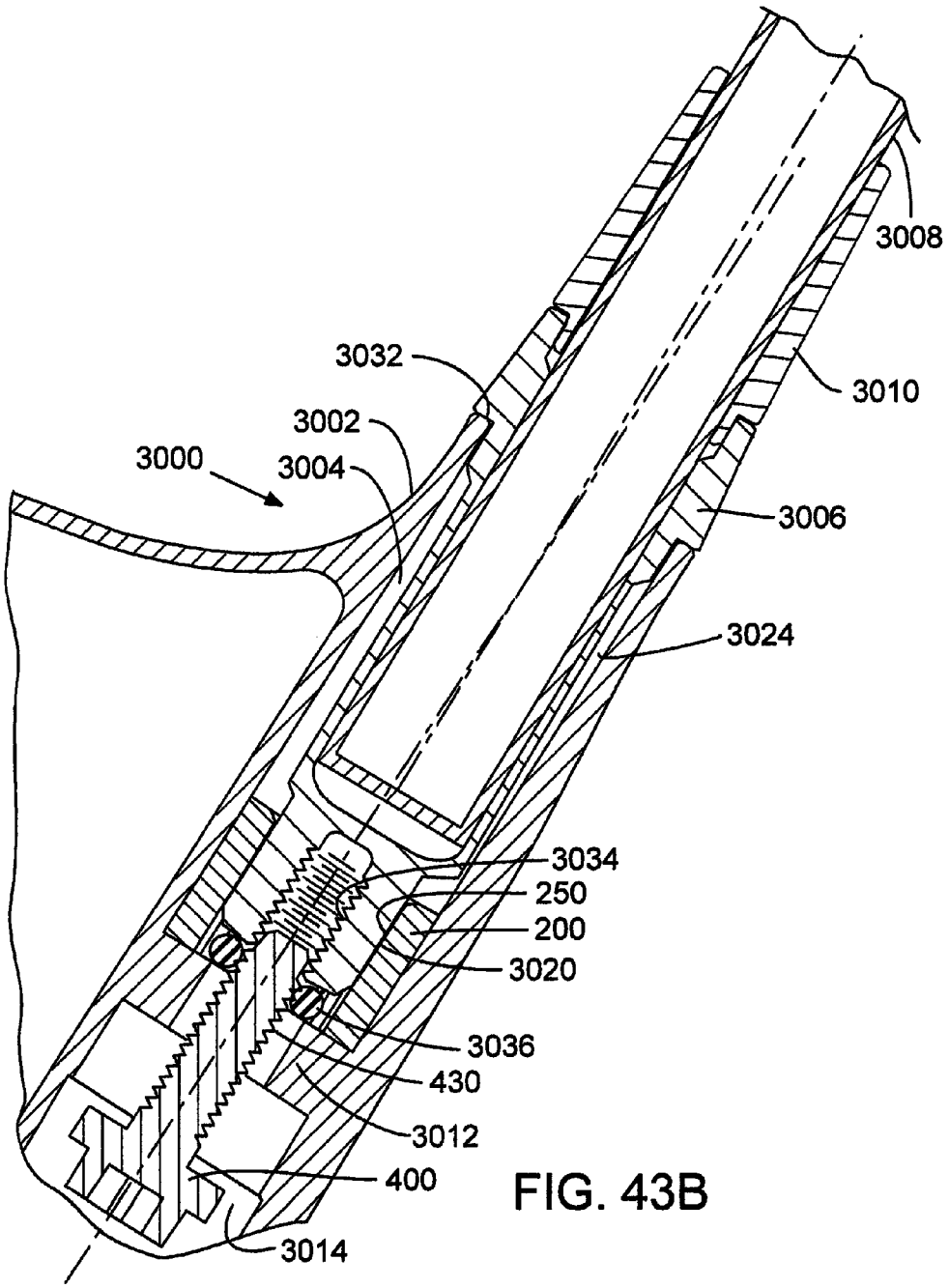
FIG. 43B shows the golf club head of FIG. 43A with the screw loosened to permit removal of the shaft from the club head.
Figure 44:
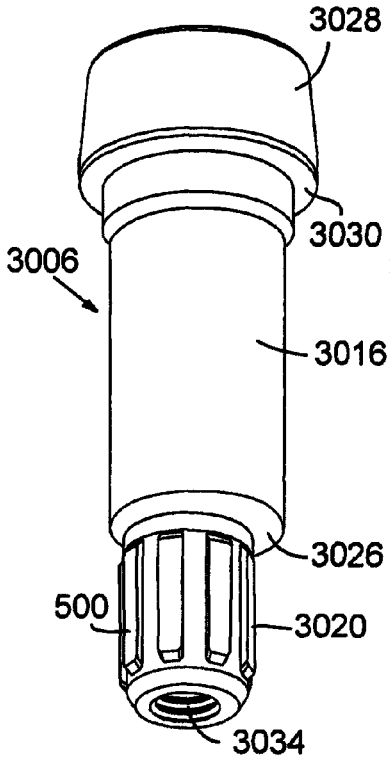
FIG. 44 is a perspective view of the shaft sleeve of the assembly shown in FIG. 43.
Figure 45:
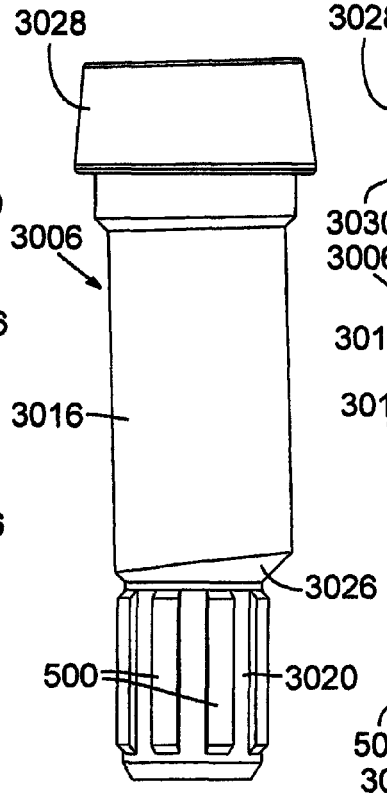
FIG. 45 is a side elevation view of the shaft sleeve of FIG. 44.

If desired, a screw capturing device, such as in the form of an o-ring or washer 3036, can be placed on the shaft of the screw 400 above shoulder 3012 to retain the screw in place within the club head when the screw is loosened to permit removal of the shaft from the club head. The ring 3036 desirably is dimensioned to frictionally engage the threads of the screw and has an outer diameter that is greater than the central opening in shoulder 3012 so that the ring 3036 cannot fall through the opening. When the screw 400 is tightened to secure the shaft to the club head, as depicted in FIG. 43A, the ring 3036 desirably is not compressed between the shoulder 3012 and the adjacent lower surface of the shaft sleeve 3006. FIG. 43B shows the screw 400 removed from the shaft sleeve 3006 to permit removal of the shaft from the club head. As shown, in the disassembled state, the ring 3036 captures the distal end of the screw to retain the screw within the club head to prevent loss of the screw. The ring 3036 desirably comprises a polymeric or elastomeric material, such as rubber, Viton, Neoprene, silicone, or similar materials. The ring 3036 can be an o-ring having a circular cross-sectional shape as depicted in the illustrated embodiment. Alternatively, the ring 3036 can be a flat washer having a square or rectangular cross-sectional shape. In other embodiments, the ring 3036 can various other cross-sectional profiles.

The shaft sleeve 3006 is shown in greater detail in FIGS. 44-47. The shaft sleeve 3006 in the illustrated embodiment comprises an upper portion 3016 having an upper opening 3018 for receiving and a lower portion 3020 located below the lower end of the shaft. The lower portion 3020 can have a threaded opening 3034 for receiving the threaded shaft of the screw 400. The lower portion 3020 of the sleeve can comprise a rotation prevention portion configured to mate with a rotation prevention portion of the hosel insert 200 to restrict relative rotation between the shaft and the club head. As shown, the rotation prevention portion can comprise a plurality of longitudinally extending external splines 500 that are adapted to mate with corresponding internal splines 240 of the hosel insert 200 (FIGS. 11-14). The lower portion 3020 and the external splines 500 formed thereon can have the same configuration as the shaft lower portion 150 and splines 500 shown in FIGS. 5-7 and 9-10 and described in detail above. Thus, the details of splines 500 are not repeated here.

Unlike the embodiment shown in FIGS. 5-7 and 9-10, the upper portion 3016 of the sleeve extends at an offset angle 3022 relative to the lower portion 3020. As shown in FIG. 43, when inserted in the club head, the lower portion 3020 is co-axially aligned with the hosel insert 200 and the hosel opening 3004, which collectively define a longitudinal axis B. The upper portion 3016 of the shaft sleeve 3006 defines a longitudinal axis A and is effective to support the shaft 3008 along axis A, which is offset from longitudinal axis B by offset angle 3022. Inserting the shaft sleeve at different angular positions relative to the hosel insert is effective to adjust the shaft loft and/or the lie angle, as further described below.

Figure 47:
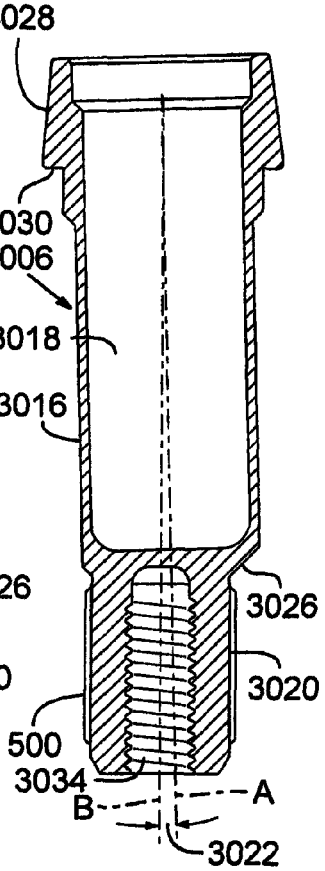
FIG. 47 is a cross-sectional view of the shaft sleeve taken along line 47-47 of FIG. 46.
Figure 46:
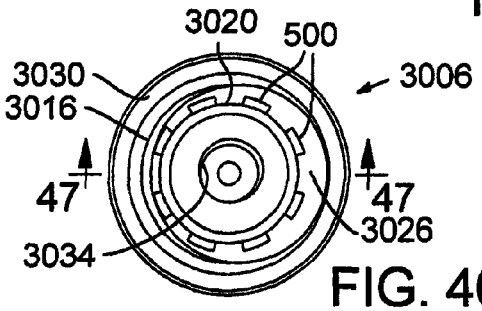
FIG. 46 is a bottom plan view of the shaft sleeve of FIG. 44.

As best shown in FIG. 47, the upper portion 3016 of the shaft sleeve desirably has a constant wall thickness from the lower end of opening 3018 to the upper end of the shaft sleeve. A tapered surface portion 3026 extends between the upper portion 3016 and the lower portion 3020. The upper portion 3016 of the shaft sleeve has an enlarged head portion 3028 that defines an annular bearing surface 3030 that contacts an upper surface 3032 of the hosel 3002 (FIG. 43). The bearing surface 3030 desirably is oriented at a 90-degree angle with respect to longitudinal axis B so that when the shaft sleeve is inserted in to the hosel, the bearing surface 3030 can make complete contact with the opposing surface 3032 of the hosel through 360 degrees.

As further shown in FIG. 43, the hosel opening 3004 desirably is dimensioned to form a gap 3024 between the outer surface of the upper portion 3016 of the sleeve and the opposing internal surface of the club head. Because the upper portion 3016 is not co-axially aligned with the surrounding inner surface of the hosel opening, the gap 3024 desirably is large enough to permit the shaft sleeve to be inserted into the hosel opening with the lower portion extending into the hosel insert at each possible angular position relative to longitudinal axis B. For example, in the illustrated embodiment, the shaft sleeve has eight external splines 500 that are received between eight internal splines 240 of the hosel insert 200. The shaft sleeve and the hosel insert can have the configurations shown in FIGS. 10 and 13, respectively. This allows the sleeve to be positioned within the hosel insert at two positions spaced 180 degrees from each other, as previously described.

Figure 48:
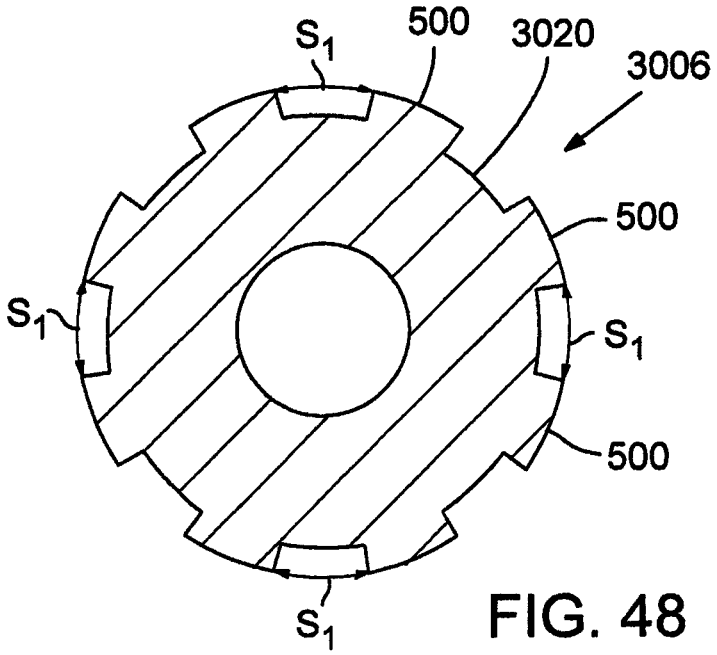
FIG. 48 is a cross-sectional view of another embodiment of a shaft sleeve and FIG. 49 is a top plan view of a hosel insert that is adapted to receive the shaft sleeve.
Figure 49:
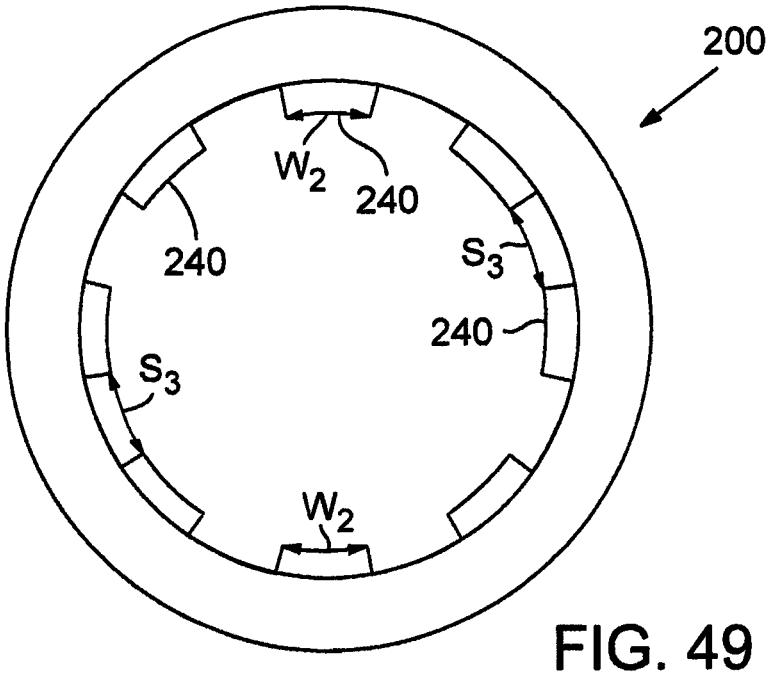

Other shaft sleeve and hosel insert configurations can be used to vary the number of possible angular positions for the shaft sleeve relative to the longitudinal axis B. FIGS. 48 and 49, for example, show an alternative shaft sleeve and hosel insert configuration in which the shaft sleeve 3006 has eight equally spaced splines 500 with radial sidewalls 502 that are received between eight equally spaced splines 240 of the hosel insert 200. Each spline 500 is spaced from an adjacent spline by spacing $S_1$ dimensioned to receive a spline 240 of the hosel insert having a width $W_2$. This allows the lower portion 3020 of the shaft sleeve to be inserted into the hosel insert 200 at eight angularly spaced positions around longitudinal axis B (similar to locations $A_1$-$A_8$ shown in FIG. 20). In a specific embodiment, the spacing $S_1$ is about 23 degrees, the arc angle of each spline 500 is about 22 degrees, and the width $W_2$ is about 22.5 degrees.

Figure 50:
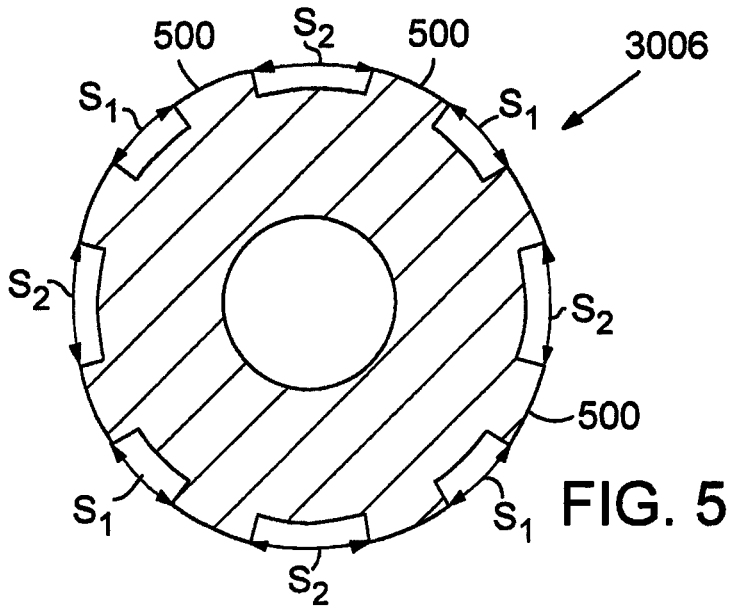
FIG. 50 is a cross-sectional view of another embodiment of a shaft sleeve and FIG. 51 is a top plan view of a hosel insert that is adapted to receive the shaft sleeve.
Figure 51:
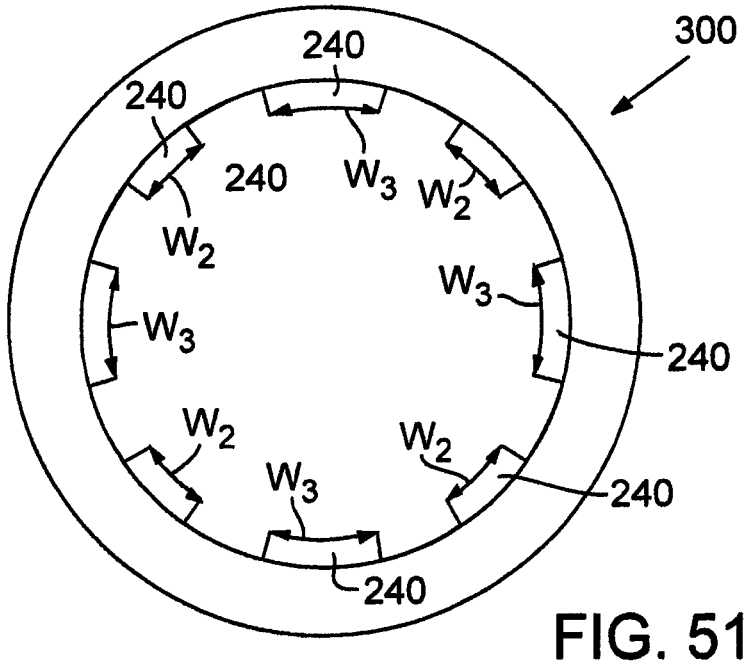

FIGS. 50 and 51 show another embodiment of a shaft sleeve and hosel insert configuration. In the embodiment of FIGS. 50 and 51, the shaft sleeve 3006 (FIG. 50) has eight splines 500 that are alternately spaced by spline-to-spline spacing $S_1$ and $S_2$, where $S_2$ is greater than $S_1$. Each spline has radial sidewalls 502 providing the same advantages previously described with respect to radial sidewalls. Similarly, the hosel insert 200 (FIG. 51) has eight splines 240 having alternating widths $W_2$ and $W_3$ that are slightly less than spline spacing $S_1$ and $S_2$, respectively, to allow each spline 240 of width $W_2$ to be received within spacing $S_1$ of the shaft sleeve and each spline 240 of width $W_3$ to be received within spacing $S_2$ of the shaft sleeve. This allows the lower portion 3020 of the shaft sleeve to be inserted into the hosel insert 200 at four angularly spaced positions around longitudinal axis B. In a particular embodiment, the spacing $S_1$ is about 19.5 degrees, the spacing $S_2$ is about 29.5 degrees, the arc angle of each spline 500 is about 20.5 degrees, the width $W_2$ is about 19 degrees, and the width $W_3$ is about 29 degrees. In addition, using a greater or fewer number of splines on the shaft sleeve and mating splines on the hosel insert increases and decreases, respectively, the number of possible positions for shaft sleeve.

As can be appreciated, the assembly shown in FIGS. 43-51 is similar to the embodiment shown in FIGS. 18-20 in that both permit a shaft to be supported at different orientations relative to the club head to vary the shaft loft and/or lie angle. An advantage of the assembly of FIGS. 43-51 is that it includes fewer pieces than the assembly of FIGS. 18-20, and therefore is less expensive to manufacture and has less mass (which allows for a reduction in overall weight).

Figure 60:
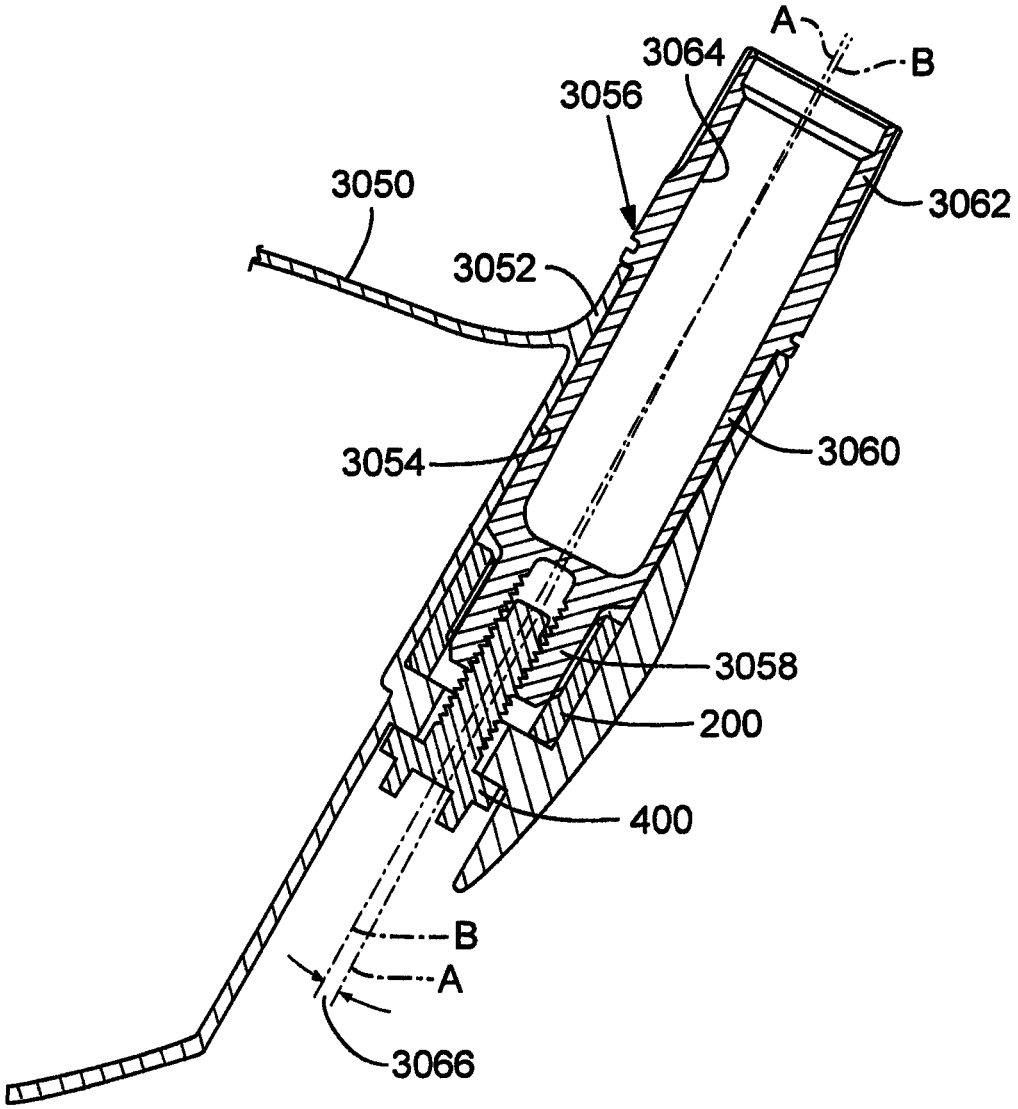
FIG. 60 is an enlarged cross-sectional view of a golf club head having a removable shaft, in accordance with another embodiment.

FIG. 60 shows another embodiment of a golf club assembly that is similar to the embodiment shown in FIG. 43A. The embodiment of FIG. 60 includes a club head 3050 having a hosel 3052 defining a hosel opening 3054, which in turn is adapted to receive a hosel insert 200. The hosel opening 3054 is also adapted to receive a shaft sleeve 3056 mounted on the lower end portion of a shaft (not shown in FIG. 60) as described herein.

The shaft sleeve 3056 has a lower portion 3058 including splines that mate with the splines of the hosel insert 200, an intermediate portion 3060 and an upper head portion 3062. The intermediate portion 3060 and the head portion 3062 define an internal bore 3064 for receiving the tip end portion of the shaft. In the illustrated embodiment, the intermediate portion 3060 of the shaft sleeve has a cylindrical external surface that is concentric with the inner cylindrical surface of the hosel opening 3054. In this manner, the lower and intermediate portions 3058, 3060 of the shaft sleeve and the hosel opening 3054 define a longitudinal axis B. The bore 3064 in the shaft sleeve defines a longitudinal axis A to support the shaft along axis A, which is offset from axis B by a predetermined angle 3066 determined by the bore 3064. As described above, inserting the shaft sleeve 3056 at different angular positions relative to the hosel insert 200 is effective to adjust the shaft loft and/or the lie angle.

Figure 61:
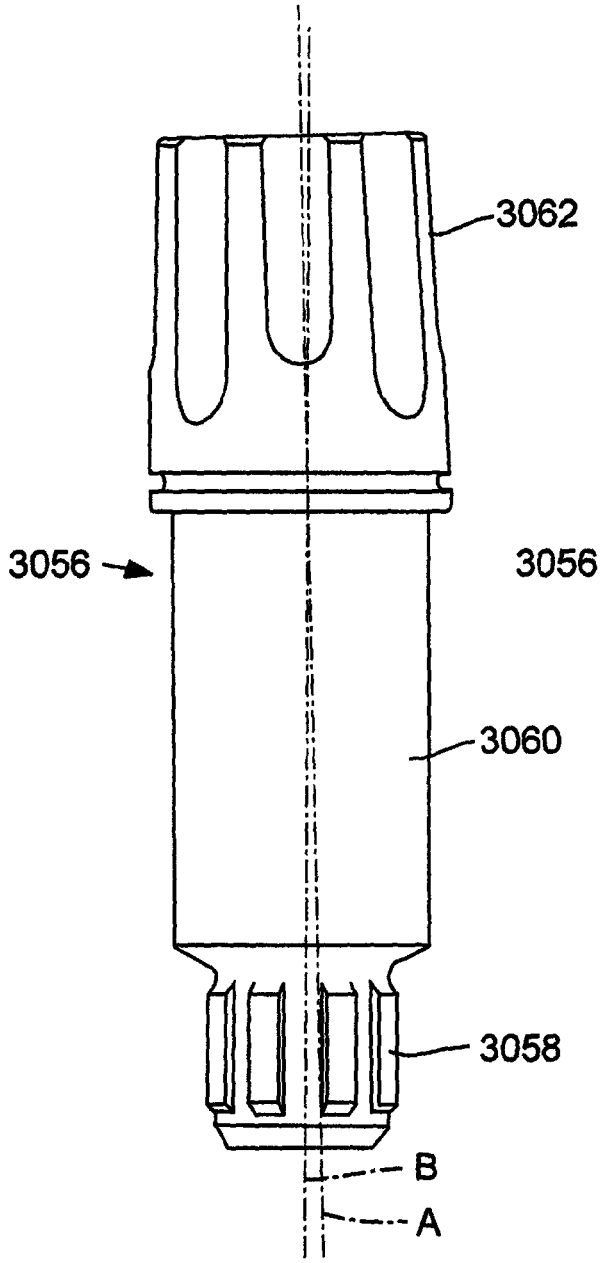
FIGS. 61 and 62 are front elevation and cross-sectional views, respectively, of the shaft sleeve of the assembly shown in FIG. 60.
Figure 62:
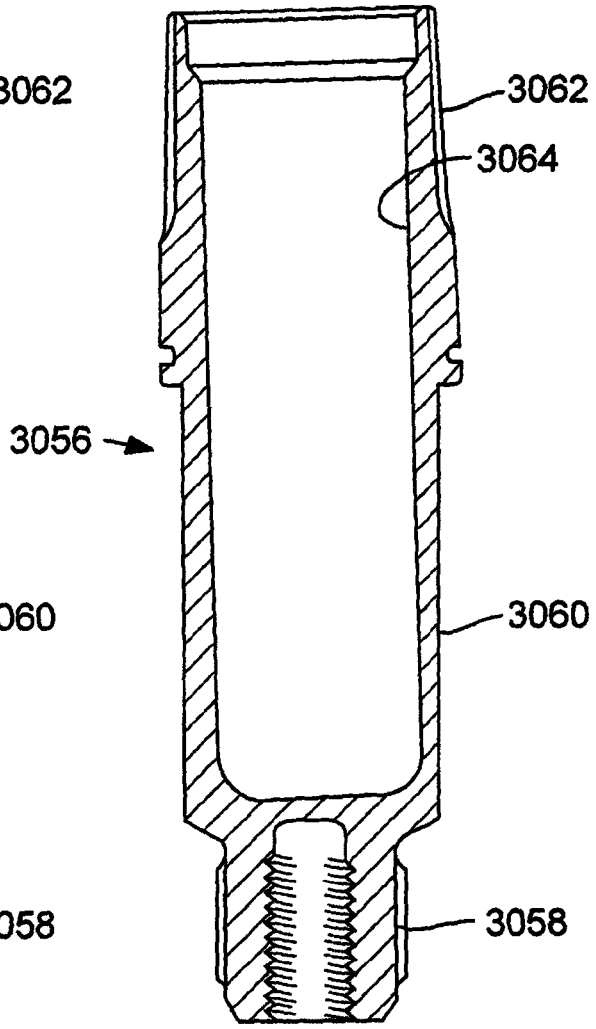

In this embodiment, because the intermediate portion 3060 is concentric with the hosel opening 3054, the outer surface of the intermediate portion 3060 can contact the adjacent surface of the hosel opening, as depicted in FIG. 60. This allows easier alignment of the mating features of the assembly during installation of the shaft and further improves the manufacturing process and efficiency. FIGS. 61 and 62 are enlarged views of the shaft sleeve 3056. As shown, the head portion 3062 of the shaft sleeve (which extends above the hosel 3052) can be angled relative to the intermediate portion 3060 by the angle 3066 so that the shaft and the head portion 3062 are both aligned along axis A. In alternative embodiments, the head portion 3062 can be aligned along axis B so that it is parallel to the intermediate portion 3060 and the lower portion 3058.

Non-Metallic Connection Assembly

The previously disclosed "head-shaft connection assembly" and "adjustable lie/loft connection assembly" may be non-metallic, or incorporate non-metallic components. In fact, this section applies to any of the shaft sleeves disclosed herein, however references in this section will be made to shaft sleeve 100 merely for simplicity. Now, with reference now to FIGS. 102-126, the shaft sleeve 100 may incorporate a primary portion 10000 formed of a non-metallic material and a secondary portion 11000 formed of a metallic material.

The primary portion 10000 has a primary portion proximal end 10010, a primary portion distal end 10020, a primary portion axis 10030, a primary portion shaft bore 10040 for receiving and mounting the shaft, a primary portion volume, and a primary portion overlap region 10050. The primary portion 10000 is formed of a primary portion non-metallic material having a primary portion density of less than 2 grams per cubic centimeter, a primary portion tensile strength of at least 150 megapascal, and a primary portion percent elongation to break. References to tensile strength in this "Non-metallic Connection Assembly" section refer to ultimate tensile strength.

Further, the secondary portion 11000 has a secondary portion proximal end 11010, a secondary portion distal end 11020, a secondary portion length 11025, a secondary portion axis 11030, a secondary portion bore 11040, and a secondary portion volume. The secondary portion 11000 is formed of a secondary portion metallic material having a secondary portion density that is greater than the primary portion density, a secondary portion tensile strength that is greater than the primary portion tensile strength, and a secondary portion percent elongation to break.

The connection assembly may include a screw, or other fastening device, to releasably join the shaft sleeve 100 and the club head. The screw may have a screw head and an externally threaded screw shaft extending from the screw head, wherein the secondary portion bore 11040 is releasably securable to the club head by inserting the screw through the lower opening and tightening the screw into the secondary portion bore 11040. Alternatively, as will be disclosed later with respect to a family of embodiments in which the shaft sleeve is constructed only of a primary portion 10000, the screw may be inserted through the lower opening and tightened directly into a bore in the primary portion. The screw is formed of a screw material having a screw material density, a screw material tensile strength, and a screw material percent elongation to break.

When the shaft sleeve 100 includes multiple materials, in this embodiment a non-metallic primary portion 10000 and a metallic secondary portion 11000, it has been discovered that strain relationships, and therefore relationships among the materials' properties of percent elongation to break, are much more significant than traditional design practices of simply designing the shaft sleeve 100 to be as strong as possible within weight constraints. In fact, applying such design practices to the design of non-metallic primary portion 10000 leads to a part formed of material having a high ultimate tensile strength, which is generally plagued by an elongation to break material property of 3.5% or less, and more commonly of 2.5% or less. Testing revealed that such a design has a high probability to fail during impact testing of the connection assembly, which often consists of 5000 off-center impacts of a golf ball striking the face, at multiple locations, at a velocity of 52 m/s.

However, multi-material shaft sleeve 100 designs focused on unique strain relationships, and more specifically the percent elongation to break, of the different materials, rather than simply ultimate tensile strength, have proven to meet stringent off-center impact durability testing. In one such embodiment the overwhelming majority of the shaft sleeve 100 is formed of non-metallic material, in fact the volume of the primary portion 10000 is at least five times the volume of the secondary portion 11000, and yet preferential durability characteristics are obtained because the percent elongation to break of the material forming the primary portion 10000, i.e. the primary portion percent elongation to break, is at least four percent, and it is (a) at least twenty-five percent of the secondary portion percent elongation to break, and (b) at least twenty-five percent of the screw material percent elongation to break.

Another embodiment exhibiting improved impact durability has a primary portion percent elongation to break that is at least fifty percent of the secondary portion percent elongation to break. In an even further embodiment the elongation relationships further incorporate the tensile loaded screw element, wherein the primary portion percent elongation to break is at least fifty percent of the screw material percent elongation to break. Still further, preferential durability characteristics have been found in an embodiment in which the primary portion percent elongation to break is less than the secondary portion percent elongation to break, while in an even further embodiment the secondary portion percent elongation to break is less than the screw material percent elongation to break.

While the secondary portion density is greater than the primary portion density, in one embodiment the secondary portion density is at least 2 grams per cubic centimeter, the secondary portion tensile strength is at least 250 megapascal, and the primary portion tensile strength is at least forty percent of secondary portion tensile strength. While in an even further embodiment the screw material tensile strength is at least fifty percent greater than secondary portion tensile strength, thereby providing a three material connection assembly possessing unique relationships among the three materials to achieve the desired durability.

Even further, in another embodiment durability is further enhanced when the primary portion percent elongation to break is at least six percent, the secondary portion percent elongation to break is at least nine percent, and the screw material percent elongation to break is at least nine percent; while another embodiment has a primary portion percent elongation to break that is 50-80% of the secondary portion percent elongation to break. Another way of expressing these unique relationships providing preferred durability is via the product of the primary portion percent elongation to break and the primary portion tensile strength in megapascal, referred to as the primary portion product. In one such embodiment the primary portion product is greater than 800, while in a further embodiment the product is greater than 1000, and greater than 1250 in a further embodiment, and greater than 1500 in yet another embodiment. One particularly durable embodiment is constructed of material having the primary product between 1250-2000, while in another embodiment the product is between 1250-1750. Likewise, a product of the secondary portion percent elongation to break and the secondary portion tensile strength in megapascal is referred to as the secondary portion product. In one such embodiment the secondary portion product is greater than 1000, while in a further embodiment the product is greater than 1500, and greater than 2000 in a further embodiment, and greater than 5000 in yet another embodiment. One particularly durable embodiment is constructed when the secondary portion product is greater than the primary portion product; while in another embodiment the secondary portion product is at least twice the primary portion product.

Unlike prior connection assemblies that may incorporate a small non-metallic aspect subject to little, or no, loading, the volume of the primary portion 10000 is at least five times the volume of the secondary portion 11000, and the non-metallic primary portion 10000 receives the shaft and substantial load carrying requirements. In fact, in one embodiment the non-metallic primary portion 10000 includes the upper annular thrust surface 130, seen best in FIGS. 2-3 and 108, and in an even further embodiment the non-metallic primary portion 10000 includes the external splines 500, seen best in FIGS. 5-6. In yet another embodiment the non-metallic primary portion 10000 also includes a lower annular surface 140, seen in FIGS. 5 and 108. Further, in some embodiments the primary portion volume is at least 3.0 cubic centimeters and is at least ten times the secondary portion volume, while in an even further embodiment the primary portion volume is at least fifteen times the secondary portion volume. Such shaft sleeve 100 embodiments composed overwhelmingly of the non-metallic primary portion material are only capable of the required load carrying capabilities necessary to pass dynamic off-center impact durability requirements when the percentage elongation to break relationships are carefully designed and controlled. In still further embodiments the mass of the secondary portion 11000 is less than 15% of the mass of the non-metallic primary portion 10000, and the combined mass of the primary portion 10000 and the secondary portion 11000 is less than 6.0 grams. In an even further embodiment the mass of the secondary portion 11000 is less than 12.5% of the mass of the non-metallic primary portion 10000, and the combined mass of the primary portion 10000 and the secondary portion 11000 is less than 5.7 grams; while in an even further embodiment the mass of the secondary portion 11000 is less than 11.5% of the mass of the non-metallic primary portion 10000, and the combined mass of the primary portion 10000 and the secondary portion 11000 is less than 5.0 grams.

In one embodiment the strain relationships are achieved by having the primary portion 10000 formed of a polyamide resin, while in a further embodiment the polyamide resin includes fiber reinforcement, and in yet another embodiment the polyamide resin includes at least 35% fiber reinforcement. In one such embodiment the fiber reinforcement includes long-glass fibers having a length of at least 10 millimeters pre-molding and produce a finished primary portion 10000 having fiber lengths of at least 3 millimeters, while another embodiment includes fiber reinforcement having short-glass fibers with a length of at least 0.5-2.0 millimeters pre-molding. Incorporation of the fiber reinforcement increases the tensile strength of the primary portion 10000, however it may also reduces the primary portion elongation to break therefore a careful balance must be struck to maintain sufficient elongation. Therefore, one embodiment includes 35-55% long fiber reinforcement, while in an even further embodiment has 40-50% long fiber reinforcement. One specific example is a long-glass fiber reinforced polyamide 66 compound with 40% carbon fiber reinforcement, such as the XuanWu XW5801 resin having a tensile strength of 245 megapascal and 7% elongation at break. Long fiber reinforced polyamides, and the resulting melt properties, produce a more isotropic material than that of short fiber reinforced polyamides, primarily due to the three-dimensional network formed by the long fibers developed during injection molding. Another advantage of long-fiber material is the almost linear behavior through to fracture resulting in less deformation at higher stresses. In one particular embodiment the primary portion 10000 is formed of a polycaprolactam, a polyhexamethylene adipinamide, or a copolymer of hexamethylene diamine adipic acid and caprolactam, however other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties.

In another embodiment the primary portion 10000 is injection molded and is formed of a material having a high melt flow rate, namely a melt flow rate (275°/2.16 Kg), per ASTM D1238, of at least 10 g/10 min. A further embodiment is formed of a primary portion non-metallic material having a primary portion density of less than 1.75 grams per cubic centimeter and a primary portion tensile strength of at least 200 megapascal; while another embodiment has a primary portion density of less than 1.50 grams per cubic centimeter and a primary portion tensile strength of at least 250 megapascal. A further embodiment is formed of a secondary portion metallic material having a secondary portion density of 1.8-3.0 grams per cubic centimeter and a secondary portion tensile strength that is greater than the primary portion tensile strength and at least 200 megapascal, while still maintaining a secondary portion percent elongation to break that is 75-200% of the primary portion percent elongation to break. While in yet a further embodiment the secondary portion metallic material has a secondary portion density of 1.8-3.0 grams per cubic centimeter and a secondary portion tensile strength that is greater than the primary portion tensile strength and at least 250 megapascal, while still maintaining a secondary portion percent elongation to break that is 100-185% of the primary portion percent elongation to break; and in an even further embodiment the secondary portion metallic material has a secondary portion density of 2.5-4.5 grams per cubic centimeter and a secondary portion tensile strength is at least 475 megapascal, while maintaining a secondary portion percent elongation to break that is 115-165% of the primary portion percent elongation to break Some examples of metals and metal alloys that can be used to form the secondary portion 11000 include, without limitation, magnesium alloys, aluminum/aluminum alloys (e.g., 3000 series alloys, 5000 series alloys, 6000 series alloys, such as 6061-T6, and 7000 series alloys, such as 7075), titanium alloys (e.g., 3-2.5, 6-4, SP700, 15-3-3-3, 10-2-3, or other alpha/near alpha, alpha-beta, and beta/near beta titanium alloys), carbon steels (e.g., 1020 or 8620 carbon steel), stainless steels (e.g., 304 or 410 stainless steel), PH (precipitation-hardenable) alloys (e.g., 17-4, C450, or C455 alloys), copper alloys, and nickel alloys.

The primary portion 10000 and the secondary portion 11000 may be attached to one another using any attachment method that provides the required durability. In one particularly effective attachment method embodiment, seen in FIGS. 102-126, a portion of the primary portion 10000 is molded around a portion of the secondary portion 11000 to define a primary portion overlap region 10050, seen in FIG. 107, having a primary portion overlap region length 10052, wherein within the primary portion overlap region 10050 the secondary portion 11000 has a secondary portion interface surface 11100. While the embodiment of FIG. 107 illustrates the primary portion overlap region length 10052 being equal to the secondary portion length 11025, this is not required and a portion of the secondary portion 11000 may extend beyond the primary portion 10000, meaning that the primary portion overlap region length 10052 may be less than the secondary portion length 11025. In one embodiment preferential loading and stress distribution is found when the primary portion overlap region length 10052 is at least five times the minimum primary portion bore wall thickness 10042, seen in FIG. 104, while in an even further embodiment the primary portion overlap region length 10052 is at least eight times the minimum primary portion bore wall thickness 10042.

Now referencing FIG. 109, the secondary portion interface surface 11100 may include a translation resistant surface 11200 oriented at a translation resistant surface projection angle 11230 from the secondary portion axis 11030, seen in FIG. 115, of at least thirty degrees, and having a translation resistant surface area of at least 7 square millimeters; while in a further embodiment the translation resistant surface projection angle 11230 is at least forty-five degrees and has a translation resistant surface area of at least 10 square millimeters; and in yet a further embodiment the translation resistant surface projection angle 11230 is at least sixty degrees and has a translation resistant surface area of at least 14 square millimeters. The translation resistant surface 11200 prevents the secondary portion 11000 from being pulled away from the primary portion 10000 as the screw is threaded into the secondary portion bore 11040. Further, secondary portion interface surface 11100 may include a rotation resistant surface 11300 oriented at a rotation resistant surface projection angle 11330 from an orthogonal extending from the secondary portion axis 11030, as seen in FIG. 116, of no more than sixty degrees, and having a translation resistant surface area of at least 7 square millimeters; while in a further embodiment the rotation resistant surface projection angle 11330 is no more than forty-five degrees and has a translation resistant surface area of at least 10 square millimeters; and in yet a further embodiment the rotation resistant surface projection angle 11330 is no more than thirty degrees and has a translation resistant surface area of at least 14 square millimeters. The rotation resistant surface 11300 prevents the secondary portion 11000 from rotating with respect to the primary portion 10000 when the club head impacts a golf ball and as the screw is threaded into the secondary portion bore 11040.

In one embodiment the translation resistant surface 11200 projects outward from the secondary portion interface surface 11100 a translation resistant surface projection distance 11210, seen in FIGS. 112 and 115, that is at least fifty percent of a minimum secondary portion bore wall thickness 11042 within the primary portion overlap region 10050. Alternatively, the translation resistant surface 11200 may projects inward, as seen in FIGS. 125 and 126, from the secondary portion interface surface 11100 a translation resistant surface projection distance 11210 that is at least fifty percent of a minimum secondary portion bore wall thickness 11042 within the primary portion overlap region 10050. The translation resistant surface area, the translation resistant surface projection distance 11210 and its relationship to the minimum secondary portion bore wall thickness 11042, and the translation resistant surface projection angle 11230 ensure that translational movement between the primary portion 10000 and the secondary portion 11000 is minimized, and localized deformation of the primary portion 10000 or the secondary portion 11000 does not occur despite the utilization of relatively high elongation materials, while incorporating surface configurations that are beneficial to molding processes. In one embodiment the minimum secondary portion bore wall thickness 11042 is less than 1.00 millimeter, while in a further embodiment the minimum secondary portion bore wall thickness 11042 is less than 0.75 millimeters.

Likewise, the rotation resistant surface 11300 may project outward or inward from the secondary portion interface surface 11100. In one embodiment the rotation resistant surface 11300 projects outward, as seen in FIGS. 109 and 112-116, from the secondary portion interface surface 11100 a rotation resistant surface projection distance 11310 that is at least fifty percent of a minimum secondary portion bore wall thickness 11042 within the primary portion overlap region 10050. Alternatively, as seen in FIG. 126, the rotation resistant surface 11300 may project inward from the secondary portion interface surface 11100 a rotation resistant surface projection distance 11310 that is at least fifty percent of a minimum secondary portion bore wall thickness 11042 within the primary portion overlap region 10050. The rotation resistant surface area, the rotation resistant surface projection distance 11310 and its relationship to the minimum secondary portion bore wall thickness 11042, and the rotation resistant surface projection angle 11330 ensure that rotational movement between the primary portion 10000 and the secondary portion 11000 is minimized, and localized deformation of the primary portion 10000 or the secondary portion 11000 does not occur despite the utilization of relatively high elongation materials, while incorporating surface configurations that are beneficial to molding processes.

Further, as seen in the embodiments of FIGS. 110, 111-113, and 117-124, the rotation resistant surface(s) 11300 may be formed in the translation resistant surface 11200. These embodiments include at least one translation resistant flange 11240 that forms the translation resistant surface 11200, which may include at least one recess in the translation resistant flange 11240 to form the rotation resistant surface(s) 11300. Such embodiments benefit from not reducing the minimum secondary portion bore wall thickness 11042, regardless of the location of the translation resistant flange 11240. While these embodiments are generally illustrated as having the translation resistant surface 11200 with the translation resistant surface projection angle 11230 of substantially 90 degrees, and the rotation resistant surface 11300 with the rotational resistant surface projection angle of substantially zero degrees, this is not required and one skilled in the art will appreciate that the same may be accomplished with the embodiment of FIG. 114.

The secondary portion 11000 may include multiple translation resistant flanges 11240. For example, the embodiment of FIGS. 117 and 104 includes three translation resistant flanges 11240 but only two translation resistant surfaces 11200 because the secondary portion distal end 11020 cannot bear against a portion of the primary portion 10000. As seen in FIG. 118, the two translation resistant surfaces 11200 of the proximal and medial translation resistant flanges 11240 are separated by a flange separation distance 11245. One such embodiment that ensures adequate contact between the primary portion 10000 and the secondary portion 11000 has a flange separation distance 11245 of at least 25% of the secondary portion length 11025, and a total translation resistant surface area of the two translation resistant flanges 11240 of at least 14 square millimeters, while in a further embodiment the flange separation distance

11245 is at least 75% of the secondary portion length 11025. In one embodiment the secondary portion length 11025 is less than 20 millimeters and less than 30% of the maximum length from the primary portion proximal end 10010 to the primary portion distal end 10020; while in an even further embodiment the secondary portion length 11025 is less than 15 millimeters and less than 27% of the maximum length from the primary portion proximal end 10010 to the primary portion distal end 10020.

In one embodiment the length from the primary portion proximal end 10010 to the primary portion distal end 10020 is at least 40 millimeters and includes a ferrule 52, seen in FIGS. 2 and 108, formed integrally with the primary portion 10000, as seen in FIG. 102; while in a further embodiment the maximum length from the primary portion proximal end 10010 to the primary portion distal end 10020 is at 45-55 millimeters, which includes the integrally formed ferrule 52. Incorporation of a ferrule 52 formed integrally with the primary portion 10000 presents challenges, particularly because of the loads experienced at the upper annular thrust surface 130, seen best in FIGS. 2-3 and 108, in addition to the extension of the ferrule 52 at least 10 millimeters beyond the hosel upper surface 395, seen best in FIG. 3, also referred to as the ferrule length 54 as seen in FIG. 107. In fact, durability testing with a 52 m/s ball speed showed that failure was common in the vicinity of the upper annular thrust surface 130, particularly when the impact location of the ball was low on the face, and increasingly so as the ferrule length 54 increased, and thus when the volume of the primary portion 10000 beyond the upper annular thrust surface 130, known as the ferrule volume, becomes a significant percentage of the entire volume of the primary portion 10000. In one such embodiment the ferrule length 54 is at least 10 millimeters and the ferrule volume is at least 15% of the total volume of the primary portion 10000; while in an even further embodiment the ferrule volume is at least 20% of the total volume of the primary portion 10000; while in an even further embodiment the ferrule volume is 25-35% of the total volume of the primary portion 10000. While the ferrule volume is a significant portion of the primary portion 10000 volume, the mass of the ferrule 52 is preferably less than 20% of the total combined mass of the primary portion 10000 and secondary portion 11000, in fact in one embodiment having the ferrule volume is 25-35% of the total volume of the primary portion 10000, the mass of the ferrule 52 is less than 20% of the total combined mass of the primary portion 10000 and secondary portion 11000. Increasing the length of this exposed ferrule 52 portion, or ferrule length 54, provides for adequate area for bonding with the shaft and the ability to control the primary portion bore distal wall thickness 10046, seen in FIG. 104 and discussed in detail later, however it further necessitates the unique strain based design of the connection assembly.

Another embodiment ensures preferred load distribution within the sleeve 100 by controlling the distance from the primary portion shaft bore 10040 to the secondary portion proximal end 11010. As seen in FIG. 107, the primary portion shaft bore 10040 has a primary portion bore distal wall 10044 and a primary portion bore wall thickness 10042, and the distance from the primary portion bore distal wall 10044 to the secondary portion proximal end 11010 defines a primary portion bore distal wall thickness 10046 that is (a) greater than the minimum primary portion bore wall thickness 10042 and (b) at least 15% of the secondary portion length 11025. This is particularly beneficial in the embodiments in which the primary portion axis 10030 is not parallel to the secondary portion axis 11030, as discussed above with respect to the "Adjustable Lie/Loft Connection Assembly," which are subject to unique loading conditions. In a further embodiment the primary portion bore distal wall thickness 10046 is at least 50% of a maximum cross-sectional dimension of the secondary portion 11000, which in the embodiment of FIG. 117 would be the exterior diameter of the translation resistant flange 11240 located at the secondary portion proximal end 11010, however one skilled in the art will appreciate that the secondary portion may have non-circular cross-sectional shapes. In an even further embodiment the primary portion bore distal wall thickness 10046 is at least 75% of a maximum cross-sectional dimension of the secondary portion 11000. Even further, in one embodiment the primary portion bore distal wall thickness 10046 is at least 3 millimeters; while in another embodiment it is at least 4 millimeters. Further, the location of the primary portion bore distal wall 10044 and the primary portion bore distal wall thickness 10046 play a role in selectively distributing the load in the primary portion 10000, and in one embodiment they are selected so that the translation resistant flange 11240 located at the secondary portion proximal end 11010 is located between the lower annular surface 140, seen in FIG. 108, and the primary portion proximal end 10010. In one embodiment the length of the primary portion shaft bore 10040 from the primary portion bore distal wall 10044 to the primary portion proximal end 10010 is at least 19 millimeters and the ferrule length 54 is at least 30% of the length of the primary portion shaft bore 10040 from the primary portion bore distal wall 10044 to the primary portion proximal end 10010; while in a further embodiment the length of the primary portion shaft bore 10040 from the primary portion bore distal wall 10044 to the primary portion proximal end 10010 is at least 25 millimeters and the ferrule length 54 is at least 40% of the length of the primary portion shaft bore 10040 from the primary portion bore distal wall 10044 to the primary portion proximal end 10010.

In addition to, or in lieu of, the translation resistant surface 11200 and/or the rotation resistant surface 11300, the secondary portion 11000 may include an interlocking recess 11400 is formed in the secondary portion interface surface 11100 and extending an interlocking recess depth 11410 inward toward the secondary portion axis 11030, as seen in FIGS. 111, 112, 113, 120, 121, and 125. In this embodiment the primary portion 10000 further includes a primary portion interlocking projection 10060, seen in FIGS. 107 and 108, that fills the interlocking recess 11400 thereby interlocking the primary portion 10000 and the secondary portion 11000 and preventing movement of the portions with respect to one another. The interlocking recess depth 11410 is greater than a minimum secondary portion bore wall thickness 11042 within the primary portion overlap region 10050, as seen in FIG. 112.

The interlocking recess 11400 has an interlocking recess length 11420 and an interlocking recess width 11430, as seen in FIGS. 111-112, which may be equal in the case of a round interlocking recess 11400, and in one embodiment produce a cross-sectional area of at least 1.5 square millimeters, which promotes adequate material flow when the primary portion 10000 is molded to the secondary portion 11000. In one embodiment preferential load distribution in the primary portion 10000 is produced when the interlocking recess depth 11410 is greater than both the interlocking recess length 11420 and the interlocking recess width 11430. Still further, in another embodiment the interlocking recess 11400 has a volume that is at least 6 cubic millimeters, while in an even further embodiment the interlocking recess 11400 has a volume that is at least 8 cubic millimeters, and in yet another embodiment the interlocking recess 11400 has a volume that is at least 4% of the volume of the secondary portion 11000, further promoting the interlock between the portions.

As seen in FIGS. 113 and 125, in one particular embodiment the interlocking recess 11400 extends through the secondary portion 11000 from a first recess opening 11440 on the secondary portion interface surface 11100 to a second recess opening 11450 on the secondary portion interface surface 11100, and the primary portion interlocking projection 10060 extends through the interlocking recess 11400. In such an embodiment the interlocking recess 11400 may extend straight through the center of the secondary portion 11000, as shown, or may take an angled route or even a curved route. In one embodiment the interlocking recess 11400 includes at least two recesses extending all the way through the secondary portion 11000, which pass, or intersect, each other at a right angle. Accordingly, in these through bore embodiments of the interlocking recess 11400 the primary portion interlocking projection 10060, seen in FIGS. 107 and 108, completely fills the interlocking recess 11400 and becomes an integral extension of the primary portion 10000 passing through the secondary portion 11000 from one side to the other thereby interlocking the primary portion 10000 and the secondary portion 11000 to distribute the load and prevent movement of the portions with respect to one another.

Up to this point the "Non-metallic Connection Assembly" discussion has focused on a primary portion 10000 formed of a non-metallic material and a secondary portion 11000 formed of a metallic material, however in another family of embodiments the entire shaft sleeve 100 is formed solely of a non-metallic primary portion 10000 without a metallic portion, although it may include multiple non-metallic pieces joined to form the non-metallic primary portion 10000 and thus may include a non-metallic secondary portion 11000. In one particular embodiment the primary portion 10000 is an integrally formed single piece non-metallic primary portion 10000. All of the disclosure applies equally to this family of embodiments, however a preferred embodiment further increases the primary portion tensile strength to at least 200 megapascal and increases the minimum primary portion percent elongation to break to at least five percent, while maintaining the minimum primary portion percent elongation to break of at least twenty-five percent of the screw material percent elongation to break, and having a primary portion density of less than 1.75 grams per cubic centimeter, while also incorporating an integral ferrule 52, and, in some embodiments, integral rotational prevention elements, which may include the disclosed splines 500. In an even further embodiment the primary portion tensile strength is at least 220 megapascal, the minimum primary portion percent elongation to break is at least six percent, and the primary portion density is less than 1.65 grams per cubic centimeter; and yet another embodiment has the primary portion tensile strength of at least 240 megapascal, the minimum primary portion percent elongation to break of at least seven percent, and the primary portion density is less than 1.50 grams per cubic centimeter.

In this non-metallic primary portion 10000 family of embodiments of the shaft sleeve 100, the necessary strain and elongation requirements for durability must be balanced with the need for strength and durability in the connection with the screw and the connection with the shaft. As previously discussed, traditional design practices of simply designing the shaft sleeve 100 to be as strong as possible does not provide the needed durability in an entirely non-metallic embodiment of the shaft sleeve 100. In fact, applying such design practices to the design of non-metallic primary portion 10000 leads to a part formed of material having a high ultimate tensile strength, but one that is generally plagued by an elongation to break material property of 3.5% or less, and more commonly of 2.5% or less. However, a non-metallic shaft sleeve 100 design focused on strain, rather than stress, and more specifically the percent elongation to break, rather than simply ultimate tensile strength, offers improved durability, particularly when the primary portion 10000 incorporates an integral ferrule 52 and has a volume of at least 3 cubic centimeters. Another way of expressing these unique relationships providing preferred durability is via the product of the primary portion percent elongation to break and the primary portion tensile strength in megapascal, referred to as the primary portion product. In one such embodiment the primary portion product is greater than 800, while in a further embodiment the product is greater than 1000, and greater than 1250 in a further embodiment, and greater than 1500 in yet another embodiment. One particularly durable embodiment has a primary portion product between 1250-2000, while in another embodiment the product is between 1250-1750.

Such non-metallic shaft sleeve 100 embodiments focused on unique strain relationships, and more specifically the percent elongation to break, rather than simply ultimate tensile strength, have proven to meet stringent off-center impact durability testing. Preferential durability characteristics have been found in an embodiment in which the primary portion percent elongation to break is less than the screw material percent elongation to break. While in an even further embodiment the screw material tensile strength is at least fifty percent greater than primary portion tensile strength, thereby providing an assembly possessing unique relationships among the materials to achieve the desired durability. Even further, in another embodiment durability is further enhanced when the primary portion percent elongation to break is at least six percent, and the screw material percent elongation to break is at least nine percent Unlike prior connection assemblies that may incorporate a small non-metallic aspect subject to little, or no, loading, the volume of the primary portion 10000 is at least is at least 3.0 cubic centimeters, and the non-metallic primary portion 10000 receives the shaft and substantial load carrying requirements. In fact, in one embodiment the non-metallic primary portion 10000 includes the upper annular thrust surface 130, seen in FIG. 108, and in an even further embodiment the non-metallic primary portion 10000 includes the external splines 500, seen best in FIGS. 5-6. In yet another embodiment the non-metallic primary portion 10000 also includes a lower annular surface 140, also seen in FIG. 108. Such shaft sleeve 100 embodiments are only capable of the required load carrying capabilities necessary to pass dynamic off-center impact durability requirements when the percentage elongation to break relationships are carefully designed and controlled. In still further embodiments the mass of the primary portion 10000 is less than 5.5 grams. In an even further embodiment the mass of the primary portion 10000 is less than 5.0 grams; while in an even further embodiment the mass of the primary portion 10000 is less than 4.5 grams.

In one embodiment the strain relationships are achieve by having the primary portion 10000 formed of a polyamide resin, while in a further embodiment the polyamide resin includes fiber reinforcement, and in yet another embodiment the polyamide resin includes at least 35% fiber reinforcement. In one such embodiment the fiber reinforcement includes long-glass fibers having a length of at least 10 millimeters pre-molding and produce a finished primary portion 10000 having fiber lengths of at least 3 millimeters, while another embodiment includes fiber reinforcement having short-glass fibers with a length of at least 0.5-2.0 millimeters pre-molding. Incorporation of the fiber reinforcement increases the tensile strength of the primary portion 10000, however it may also reduces the primary portion elongation to break therefore a careful balance must be struck to maintain sufficient elongation. Therefore, one embodiment includes 35-55% long fiber reinforcement, while in an even further embodiment has 40-50% long fiber reinforcement. One specific example is a long-glass fiber reinforced polyamide 66 compound with 40% carbon fiber reinforcement, such as the XuanWu XW5801 resin having a tensile strength of 245 megapascal and 7% elongation at break. Long fiber reinforced polyamides, and the resulting melt properties, produce a more isotropic material than that of short fiber reinforced polyamides, primarily due to the three-dimensional network formed by the long fibers developed during injection molding. Another advantage of long-fiber material is the almost linear behavior through to fracture resulting in less deformation at higher stresses. In one particular embodiment the primary portion 10000 is formed of a polycaprolactam, a polyhexamethylene adipinamide, or a copolymer of hexamethylene diamine adipic acid and caprolactam, however other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties.

In another embodiment the primary portion 10000 is injection molded and is formed of a material having a high melt flow rate, namely a melt flow rate (275°/2.16 Kg), per ASTM D1238, of at least 10 g/10 min. A further embodiment is formed of a primary portion non-metallic material having a primary portion density of less than 1.75 grams per cubic centimeter and a primary portion tensile strength of at least 200 megapascal; while another embodiment has a primary portion density of less than 1.50 grams per cubic centimeter and a primary portion tensile strength of at least 250 megapascal.

In one embodiment the length from the primary portion proximal end 10010 to the primary portion distal end 10020 is at least 40 millimeters and includes a ferrule 52, seen in FIG. 108, formed integrally with the primary portion 10000; while in a further embodiment the maximum length from the primary portion proximal end 10010 to the primary portion distal end 10020 is at 45-55 millimeters, which includes the integrally formed ferrule 52. Incorporation of a ferrule 52 formed integrally with the primary portion 10000 presents challenges, particularly because of the loads experienced at the upper annular thrust surface 130, seen in FIG. 108, in addition to the extension of the ferrule 52 at least 10 millimeters beyond the upper annular thrust surface 130, also referred to as the ferrule length 54 as seen in FIG. 107. In fact, durability testing with a 52 m/s ball speed showed that failure was common in the vicinity of the upper annular thrust surface 130, particularly when the impact location of the ball was low on the face, and increasingly so as the ferrule length 54 increased, and thus when the ferrule volume becomes a significant percentage of the entire volume of the primary portion 10000. In one such embodiment the ferrule length 54 is at least 10 millimeters and the ferrule volume is at least 15% of the total volume of the primary portion 10000; while in an even further embodiment the ferrule volume is at least 20% of the total volume of the primary portion 10000; while in an even further embodiment the ferrule volume is 25-35% of the total volume of the primary portion 10000. In one embodiment the total volume of the primary portion 10000 is at least 3.0 cubic centimeters, while in a further embodiment the total volume of the primary portion 10000 is at least 3.5 cubic centimeters. Further, in one embodiment the ferrule volume is at least 0.5 cubic centimeters, while in a further embodiment it is at least 0.8 cubic centimeters, and in an even further embodiment it is at least 1.0 cubic centimeter. One particularly durable embodiment has the ferrule volume in the range of 1.0-1.5 cubic centimeters, with a ferrule length 54 that is at least 15 millimeters, and a total volume of the primary portion 10000 that is at least 3.5 cubic centimeters. Increasing the ferrule length 54 provides for adequate area for bonding with the shaft and the ability to control the primary portion bore distal wall thickness 10046, seen in FIG. 104, however it further necessitates the unique strain based design of the connection assembly.

Another embodiment ensures preferred load distribution within the sleeve 100 by controlling the distance from the primary portion shaft bore 10040 to a screw bore formed in the single piece sleeve 100. As seen in FIG. 107, the primary portion shaft bore 10040 has a primary portion bore distal wall 10044 and a primary portion bore wall thickness 10042, and, although not independently illustrated but understood by one skilled in the art, the distance from the primary portion bore distal wall 10044 to the nearest portion of the screw bore defines a primary portion bore distal wall thickness 10046 that is (a) greater than the minimum primary portion bore wall thickness 10042 and (b) at least 20% of the ferrule length 54. This is particularly beneficial in the embodiments in which the primary portion axis 10030 is not parallel to the secondary portion axis 11030, as discussed above with respect to the "Adjustable Lie/Loft Connection Assembly," which are subject to unique loading conditions. In a further embodiment the primary portion bore distal wall thickness 10046 is at least 50% of a maximum cross-sectional dimension of the screw bore. In an even further embodiment the primary portion bore distal wall thickness 10046 is at least 75% of a maximum cross-sectional dimension of the screw bore. Even further, in one embodiment the primary portion bore distal wall thickness 10046 is at least 3 millimeters; while in another embodiment it is at least 4 millimeters. The location of the primary portion bore distal wall 10044 and the primary portion bore distal wall thickness 10046 play a role in selectively distributing the load in the primary portion 10000. In one embodiment the length of the primary portion shaft bore 10040 from the primary portion bore distal wall 10044 to the primary portion proximal end 10010 is at least 19 millimeters and the ferrule length 54 is at least 10 millimeters, while in a further embodiment the length of the primary portion shaft bore 10040 from the primary portion bore distal wall 10044 to the primary portion proximal end 10010 is at least 25 millimeters and the ferrule length 54 is at least 15 millimeters.

Additionally, the hosel insert 200, seen in FIGS. 11-14, may likewise be formed of non-metallic materials having the unique relationships disclosed above with respect to the single piece non-metallic primary portion 10000 family of embodiments.

An additional benefit of the disclosed designs is reduced cost. Traditionally connection assemblies have been composed largely of machined aluminum. The cost of the asymmetric machining necessary to achieve a primary portion axis 10030 that is not parallel to the secondary portion axis 11030, and therefore affords the adjustability discussed in the "Adjustable Lie/Loft Connection Assembly" section, is significant. Injection molding of the shaft sleeve 100, or at least the majority of it, and its tilted primary portion shaft bore 10040 is estimated to reduce the cost of the connection assembly significantly, even if a secondary portion 11000 of metallic material must be symmetrically machined.

Adjustable Sole

As discussed above, the grounded loft 80 of a club head is the vertical angle of the centerface normal vector when the club is in the address position (i.e., when the sole is resting on the ground), or stated differently, the angle between the club face and a vertical plane when the club is in the address position. When the shaft loft of a club is adjusted, such as by employing the system disclosed in FIGS. 18-42 or the system shown in FIGS. 43-51 or by traditional bending of the shaft, the grounded loft does not change because the orientation of the club face relative to the sole of the club head does not change. On the other hand, adjusting the shaft loft is effective to adjust the square loft of the club by the same amount. Similarly, when shaft loft is adjusted and the club head is placed in the address position, the face angle of the club head increases or decreases in proportion to the change in shaft loft. For example, for a club having a 60-degree lie angle, decreasing the shaft loft by approximately 0.6 degree increases the face angle by +1.0 degree, resulting in the club face being more "open" or turned out. Conversely, increasing the shaft loft by approximately 0.6 degree decreases the face angle by −1.0 degree, resulting in the club face being more "closed" or turned in.

Figure 52:
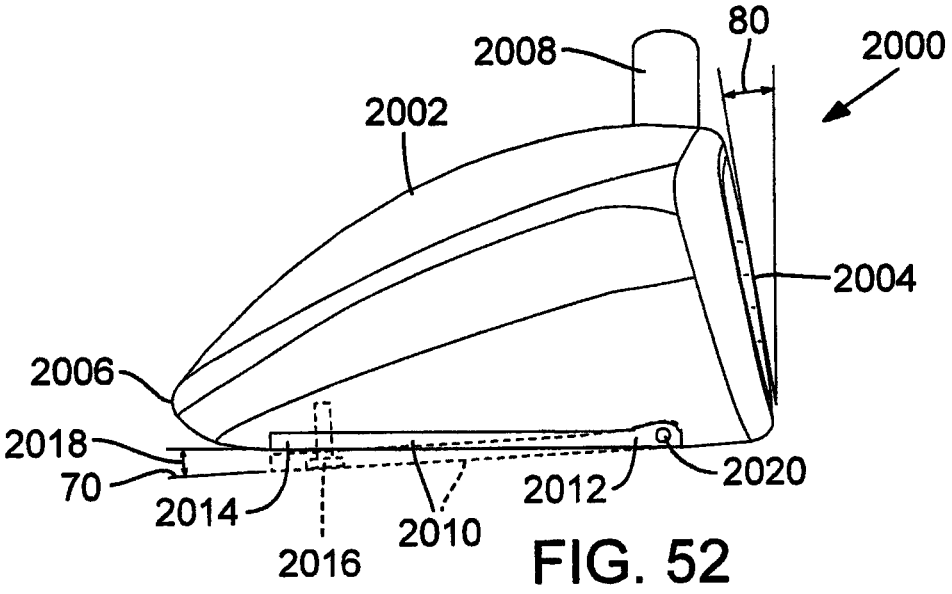
FIG. 52 is a side elevational view of a golf club head having an adjustable sole plate, in accordance with one embodiment.
Figure 53:
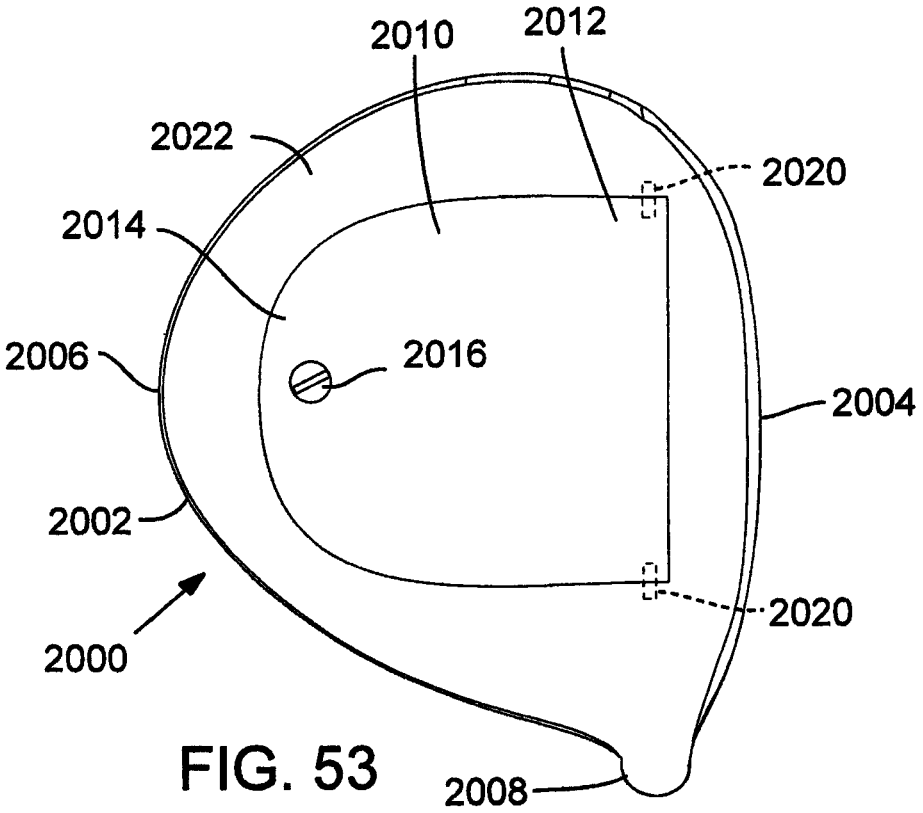
FIG. 53 is a bottom plan view of the golf club head of FIG. 48.
Figure 54:
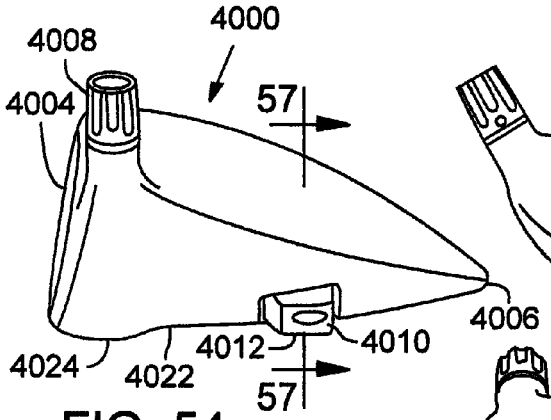
FIG. 54 is a side elevation view of a golf club head having an adjustable sole portion, according to another embodiment.
Figure 55:
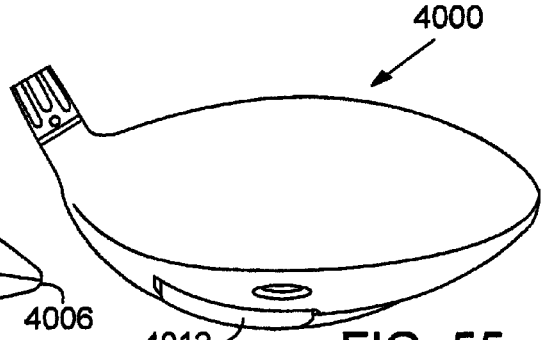
FIG. 55 is a rear elevation view of the golf club head of FIG. 54.

Conventional clubs do not allow for adjustment of the hosel/shaft loft without causing a corresponding change in the face angle. FIGS. 52-53 illustrates a club head 2000, according to one embodiment, configured to "decouple" the relationship between face angle and hosel/shaft loft (and therefore square loft), that is, allow for separate adjustment of square loft and face angle. The club head 2000 in the illustrated embodiment comprises a club head body 2002 having a rear end 2006, a striking face 2004 defining a forward end of the body, and a bottom portion 2022. The body also has a hosel 2008 for supporting a shaft (not shown).

The bottom portion 2022 comprises an adjustable sole 2010 (also referred to as an adjustable "sole portion") that can be adjusted relative to the club head body 2002 to raise and lower at least the rear end of the club head relative to the ground. As shown, the sole 2010 has a forward end portion 2012 and a rear end portion 2014. The sole 2010 can be a flat or curved plate that can be curved to conform to the overall curvature of the bottom 2022 of the club head. The forward end portion 2012 is pivotably connected to the body 2002 at a pivot axis defined by pivot pins 2020 to permit pivoting of the sole relative to the pivot axis. The rear end portion 2014 of the sole therefore can be adjusted upwardly or downwardly relative to the club head body so as to adjust the "sole angle" 2018 of the club (FIG. 52), which is defined as the angle between the bottom of the adjustable sole 2010 and the non-adjustable bottom surface 2022 of the club head body. As can be seen, varying the sole angle 2018 causes a corresponding change in the grounded loft 80. By pivotably connecting the forward end portion of the adjustable sole, the lower leading edge of the club head at the junction of the striking face and the lower surface can be positioned just off the ground at contact between the club head and a ball. This is desirable to help avoid so-called "thin" shots (when the club head strikes the ball too high, resulting in a low shot) and to allow a golfer to hit a ball "off the deck" without a tee if necessary.

The club head can have an adjustment mechanism that is configured to permit manual adjustment of the sole 2010. In the illustrated embodiment, for example, an adjustment screw 2016 extends through the rear end portion 2014 and into a threaded opening in the body (not shown). The axial position of the screw relative to the sole 2010 is fixed so that adjustment of the screw causes corresponding pivoting of the sole 2010. For example, turning the screw in a first direction lowers the sole 2010 from the position shown in solid lines to the position shown in dashed lines in FIG. 52. Turning the screw in the opposite direction raises the sole relative to the club head body. Various other techniques and mechanisms can be used to affect raising and lowering of the sole 2010.

Moreover, other techniques or mechanisms can be implemented in the club head 2000 to permit raising and lowering of the sole angle of the club. For example, the club head can comprise one or more lifts that are located near the rear end of the club head, such as shown in the embodiment of FIGS. 54-58, discussed below. The lifts can be configured to be manually extended downwardly through openings in the bottom portion 2022 of the club head to increase the sole angle and retracted upwardly into the club head to decrease the sole angle. In a specific implementation, a club head can have a telescoping protrusion near the aft end of the head which can be telescopingly extended and retracted relative to the club head to vary the sole angle.

In particular embodiments, the hosel 2008 of the club head can be configured to support a removable shaft at different predetermined orientations to permit adjustment of the shaft loft and/or lie angle of the club. For example, the club head 2000 can be configured to receive the assembly described above and shown in FIG. 19 (shaft sleeve 900, adapter sleeve 1000, and insert 1100) to permit a user to vary the shaft loft and/or lie angle of the club by selecting an adapter sleeve 1000 that supports the club shaft at the desired orientation. Alternatively, the club head can be adapted to receive the assembly shown in FIGS. 43-47 to permit adjustment of the shaft loft and/or lie angle of the club. In other embodiments, a club shaft can be connected to the hosel 2008 in a conventional manner, such as by adhesively bonding the shaft to the hosel, and the shaft loft can be adjusted by bending the shaft and hosel relative to the club head in a conventional manner. The club head 2000 also can be configured for use with the removable shaft assembly described above and disclosed in FIGS. 1-16.

Varying the sole angle of the club head changes the address position of the club head, and therefore the face angle of the club head. By adjusting the position of the sole and by adjusting the shaft loft (either by conventional bending or using a removable shaft system as described herein), it is possible to achieve various combinations of square loft and face angle with one club. Moreover, it is possible to adjust the shaft loft (to adjust square loft) while maintaining the face angle of club by adjusting the sole a predetermined amount.

As an example, Table 5 below shows various combinations of square loft, grounded loft, face angle, sole angle, and hosel loft that can be achieved with a club head that has a nominal or initial square loft of 10.4 degrees and a nominal or initial face angle of 6.0 degrees and a nominal or initial grounded loft of 14 degrees at a 60-degree lie angle. The nominal condition in Table 5 has no change in sole angle or hosel loft angle (i.e., Δ sole angle=0.0 and A hosel loft angle=0.0). The parameters in the other rows of Table 5 are deviations to this nominal state (i.e., either the sole angle and/or the hosel loft angle has been changed relative to the nominal state). In this example, the hosel loft angle is increased by 2 degrees, decreased by 2 degrees or is unchanged, and the sole angle is varied in 2-degree increments. As can be seen in the table, these changes in hosel loft angle and sole angle allows the square loft to vary from 8.4, 10.4, and 12.4 with face angles of −4.0, −0.67, 2.67, −7.33, 6.00, and 9.33. In other examples, smaller increments and/or larger ranges for varying the sole angle and the hosel loft angle can be used to achieve different values for square loft and face angle.

Also, it is possible to decrease the hosel loft angle and maintain the nominal face angle of 6.0 degrees by increasing the sole angle as necessary to achieve a 6.0-degree face angle at the adjusted hosel loft angle. For example, decreasing the hosel loft angle by 2 degrees of the club head represented in Table 5 will increase the face angle to 9.33 degrees. Increasing the sole angle to about 2.0 degrees will readjust the face angle to 6.0 degrees.

TABLE 5

| Square loft (deg) | Grounded loft (deg) | Face angle (deg) | Δ Sole angle (deg) | ΔHosel loft angle (deg) "+" = weaker "−" = stronger |
|---|---|---|---|---|
| 12.4 | 10.0 | −4.00 | 4.0 | 2.0 |
| 10.4 | 8.0 | −4.00 | 6.0 | 0.0 |
| 8.4 | 6.0 | −4.00 | 8.0 | −2.0 |
| 12.4 | 12.0 | −0.67 | 2.0 | 2.0 |
| 10.4 | 10.0 | −0.67 | 4.0 | 0.0 |
| 8.4 | 8.0 | −0.67 | 6.0 | −2.0 |
| 12.4 | 14.0 | 2.67 | 0.0 | 2.0 |
| 10.4 | 12.0 | 2.67 | 2.0 | 0.0 |
| 8.4 | 10.0 | 2.67 | 4.0 | −2.0 |
| 12.4 | 8.0 | −7.33 | 6.0 | 2.0 |
| 10.4 | 14.0 | 6.00 | 0.0 | 0.0 |
| 8.4 | 14.0 | 9.33 | 0.0 | −2.0 |
| 8.4 | 6.0 | −4.00 | 8.0 | −2.0 |

FIGS. 54-58 illustrates a golf club head 4000, according to another embodiment, that has an adjustable sole. The club head 4000 comprises a club head body 4002 having a rear end 4006, a striking face 4004 defining a forward end of the body, and a bottom portion 4022. The body also has a hosel 4008 for supporting a shaft (not shown). The bottom portion 4022 defines a leading edge surface portion 4024 adjacent the lower edge of the striking face that extends transversely across the bottom portion 4022 (i.e., the leading edge surface portion 4024 extends in a direction from the heel to the toe of the club head body).

Figure 56:
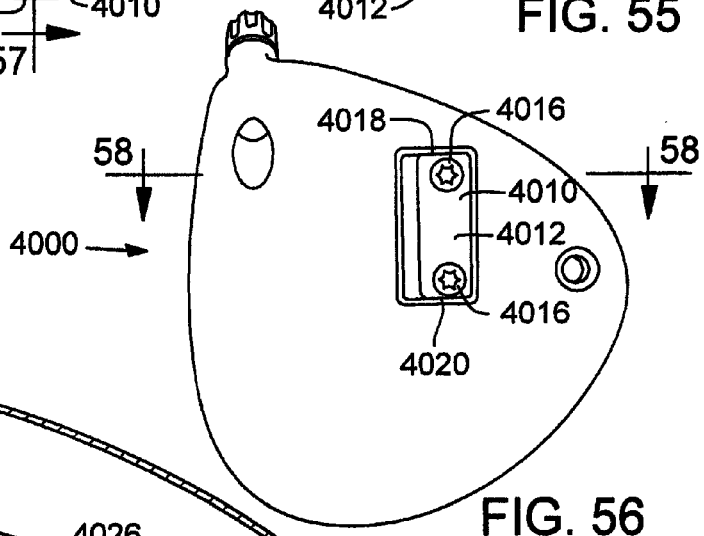
FIG. 56 is a bottom plan view of the golf club head of FIG. 54.

The bottom portion 4022 further includes an adjustable sole portion 4010 that can be adjusted relative to the club head body 4002 to raise and lower the rear end of the club head relative to the ground. As best shown in FIG. 56, the adjustable sole portion 4010 is elongated in the heel-to-toe direction of the club head and has a lower surface 4012 that desirably is curved to match the curvature of the leading edge surface portion 4024. In the illustrated embodiment, both the leading edge surface 4024 and the bottom surface 4012 of the sole portion 4010 are concave surfaces. In other embodiments, surfaces 4012 and 4024 are not necessarily curved surfaces but they desirably still have the same profile extending in the heel-to-toe direction. In this manner, if the club head deviates from the grounded address position (e.g., the club is held at a lower or flatter lie angle), the effective face angle of the club head does not change substantially, as further described below. The crown to face transition or top-line would stay relatively stable when viewed from the address position as the club is adjusted between the lie ranges described herein. Therefore, the golfer is better able to align the club with the desired direction of the target line. In some embodiments, the top-line transition is clearly delineated by a masking line between the painted crown and the unpainted face.

The sole portion 4010 has a first edge 4018 located toward the heel of the club head and a second edge 4020 located at about the middle of the width of the club head. In this manner, the sole portion 4010 (from edge 4018 to edge 4020) has a length that extends transversely across the club head less than half the width of the club head. As noted above, studies have shown that most golfers address the ball with a lie angle between 10 and 20 degrees less than the intended scoreline lie angle of the club head (the lie angle when the club head is in the address position). The length of the sole portion 4010 in the illustrated embodiment is selected to support the club head on the ground at the grounded address position or any lie angle between 0 and 20 degrees less than the lie angle at the grounded address position. In alternative embodiments, the sole portion 4010 can have a length that is longer or shorter than that of the illustrated embodiment to support the club head at a greater or smaller range of lie angles. For example, the sole portion 4010 can extend past the middle of the club head to support the club head at lie angles that are greater than the scoreline lie angle (the lie angle at the grounded address position).

Figure 58:
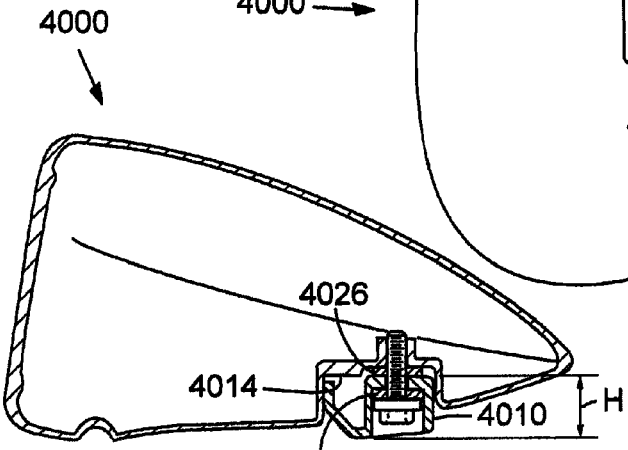
FIG. 58 is a cross-sectional view of the golf club head taken along line 58-58 of FIG. 56.
Figure 57:
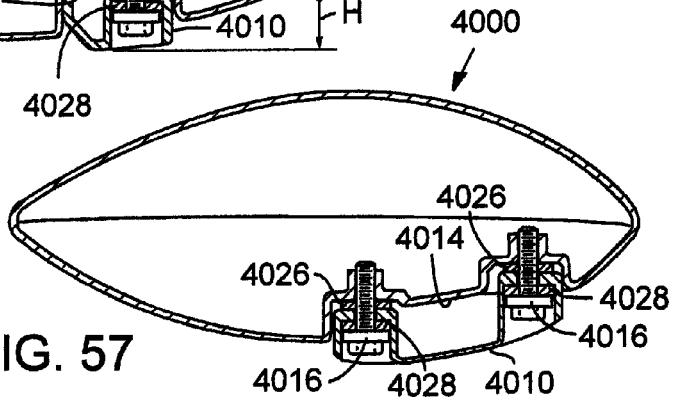
FIG. 57 is a cross-sectional view of the golf club head taken along line 57-57 of FIG. 54.

As best shown in FIGS. 57 and 58, the bottom portion of the club head body can be formed with a recess 4014 that is shaped to receive the adjustable sole portion 4010. One or more screws 4016 (two are shown in the illustrated embodiment) can extend through respective washers 4028, corresponding openings in the adjustable sole portion 4010, one or more shims 4026 and into threaded openings in the bottom portion 4022 of the club head body. The sole angle of the club head can be adjusted by increasing or decreasing the number of shims 4026, which changes the distance the sole portion 4010 extends from the bottom of the club head. The sole portion 4010 can also be removed and replaced with a shorter or taller sole portion 4010 to change the sole angle of the club. In one implementation, the club head is provided with a plurality of sole portions 4010, each having a different height H (FIG. 58) (e.g., the club head can be provided with a small, medium and large sole portion 4010). Removing the existing sole portion 4010 and replacing it with one having a greater height H increases the sole angle while replacing the existing sole portion 4010 with one having a smaller height H will decrease the sole angle.

In an alternative embodiment, the axial position of each of the screws 4016 relative to the sole portion 4010 is fixed so that adjustment of the screws causes the sole portion 4010 to move away from or closer to the club head. Adjusting the sole portion 4010 downwardly increases the sole angle of the club head while adjusting the sole portion upwardly decreases the sole angle of the club head.

When a golfer changes the actual lie angle of the club by tilting the club toward or away from the body so that the club head deviates from the grounded address position, there is a slight corresponding change in face angle due to the loft of the club head. The effective face angle, eFA, of the club head is a measure of the face angle with the loft component removed (i.e. the angle between the horizontal component of the face normal vector and the target line vector), and can be determined by the following equation:

$$eF11 = -\arctan\left[\frac{(\sin\Delta lie \cdot \sin GL \cdot \cos MFA) - (\cos\Delta lie \cdot \sin MFA)}{d\cos GL \cdot \cos MFA}\right] \quad \text{Eq. 3}$$

where Δlie is the measured lie angle-scoreline lie angle, GL is the grounded loft angle of the club head, and MFA is the measured face angle.

As noted above, the adjustable sole portion 4010 has a lower surface 4012 that matches the curvature of the leading edge surface portion 4024 of the club head. Consequently, the effective face angle remains substantially constant as the golfer holds the club with the club head on the playing surface and the club is tilted toward and away from the golfer so as to adjust the actual lie angle of the club. In particular embodiments, the effective face angle of the club head 4000 is held constant within a tolerance of +/−0.2 degrees as the lie angle is adjusted through a range of 0 degrees to about 20 degrees less than the scoreline lie angle. In a specific implementation, for example, the scoreline lie angle of the club head is 60 degrees and the effective face angle is held constant within a tolerance of +/−0.2 degrees for lie angles between 60 degrees and 40 degrees. In another example, the scoreline lie angle of the club head is 60 degrees and the effective face angle is held constant within a tolerance of +/−0.1 degrees for lie angles between 60 degrees and 40 degrees. In several embodiments, the effective face angle is held constant within a tolerance of about +/−0.1 degrees to about +/−0.5 degrees. In certain embodiments, the effective face angle is held constant within a tolerance of about less than +/−1 degree or about less than +/−0.7 degrees.

Figure 59:
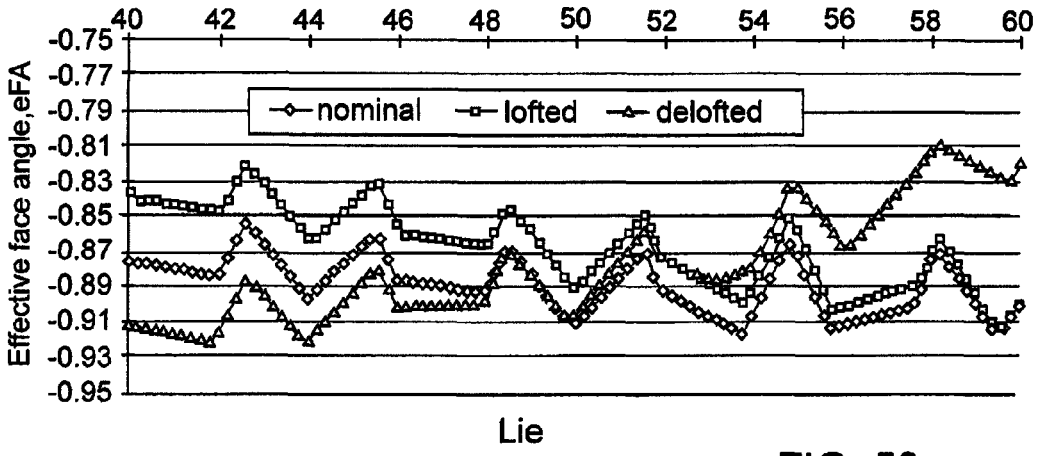
FIG. 59 is a graph showing the effective face angle through a range of lie angles for a shaft positioned at a nominal position, a lofted position and a delofted position.

FIG. 59 illustrates the effective face angle of a club head through a range of lie angles for a nominal state (the shaft loft is unchanged), a lofted state (the shaft loft is increased by 1.5 degrees), and a delofted state (the shaft loft is decreased by 1.5 degrees). In the lofted state, the sole portion 4010 was removed and replaced with a sole portion 4010 having a smaller height H to decrease the sole angle of the club head. In the delofted state, the sole portion was removed and replaced with a sole portion 4010 having a greater height H to increase the sole angle of the club head. As shown in FIG. 59, the effective face angle of the club head in the nominal, lofted and delofted state remained substantially constant through a lie angle range of about 40 degrees to about 60 degrees.

Materials

The components of the head-shaft connection assemblies disclosed in the present specification can be formed from any of various suitable metals, metal alloys, polymers, composites, or various combinations thereof.

In addition to those noted above, some examples of metals and metal alloys that can be used to form the components of the connection assemblies include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon™).

EXAMPLES

Table 6 illustrates twenty-four possible driver head configurations between a sleeve position and movable weight positions for a driver having movable weights installed in weight ports. Each configuration shown in Table 6 has a different configuration for providing a desired shot bias. An associated loft angle, face angle, and lie angle is shown corresponding to each sleeve position shown.

The tabulated values in Table 6 are assuming a nominal club loft of 10.5°, a nominal lie angle of 60°, and a nominal face angle of 2.0° in a neutral position. In the exemplary embodiment of Table 6, the offset angle is nominally 1.0°. The eight discrete sleeve positions "L", "N", NU", "R", "N-R", "N-L", NU-R", and NU-L" represent the different spline positions a golfer can position a sleeve with respect to the club head. Of course, it is understood that four, twelve, or sixteen sleeve positions are possible. In each embodiment, the sleeve positions are symmetric about four orthogonal positions. The preferred method to locate and lock these positions is with spline teeth engaged in a mating slotted piece in the hosel as described in the embodiments described herein.

The "L" or left position allows the golfer to hit a draw or draw biased shot. The "NU" or neutral upright position enables a user to hit a slight draw (less draw than the "L" position). The "N" or neutral position is a sleeve position having little or no draw or fade bias. In contrast, the "R" or right position increases the probability that a user will hit a shot with a fade bias.

TABLE 6

| Config. No. | Sleeve Position | Toe Weight | Rear Weight | Heel Weight | Loft Angle | Face Angle | Lie Angle |
|---|---|---|---|---|---|---|---|
| 1 | L | 16 g | 1 g | 1 g | 11.5° | 0.3° | 60° |
| 2 | L | 1 g | 16 g | 1 g | 11.5° | 0.3° | 60° |
| 3 | L | 1 g | 1 g | 16 g | 11.5° | 0.3° | 60° |
| 4 | N | 16 g | 1 g | 1 g | 10.5° | 2.0° | 59° |
| 5 | N | 1 g | 16 g | 1 g | 10.5° | 2.0° | 59° |
| 6 | N | 1 g | 1 g | 16 g | 10.5° | 2.0° | 59° |
| 7 | NU | 16 g | 1 g | 1 g | 10.5° | 2.0° | 61° |
| 8 | NU | 1 g | 16 g | 1 g | 10.5° | 2.0° | 61° |
| 9 | NU | 1 g | 1 g | 16 g | 10.5° | 2.0° | 61° |
| 10 | R | 16 g | 1 g | 1 g | 9.5° | 3.7° | 60° |
| 11 | R | 1 g | 16 g | 1 g | 9.5° | 3.7° | 60° |
| 12 | R | 1 g | 1 g | 16 g | 9.5° | 3.7° | 60° |
| 13 | N-R | 16 g | 1 g | 1 g | 9.8° | 3.2° | 59.3° |
| 14 | N-R | 1 g | 16 g | 1 g | 9.8° | 3.2° | 59.3° |
| 15 | N-R | 1 g | 1 g | 16 g | 9.8° | 3.2° | 59.3° |
| 16 | N-L | 16 g | 1 g | 1 g | 11.2° | 0.8° | 59.3° |
| 17 | N-L | 1 g | 16 g | 1 g | 11.2° | 0.8° | 59.3° |
| 18 | N-L | 1 g | 1 g | 16 g | 11.2° | 0.8° | 59.3° |
| 19 | NU-R | 16 g | 1 g | 1 g | 9.8° | 3.2° | 60.7° |
| 20 | NU-R | 1 g | 16 g | 1 g | 9.8° | 3.2° | 60.7° |

TABLE 6-continued

| Config. No. | Sleeve Position | Toe Weight | Rear Weight | Heel Weight | Loft Angle | Face Angle | Lie Angle |
|---|---|---|---|---|---|---|---|
| 21 | NU-R | 1 g | 1 g | 16 g | 9.8° | 3.2° | 60.7° |
| 22 | NU-L | 16 g | 1 g | 1 g | 11.2° | 0.8° | 60.7° |
| 23 | NU-L | 1 g | 16 g | 1 g | 11.2° | 0.8° | 60.7° |
| 24 | NU-L | 1 g | 1 g | 16 g | 11.2° | 0.8° | 60.7° |

As shown in Table 6, the heaviest movable weight is about 16 g and two lighter weights are about 1 g. A total weight of 18 g is provided by movable weights in this exemplary embodiment. It is understood that the movable weights can be more than 18 g or less than 18 g depending on the desired CG location. The movable weights can be of a weight and configuration as described in U.S. Pat. Nos. 6,773,360, 7,166,040, 7,186,190, 7,407,447, 7,419,441, 7,628,707, or 7,744,484, which are incorporated by reference herein in their entirety. Placing the heaviest weight in the toe region will provide a draw biased shot. In contrast, placing the heaviest weight in the heel region will provide a fade biased shot and placing the heaviest weight in the rear position will provide a more neutral shot.

The exemplary embodiment shown in Table 6 provides at least five different loft angle values for eight different sleeve configurations. The loft angle value varies from about 9.5° to 11.5° for a nominal 10.5° loft (at neutral) club. In one embodiment, a maximum loft angle change is about 2°. The sleeve assembly or adjustable loft system described above can provide a total maximum loft change (Δloft) of about 0.5° to about 3° which can be described as the following expression in Eq. 4.

$$0.5 \leq \Delta loft \leq 3° \quad \text{Eq. 4}$$

The incremental loft change can be in increments of about 0.2° to about 1.5° in order to have a noticeable loft change while being small enough to fine tune the performance of the club head. As shown in Table 6, when the sleeve assembly is positioned to increase loft, the face angle is more closed with respect to how the club sits on the ground when the club is held in the address position. Similarly, when the sleeve assembly is positioned to decrease loft, the face angle sits more open.

Furthermore, five different face angle values for eight different sleeve configurations are provided in the embodiment of Table 6. The face angle varies from about 0.3° to 3.7° in the embodiment shown with a neutral face angle of 2.0°. In one embodiment, the maximum face angle change is about 3.4°. It should be noted that a 1° change in loft angle results in a 1.7° change in face angle.

The exemplary embodiment shown in Table 6 further provides five different lie angle values for eight different sleeve configurations. The lie angle varies from about 59° to 61° with a neutral lie angle of 60°. Therefore, in one embodiment, the maximum lie angle change is about 2°.

In an alternative exemplary embodiment, an equivalent 9.5° nominal loft club would have similar face angle and lie angle values described above in Table 6. However, the loft angle for an equivalent 9.5° nominal loft club would have loft values of about 1° less than the loft values shown throughout the various settings in Table 6. Similarly, an equivalent 8.5° nominal loft club would have a loft angle value of about 2° less than those shown in Table 6.

According to some embodiments of the present application, a golf club head has a loft angle between about 6 degrees and about 16 degrees or between about 13 degrees and about 30 degrees in the neutral position. In yet other embodiments, the golf club has a lie angle between about 55 degrees and about 65 degrees in the neutral position.

Table 7 illustrates another exemplary embodiment having a nominal club loft of 10.5°, a nominal lie angle of 60°, and a nominal face angle of 2.0°. In the exemplary embodiment of Table 7, the offset angle of the shaft is nominally 1.5°.

TABLE 7

| Sleeve Position | Loft Angle | Face Angle | Lie Angle |
|---|---|---|---|
| L | 12.0° | −0.5° | 60.0° |
| N | 10.5° | 2.0° | 58.5° |
| NU | 10.5° | 2.0° | 61.5° |
| R | 9.0° | 4.5° | 60.0° |
| N-R | 9.4° | 3.8° | 58.9° |
| N-L | 11.6° | 0.2° | 58.9° |
| NU-R | 9.4° | 3.8° | 61.1° |
| NU-L | 11.6° | 0.2° | 61.1° |

The different sleeve configurations shown in Table 7 can be combined with different movable weight configurations to achieve a desired shot bias, as already described above. In the embodiment of Table 7, the loft angle ranges from about 9.0° to 12.0° for a 10.5° neutral loft angle club resulting in a total maximum loft angle change of about 3°. The face angle in the embodiment of Table 7 ranges from about 0.5° to 4.5° for a 2.0° neutral face angle club thereby resulting in a total maximum face angle change of about 5°. The lie angle in Table 7 ranges from about 58.5° to 61.5° for a 60° neutral lie angle club resulting in a total maximum lie angle change of about 3°.

Figure 63A:
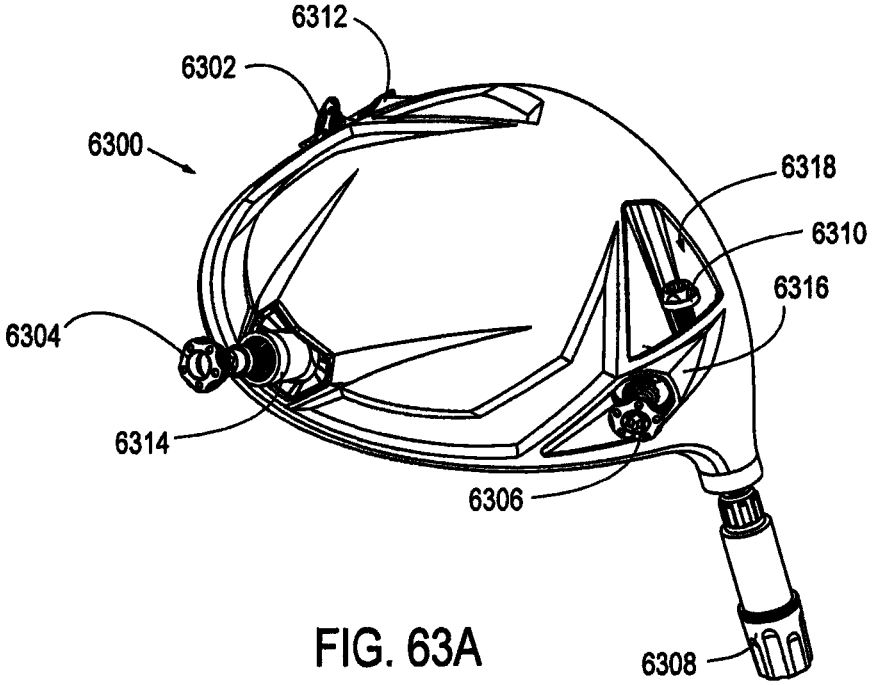
FIG. 63A is an exploded assembly view of a golf club head, in accordance with another embodiment.

FIG. 63A illustrates one exemplary embodiment of an exploded golf club head assembly. A golf club head 6300 is shown having a heel port 6316, a rear port 6314, a toe port 6312, a heel weight 6306, a rear weight 6304, and a toe weight 6302. The golf club head 6300 also includes a sleeve 6308 and screw 6310 as previously described. The screw 6310 is inserted into a hosel opening 6318 to secure the sleeve 6308 to the club head 6300.

Figure 63B:
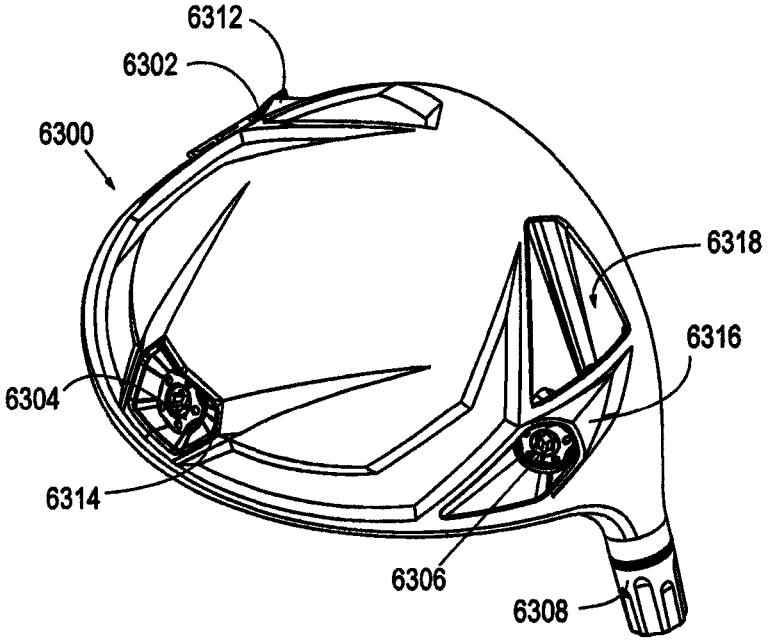
FIG. 63B is an assembled view of the golf club head of FIG. 63A.

FIG. 63B shows an assembled view of the golf club head 6300, sleeve 6308, screw 6310 and movable weights 6302, 6304,6306. The golf club head 6300 includes the hosel opening 6318 which is comprised of primarily three planar surfaces or walls.

Mass Characteristics

A golf club head has a head mass defined as the combined masses of the body, weight ports, and weights. The total weight mass is the combined masses of the weight or weights installed on a golf club head. The total weight port mass is the combined mass of the weight ports and any weight port supporting structures, such as ribs.

In one embodiment, the rear weight 6304 is the heaviest weight being between about 15 grams to about 20 grams. In certain embodiments, the lighter weights can be about 1 gram to about 6 grams. In one embodiment, a single heavy weight of 16 g and two lighter weights of 1 g is preferred.

In some embodiments, a golf club head is provided with three weight ports having a total weight port mass between about 1 g and about 12 g. In certain embodiments, the weight port mass without ribs is about 3 g for a combined weight port mass of about 9 g. In some embodiments, the total weight port mass with ribbing is about 5 g to about 6 g for a combined total weight port mass of about 15 g to about 18 g.

Figure 64A:
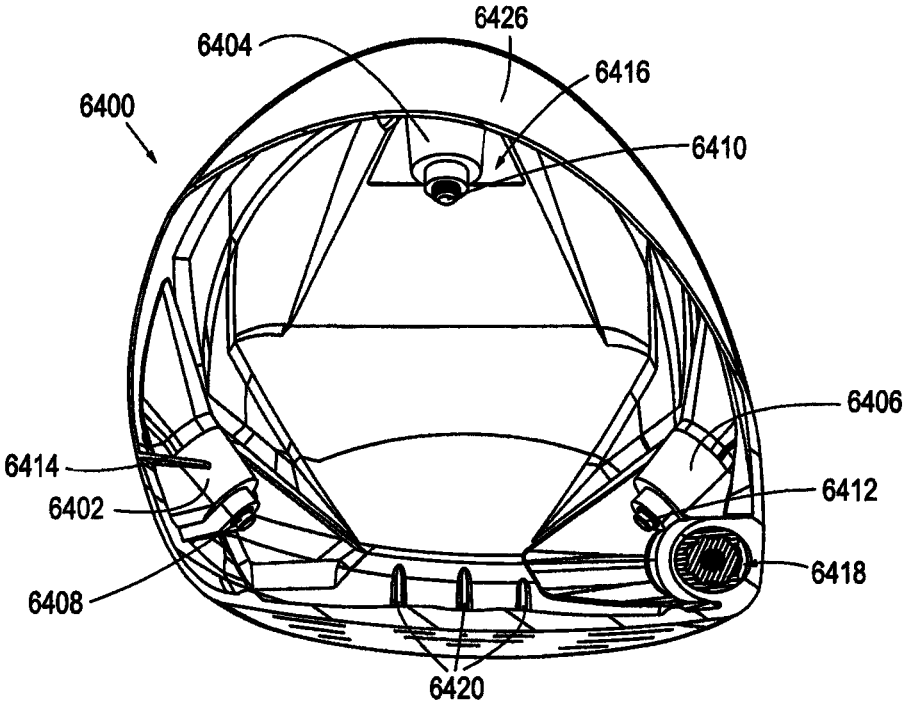
FIG. 64A is a top cross-sectional view of a golf club head, in accordance with another embodiment.

FIG. 64A illustrates a top cross-sectional view with a portion of the crown 6426 partially removed for purposes of illustration. A toe weight 6408, a rear weight 6410, and a heel weight 6412 are fully inserted into a toe weight port 6402, a rear weight port 6404, and a heel weight port 6406, respectively. A sleeve assembly 6418 of the type described herein is also shown. In one embodiment, the toe weight port 6402 is provided with at least one rib 6414 and the rear weight port 6404 is provided with at least one rib 6416. The heel weight port 6412 shown in FIG. 64A does not require a rib due to the additional stability and mass provided by the hosel recess walls 6422. Thus, in one embodiment, the heel weight port 6412 is lighter than the toe weight port 6402 and rear weight port 6404 due to the lack of ribbing. The toe weight port rib 6414 is comprised of a first rib 6414*a* and a second rib 6414*b* that attach the toe weight port rib to a portion of the interior wall of the sole 6424.

Figure 64B:
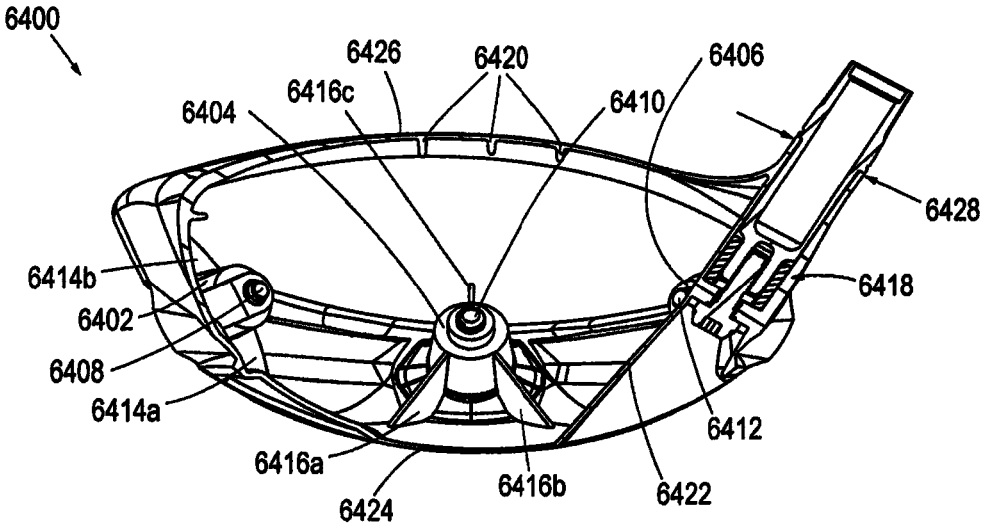
FIG. 64B is a front cross-section view of the golf club head of FIG. 64A.

FIG. 64B illustrates a front cross-sectional view showing the sleeve assembly 6418 and a hosel recess walls 6422. The heel weight port ribs 6416 are comprised of a first 6416*a*, second 6416*b*, and third 6416*c* rib. The first 6416*a* and second 6416*b* rib are attached to the outer surface of the rear weight port 6404 and an inner surface of the sole 6424. The third rib 6416*c* is attached to the outer surface of the rear weight port 6406 and an inner surface of the crown 6426.

In one embodiment, the addition of the sleeve assembly 6418 and hosel recess walls 6422 increase the weight in the heel region by about 10 g to about 12 g. In other words, a club head construction without the hosel recess walls 6422 and sleeve assembly 6418 would be about 10 g to about 12 g lighter. Due to the increase in weight in the heel region, a mass pad or fixed weight that might be placed in the heel region is unnecessary. Therefore, the additional weight from the hosel recess walls 6422 and sleeve assembly 6418 provides a sufficient impact on the center of gravity location without having to insert a mass pad or fixed weight.

In one exemplary embodiment, the weight port walls are roughly 0.6 mm to 1.5 mm thick and has a mass between 2 g to about 5 g. In one embodiment, the weight port walls alone weigh about 3 g to about 4 g. A hosel insert (as described above) has a weight of between 1 g to about 4 g. In one embodiment, the hosel insert is about 2 g. The sleeve that is inserted into the hosel insert weighs about 5 g to about 8 g. In one embodiment, the sleeve is about 6 g to about 7 g. The screw that is inserted into the sleeve weighs about 1 g to 2 g. In one exemplary embodiment, the screw weighs about 1 g to about 2 g.

Therefore, in certain embodiments, the hosel recess walls, hosel insert, sleeve, and screw have a combined weight of about 10 g to 15 g, and preferably about 14 g.

In some embodiments of the golf club head with three weight ports and three weights, the sum of the body mass, weight port mass, and weights is between about 80 g and about 220 g or between about 180 g and about 215 g. In specific embodiments the total mass of the club head is between 200 g and about 210 g and in one example is about 205 g.

The above mass characteristics seek to create a compact and lightweight sleeve assembly while accommodating the additional weight effects of the sleeve assembly on the CG of the club head. Preferably, the club head has a hosel outside diameter 6428 (shown in FIG. 64B) which is less than 15 mm or even more preferably less than 14 mm. The smaller hosel outside diameter when coupled with the sleeve assembly of the embodiments described above will ensure that an excessive weight in the hosel region is minimized and therefore does not have a significant effect on CG location. In other words, a small hosel diameter when coupled with the sleeve assembly is desirable for mass and CG properties and avoids the problems associated with a large, heavy, and bulky hosel. A smaller hosel outside diameter will also be more aesthetically pleasing to a player than a large and bulky hosel.

Volume Characteristics

The golf club head of the present application has a volume equal to the volumetric displacement of the club head body. In several embodiments, a golf club head of the present application can be configured to have a head volume between about 110 $cm^3$ and about 600 $cm^3$. In more particular embodiments, the head volume is between about 250 $cm^3$ and about 500 $cm^3$, 400 $cm^3$ and about 500 $cm^3$, 390 $cm^3$ and about 420 $cm^3$, or between about 420 $cm^3$ and 475 $cm^3$. In one exemplary embodiment, the head volume is about 390 to about 410 $cm^3$.

Moments of Inertia and CG Location

Golf club head moments of inertia are defined about axes extending through the golf club head CG. As used herein, the golf club head CG location can be provided with reference to its position on a golf club head origin coordinate system. The golf club head origin is positioned on the face plate at approximately the geometric center, i.e. the intersection of the midpoints of a face plate's height and width.

The head origin coordinate system includes an x-axis and a y-axis. The origin x-axis extends tangential to the face plate and generally parallel to the ground when the head is ideally positioned with the positive x-axis extending from the origin towards a heel of the golf club head and the negative x-axis extending from the origin to the toe of the golf club head. The origin y-axis extends generally perpendicular to the origin x-axis and parallel to the ground when the head is ideally positioned with the positive y-axis extending from the head origin towards the rear portion of the golf club. The head origin can also include an origin z-axis extending perpendicular to the origin x-axis and the origin y-axis and having a positive z-axis that extends from the origin towards the top portion of the golf club head and negative z-axis that extends from the origin towards the bottom portion of the golf club head.

In some embodiments, the golf club head has a CG with a head origin x-axis (CGx) coordinate between about −10 mm and about 10 mm and a head origin y-axis (CGy) coordinate greater than about 15 mm or less than about 50 mm. In certain embodiments, the club head has a CG with an origin x-axis coordinate between about −5 mm and about 5 mm, an origin y-axis coordinate greater than about 0 mm and an origin z-axis (CGz) coordinate less than about 0 mm.

More particularly, in specific embodiments of a golf club head having specific configurations, the golf club head has a CG with coordinates approximated in Table 8 below. The golf club head in Table 8 has three weight ports and three weights. In configuration 1, the heaviest weight is located in the back most or rear weight port. The heaviest weight is located in a heel weight port in configuration 2, and the heaviest weight is located in a toe weight port in configuration 3.

TABLE 8

| Configuration | CG origin x-axis coordinate (mm) | CG Y origin y-axis coordinate (mm) | CG Z origin z-axis coordinate (mm) |
|---|---|---|---|
| 1 | 0 to 5 | 31 to 36 | 0 to −5 |
| | 1 to 4 | 32 to 35 | −1 to −4 |
| | 2 to 3 | 33 to 34 | −2 to −3 |
| 2 | 3 to 8 | 27 to 32 | 0 to 5 |
| | 4 to 7 | 28 to 31 | −1 to −4 |
| | 5 to 6 | 29 to 30 | −2 to −3 |
| 3 | −2 to 3 | 27 to 32 | 0 to −5 |
| | −1 to 2 | 28 to 31 | −1 to −4 |
| | 0 to 1 | 29 to 30 | −2 to −3 |

Table 8 emphasizes the amount of CG change that can be possible by moving the movable weights. In one embodiment, the movable weight change can provide a CG change in the x-direction (heel-toe) of between about 2 mm and about 10 mm in order to achieve a large enough CG change to create significant performance change to offset or enhance the possible loft, lie, and face angel adjustments described above. A substantial change in CG is accomplished by having a large difference in the weight that is moved between different weight ports and having the weight ports spaced far enough apart to achieve the CG change. In certain embodiments, the CG is located below the center face with a CGz of less than 0. The CGx is between about −2 mm (toe-ward) and 8 mm (heel-ward) or even more preferably between about 0 mm and about 6 mm. Furthermore, the CGy can be between about 25 mm and about 40 mm (aft of the center-face).

A moment of inertia of a golf club head is measured about a CG x-axis, CG y-axis, and CG z-axis which are axes similar to the origin coordinate system except with an origin located at the center of gravity, CG.

In certain embodiments, the golf club head of the present invention can have a moment of inertia ($I_{xx}$) about the golf club head CG x-axis between about 70 kg·mm$^2$ and about 400 kg·mm$^2$. More specifically, certain embodiments have a moment of inertia about the CG x-axis between about 200 kg·mm$^2$to about 300 kg·mm$^2$or between about 200 kg·mm$^2$and about 500 kg·mm$^2$.

In several embodiments, the golf club head of the present invention can have a moment of inertia ($I_{zz}$) about the golf club head CG z-axis between about 200 kg·mm$^2$ and about 600 kg·mm$^2$. More specifically, certain embodiments have a moment of inertia about the CG z-axis between about 400 kg·mm$^2$to about 500 kg·mm$^2$or between about 350 kg·mm$^2$ and about 600 kg·mm$^2$.

In several embodiments, the golf club head of the present invention can have a moment of inertia ($I_{yy}$) about the golf club head CG y-axis between about 200 kg·mm$^2$and 400 kg·mm$^2$. In certain specific embodiments, the moment of inertia about the golf club head CG y-axis is between about 250 kg·mm$^2$ and 350 kg·mm$^2$.

The moment of inertia can change depending on the location of the heaviest removable weight as illustrated in Table 9 below. Again, in configuration 1, the heaviest weight is located in the back most or rear weight port. The heaviest weight is located in a heel weight port in configuration 2, and the heaviest weight is located in a toe weight port in configuration 3.

TABLE 9

| Configuration | $I_{xx}$ (kg · mm$^2$) | $I_{yy}$ (kg · mm$^2$) | Izz (kg · mm$^2$) |
|---|---|---|---|
| 1 | 250 to 300 | 250 to 300 | 410 to 460 |
| | 260 to 290 | 260 to 290 | 420 to 450 |
| | 270 to 280 | 270 to 280 | 430 to 440 |
| 2 | 200 to 250 | 270 to 320 | 380 to 430 |
| | 210 to 240 | 280 to 310 | 390 to 420 |
| | 220 to 230 | 290 to 300 | 400 to 410 |
| 3 | 200 to 250 | 280 to 330 | 400 to 450 |
| | 210 to 240 | 290 to 320 | 410 to 440 |
| | 220 to 230 | 300 to 310 | 420 to 430 |

Thin Wall Construction

According to some embodiments of a golf club head of the present application, the golf club head has a thin wall construction. Among other advantages, thin wall construction facilitates the redistribution of material from one part of a club head to another part of the club head. Because the redistributed material has a certain mass, the material may be redistributed to locations in the golf club head to enhance performance parameters related to mass distribution, such as CG location and moment of inertia magnitude. Club head material that is capable of being redistributed without affecting the structural integrity of the club head is commonly called discretionary weight. In some embodiments of the present invention, thin wall construction enables discretionary weight to be removed from one or a combination of the striking plate, crown, skirt, or sole and redistributed in the form of weight ports and corresponding weights.

Thin wall construction can include a thin sole construction, i.e., a sole with a thickness less than about 0.9 mm but greater than about 0.4 mm over at least about 50% of the sole surface area; and/or a thin skirt construction, i.e., a skirt with a thickness less than about 0.8 mm but greater than about 0.4 mm over at least about 50% of the skirt surface area; and/or a thin crown construction, i.e., a crown with a thickness less than about 0.8 mm but greater than about 0.4 mm over at least about 50% of the crown surface area. In one embodiment, the club head is made of titanium and has a thickness less than 0.65 mm over at least 50% of the crown in order to free up enough weight to achieve the desired CG location.

More specifically, in certain embodiments of a golf club having a thin sole construction and at least one weight and two weight ports, the sole, crown and skirt can have respective thicknesses over at least about 50% of their respective surfaces between about 0.4 mm and about 0.9 mm, between about 0.8 mm and about 0.9 mm, between about 0.7 mm and about 0.8 mm, between about 0.6 mm and about 0.7 mm, or less than about 0.6 mm. According to a specific embodiment of a golf club having a thin skirt construction, the thickness of the skirt over at least about 50% of the skirt surface area can be between about 0.4 mm and about 0.8 mm, between about 0.6 mm and about 0.7 mm or less than about 0.6 mm.

The thin wall construction can be described according to areal weight as defined by the equation (Eq. 5) below:

$$AW=\rho \cdot t \qquad \text{Eq. 5}$$

In the above equation, AW is defined as areal weight, ρ is defined as density, and t is defined as the thickness of the material. In one exemplary embodiment, the golf club head is made of a material having a density, ρ, of about 4.5 g/cm$^3$ or less. In one embodiment, the thickness of a crown or sole portion is between about 0.04 cm and about 0.09 cm. Therefore the areal weight of the crown or sole portion is between about 0.18 g/cm$^2$ and about 0.41 g/ cm$^2$. In some embodiments, the areal weight of the crown or sole portion is less than 0.41 g/ cm$^2$ over at least about 50% of the crown or sole surface area. In other embodiments, the areal weight of the crown or sole is less than about 0.36 g/ cm$^2$ over at least about 50% of the entire crown or sole surface area.

In certain embodiments, the thin wall construction is implemented according to U.S. patent application Ser. No. 11/870,913 and U.S. Pat. No. 7,186,190, which are incorporated by reference herein in their entirety.

Variable Thickness Faceplate

According to some embodiments, a golf club head face plate can include a variable thickness faceplate. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for reallocation to another area of the club head.

Figure 65A:
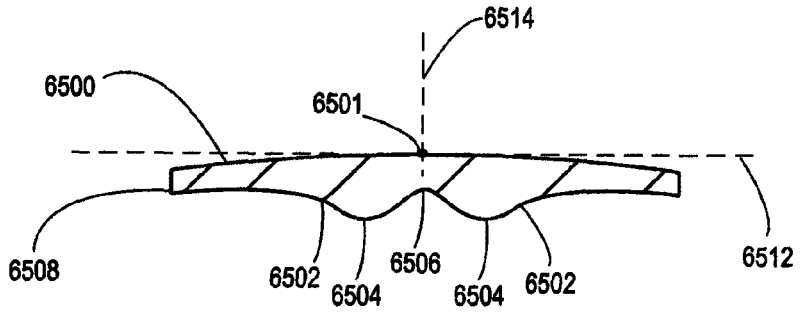
FIG. 65A is a cross-sectional view of a golf club head face plate protrusion.
Figure 65B:
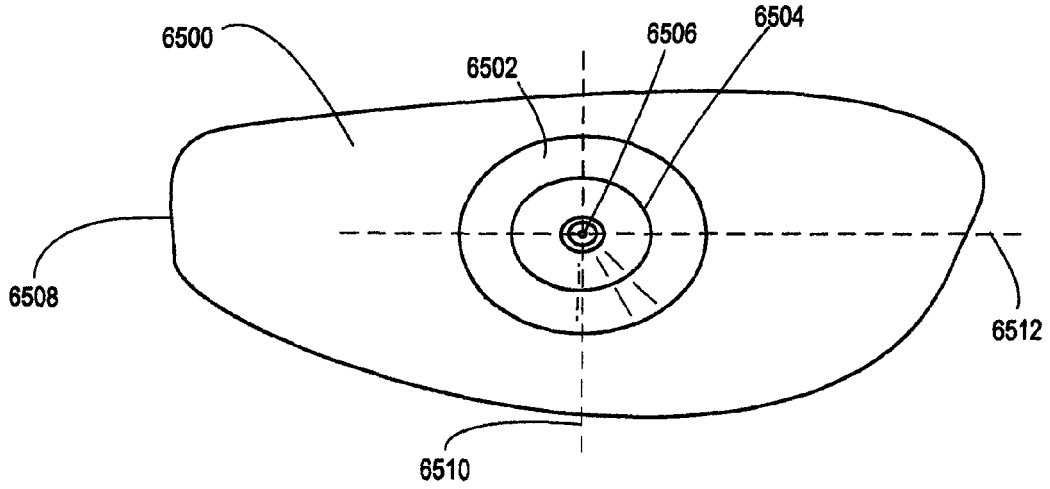
FIG. 65B is a rear view of a golf club face plate protrusion.

A variable thickness face plate 6500, according to one embodiment of a golf club head illustrated in FIGS. 65A and 65B, includes a generally circular protrusion 6502 extending into the interior cavity towards the rear portion of the golf club head. When viewed in cross-section, as illustrated in FIG. 65A, protrusion 6502 includes a portion with increasing thickness from an outer portion 6508 of the face plate 6500 to an intermediate portion 6504. The protrusion 6502 further includes a portion with decreasing thickness from the intermediate portion 6504 to an inner portion 6506 positioned approximately at a center of the protrusion preferably proximate the golf club head origin. An origin x-axis 6512 and an origin z-axis 6510 intersect near the inner portion 6506 across an x-z plane. However, the origin x-axis 6512, origin z-axis 6510, and an origin y-axis 6514 pass through an ideal impact location 6501 located on the striking surface of the face plate. In certain embodiments, the inner portion 6506 can be aligned with the ideal impact location with respect to the x-z plane.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm. The face thickness should have a thickness change of at least 25% over the face (thickest portion compared to thinnest) in order to save weight and achieve a higher ball speed on off-center hits.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

In certain embodiments, a variable thickness face profile is implemented according to U.S. patent application Ser. No. 12/006,060, U.S. Pat. Nos. 6,997,820, 6,800,038, and 6,824,475, which are incorporated herein by reference in their entirety.

Distance Between Weight Ports

In some embodiments of a golf club head having at least two weight ports, a distance between the first and second weight ports is between about 5 mm and about 200 mm. In more specific embodiments, the distance between the first and second weight ports is between about 5 mm and about 100 mm, between about 50 mm and about 100 mm, or between about 70 mm and about 90 mm. In some specific embodiments, the first weight port is positioned proximate a toe portion of the golf club head and the second weight port is positioned proximate a heel portion of the golf club head.

In some embodiments of the golf club head having first, second and third weight ports, a distance between the first and second weight port is between about 40 mm and about 100 mm, and a distance between the first and third weight port, and the second and third weight port, is between about 30 mm and about 90 mm. In certain embodiments, the distance between the first and second weight port is between about 60 mm and about 80 mm, and the distance between the first and third weight port, and the second and third weight port, is between about 50 mm and about 80 mm. In a specific example, the distance between the first and second weight port is between about 80 mm and about 90 mm, and the distance between the first and third weight port, and the second and third weight port, is between about 70 mm and about 80 mm. In some embodiments, the first weight port is positioned proximate a toe portion of the golf club head, the second weight port is positioned proximate a heel portion of the golf club head and the third weight port is positioned proximate a rear portion of the golf club head.

In some embodiments of the golf club head having first, second, third and fourth weights ports, a distance between the first and second weight port, the first and fourth weight port, and the second and third weight port is between about 40 mm and about 100 mm; a distance between the third and fourth weight port is between about 10 mm and about 80 mm; and a distance between the first and third weight port and the second and fourth weight port is about 30 mm to about 90 mm. In more specific embodiments, a distance between the first and second weight port, the first and fourth weight port, and the second and third weight port is between about 60 mm and about 80 mm; a distance between the first and third weight port and the second and fourth weight port is between about 50 mm and about 70 mm; and a distance between the third and fourth weight port is between about 30 mm and about 50 mm. In some specific embodiments, the first weight port is positioned proximate a front toe portion of the golf club head, the second weight port is positioned proximate a front heel portion of the golf club head, the third weight port is positioned proximate a rear toe portion of the golf club head and the fourth weight port is positioned proximate a rear heel portion of the golf club head.

Product of Distance Between Weight Ports and the Maximum Weight

As mentioned above, the distance between the weight ports and weight size contributes to the amount of CG change made possible in a system having the sleeve assembly described above.

n some embodiments of a golf club head of the present application having two, three or four weights, a maximum weight mass multiplied by the distance between the maximum weight and the minimum weight is between about 450 g·mm and about 2,000 g·mm or about 200 g·mm and 2,000 g·mm. More specifically, in certain embodiments, the maximum weight mass multiplied by the weight separation distance is between about 500 g·mm and about 1,500 g·mm, between about 1,200 g·mm and about 1,400 g·mm.

When a weight or weight port is used as a reference point from which a distance, i.e., a vectorial distance (defined as the length of a straight line extending from a reference or feature point to another reference or feature point) to another weight or weights port is determined, the reference point is typically the volumetric centroid of the weight port.

When a movable weight club head and the sleeve assembly are combined, it is possible to achieve the highest level of club trajectory modification while simultaneously achieving the desired look of the club at address. For example, if a player prefers to have an open club face look at address, the player can put the club in the "R" or open face position. If that player then hits a fade (since the face is open) shot but prefers to hit a straight shot, or slight draw, it is possible to take the same club and move the heavy weight to the heel port to promote draw bias. Therefore, it is possible for a player to have the desired look at address (in this case open face) and the desired trajectory (in this case straight or slight draw).

In yet another advantage, by combining the movable weight concept with an adjustable sleeve position (effecting loft, lie and face angle) it is possible to amplify the desired trajectory bias that a player may be trying to achieve.

For example, if a player wants to achieve the most draw possible, the player can adjust the sleeve position to be in the closed face position or "L" position and also put the heavy weight in the heel port. The weight and the sleeve position work together to achieve the greater draw bias possible. On the other hand, to achieve the greatest fade bias, the sleeve position can be set for the open face or "R" position and the heavy weight is placed in the top port.

Product of Distance Between Weight Ports, the Maximum Weight, and the Maximum Loft Change As described above, the combination of a large CG change (measured by the heaviest weight multiplied by the distance between the ports) and a large loft change (measured by the largest possible change in loft between two sleeve positions, Δloft) results in the highest level of trajectory adjustability. Thus, a product of the distance between at least two weight ports, the maximum weight, and the maximum loft change is important in describing the benefits achieved by the embodiments described herein.

In one embodiment, the product of the distance between at least two weight ports, the maximum weight, and the maximum loft change is between about 50 mm·g·deg and about 6,000 mm·g·deg or even more preferably between about 500 mm·g·deg and about 3,000 mm·g·deg. In other words, in certain embodiments, the golf club head satisfies the following expressions in Eq. 6 and Eq. 7.

$$50\ \text{mm·g·degrees} < \text{Dwp·Mhw·}\Delta\text{loft} < 6{,}000\ \text{mm·g·degrees} \quad \text{Eq. 6}$$

$$500\ \text{mm·g·degrees} < \text{Dwp·Mhw·}\Delta\text{loft} < 3{,}000\ \text{mm·g·degrees} \quad \text{Eq. 7}$$

In the above expressions, Dwp, is the distance between two weight port centroids (mm), Mhw, is the mass of the heaviest weight (g), and Δloft is the maximum loft change (degrees) between at least two sleeve positions. A golf club head within the ranges described above will ensure the highest level of trajectory adjustability.

Torque Wrench

Figure 66:
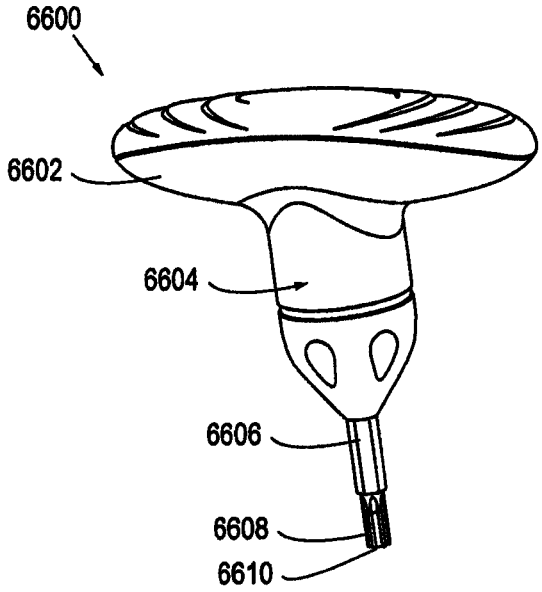
FIG. 66 is an isometric view of a tool.

With respect to FIG. 66, the torque wrench 6600 includes a grip 6602, a shank 6606 and a torque limiting mechanism housed inside the torque wrench. The grip 6602 and shank 6606 form a T-shape and the torque-limiting mechanism is located between the grip 6602 and shank 6606 in an intermediate region 6604. The torque-limiting mechanism prevents over-tightening of the movable weights, the adjustable sleeve, and the adjustable sole features of the embodiments described herein. In use, once the torque limit is met, the torque-limiting mechanism of the exemplary embodiment will cause the grip 6602 to rotationally disengage from the shank 6606. Preferably, the wrench 6600 is limited to between about 30 inch-lbs. and about 50 inch-lbs of torque. More specifically, the limit is between about 35 inch-lbs. and about 45 inch-lbs. of torque. In one exemplary embodiment, the wrench 6600 is limited to about 40 inch-lbs. of torque.

The use of a single tool or torque wrench 6600 for adjusting the movable weights, adjustable sleeve or adjustable loft system, and adjustable sole features provides a unique advantage in that a user is not required to carry multiple tools or attachments to make the desired adjustments.

The shank 6606 terminates in an engagement end i.e. tip 6610 configured to operatively mate with the movable weights, adjustable sleeve, and adjustable sole features described herein. In one embodiment, the engagement end or tip 6610 is a bit-type drive tip having one single mating configuration for adjusting the movable weights, adjustable sleeve, and adjustable sole features. The engagement end can be comprised of lobes and flutes spaced equidistantly about the circumference of the tip.

In certain embodiments, the single tool 6600 is provided to adjust the sole angle and the adjustable sleeve (i.e. affecting loft angle, lie angle, or face angle) only. In another embodiment, the single tool 6600 is provided to adjust the adjustable sleeve and movable weights only. In yet other embodiments, the single tool 6600 is provided to adjust the movable weights and sole angle only.

Composite Face Insert

Figure 67A:
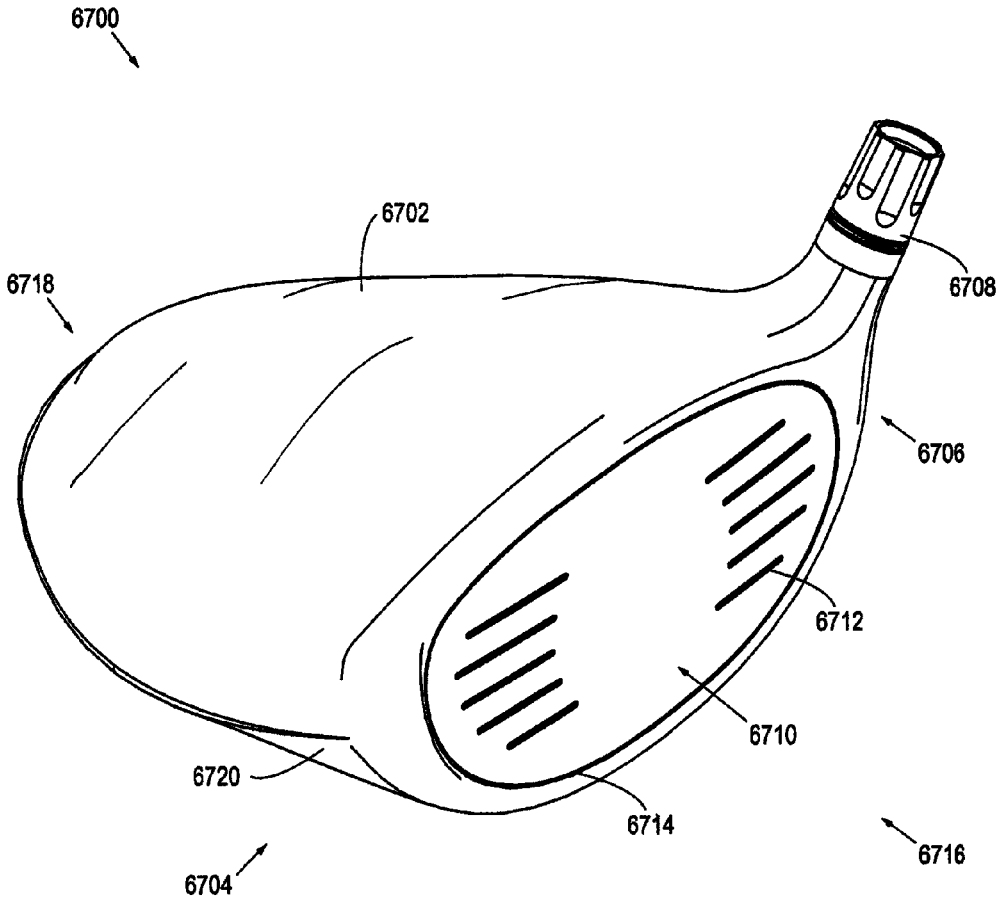
FIG. 67A is an isometric view of a golf club head.

FIG. 67A shows an isometric view of a golf club head 6700 including a crown portion 6702, a sole portion 6720, a rear portion 6718, a front portion 6716, a toe region 6704, heel region 6706, and a sleeve 6708. A face insert 6710 is inserted into a front opening inner wall 6714 located in the front portion 6716. The face insert 6710 can include a plurality of score lines.

Figure 67B:
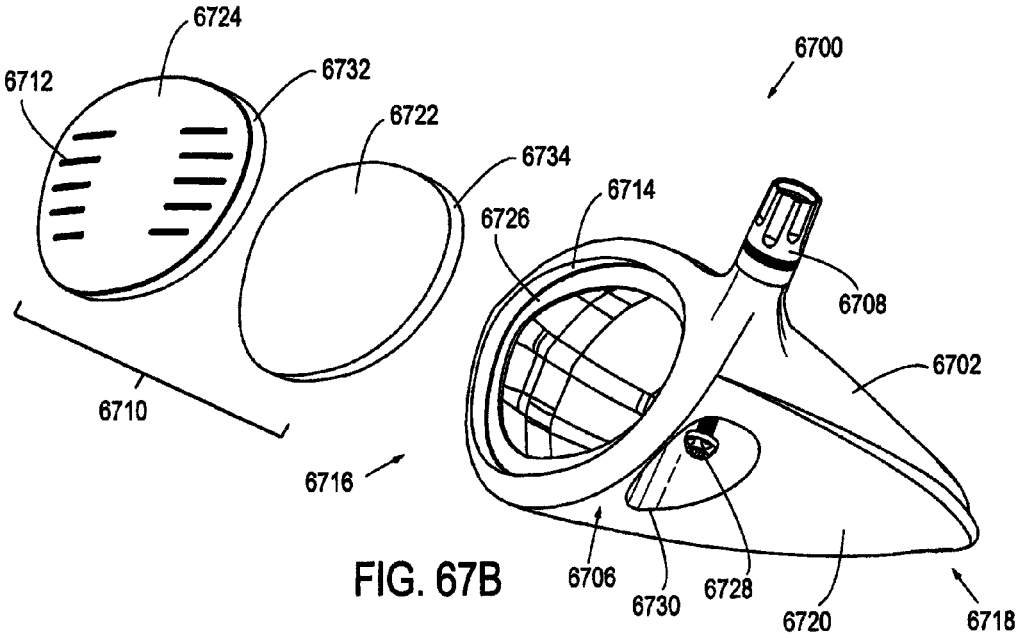
FIG. 67B is an exploded view of the golf club head of FIG. 67A.

FIG. 67B illustrates an exploded assembly view of the golf club head 6700 and a face insert 6710 including a composite face insert 6722 and a metallic cap 6724. In certain embodiments, the metallic cap 6724 is a titanium alloy, such as 6-4 titanium or CP titanium. In some embodiments, the metallic cap 6725 includes a rim portion 6732 that covers a portion of a side wall 6734 of the composite insert 6722.

In other embodiments, the metallic cap 6724 does not have a rim portion 6732 but includes an outer peripheral edge that is substantially flush and planar with the side wall 6734 of the composite insert 6722. A plurality of score lines 6712 can be located on the metallic cap 6724. The composite face insert 6710 has a variable thickness and is adhesively or mechanically attached to the insert ear 6726 located within the front opening and connected to the front opening inner wall 6714. The insert ear 6726 and the composite face insert 6710 can be of the type described in U.S. patent application Ser. No. 11/642,310, Ser. No. 11/825,138, Ser. No. 11/960,609, Ser. No. 11/960,610 and U.S. Pat. No. 7,267,620, RE42,544, U.S. Pat. Nos. 7,874,936, 7,874,937, and 7,985,146, which are incorporated by reference herein in their entirety.

FIG. 67B further shows a heel opening 6730 located in the heel region 6706 of the club head 6700. A fastening member 6728 is inserted into the heel opening 6730 to secure a sleeve 6708 in a locked position as shown in the various embodiments described above. In certain embodiments, the sleeve 6708 can have any of the specific design parameters disclosed herein and is capable of providing various face angle and loft angle orientations as described above.

Figure 67C:
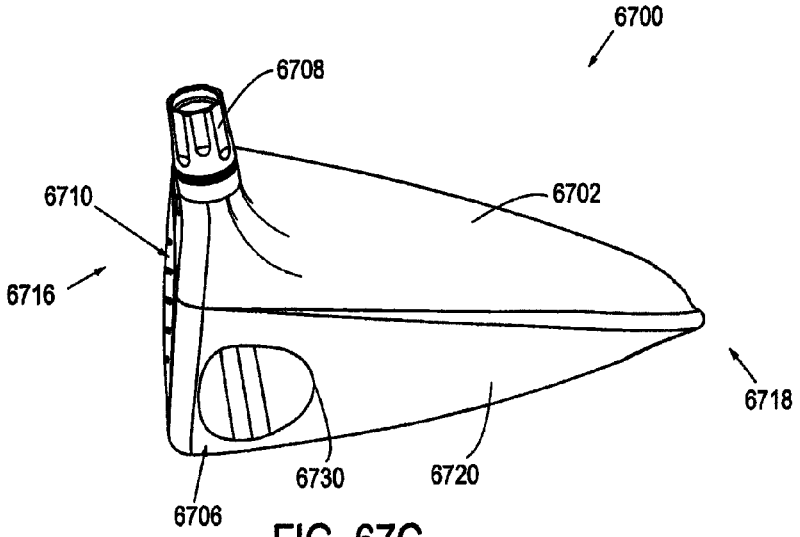
FIG. 67C is a side view of the golf club head of FIG. 67A.

FIG. 67C shows a heel-side view of the club head 6700 having the fastening member 6728 fully inserted into the heel opening 6730 to secure the sleeve 6708.

Figure 67D:
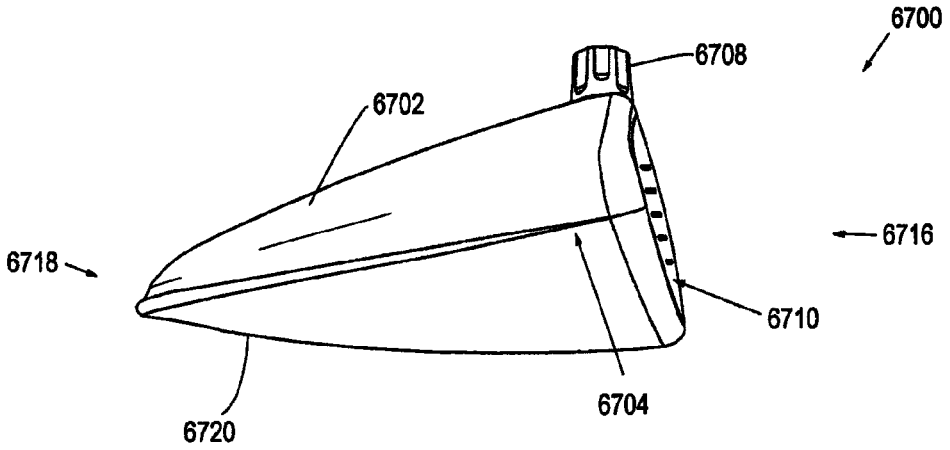
FIG. 67D is a side view of the golf club head of FIG. 67A.

FIG. 67D shows a toe-side view of the club head 6700 including the face insert 6710 and sleeve 6708.

Figure 67E:
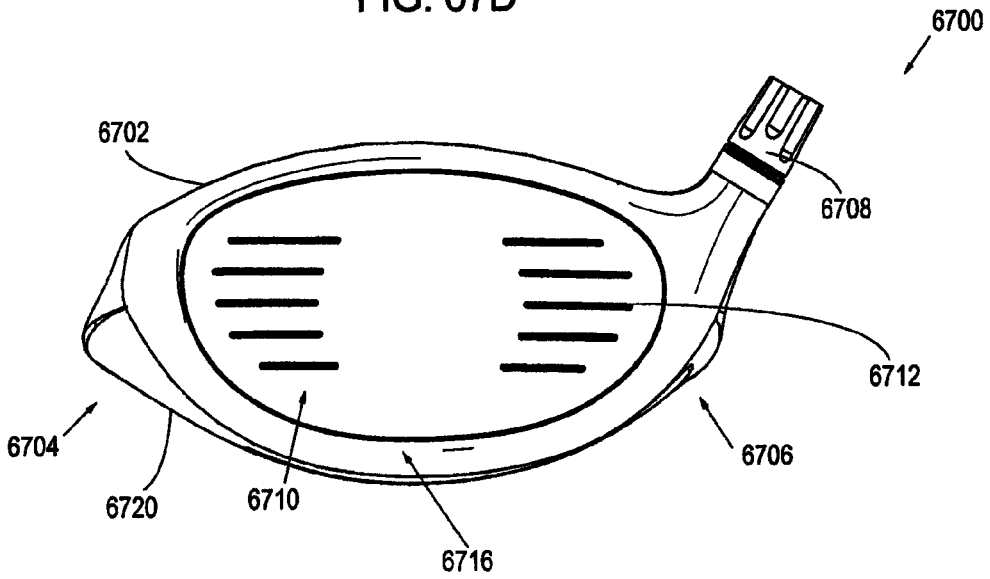
FIG. 67E is a front view of the golf club head of FIG. 67A.

FIG. 67E illustrates a front side view of the club head 6700 face insert 6710 and sleeve 6708.

Figure 67F:
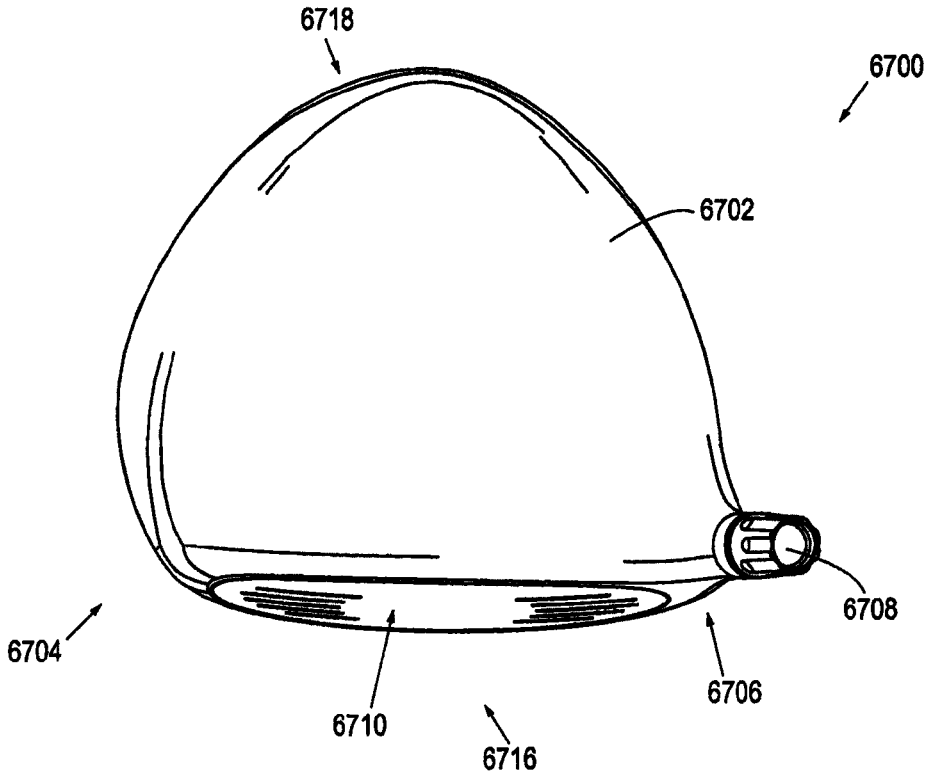
FIG. 67F is atop view of the golf club head of FIG. 67A.

FIG. 67F illustrates a top side view of the club head 6700 having the face insert 6710 and sleeve 6708 as described above.

Figure 67G:
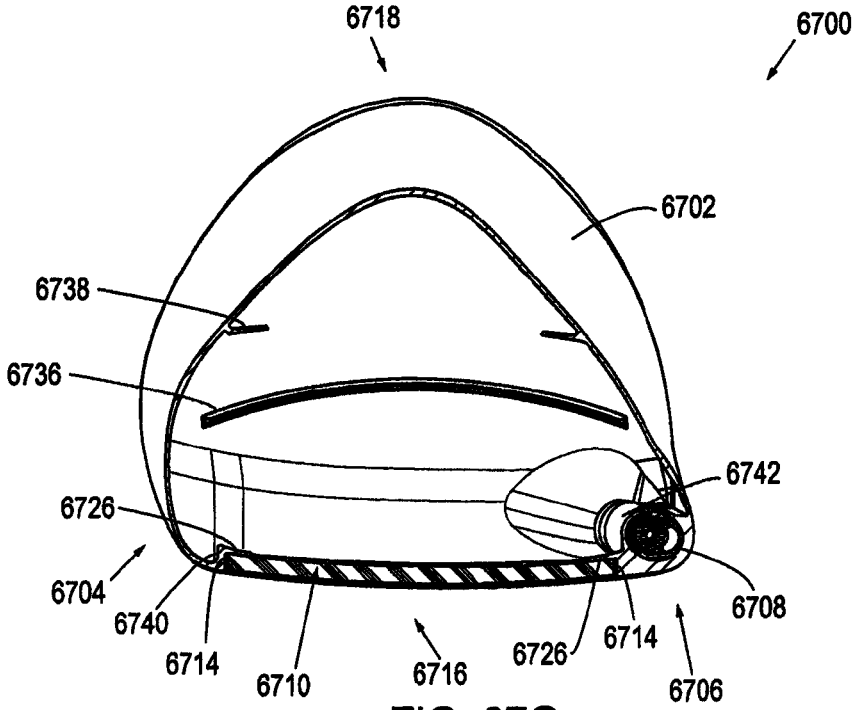
FIG. 67G is a cross-sectional top view of the golf club head of FIG. 67A.

FIG. 67G illustrates a cross-sectional view through a portion of the crown 6702 and face insert 6710. The front opening inner wall 6714 located near the toe region 6704 of the club head 6700 includes a front opening outer wall 6740 that defines a substantially constant thickness between the front opening inner wall 6714 and the front opening outer wall 6740. The front opening outer wall 6740 extends around a majority of the front opening circumference. However, in a portion of the heel region 6706 of the club head 6700, the front opening outer wall 6740 is not present.

FIG. 67G shows the front opening inner wall 6714 and a portion of the insert ear 6726 being integral with a hosel opening interior wall 6742. The hosel opening interior wall 6742 extends from an interior sole portion to a hosel region near the heel region 6706. In one embodiment, the insert ear 6726 extends from the hosel opening interior wall 6742 within an interior cavity of the club head 6700. Furthermore, a sole plate rib 6736 reinforces the interior of the sole 6720. In one embodiment, the sole plate rib 6736 extends in a heel to toe direction and is primarily parallel with the face insert 6710. A similar crown interior surface rib 6738 extends in a heel to toe direction along the interior surface of the crown 6702.

Figure 68:
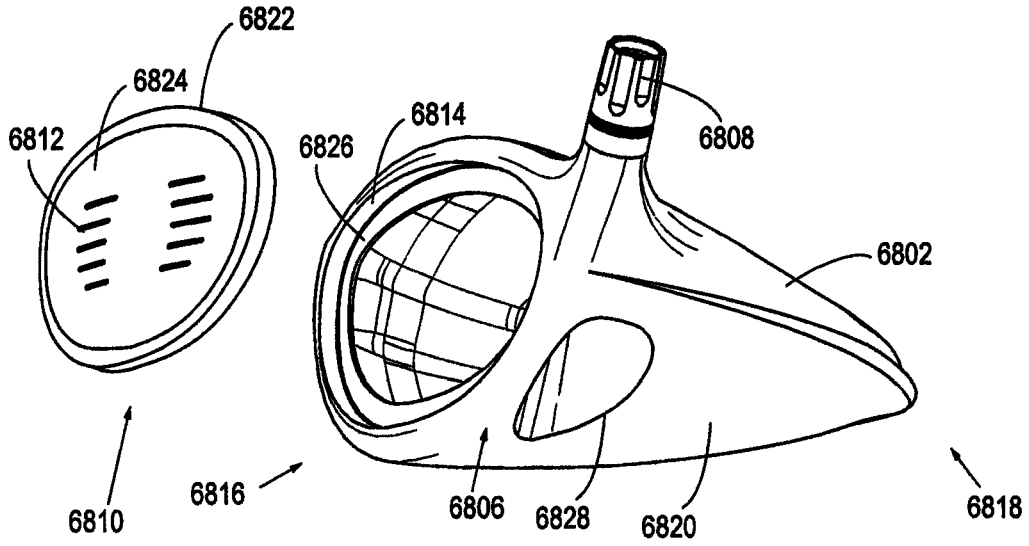
FIG. 68 is an isometric view of a golf club head.

FIG. 68 shows an alternative embodiment having a sleeve 6808, a heel region 6806, a front region 6816, a rear region 6818, a hosel opening 6828, a front opening inner wall 6814, and an insert ear 6826 as fully described above. However, FIG. 68 shows a face insert 6810 including a composite face insert 6822 with a front cover 6824. In one embodiment, the front cover 6824 is a polymer material. The face insert 6810 can include score lines located on the polymer cover 6824 or the composite face insert 6822.

The club head of the embodiments described in FIGS. 67A-G and FIG. 68 can have a mass of about 200 g to about 210 g or about 190 g to about 200 g. In certain embodiments, the mass of the club head is less than about 205 g. In one embodiment, the mass is at least about 190 g. Additional mass added by the hosel opening and the insert ear in certain embodiments will have an effect on moment of inertia and center of gravity values as shown in Tables 10 and 11.

TABLE 10

| $I_{xx}$ (kg · mm$^2$) | $I_{yy}$ (kg · mm$^2$) | $I_{zz}$ (kg · mm$^2$) |
|---|---|---|
| 330 to 340 | 340 to 350 | 520 to 530 |
| 320 to 350 | 330 to 360 | 510 to 540 |
| 310 to 360 | 320 to 370 | 500 to 550 |

TABLE 11

| CG origin x-axis coordinate (mm) | CG Y origin y-axis coordinate (mm) | CG Z origin z-axis coordinate (mm) |
|---|---|---|
| 5 to 7 | 32 to 34 | −5 to −6 |
| 4 to 8 | 31 to 36 | −4 to −7 |
| 3 to 9 | 30 to 37 | −3 to −8 |

A golf club having an adjustable loft and lie angle with a composite face insert can achieve the moment of inertia and CG locations listed in Table 10 and 11. In certain embodiments, the golf club head can include movable weights in addition to the adjustable sleeve system and composite face. In embodiments where movable weights are implemented, similar moment of inertia and CG values already described herein can be achieved.

The golf club head embodiments described herein provide a solution to the additional weight added by a movable weight system and an adjustable loft, lie, and face angle system. Any undesirable weight added to the golf club head makes it difficult to achieve a desired head size, moment of inertia, and nominal center of gravity location.

In certain embodiments, the combination of ultra-thin wall casting technology, high strength variable face thickness, strategically placed compact and lightweight movable weight ports, and a lightweight adjustable loft, lie, and face angle system make it possible to achieve high performing moment of inertia, center of gravity, and head size values.

Furthermore, an advantage of the discrete positions of the sleeve embodiments described herein allow for an increased amount of durability and more user friendly system.

Rotationally Adjustable Sole Portion

As discussed above, conventional golf clubs do not allow for adjustment of the hosel/shaft loft 72 without causing a corresponding change in the face angle 30. FIGS. 54-58 illustrate one embodiment of a golf club head 4000 configured to "decouple" the relationship between face angle and hosel/shaft loft (and therefore square loft), that is, allow for separate adjustment of square loft 20 and face angle 30.

The club head 4000 includes an adjustable sole portion 4010 that can be adjusted relative to the club head body 4002 to raise and lower the rear end of the club head relative to the ground. One or more screws 4016 can extend through respective washers 4028, corresponding openings in the adjustable sole portion 4010, one or more shims 4026 and into threaded openings in the bottom portion 4022 of the club head body. The sole angle of the club head can be adjusted by increasing or decreasing the number of shims 4026, which changes the distance the sole portion 4010 extends from the bottom of the club head.

FIGS. 69-73 illustrate a golf club head 8000 according to another embodiment that also includes an adjustable sole portion. As shown in FIGS. 69A-69F, the club head 8000 comprises a club head body 8002 having a heel 8005, a toe 8007, a rear end 8006, a forward striking face 8004, a top portion or crown 8021, and a bottom portion or sole 8022. The body also includes a hosel 8008 for supporting a shaft (not shown). The sole 8022 defines a leading edge surface portion 8024 adjacent the lower edge of the striking face 8004 that extends transversely across the sole 8022 (i.e., the leading edge surface portion 8024 extends in a direction from the heel 8005 to the toe 8007 of the club head body). The hosel 8008 can be adapted to receive a removable shaft sleeve 8009, as disclosed herein.

Figure 70:
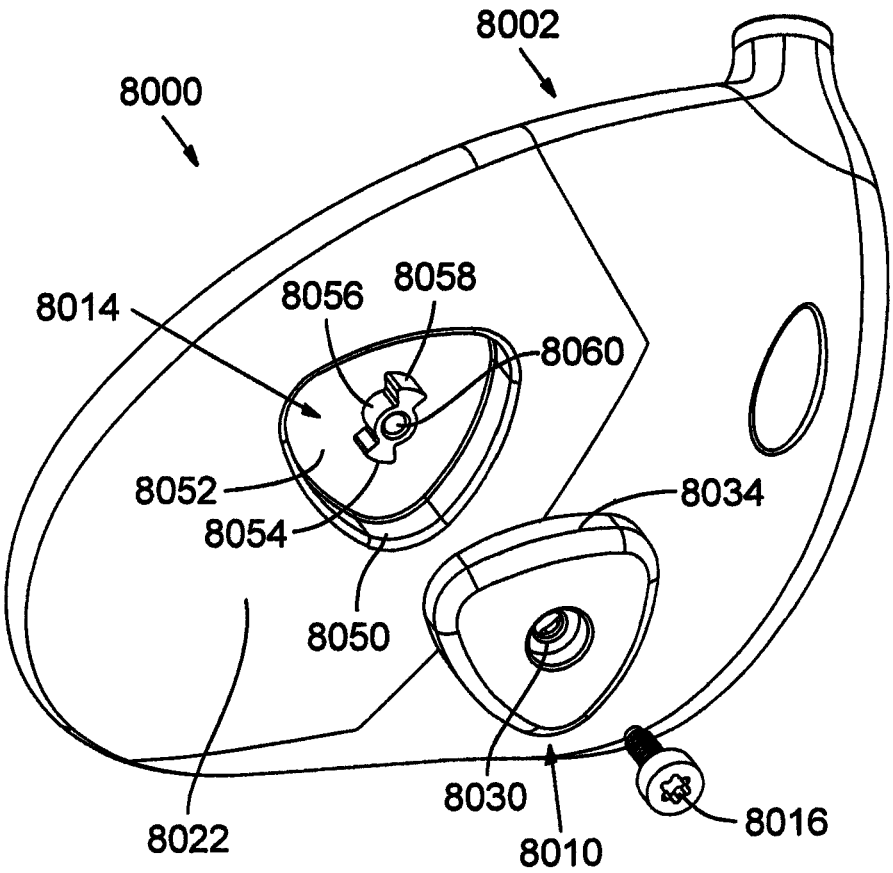
FIG. 70 is an exploded perspective view of the golf club head of FIG. 69A.

The sole 8022 further includes an adjustable sole portion 8010 (also referred to as a sole piece) that can be adjusted relative to the club head body 8002 to a plurality of rotational positions to raise and lower the rear end 8006 of the club head relative to the ground. This can rotate the club head about the leading edge surface portion 8024 of the sole 8022, changing the sole angle 2018. As best shown in FIG. 70, the sole 8022 of the club head body 8002 can be formed with a recessed cavity 8014 that is shaped to receive the adjustable sole portion 8010.

Figure 72A:
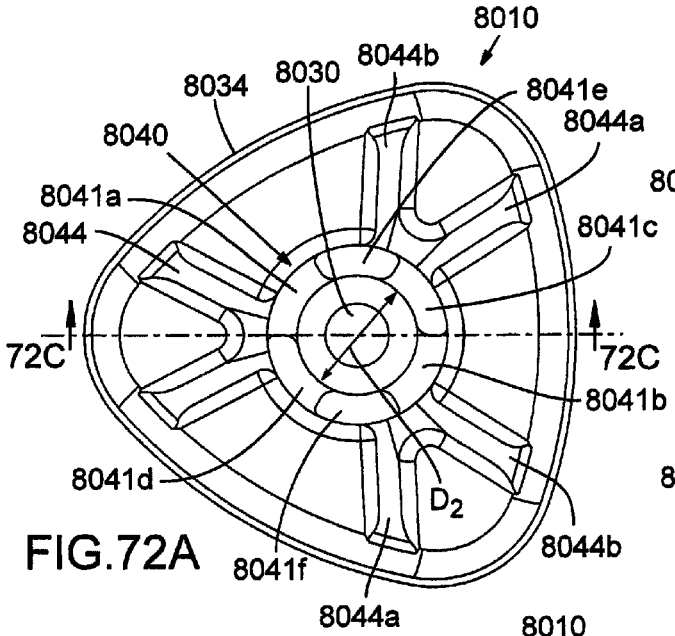
FIG. 72A is top view of an adjustable sole portion of the golf club head of FIG. 69A.
Figure 72B:
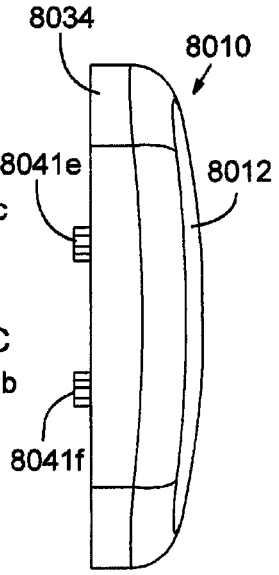
FIG. 72B is a side view of the adjustable sole portion of FIG. 72A.
Figure 72C:
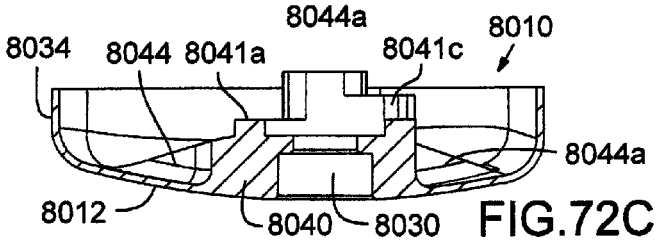
FIG. 72C is a cross-sectional side view of the adjustable sole portion of FIG. 72A.
Figure 72D:
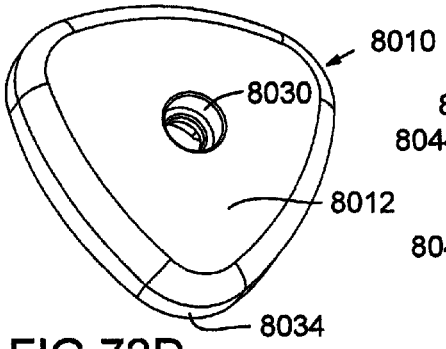
FIG. 72D is a perspective view of the bottom of the adjustable sole portion of FIG. 72A.

As best shown in FIG. 72A, the adjustable sole portion 8010 can be triangular. In other embodiments, the adjustable sole portion 8010 can have other shapes, including a rectangle, square, pentagon, hexagon, circle, oval, star or combinations thereof. Desirably, although not necessarily, the sole portion 8010 is generally symmetrical about a center axis as shown. As best shown in FIG. 72C, the sole portion 8010 has an outer rim 8034 extending upwardly from the edge of a bottom wall 8012. The rim 8034 can be sized and shaped to be received within the walls of the recessed cavity 8014 with a small gap or clearance between the two when the adjustable sole portion 8010 is installed in the body 8002. The bottom wall 8012 and outer rim 8034 can form a thin-walled structure as shown. At the center of the bottom surface 8012 can be a recessed screw hole 8030 that passes completely through the adjustable sole portion 8010.

A circular, or cylindrical, wall 8040 can surround the screw hole 8030 on the upper/inner side of the adjustable sole portion 8010. The wall 8040 can also be triangular, square, pentagonal, etc., in other embodiments. The wall 8040 can be comprised of several sections 8041 having varying heights. Each section 8041 of the wall 8040 can have about the same width and thickness, and each section 8041 can have the same height as the section diametrically across from it. In this manner, the circular wall 8040 can be symmetrical about the centerline axis of the screw hole 8030. Furthermore, each pair of wall sections 8041 can have a different height than each of the other pairs of wall sections. Each pair of wall sections 8041 is sized and shaped to mate with corresponding sections on the club head to set the sole portion 8010 at a predetermined height, as further discussed below.

Figure 72E:
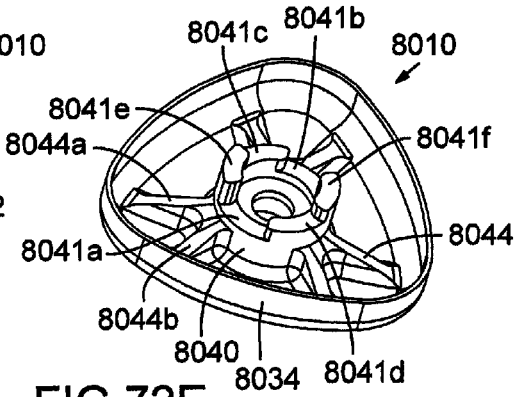
FIG. 72E is a perspective view of the top of the adjustable sole portion of FIG. 72A.
Figure 73A:
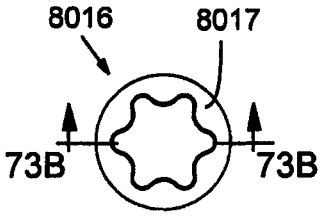
FIG. 73A is a plan view of the head of a screw that can be used to secure the adjustable sole portion of FIG. 72A to a club head.
Figure 73B:
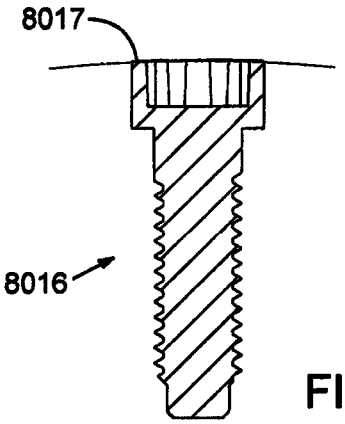
FIG. 73B is a cross-sectional view of the screw of FIG. 73A, taken along line A-A.

For example, in the triangular embodiment of the adjustable sole portion 8010 shown in FIG. 72E, the circular wall 8040 has six wall sections 8041*a, b, c, d, e* and *f* that make up three pairs of wall sections, each pair having different heights. Each pair of wall sections 8041 project upward a different distance from the upper/inner surface of the adjustable sole portion 8010. Namely, a first pair is comprised of wall sections 8041*a* and 8041*b;* a second pair is comprised of 8041*c* and 8041*d* that extend past the first pair; and a third pair is comprised of wall sections 8041*e* and 8041*f* that extend past the first and second pairs. Each pair of wall sections 8041 desirably is symmetrical about the centerline axis of the screw hole 8030. The tallest pair of wall sections 8041*e,* 8041*f* can extend beyond the height of the outer rim 8034, as shown in FIGS. 72B and 72C. The number of wall section pairs (three) desirably equals the number of planes of symmetry (three) of the overall shape (see FIG. 72A) of the adjustable sole portion 8010. As explained in more detail below, a triangular adjustable sole portion 8010 can be installed into a corresponding triangular recessed cavity 8014 in three different orientations, each of which aligns one of the pairs of wall sections 8041 with mating surfaces on the sole portion 8010 to adjust the sole angle 2018.

The adjustable sole portion 8010 can also include any number ribs 8044, as shown in FIG. 72E, to add structural rigidity. Such increased rigidity is desirable because, when installed in the body 8002, the bottom wall 8012 and parts of the outer rim 8034 can protrude below the surrounding portions of the sole 8022 and therefore can take the brunt of impacts of the club head 8000 against the ground or other surfaces. Furthermore, because the bottom wall 8012 and outer rim 8034 of the adjustable sole portion 8010 are desirably made of thin-walled material to reduce weight, adding structural ribs is a weight-efficient means of increasing rigidity and durability.

The triangular embodiment of the adjustable sole portion 8010 shown in FIG. 72E includes three pairs of ribs 8044 extending from the circular wall 8040 radially outwardly toward the outer rim 8034. The ribs 8044 desirably are angularly spaced around the center wall 8040 in equal intervals. The ribs 8044 can be attached to the lower portion of the circular wall 8040 and taper in height as they extend outward along the upper/inner surface of the bottom wall 8012 toward the outer wall 8034. As shown, each rib can comprise first and second sections 8044*a,* 8044*b* that extent from a common apex at the circular wall 8040 to separate locations on the outer wall 8034. In alternative embodiments, a greater or fewer number of ribs 8044 can be used (i.e., greater or fewer than three ribs 8044).

Figure 71B:
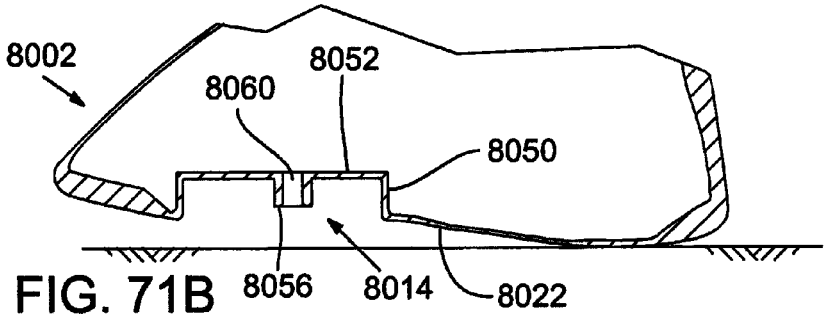
FIG. 71B is a cross-sectional view of the golf club head of FIG. 71A, taken along line G-G.
Figure 71A:
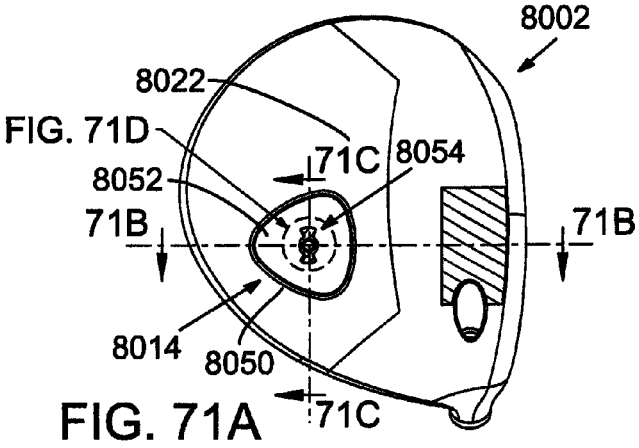
FIG. 71A is a bottom view of a body of the golf club head of FIG. 69A, showing a recessed cavity in the sole.
Figure 71D:
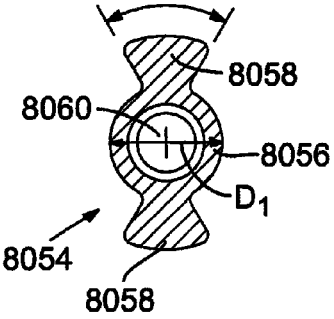
FIG. 71D is an enlarged cross-sectional view of a raised platform or projection formed in the sole of the club head of FIG. 71A.
Figure 71C:
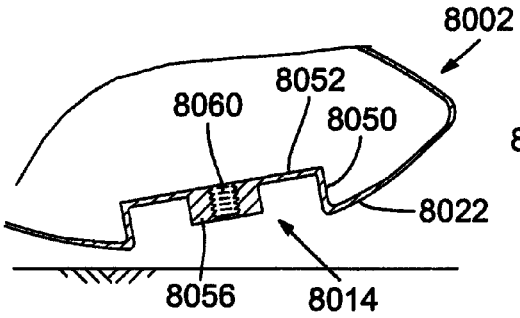
FIG. 71C is a cross-sectional view of the golf club head of FIG. 71A, taken along line E-E.

As shown in FIG. 71A-C, the recessed cavity 8014 in the sole 8022 of the body 8002 can be shaped to fittingly receive the adjustable sole portion 8010. The cavity 8014 can include a cavity side wall 8050, an upper surface 8052, and a raised platform, or projection, 8054 extending down from the upper surface 8052. The cavity wall 8050 can be substantially vertical to match the outer rim 8034 of the adjustable sole portion 8010 and can extend from the sole 8022 up to the upper surface 8052. The upper surface 8052 can be substantially flat and proportional in shape to the bottom wall 8012 of the adjustable sole portion 8010. As best shown in FIG. 70, the cavity side wall 8050 and upper surface 8052 can define a triangular void that is shaped to receive the sole portion 8010. In alternative embodiments, the cavity 8014 can be replaced with an outer triangular channel for receiving the outer rim 8034 and a separate inner cavity to receive the wall sections 8041. The cavity 8014 can have various other shapes, but desirably is shaped to correspond to the shape of the sole portion 8010. For example, if the sole portion 8010 is square, then the cavity 8014 desirably is square.

Figure 71E:
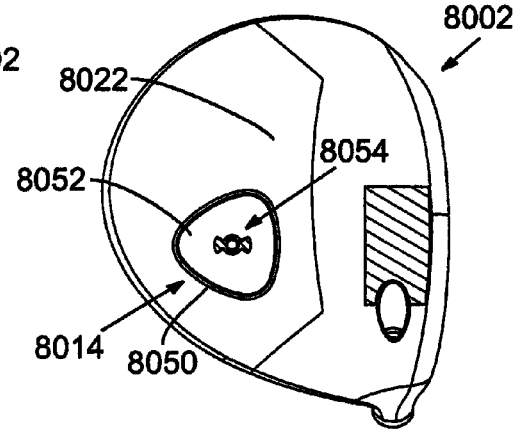
FIG. 71E is a bottom view of a body of the golf club head of FIG. 69A, showing an alternative orientation of the raised platform or projection.

As shown in FIG. 71A, the raised platform 8054 can be geometrically centered on the upper surface 8052. The platform 8054 can be bowtie-shaped and include a center post 8056 and two flared projections, or ears, 8058 extending from opposite sides of the center post, as shown in FIG. 71D. The platform 8054 can also be oriented in different rotational positions with respect to the club head body 8002. For example, FIG. 71E shows an embodiment wherein the platform 8054 is rotated 90-degrees compared to the embodiment shown in FIG. 71A. The platform can be more or less susceptible to cracking or other damage depending on the rotational position. In particular, durability tests have shown that the platform is less susceptible to cracking in the embodiment shown in FIG. 71E compared to the embodiment shown in FIG. 71A.

In other embodiments, the shape of the raised platform 8054 can be rectangular, wherein the center post and the projections collectively form a rectangular block. The projections 8058 can also have parallel sides rather than sides that flare out from the center post. The center post 8056 can include a threaded screw hole 8060 to receive a screw 8016 (see FIG. 73) for securing the sole portion 8010 to the club head. In some embodiments, the center post 8056 is cylindrical, as shown in FIG. 71D. The outer diameter D1 of a cylindrical center post 8056 (FIG. 71D) can be less than the inner diameter D2 of the circular wall 8040 of the adjustable sole portion 8010 (FIG. 72A), such that the center post can rest inside the circular wall when the adjustable sole portion 8010 is installed. In other embodiments, the center post 8056 can be triangular, square, hexagonal, or various other shapes to match the shape of the inner surface of the wall 8040 (e.g., if the inner surface of wall 8040 is non-cylindrical).

The projections 8058 can have a different height than the center post 8056, that is to say that the projections can extend downwardly from the cavity roof 8052 either farther than or not as far as the center post. In the embodiment shown in FIG. 70, the projections and the center post have the same height. FIG. 70 also depicts one pair of projections 8058 extending from opposite sides of the center post 8056. Other embodiments can include a set of three or more projections spaced apart around the center post. Because the embodiment shown in FIG. 70 incorporates a triangular shaped adjustable sole portion 8010 having three pairs of varying height wall sections 8041, the projections 8058 each occupy about one-sixth of the circumferential area around of the center post 8056. In other words, each projection 8058 spans a roughly 60-degree section (see FIG. 71D) to match the wall sections 8041 that also each span a roughly 60-degree section of the circular wall 8040 (see FIG. 72A). The projections 8058 do not need to be exactly the same circumferential width as the wall sections 8041 and can be slightly narrower that the width of the wall sections. The distance from the centerline axis of the screw hole 8060 to the outer edge of the projections 8058 can be at least as great as the inner radius of the circular wall 8040, and desirably is at least as great as the outer radius of the circular wall 8040 to provide a sufficient surface for the ends of the wall sections 8041 to seat upon when the adjustable sole portion 8010 is installed in the body 8002.

A releasable locking mechanism or retaining mechanism desirably is provided to lock or retain the sole portion 8010 in place on the club head at a selected rotational orientation of the sole portion. For example, at least one fastener can extend through the bottom wall 8012 of the adjustable sole portion 8010 and can attach to the recessed cavity 8014 to secure the adjustable sole portion to the body 8002. In the embodiment shown in FIG. 70, the locking mechanism comprises a screw 8016 that extends through the recessed screw hole 8030 in the adjustable sole portion 8010 and into a threaded opening 8060 in the recessed cavity 8014 in the sole 8022 of the body 8002. In other embodiments, more than one screw or another type of fastener can be used to lock the sole portion in place on the club head.

In the embodiment shown in FIG. 70, the adjustable sole portion 8010 can be installed into the recessed cavity 8014 by aligning the outer rim 8034 with the cavity wall 8050. As the outer rim 8034 telescopes inside of the cavity wall 8050, the center post 8056 can telescope inside of the circular wall 8040. The matching shapes of the outer rim 8034 and the cavity wall 8050 can align one of the three pairs of wall sections 8041 with the pair of projections 8058. As the adjustable sole portion 8010 continues to telescope into the recessed cavity 8014, one pair of wall sections 8041 will abut the pair of projections 8058, stopping the adjustable sole portion from telescoping any further into the recessed cavity. The cavity wall 8050 can be deep enough to allow the outer rim 8034 to freely telescope into the recessed cavity without abutting the cavity roof 8052, even when the shortest pair of wall sections 8041*a*, 8041*b* abuts the projections 8058. While the wall sections 8041 abut the projections 8058, the screw 8016 can be inserted and tightened as described above to secure the components in place. Even with only one screw in the center, as shown in FIG. 69D, the adjustable sole portion 8010 is prevented from rotating by its triangular shape and the snug fit with the similarly shaped cavity wall 8050.

Figure 69A:
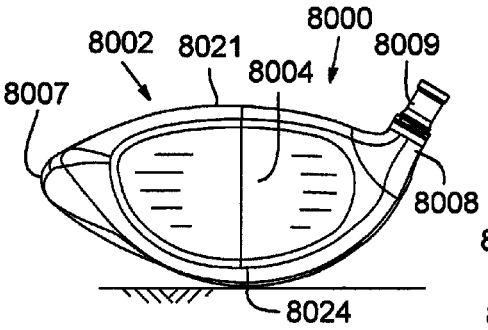
FIG. 69A is a front view of a golf club head, according to another embodiment.
Figure 69B:
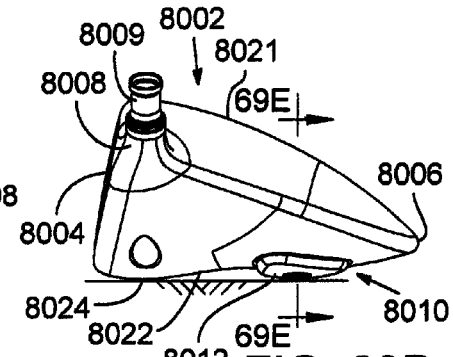
FIG. 69B is a side view of the golf club head of FIG. 69A.
Figure 69C:
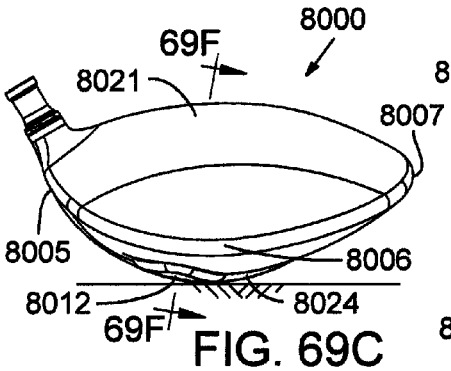
FIG. 69C is a rear view of the golf club head of FIG. 69A.

As best shown in FIG. 69C, the adjustable sole portion 8010 can have a bottom surface 8012 that is curved (see also FIG. 72B) to match the curvature of the leading surface portion 8024 of the sole 8022. In addition, the upper surface 8017 of the head of the screw 8016 can be curved (see FIG. 73B) to match the curvature of the bottom surface of the adjustable sole portion 8010 and the leading surface portion 8024 of the sole 8022.

In the illustrated embodiment, both the leading edge surface 8024 and the bottom surface 8012 of the adjustable sole portion 8010 are convex surfaces. In other embodiments, surfaces 8012 and 8024 are not necessarily curved surfaces but they desirably still have the same profile extending in the heel-to-toe direction. In this manner, if the club head 8000 deviates from the grounded address position (e.g., the club is held at a lower or flatter lie angle), the effective face angle of the club head does not change substantially, as further described below. The crown-to-face transition or top-line would stay relatively stable when viewed from the address position as the club is adjusted between the lie ranges described herein. Therefore, the golfer is better able to align the club with the desired direction of the target line.

Figure 69D:
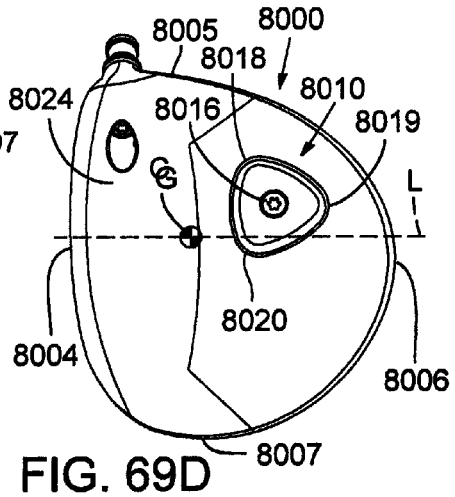
FIG. 69D is a bottom view of the golf club head of FIG. 69A.
Figure 69E:
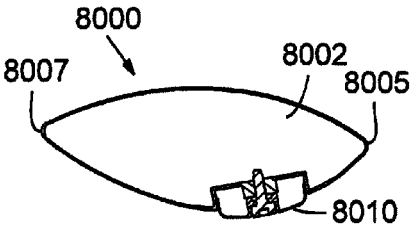
FIG. 69E is a cross-sectional view of the golf club head of FIG. 69B, taken along line A-A.
Figure 69F:
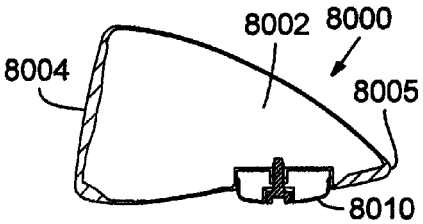
FIG. 69F is a cross-sectional view of the golf club head of FIG. 69C, taken along line H-H.

In the embodiment shown in FIG. 69D, the triangular sole portion 8010 has a first corner 8018 located toward the heel 8005 of the club head and a second corner 8020 located near the middle of the sole 8022. A third corner 8019 is located rearward of the screw 8016. In this manner, the adjustable sole portion 8010 can have a length (from corner 8018 to corner 8020) that extends heel-to-toe across the club head less than half the width of the club head at that location of the club head. The adjustable sole portion 8010 is desirably positioned substantially heelward of a line L (see FIG. 69D) that extends rearward from the center of the striking face 8004 such that a majority of the sole portion is located heelward of the line L. As noted above, studies have shown that most golfers address the ball with a lie angle between 10 and 20 degrees less than the intended scoreline lie angle of the club head (the lie angle when the club head is in the address position). The length, size, and position of the sole portion 8010 in the illustrated embodiment is selected to support the club head on the ground at the grounded address position or any lie angle between 0 and 20 degrees less than the lie angle at the grounded address position while minimizing the overall size of the sole portion (and therefore, the added mass to the club head). In alternative embodiments, the sole portion 8010 can have a length that is longer or shorter than that of the illustrated embodiment to support the club head at a greater or smaller range of lie angles. For example, in some embodiments, the sole portion 8010 can extend past the middle of the sole 8022 to support the club head at lie angles that are greater than the scoreline lie angle (the lie angle at the grounded address position). The adjustable sole portion 8010 is furthermore desirably positioned entirely rearward of the center of gravity (CG) of the golf club head, as shown in FIG. In some embodiments, the golf club head has an adjustable sole portion and a CG with a head origin x-axis (CGx) coordinate between about −10 mm and about 10 mm and a head origin y-axis (CGy) coordinate greater than about 10 mm or less than about 50 mm. In certain embodiments, the club head has a CG with an origin x-axis coordinate between about -5 mm and about 5 mm, an origin y-axis coordinate greater than about 0 mm and an origin z-axis (CGz) coordinate less than about 0 mm. In one embodiment, the CGz is less than 2 mm.

The CGy coordinate is located between the leading edge surface portion 8024 that contacts the ground surface and the point where the bottom wall 8012 of the adjustable sole portion 8010 contacts the ground surface (as measured along the head origin-y-axis).

The sole angle 2018 of the club head 8000 can be adjusted by changing the distance the adjustable sole portion 8010 extends from the bottom of the body 8002. Adjusting the adjustable sole portion 8010 downwardly increases the sole angle 2018 of the club head 8000 while adjusting the sole portion upwardly decreases the sole angle of the club head. This can be done by loosening or removing the screw 8016 and rotating the adjustable sole portion 8010 such that a different pair of wall sections 8041 aligns with the projections 8058, then re-tightening the screw. In a triangular embodiment, the adjustable sole portion 8010 can be rotated to three different discrete positions, with each position aligning a different height pair of wall sections 8041 with the projections 8058. In this manner, the sole portion 8010 can be adjusted to extend three different distances from the bottom of the body 8002, thus creating three different sole angle options.

In particular, the sole portion 8010 extends the shortest distance from the sole 8022 when the projections 8058 are aligned with wall sections 8041*a,* 8041*b;* the sole portion 8010 extends an intermediate distance when the projections are aligned with wall sections 8041*c,* 8041*d;* and the sole portion extends the farthest distance when the projections 8058 are aligned with wall sections 8041*e,* 8041*f.* Similarly, in an embodiment of the adjustable sole portion 8010 having a square shape, it is possible to have four different sole angle options.

In alternative embodiments, the adjustable sole portion 8010 can include more than or fewer than three pairs of wall sections 8041 that enable the adjustable sole portion to be adjusted to extend more than or fewer than three different discrete distances from the bottom of body 8002.

The sole portion 8010 can be adjusted to extend different distances from the bottom of the body 8002, as discussed above, which in turn causes a change in the face angle 30 of the club. In particular, adjusting the sole portion 8010 such that it extends the shortest distance from the bottom of the body 8002 (i.e. the projections 8058 are aligned with sections 8041*a* and 8041*b*) can result in an increased face angle 30 or open the face and adjusting the sole portion such that it extends the farthest distance from the bottom of the body (i.e. the projections are aligned with sections 8041*e* and 8041*f*) can result in a decreased face angle or close the face. In particular embodiments, adjusting the sole portion 8010 can change the face angle 30 of the golf club head 8000 about 0.5 to about 12 degrees. Also, as discussed above with respect to the embodiments shown in FIGS. 52-58, the hosel loft angle can also be adjusted to achieve various combinations of square loft, grounded loft, face angle and hosel loft. Additionally, hosel loft can be adjusted while maintaining a desired face angle by adjusting the sole angle accordingly.

It can be appreciated that the non-circular shape of the sole portion 8010 and the recessed cavity 8014 serves to help prevent rotation of the sole portion relative to the recessed cavity and defines the predetermined positions for the sole portion. However, the adjustable sole portion 8010 could have a circular shape (not shown). To prevent a circular outer rim 8034 from rotating within a cavity, one or more notches can be provided on the outer rim 8034 that interact with one or more tabs extending inward from the cavity side wall 8050, or vice versa. In such circular embodiments, the sole portion 8010 can include any number of pairs of wall sections 8041 having different heights. Sufficient notches on the outer rim 8034 can be provided to correspond to each of the different rotational positions that the wall sections 8041 allow for.

In other embodiments having a circular sole portion 8010, the sole portion can be rotated within a cavity in the club head to an infinite number of positions. In one such embodiment, the outer rim of the sole portion and the cavity side wall 8050 can be without notches and the circular wall 8040 can comprise one or more gradually inclining ramp-like wall sections (not shown). The ramp-like wall sections can allow the sole portion 8010 to gradually extend farther from the bottom of the body 8002 as the sole portion is gradually rotated in the direction of the incline such that projections 8058 contact gradually higher portions of the ramp-like wall sections. For example, two ramp-like wall sections, each extending about 180-degrees around the circular wall 8040, can be included, such that the shortest portion of each ramp-like wall section is adjacent to the tallest portion of the other wall section. In such an embodiment having an "analog" adjustability, the club head can rely on friction from the screw 8016 or other central fastener to prevent the sole portion 8010 from rotating within the recessed cavity 8014 once the position of the sole portion is set.

The adjustable sole portion 8010 can also be removed and replaced with an adjustable sole portion having shorter or taller wall sections 8041 to further add to the adjustability of the sole angle 2018 of the club 8000. For example, one triangular sole portion 8010 can include three different but relatively shorter pairs of wall sections 8014, while a second sole portion can include three different but relatively longer pairs of wall sections. In this manner, six different sole angles 2018 can be achieved using the two interchangeable triangular sole portions 8010. In particular embodiments, a set of a plurality of sole portions 8010 can be provided. Each sole portion 8010 is adapted to be used with a club head and has differently configured wall sections 8041 to achieve any number of different sole angles 2018 and/or face angles 30.

In particular embodiments, the combined mass of the screw 8016 and the adjustable sole portion 8010 is between about 2 and about 11 grams, and desirably between about 4.1 and about 4.9 grams. Furthermore, the recessed cavity 8014 and the projection 8054 can add about 1 to about 10 grams of additional mass to the sole 8022 compared to if the sole had a smooth, 0.6 mm thick, titanium wall in the place of the recessed cavity 8014. In total, the golf club head 8000 (including the sole portion 8010) can comprise about 3 to about 21 grams of additional mass compared to if the golf club head had a conventional sole having a smooth, 0.6 mm thick, titanium wall in the place of the recessed cavity 8014, the adjustable sole portion 8010, and the screw 8016.

In other particular embodiments, at least 50% of the crown 8021 of the club head body 8002 can have a thickness of less than about 0.7 mm.

In still other particular embodiments, the golf club body 8002 can define an interior cavity (not shown) and the golf club head 8000 can have a center of gravity with a head origin x-axis coordinate greater than about 2 mm and less than about 8 mm and a head origin y-axis coordinate greater than about 25 mm and less than about 40 mm, where a positive y-axis extends toward the interior cavity. In at least these embodiments, the golf club head 8000 center of gravity can have a head origin z-axis coordinate less than about 0 mm.

In other particular embodiments, the golf club head 8000 can have an moment of inertia about a head center of gravity x-axis generally parallel to an origin x-axis that can be between about 200 and about 500 kg·mm$^2$ and a moment of inertia about a head center of gravity z-axis generally perpendicular to ground, when the golf club head is ideally positioned, that can be between about 350 and about 600 kg·mm$^2$.

In certain embodiments, the golf club head 8000 can have a volume greater than about 400 cc and a mass less than about 220 grams. Table 12 below lists various properties of one particular embodiment of the golf club head 8000.

TABLE 12

| | | | |
|---|---|---|---|
| Address Area | 11369 mm$^2$ | Bulge Radius | 304.8 mm |
| CGX | 5.6 mm | Roll Radius | 304.8 mm |
| CGZ | −3.2 mm | Face Height | 62.8 mm |
| ZUp | 30.8 mm | Face Width | 88.9 mm |
| Ixx (axis heel/toe) | 363 kg · mm$^2$ | Face Area 0.5 mm offset method | 4514 mm$^2$ |
| Iyy (axis front/back) | 326 kg · mm$^2$ | Head Height | 68.8 mm |
| Izz (axis normal to grnd) | 550 kg · mm$^2$ | Head Length | 119.1 mm |
| Square Loft | 10° | Body Density | 4.5 g/cc |
| Lie | 59° | Mass | 215.8 g |
| Face Angle | 3° | Volume | 438 cc |

Internal Ribs

FIGS. 74-89 show an exemplary golf club head having an adjustable sole piece, like that shown in FIGS. 69-73, and a plurality of ribs positioned on the inner surface of the sole. The ribs can reinforce and stabilize the sole, especially the area of the sole where the external adjustable sole piece is attached, and can improve the sound the club makes when striking a golf ball.

The addition of a recessed sole port and an attached adjustable sole piece can undesirably change the sound the club makes during impact with a ball. For example, compared to a similar club without an adjustable sole piece, the addition of the sole piece can cause lower sound frequencies, such as first mode sound frequencies below 3,000 Hz and/or below 2,000 Hz, and a longer sound duration, such as 0.09 seconds or longer. The lower and long sound frequencies can be distracting to golfers. The ribs on the internal surface of the sole can be oriented in several different directions and can tie the sole port to other strong structures of the club head body, such as weight ports at the sole and heel of the body and/or the skirt region between the sole and the crown. One or more ribs can also be tied to the hosel to further stabilize the sole. With the addition of such ribs on the internal surface of the sole, the club head can produce higher sound frequencies when striking a golf ball on the face, such as above 2,500 Hz, above 3,000 Hz, and/or above 3,500 Hz, and with a shorter sound duration, such as less than 0.05 seconds, which can be more desirable for a golfer. In addition, with the described ribs, the sole can have a frequency, such as a natural frequency, of a first fundamental sole mode that is greater than 2,500 Hz and/or greater than 3,000 Hz, wherein the sole mode is a vibration frequency associated with a location on the sole. Typically, this location is the location on the sole that exhibits a largest degree of deflection resulting from striking a golf ball.

As shown in FIGS. 74-89, exemplary golf club heads described herein can include an adjustable sole piece and internal sole ribs. Such exemplary golf club heads can also include adjustable weights at the toe and/or heel of the body, an adjustable shaft attachment system, a variable thickness face plate, thin wall body construction, and/or any other club head features described herein. While this description proceeds with respect to the particular embodiment shown in FIGS. 74-90, this embodiment is only exemplary and should not be considered as a limitation on the scope of the underlying concepts. For example, although the illustrated example includes many described features, alternative embodiments can include various subsets of these features and/or additional features.

Figure 74:
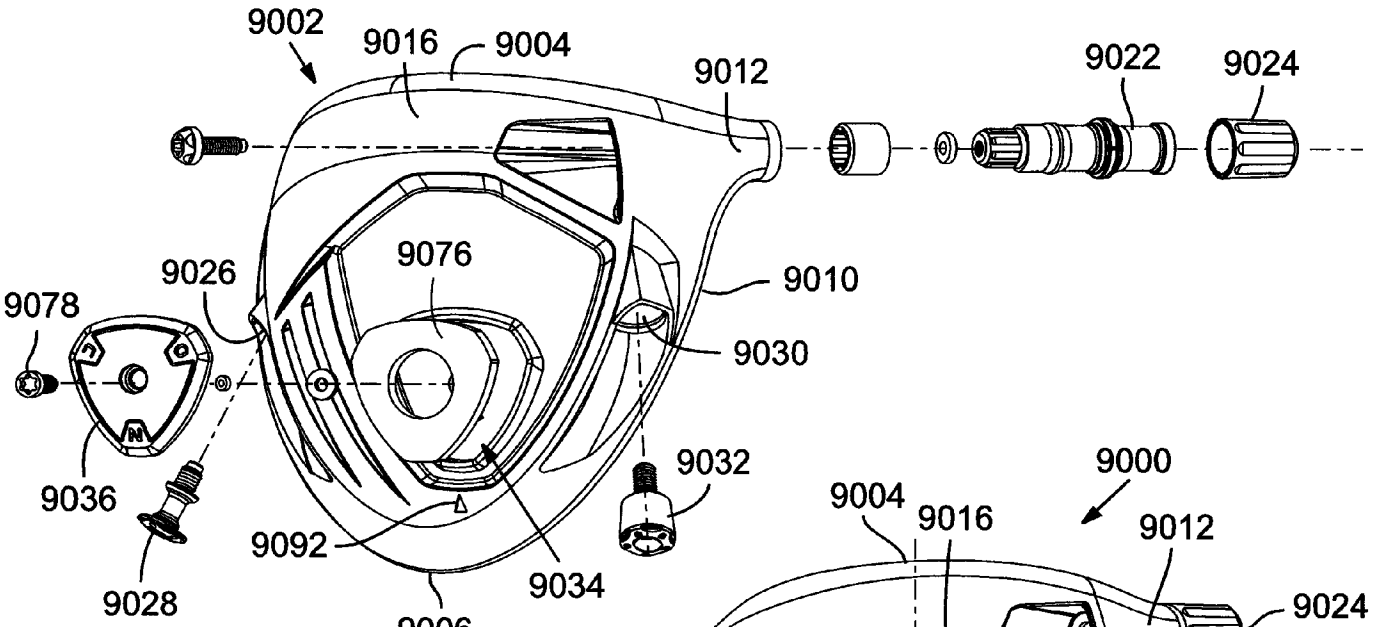
FIG. 74 is an exploded view of a golf club head, according to yet another embodiment.
Figure 75:
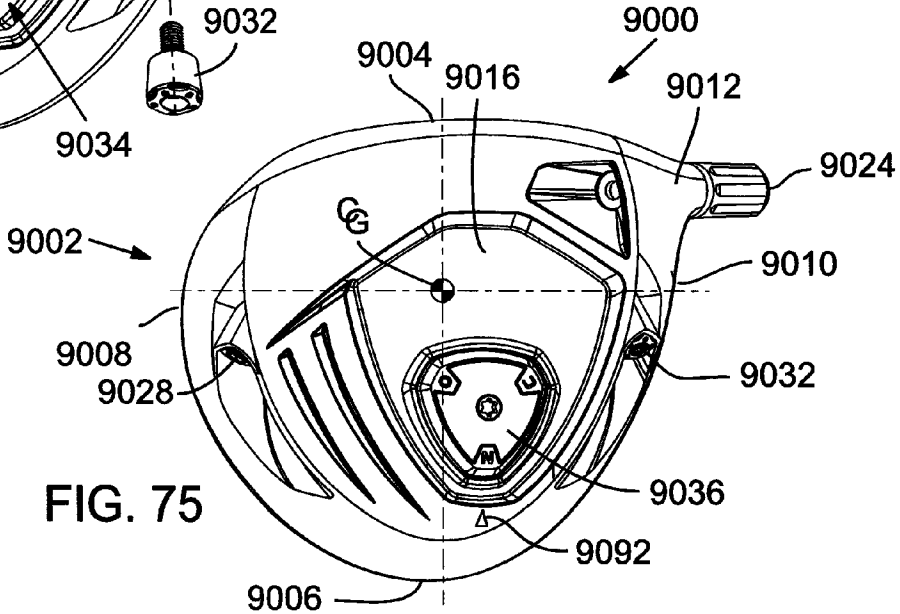
FIG. 75 is an assembled view of the golf club head of FIG. 74.
Figure 76:
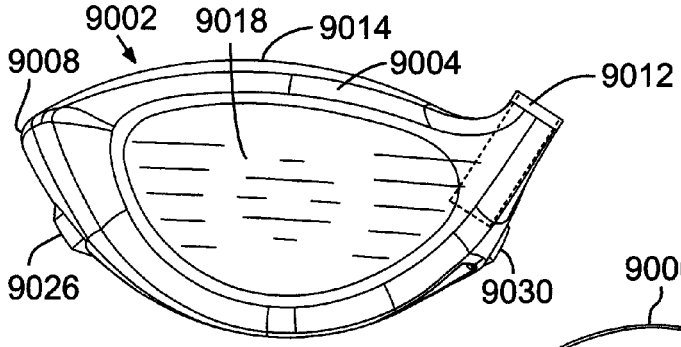
FIGS. 76-80 are front, top, heel side, toe side, and bottom views, respectively, of a body of the club head of FIG. 74.
Figure 77:
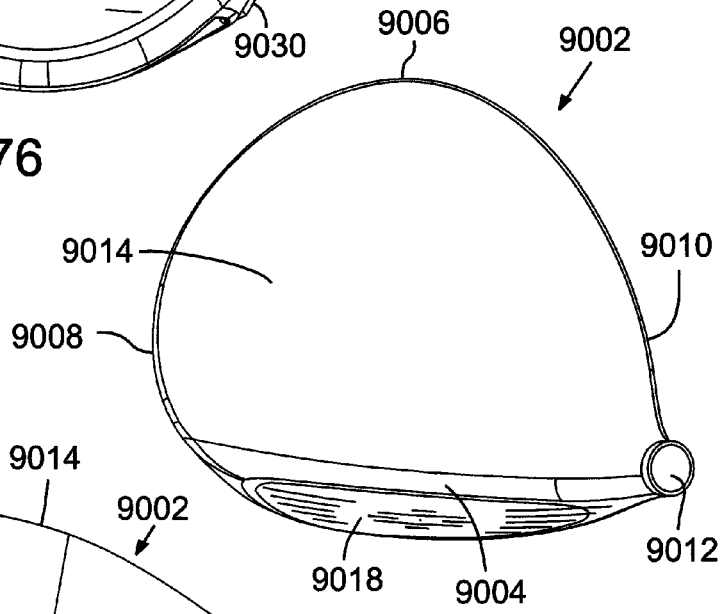
Figure 78:
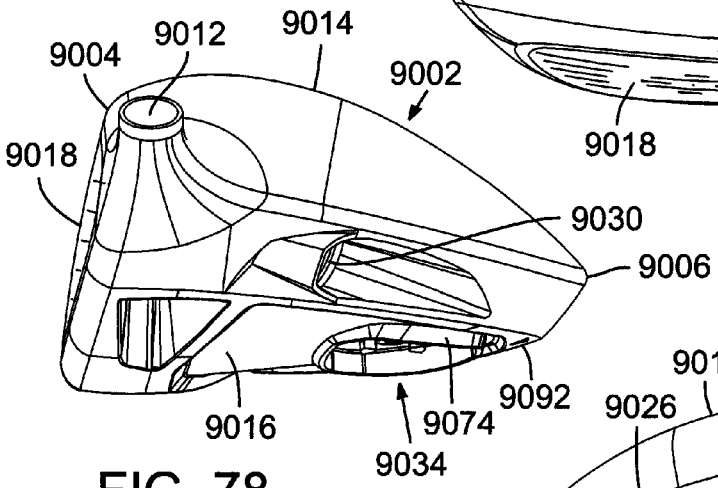
Figure 79:
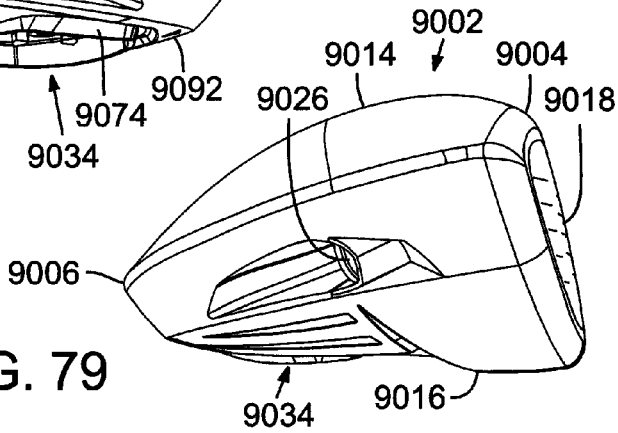

FIG. 74 shows an exploded view of an exemplary golf club head 9000, and FIG. 75 shows the head assembled. The head 9000 comprises a hollow body 9002, as shown in various views in FIGS. 76-80. The body 9002 (and thus the whole club head 9000) includes a front portion 9004, a rear portion 9006, a toe portion 9008, a heel portion 9010, a hosel 9012, a crown 9014 and a sole 9016. The front portion 9004 forms an opening that receives a face plate 9018, which can be a variable thickness, composite and/or metal face plate, as described above. The illustrated club head 9000 can also comprise an adjustable shaft connection system 9020 for coupling a shaft to the hosel 9012, the system including various components, such as a sleeve 9022 and a ferrule 9024 (more detail regarding the hosel and the adjustable shaft connection system can be found, for example, in U.S. Pat. No. 7,887,431 and U.S. patent application Ser. Nos. 13/077,825, 12/986,030, 12,687,003, 12/474,973, which are incorporated herein by reference in their entirety). The shaft connection system 9020, in conjunction with the hosel 9012, can be used to adjust the orientation of the club head 9000 with respect to the shaft, as described in detail above.

The illustrated club head 9000 also comprises an adjustable toe weight 9028 at a toe weight port 9026, an adjustable heel weight 9032 at a heel weight port 9030, and an adjustable sole piece 9036 at a sole port, or pocket, 9034, as described in detail above.

Figure 81:
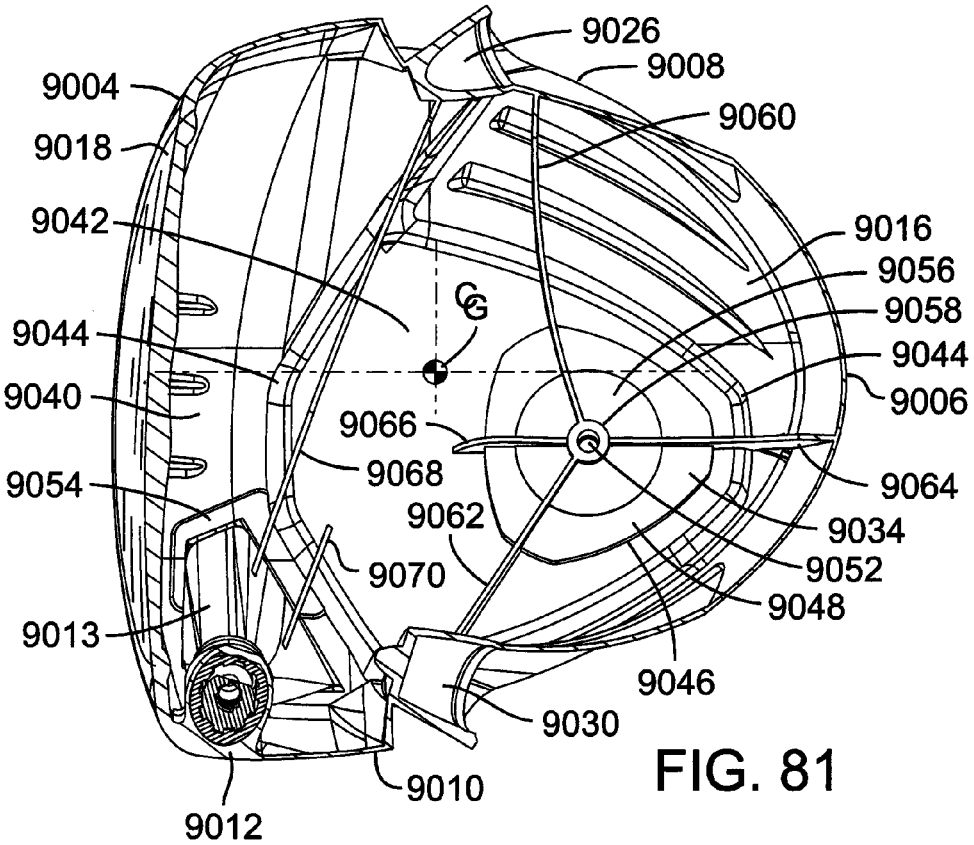
FIG. 81 is a top-down cross-sectional view of the body of FIG. 74 showing the internal features of the sole.

FIGS. 81-88 are cross-sectional views of the body 9002 that show internal features of the body, including a plurality of ribs on the internal surfaces of the sole 9016. FIG. 81 shows a top-down view of a bottom portion of the body 9002 with top half cut-away. The sole 9016 can include multiple regions at different recessed depths that are separated by one or more sloped transition zones. In the illustrated example, the sole includes a primary sole region 9040 extending around the periphery of the sole; a recessed sole region 9042 within the primary sole region; a transition zone 9044 that forms transitions between the primary sole region and the recessed sole region; and a sole port 9034 that is recessed further within the recessed sole region 9042.

Figure 80:
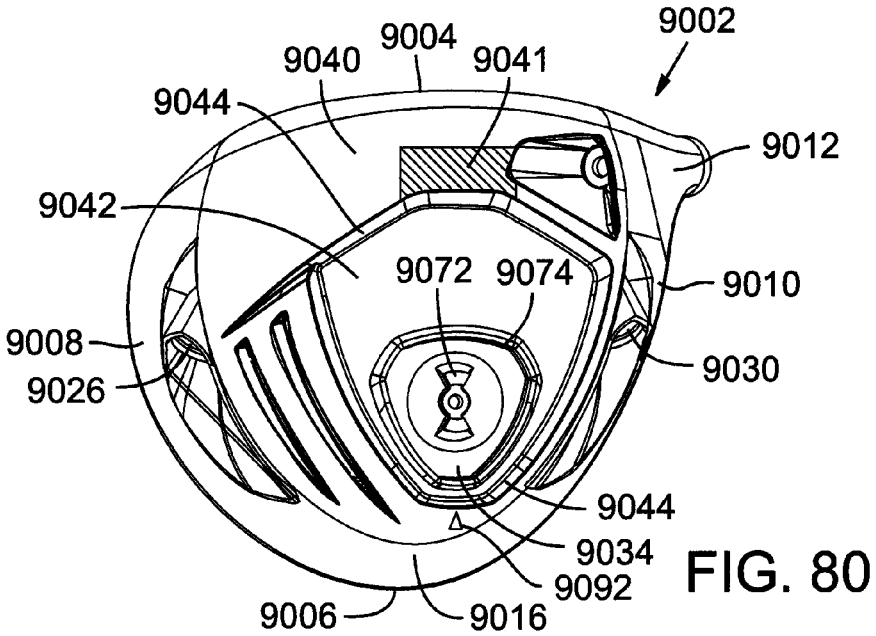
Figure 84:
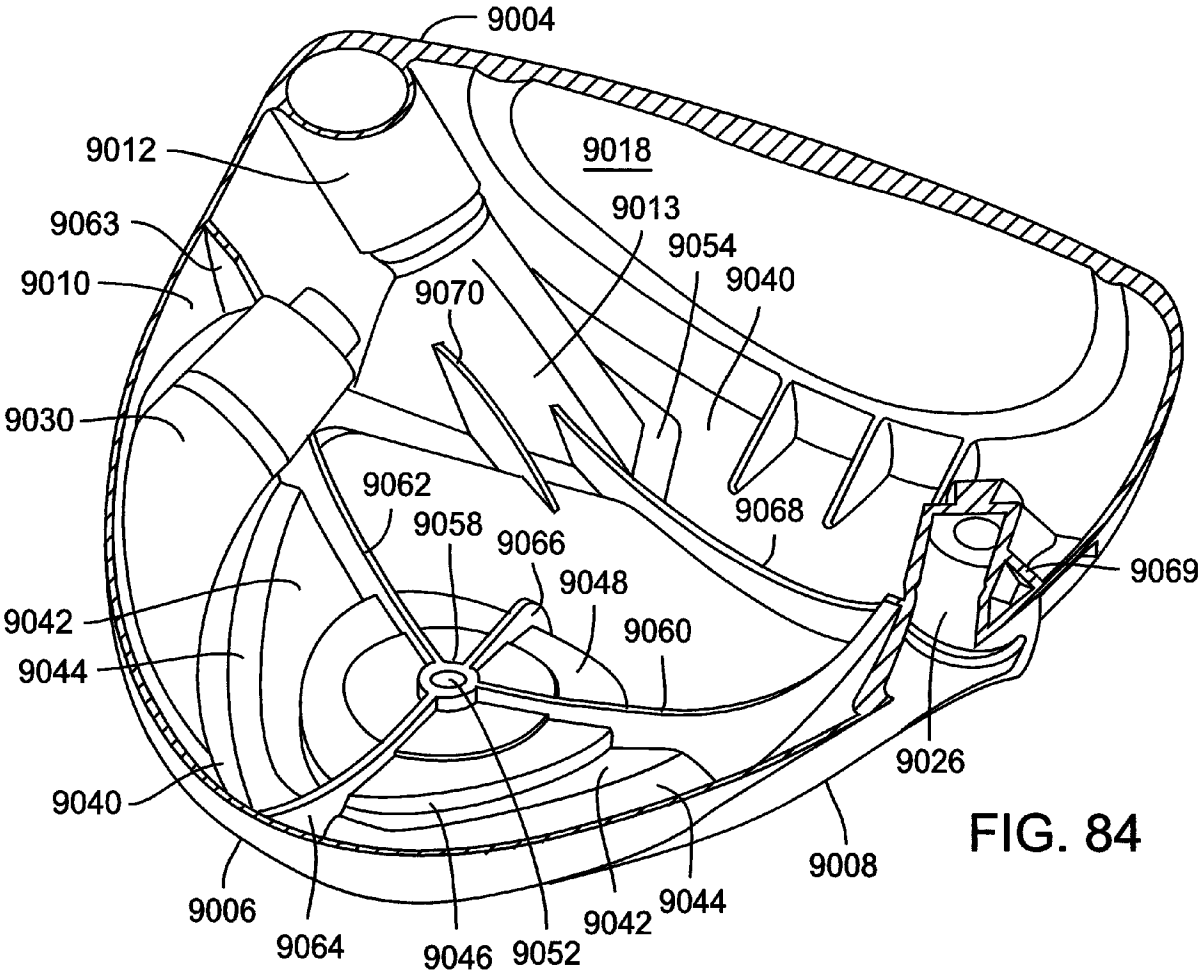
FIGS. 84-86 are cross-sectional perspective views of the body of FIG. 74 showing the internal features of the body.

As shown in FIGS. 80 and 81, the primary sole region includes the portion of the sole 9016 that surrounds the transition zone 9044 and which extends from the toe portion 9008 to the heel portion 9010 and from the front portion 9004 to the rear portion 9006. The thickness of the primary sole region can vary across the sole, with the thickness adjacent the front of the body being greater (such as about 1.0 mm to about 1.25 mm) and the thickness adjacent the rear of the body being lesser (such as about 0.5 mm to about 0.75 mm). The thicker front portion of the primary sole region 9040 can include a contact zone 9041, as shown in FIG. 80 in cross-hatching, that contacts the ground when the club head 9000 is in the address position. The contact zone 9041, along with the adjustable sole piece 9036, can be the only two portions of the club head that contact the ground when in the address position. The primary sole region 9040 can also include a hosel perimeter region 9054, as shown in FIGS. 81 and 84, at a boundary with a flared, lower portion of the hosel, or hosel base portion, 9013. The hosel perimeter region 9054 can have a thickness from about 1.1 mm to about 1.5 mm.

The transition zone 9044 can extend around the recessed sole region 9042 and can define the boundary between the primary sole region 9040 and the recessed sole region 9042. The transition zone 9044 can comprise a sloped, annular wall that creates a sharp elevation change between the lower primary sole region and the raised recessed sole region. The thickness of the sole 9016 can also change across the transition zone 9044.

The recessed sole region 9042 is the portion of the sole inside the transition zone 9044 and outside of the sole port 9034. The recessed sole region can have a thickness of about 0.55 mm to about 0.85 mm and can be recessed from about 2 mm to about 6 mm above the surrounding primary sole region 9040.

Figure 88:
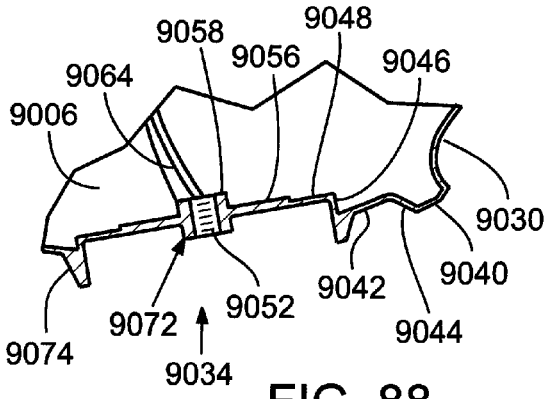
FIG. 88 is a cross-sectional side view of the sole port of FIG. 85A, taken along a toe-heel plane.

The sole port 9034 is positioned within the recessed sole region 9042 and forms a cavity that is recessed to a greater extent than the surrounding recessed sole region 9042. The sole port 9034 can include an annular side wall 9046 and an upper wall 9048. The side wall 9046 and the upper wall 9048 can have a thickness of about 0.55 mm to about 0.85 mm, such as about 0.7 mm. As shown in FIG. 88, the upper wall 9048 can include a central disk shaped region 9056 that is thicker and raised slightly higher than the surrounding portion of the upper wall. The central region 9056 can have a diameter of about 22 mm a thickness of about 1.0 mm to about 1.35 mm. The sole pocket can also include a cylindrical wall 9058 extending upwardly from the center of the disk shaped region 9056. The cylindrical wall can have an outside diameter of about 5 mm to about 10 mm, a wall thickness of about 1 mm to about 2 mm, and a vertical height of about 1 mm to about 3 mm above the disk shaped region 9056. The cylindrical wall 9058 surrounds an aperture 9052 that extends through the sole port 9034 and is configured to receive a fastener 9078 for securing the adjustable sole piece 9036 to the external surface of the sole port. The aperture 9052 can define a central axis about which the sole port 9034 and the sole piece 9034 are substantially symmetrical. The axial length of the aperture 9052 can be about 5 mm and the diameter of the aperture can be about 3 mm.

As shown in FIG. 75, the CG of the golf club head 9000 can divide the club head into four quadrants, a front-heel quadrant that is frontward and heelward of the CG, a front-toe quadrant that is frontward and toeward of the CG, a rear-heel quadrant that is rearward and heelward of the CG, and a rear-toe quadrant that is rearward and toeward of the CG. The center of the sole port 9034, e.g., the aperture 9052, can be positioned heelward and rearward of the CG (as shown in FIG. 75), or in other words, in the rear-heel quadrant of the club head. As such, a majority of the sole piece 9036 and a majority of the sole port 9034 can be positioned in the rear-heal quadrant of the club head, but a portion of the sole piece and/or a portion of the sole port can also be in the rear-toe quadrant of the club head. In some embodiments, all of the sole piece and all of the sole port can be rearward of the CG.

With the aperture 9052 is located in a rear-heel quadrant, at least two ribs can converge at a convergence location near the aperture 9052. In some embodiments, at least three ribs or at least four ribs converge at a convergence location located in the rear-heel quadrant of the club head. It is understood that the number of ribs that converge in the rear-heel quadrant can be between two and ten ribs in total.

One or more ribs are disposed on the internal surface of the sole 9016. The ribs can be part of the same material that forms the sole 9016 and/or the rest of the body, such a metal or metal alloy, as describe above in detail. The ribs can be formed as an integral part of the sole, such as by casting, such that the ribs and the sole are of the same monolithic structure. The bottom of the ribs can be integrally connected to sole without the need for welding or other attachment methods. In other embodiments, one or more of the ribs can be formed at least partially separate from the sole and then attached to the sole, such as by welding.

As shown in FIGS. 81-86, the ribs can comprise a first rib 9060 extending from the toe portion 9008 in a rearward and heelward direction, a second rib 9062 extending from the heel portion 9010 in a rearward and heelward direction, and a third rib 9064 extending from the rear portion 9006 in a frontward direction. The first, second and third ribs converge at a convergence location. The convergence location can be positioned within a convergence zone. The convergence zone can be the region of the sole that corresponds to the sole port 9034. Thus, the first, second and third ribs 9060, 9062, 9064 can converge at a location directly above the sole port 9034, such as at the cylindrical wall 9058 and/or at the aperture 9052.

The first rib 9060 can extend between the toe weight port 9026 and the cylindrical wall 9058, the second rib 9062 can extend between the heel weight port 9030 and the cylindrical wall, and the third rib 9064 can extend between the rear portion 9006 and the cylindrical wall. The ribs can also include a fourth rib 9066 that extends from the cylindrical wall 9058 in a frontward direction. The fourth rib 9066 can terminate at a forward end along the recessed sole region 9042. All four of these ribs can extend from the cylindrical wall 9058, across upper wall 9048 and the side wall 9046 of the sole port 9034, and along the recessed sole region 9042. The first, second and third ribs, 9060, 9062, 9064, respectively, can extend further across the recessed sole region 9042, across the transition zone 9044, and across the primary sole region 9040. Positioning ribs along the upper, internal surfaces of the sole port 9034 can stabilize the sole port region of the body and endow the sole with vibration and sound characteristic that are similar to that of a smooth sole that does not include an adjustable sole. Connecting multiple ribs together above the sole port, such as with the cylindrical wall, can further enhance the stabilization of the sole port region.

The first rib 9060 can extend across the both the rear-heel quadrant and the rear-toe quadrant of the club head, as shown in FIG. 81. The second rib 9062 and/or the fourth rib 9066 can extend across both the rear-heel quadrant and a front-heel quadrant of the club head, depending on the exact location of the CG, which can change relative to the ribs as the adjustable weights 9028 and 9032 are adjusted. A fifth rib 9068 can extend across both the front-heel quadrant and the front-toe quadrant of the club head, and can also extend into the rear-toe quadrant depending on the exact location of the CG. The ribs as a group can extend across all four of the quadrants and can therefore better stabilize the entire sole of the club head.

Figure 82:
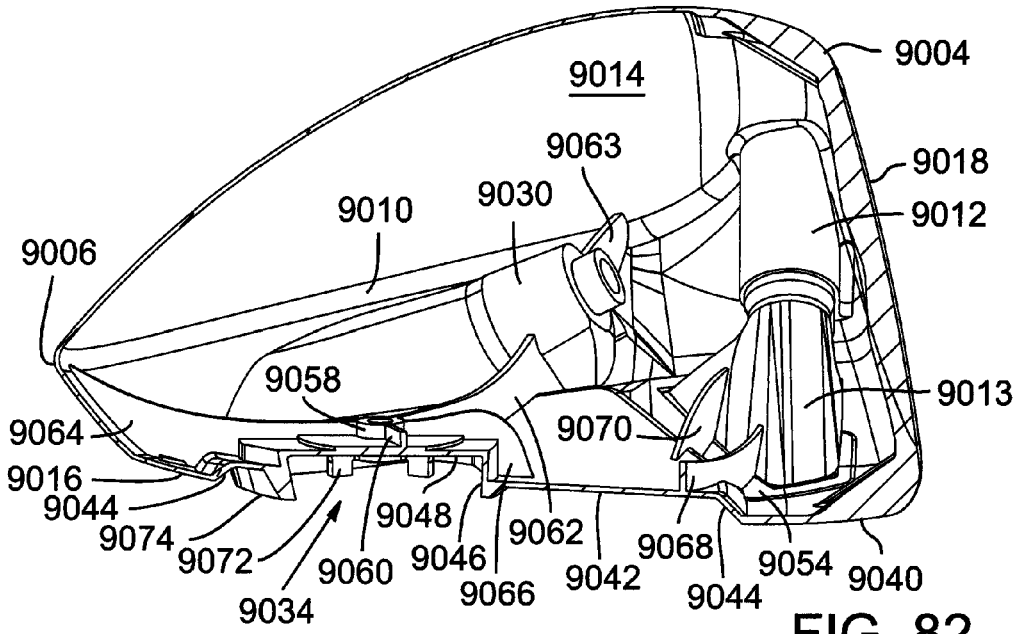
FIG. 82 is a cross-sectional side view of the body of FIG. 74 showing the internal features of the heel portion of the body.
Figure 83:
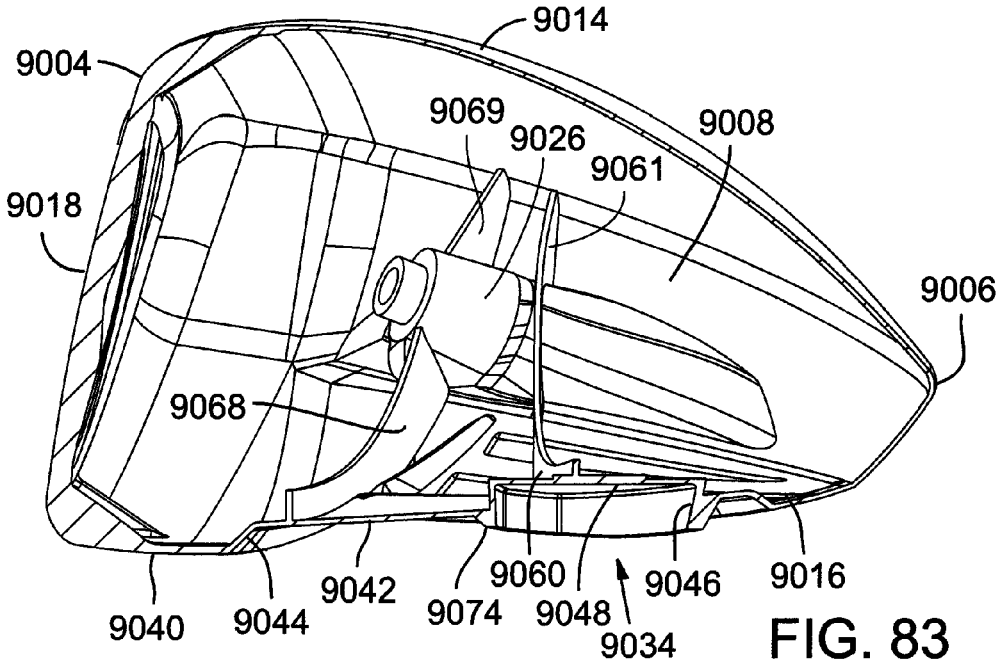
FIG. 83 is a cross-sectional side view of the body of FIG. 74 showing the internal features of the toe portion of the body.

As shown in FIG. 83, the first rib 9060 can extend over the toe weight port 9026 and terminate in the toe portion 9008 adjacent the crown 9014. In other embodiments, the first rib can terminate at the toe weight port 9026 and an additional rib section 9061 can extend from the opposite side of the toe weight port to the crown 9014. As shown in FIG. 82, the second rib 9062 can terminate at the heel weight port 9030 and an additional rib section 9063 can extend from the opposite side of the heel weight port to the crown 9014. Extending one or more of the ribs all the way to the crown perimeter can further enhance the stabilization effects of the ribs on the sole.

Figure 85:
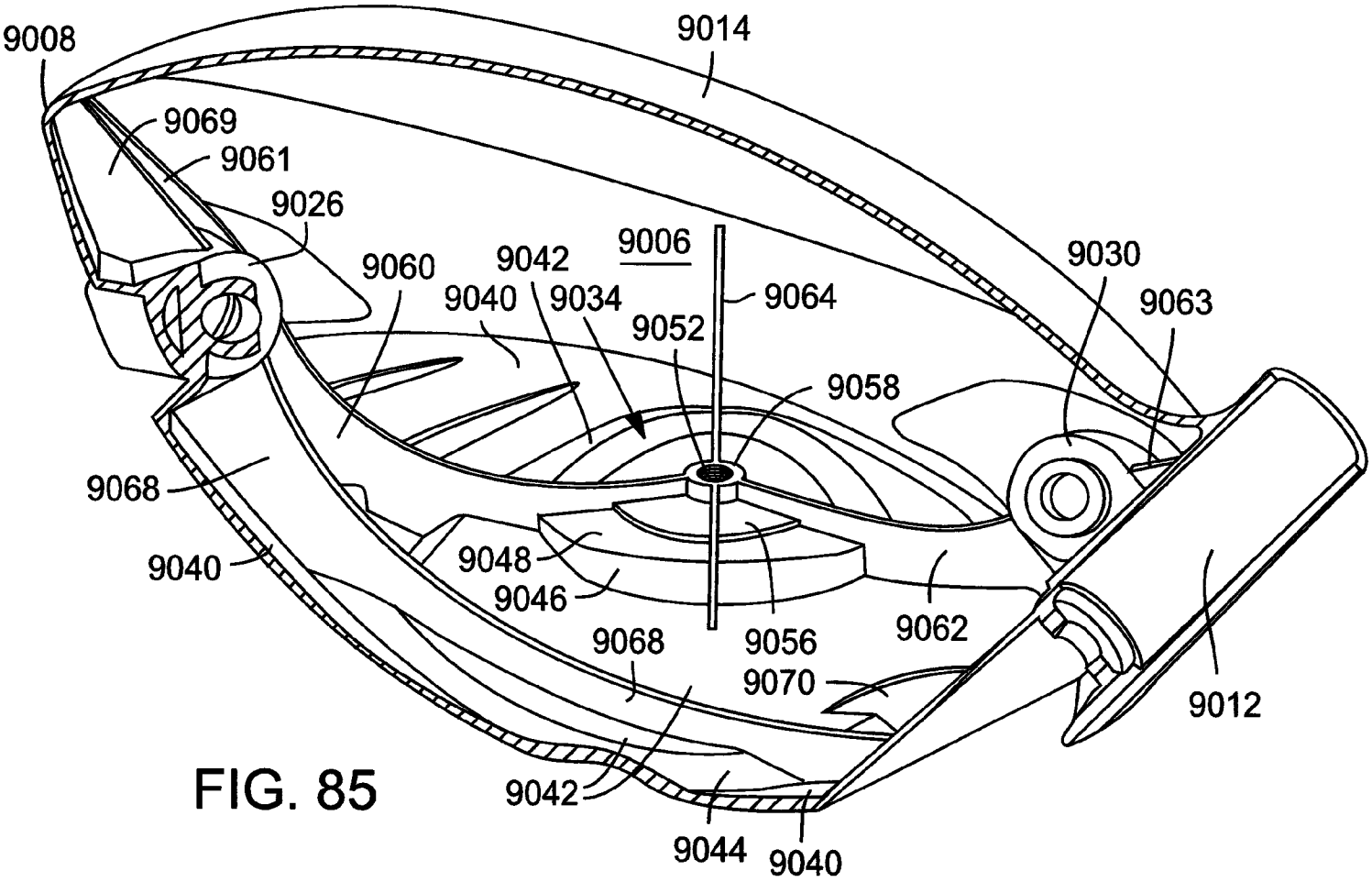
Figure 86:
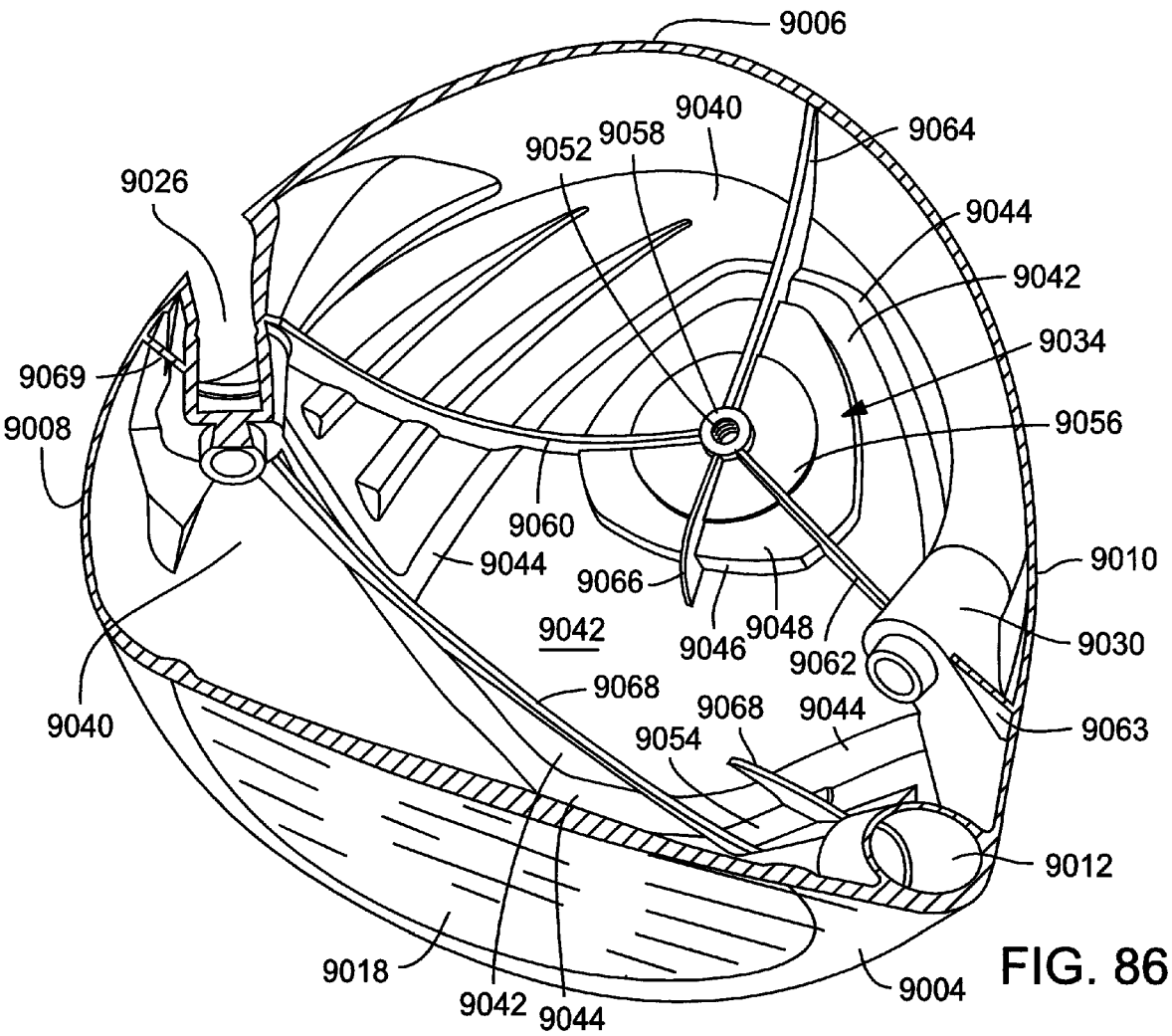

The ribs can further comprise the fifth rib 9068 and/or a sixth rib 9070, as shown in FIGS. 81-86. The fifth rib 9068 can extend along the sole 9016 between the hosel 9012 and the toe weight port 9026. As shown in FIG. 81, the fifth rib 9068 has a first end portion that is connected to the hosel base portion 9013 and a second end portion that is connected to the toe weight port 9026. As shown in FIGS. 81 and 86, the fifth rib 9068 can extend from the hosel 9012, across a first portion of the primary sole region 9040, such as the hosel perimeter region 9054, across a first portion of the sole transition zone 9048, across a portion of the recessed sole region 9042, across a second portion of the sole transition zone 9048, across a second portion of the primary sole region 9040, and to the toe weight port 9026. As shown in FIGS. 83 and 85, the fifth rib 9068 can terminate at the toe weight port 9026 and an additional rib section 9069 can extend from the opposite side of the toe weight port to the crown 9014.

The sixth rib 9070 can be shorter that the fifth rib 9068 and can extend from the hosel base portion 9013, across the hosel perimeter region 9054, across the sole transition zone 9044, and can terminate along the recessed sole region 9070 at a location rearward of the fifth rib 9068. The first, second, third, fourth, fifth and sixth ribs, 9060, 9062, 9064, 9066, 9068, 9070, respectively, are hereinafter collectively referred to as "the ribs" unless otherwise specified.

As shown in FIGS. 84-86, each of the ribs can have a smooth, curved upper surface and can have height dimensions (distances from the sole 9016 to the upper surface) that vary as the ribs extend laterally along the sole and across the various contours in the sole. For example, the first, second, third and fourth ribs can have smaller height dimensions (such as about 1 mm to about 3 mm) at locations above the upper wall 9048 of the sole port 9034 adjacent the cylindrical wall 9058, larger height dimensions (such as about 3 mm to about 6 mm) at locations above the recessed sole region 9042, and even larger height dimensions (such as up to about 12 mm) at locations above the primary sole region 9040. The height of these ribs can decrease as the ribs curve upward toward the perimeter of the body.

The fifth rib 9068 can have a variable height that is larger (such as about 3 mm to about 12 mm) adjacent the hosel 9012 and adjacent the toe weight port 9026 and smaller (such as about 2 mm to about 5 mm) where the fifth rib crosses the recess sole region 9042. The fifth rib 9068 can decrease in height as it crosses over the sole transition zone 9044 at a first location nearer to the hosel from the hosel perimeter region 9054 to the recessed sole region 9042, and the fifth rib 9068 can increase in height as the it crosses the sole transition zone 9044 at a second location nearer to the toe from the recessed sole region 9042 to the primary sole region 9040. The sixth rib 9070 can similarly have a greater height above the hosel perimeter region 9054 and a relatively smaller height above the recessed sole region 9042. The increased height of the ribs adjacent their more rigid connection locations at the respective perimeter portions of the club head can provide the ribs with greater rigidity and/or moment resistance at those perimeter locations. In addition, the connection of ribs to relatively more rigid structures of the body 9002, such as the hosel 9012, the toe weight port 9026, the heel weight port 9030 and the cylindrical wall 9058 can also provide a more rigidity and/or moment resistance to the ribs. The increased rigidity and/or moment resistance of the ribs can provide a more optimal influence on the vibration and sound characteristics of the club head 9000 when striking a golf ball. In some embodiments, the ribs are configured to cause the club head 9000 to emit a sound frequency, when striking a golf ball, that corresponds to a sound frequency that would be emitted by the club head if the sole port 9034, the ribs, the sole piece 9036 and the sole piece fastener 9078 were removed and replaced with a smooth sole portion.

One or more of the ribs can have a width dimension that is constant or nearly constant along the entire length of the rib. In some embodiments, such as the illustrated embodiment, each of the ribs has the same, constant width, such as about 0.8 mm, or greater than 0.5 mm and less than about 1.5 mm. In one embodiment, the rib has a width of about 0.7 mm. In other embodiments, different ribs can have different widths. In some embodiments, the width of one or more of the ribs can vary along the length of the rib, such as being wider nearer to the rib end portions and narrower at an intermediate portion. In general, the width of the ribs is less than the height of the ribs.

One or more of the ribs can form a straight line when projected onto a plane parallel with the ground, when the club head 9000 is in the address position. In other words, one or more of the ribs can extend along a two-dimensional path between its end points. For example, from the top-down perspective shown in FIG. 81, the second, third, fourth, fifth and sixth ribs 9062, 9064, 9066, 9068, 9070 extend in straight paths while the first rib 9060 extends in a slightly curved path. In other embodiments, all six ribs can extend in a straight path. The third rib 9064 and the fourth rib 9066 can extend in co-linear paths on opposite sides of the cylindrical wall 9058 and the fifth rib 9068 and the sixth rib 9070 can extend in parallel linear paths, as shown in FIG. 81. In some embodiments, the ribs can extend in at least four, at least five, or at least six different directions across the sole, as viewed from above. For example, as illustrated, the six ribs extend in four different directions, with the third rib 9064 and the fourth rib 9066 extending in the same direction and the fifth rib 9068 and the sixth rib 9070 extending in the same direction. The direction of each of the ribs can help stabilize the sole 9016 in that direction. Thus, having ribs in multiple directions desirably helps to stabilize the sole in multiple directions.

It should be noted that the internal sole ribs described herein are not raised portions of the sole that correspond to recessed grooves in the external surface of sole. Instead, the ribs described herein comprise additional structural material that is positioned above the internal surface of sole. In other words, if the ribs were removed, a smooth internal sole surface would remain.

Figure 87A:
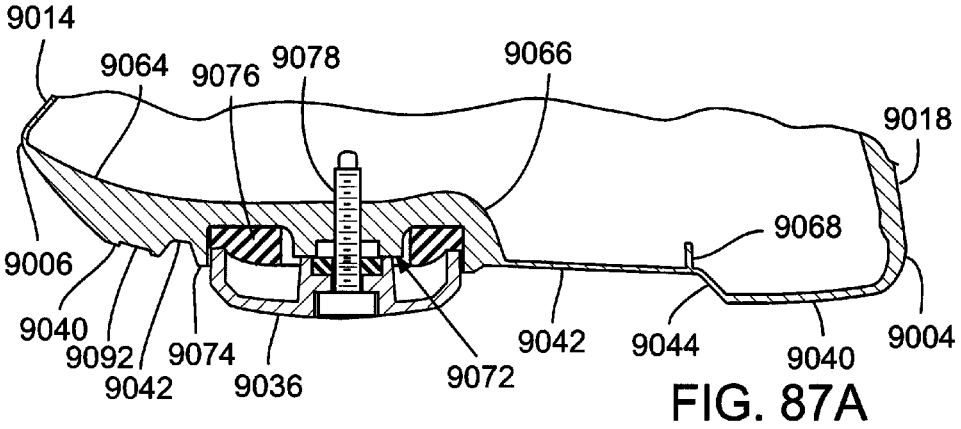
FIGS. 87A and B are cross-sectional side views of the sole of the body of FIG. 74, taken along a front-rear plane, showing an exemplary adjustable sole piece secured to a sole port with a fastener.
Figure 87B:
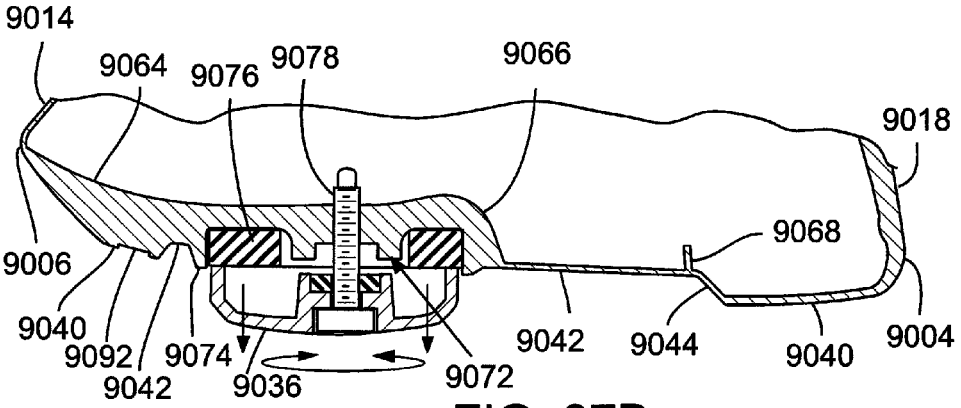
Figure 89:
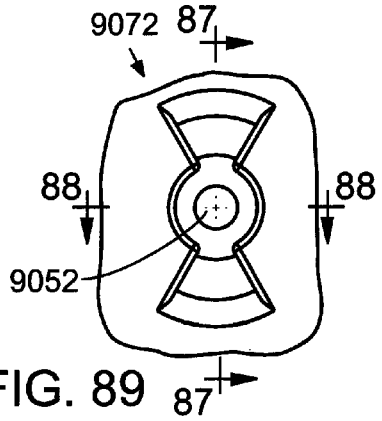
FIG. 89 is a bottom plan view of a raised platform of the sole port of FIG. 85A.

The external surface of the sole port 9034 can be configured to fittingly receive the adjustable sole portion 9036, as described above in detail with respect to FIGS. 71A-E. As shown in FIGS. 80 and 89, the sole port 9034 can include a raised platform 9072 that includes at least two projections that mate with surfaces on the adjustable sole piece 9036 that are configured to receive the at least two projections to determine the axial position of the sole piece with respect to the sole port 9034. A ridge 9074 can extend around the sole port 9034 on the external surface of the sole. When the sole piece 9036 is secured within the sole port 9034, as shown in FIG. 87A, the ridge 9074 can form a sloped transition region between the recessed sole region 9042 and the downwardly projecting outer surface of the sole piece. Also shown in FIG. 87A is a resiliently deformable gasket 9076 that is inserted into the sole port 9034 around the raised platform 9072 that helps form a seal between the annular side wall of the sole piece and the upper wall of the sole port, such as to keep dirt or moisture from entering the hollow area within the sole piece, and helps reduce or prevent movement, such as rattling and vibrations, between the sole piece and sole port. In addition, the deformable gasket 9076 reduces the duration and amplitude of the mode shape associated with the sole piece which can improve the sound quality of the club head upon impact. As shown in FIGS. 87A and B, the deformable nature of the gasket 9076 keep a seal between the sole piece and the sole port throughout a range and axial and rotational positions of the sole piece. FIGS. 87A and B also show a fastener 9078 passing through the sole piece and the aperture 9052 in the upper wall of the sole piece.

FIG. 88 shows a cross-sectional view of the sole port 9034 as viewed from the front of the body and cutting through the aperture 9052. This view shows the cylindrical wall 9058 surrounding the aperture 9052 as well as the ridge 9074 surrounding the sole port 9034.

FIGS. 90A-F show an alternative embodiment of the adjustable sole piece 9080 that has a generally pentagonal configuration. The pentagonal sole piece 9080 is similar to the triangular sole piece 8010 shown in FIGS. 72A-E and the triangular sole piece 9036 shown in FIGS. 74-75 in that it includes a curved lower wall 9082, an annular rim 9084, a central aperture 9086, a stepped wall 9088 extending upward from the lower wall 9082, and a plurality of ribs 9090 extending between the stepped wall and the lower wall 9082. The stepped wall 9088 of the pentagonal sole piece 9080 comprises five pairs of surfaces A, B, C, D, and E, with each pair of surfaces being about 180° rom each other and being at a different axial height from the lower wall 9082 than the other pairs of surfaces. Because there are a total of ten of these surfaces, each surface can occupy about a 36° section of the stepped wall 9088.

Figure 90A:
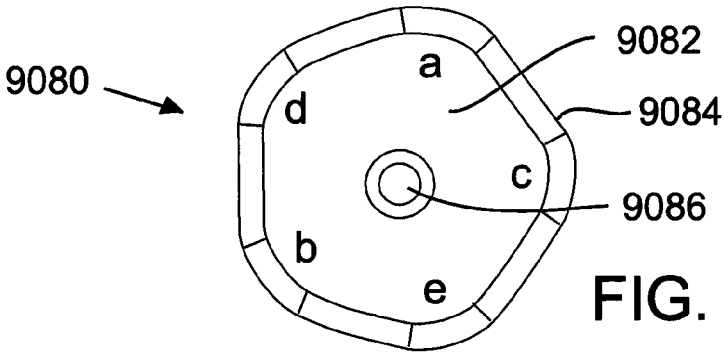
FIGS. 90A-F are various views of an alternative embodiment of the sole piece of FIG. 74 that is pentagonal in shape.
Figure 90B:
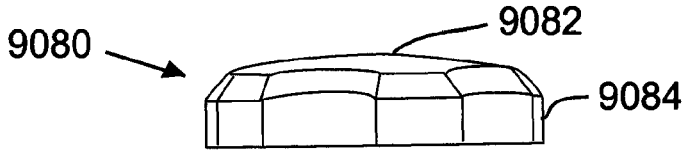
Figure 90C:
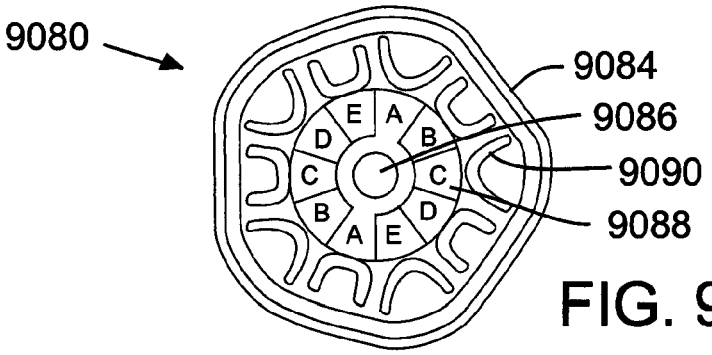
Figure 90D:
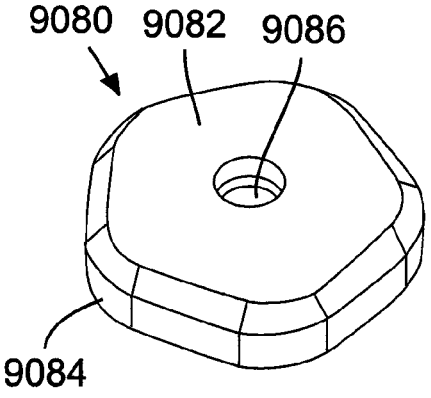
Figure 90E:
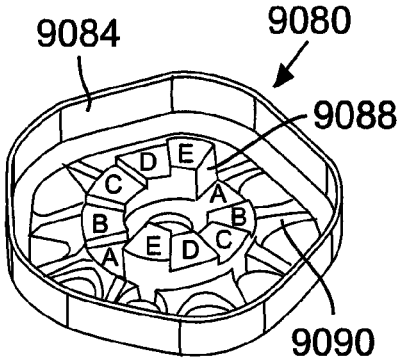
Figure 91A:
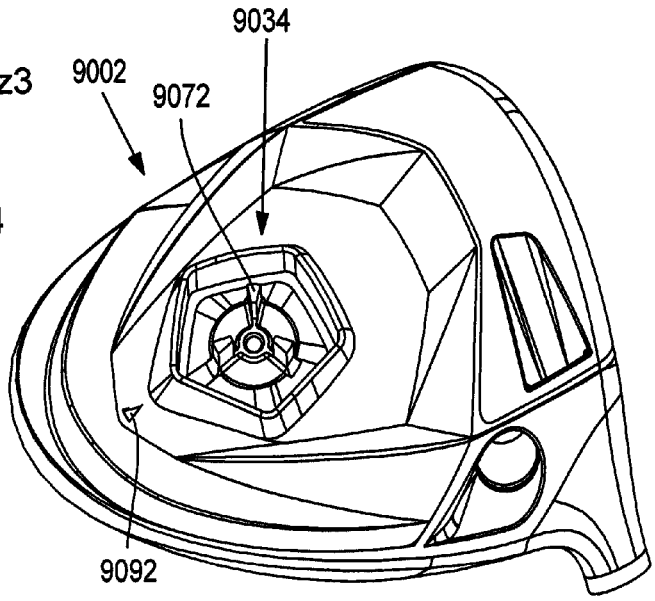
FIGS. 91A and B are bottom views of an alternative embodiment of a sole port having three raised platforms.

In accordance with the pentagonal sole piece 9080, the sole port 9034 can have a matching pentagonal shape to receive the sole piece 9080. FIGS. 91A and B show an exemplary embodiment of a club head body 9002 having a pentagonal sole port 9034, although this embodiment comprises three raised platforms 9072 and is configured to be used with the alternative pentagonal sole piece embodiment 9100 that is shown in FIGS. 92A-E and discussed below. A similar embodiment (not shown) with two raised platforms 9072, like the embodiments shown in FIG. 71D and FIG. 80, can be used with the pentagonal sole piece 9080 (i.e., the club head can have a pentagonal sole port like the one shown in FIGS. 91A and B, but formed with two platforms rather than three). With a pentagonal sole port, the raised platforms 9072 can have a narrower configuration that correspond to the smaller surfaces A-E of the stepped wall of the pentagonal sole piece. The width of the lower contact surfaces of the platforms 9072 can be equal to or slightly narrower than the widths of the upper contact surfaces A-E of the stepped wall. For example, each of the platforms 9072 can comprise an angular section of about 36° or slightly less when configured to be used with the pentagonal sole piece 9080 shown in FIGS. 90A-E (where the sole port has two platforms), or about 24° or slightly less when configured to be used with the pentagonal sole piece 9100 shown in FIGS. 92A-E (where the sole port has three platforms).

Referring to FIGS. 90A-E, because of the pentagonal shape of the outer rim 9088 of the sole piece 9080 and the matching pentagonal shape of the sole port 9034, the pentagonal sole piece is adjustable to five different rotational positions. At each of these five rotational positions, a different pair of the upper contact surfaces A-E is in contact with the ears of the platform 9072. Because each pair of surfaces A-E have a different axial height from the lower wall 9082, the pentagonal sole piece 9080 has five different axial positions corresponding to the five rotational positions. At each axial position, the lower wall 9082 of the sole piece extends a different distance from the sole 9016 of the club head, which can change the face angle of the club head.

In one embodiment, when surfaces C of the stepped wall 9088 are in contact with the platform 9072, the face angle is at a neutral face angle, or 0°. In this embodiment, surfaces A correspond with a 4° open face angle, surfaces B correspond with a 2° open face angle, surfaces D correspond with a −2° closed face angle, and surfaces E correspond with a −4° closed face angle. The heights of the surfaces A-E can vary to produce other face angle adjustments. Having five face angle settings can be a desirable feature for golfers. In addition, the five face angle settings can cover a broader range of face angles without unduly large angle gaps between each setting.

As shown in FIG. 75, the sole 9016 can include a marker 9092 adjacent the sole port 9034, such as directly behind the sole port. The triangular sole piece 9036 can include three indicators, such as "O", "N" and "C", that indicate that the sole piece is set such that the face angle is "Open", "Neutral" and "Closed", respectively, depending on which indicator is adjacent the marker 9092. Similarly, the bottom surface of the lower wall 9082 of the pentagonal sole piece 9080 can include five indicators a, b, c, d and e, as shown in FIG. 90A, that indicate a face angle setting. When the pentagonal sole piece 9080 is secured to the sole port 9034 (similar to FIG. 75), one of the indicators a, b, c, d, or e can be aligned with the marker 9092, and that indicator can indicate which pair of surfaces A-E (see FIG. 90C), or trio of surfaces (see FIG. 92A and related discussion below), are in contact with the platform 9072, and thus what face angle setting corresponds to that positioning of the sole piece. For example, if the indicator "d" on the bottom of the sole piece is aligned with the marker 9092, that can indicate that the surfaces D are in contact with the platform 9072 and that the sole piece is positioned such that the face angle will be closed −2° when in the address position. The indicators a, b, c, d and e can, for example, be "+4°", "+2°", "0°, "−2°", and "−4°", respectively, or any other indicator scheme that represents to a person what face angle setting is caused by aligning a particular indicator with the marker 9092.

Regardless of the configuration of the adjustable sole piece (whether it is circular, elliptical, polygonal, triangular, quadrilateral, pentagonal, hexagonal, heptagonal, octagonal, enneagonal, decagonal, or some other shape), the curvature of the bottom surface of the sole piece can be selected to match the curvature of the front contact surface 9041 at the front of the sole 9016 (see FIG. 80). The contact surface 9041 and the bottom surface of the sole piece 9036 can be the only two surfaces that contact the ground when the club head is in the address position, as described above with respect to FIGS. 71A-E. The lateral distance between the front contact surface 9041 and the center aperture 9086 of the sole piece 9036 can be from about 45 mm to about 60 mm, such as about 52 mm.

Figure 90F:
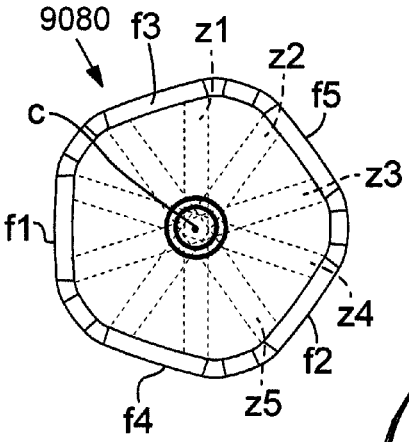

FIG. 90F illustrates zones z1, z2, z3, z4 and z5 (shown in dashed lines) of the bottom surface of the pentagonal sole piece 9080 that can contact the ground when the club head is in the address position. Each of the zones z1-z5 intersects the central aperture 9086 (labeled "c" in FIG. 90F) of the sole piece 9080 and is parallel with a corresponding one of the flat segments f1, f2, f3, f4 and f5 of the side wall 9084 of the pentagonal sole piece 9080. For example, when the pentagonal sole piece 9080 is secured to the sole port 9034 with the side wall segment f1 facing forward (toward the face plate 9018), the zone z1 is configured to contact the ground when the club head is in the address position. Each of the zones z1-z5 can have the same curvature, such as a convex curvature. In some embodiments, the bottom surface of the sole piece is spherical such that all of the zones z1-z5 are also spherical surfaces with the same radius of curvature. In other embodiment, the bottom surface and the zones z1-z5 can be non-spherical and/or can have a non-constant radius of curvature. The curvature of each zone z1-z5 can be selected to match the curvature of the front contact surface 9041 at the front of the sole 9016 (see FIG. 80). In some embodiments, the shape of the bottom surface of the sole piece 9080 can be selected such that the face angle of the club head can be adjusted independently of the loft angle of the club head.

FIGS. 92A-F show an alternative embodiment of a pentagonal sole piece 9100 that is configured to be used with the pentagonal sole port 9034 shown in FIGS. 91A and B. The pentagonal sole piece 9100 is similar to the pentagonal sole piece 9080 shown in FIGS. 90A-E in that it includes a curved lower wall 9102, an annular rim 9104, a central aperture 9106, and a stepped wall 9108 extending upward from the lower wall 9102. The stepped wall 9108 of the pentagonal sole piece 9100 comprises five trios of surfaces A, B, C, D, and E, with each trio of surfaces being spaced about 120° apart from each other around the central aperture 9106 and being at a different axial height from the lower wall 9102 than the other trios of surfaces. Because there are a total of fifteen of these surfaces, each surface can occupy about a 24° angular section of the stepped wall 9108.

In accordance with the pentagonal sole piece 9100, the sole port 9034 can have a matching pentagonal shape as shown in FIGS. 91A and B. In addition, the sole port can comprise three raised platforms 9072 spaced about 120° apart around the central aperture 9052. The three platforms 9072 can have narrower configurations that correspond to the trios of smaller surfaces A-E of the stepped wall 9108. The width of the lower contact surfaces of the platforms 9072 can be equal to or slightly narrower than the widths of the upper contact surfaces A-E of the stepped wall 9108. For example, each of the three platforms 9072 can comprise an angular section of about 24° or slightly less to allow the platforms 9072 to make contact with a selected trio of surfaces A-E when the sole piece is inserted into the sole port.

Figure 91B:
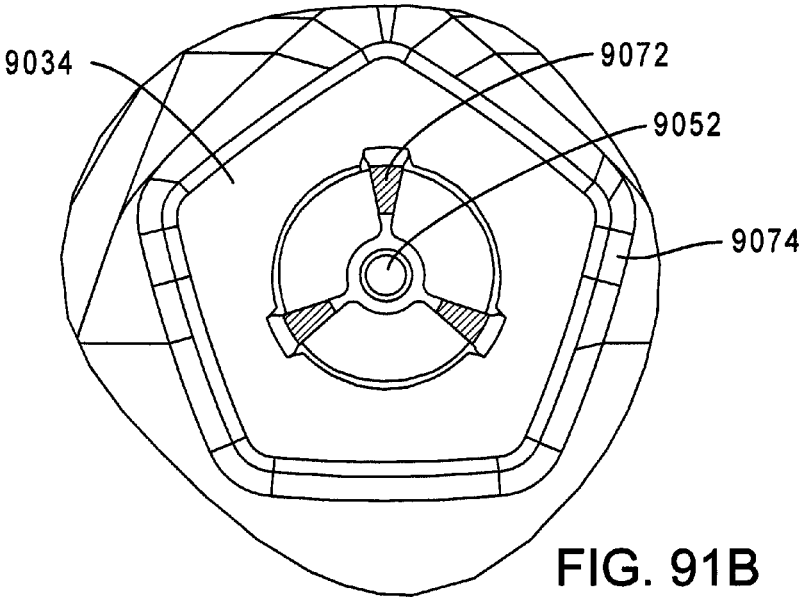
Figure 92A:
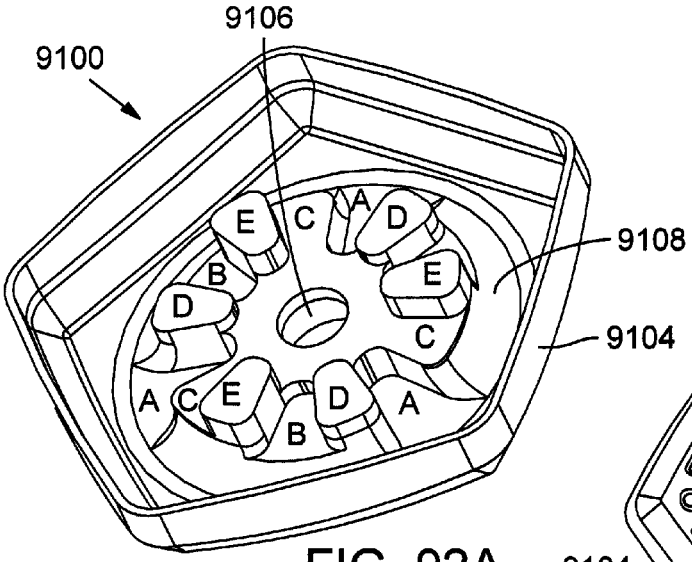
FIGS. 92A-E are various views of an alternative embodiment of the pentagonal sole piece of FIG. 90A-F.
Figure 92B:
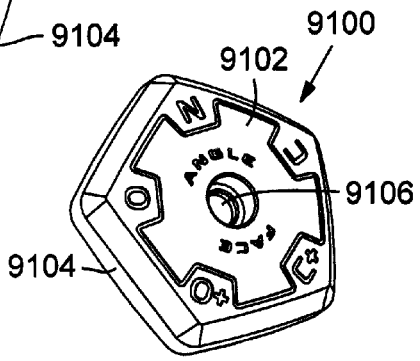
Figure 92C:
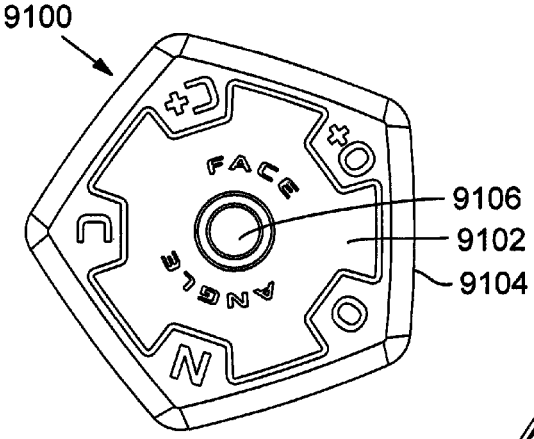
Figure 92E:
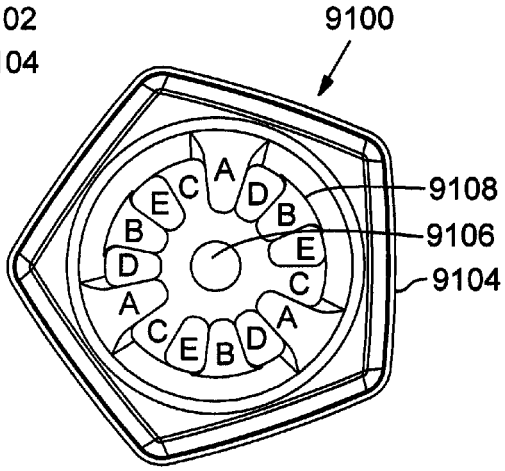
Figure 92D:
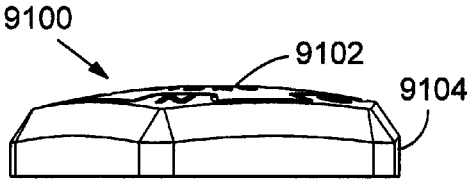

Because of the pentagonal shape of the outer rim 9104 of the sole piece 9100 and the matching pentagonal shape of the sole port 9034 of FIG. 91B, the sole piece 9100 is adjustable to five different rotational positions. At each of these five rotational positions, a different trio of the upper contact surfaces A-E is in contact with the three platforms 9072. Because each trio of surfaces A-E has a different axial height from the lower wall 9102, the pentagonal sole piece 9100 has five different axial positions corresponding to the five rotational positions. At each axial position, the lower wall 9102 of the sole piece 9100 extends a different distance from the sole 9016 of the club head 9000, which changes the face angle of the club head. Unlike the stepped wall 9088 (FIGS. 90C and 90E), where the surfaces A-E are increasingly taller moving clockwise when viewed as in FIG. 90C, the surfaces A-E of the stepped wall 9108 are staggered. For example, surface A is next to surfaces C and D, etc. This arrangement avoids having the lowest surfaces A adjacent to the tallest surfaces E.

Slidably Repositionable Weight

According to some embodiments of the golf club heads described herein, the golf club head includes a slidably repositionable weight. Among other advantages, a slidably repositionable weight facilitates the ability of the end user of the golf club to adjust the location of the CG of the club head over a range of locations relating to the position of the repositionable weight. FIGS. 93-100 show an exemplary golf club head having a slidably repositionable weight retained within a channel located at a forward region of the sole of the club head. The weight is slidably repositionable such that it can be positioned at a plurality of selected points between the heel and toe ends of the channel The exemplary golf club heads described herein and shown in FIGS. 93-100 can include an adjustable sole piece and internal sole ribs, an adjustable shaft attachment system, a variable thickness face plate, thin wall body construction, movable weights inserted in weight ports, and/or any other club head features described herein. While this description proceeds with respect to the particular embodiments shown in FIGS. 93-100, these embodiments are only exemplary and should not be considered as a limitation on the scope of the underlying concepts. For example, although the illustrated examples include many described features, alternative embodiments can include various subsets of these features and/or additional features.

FIGS. 93A-D show several views of an exemplary golf club head 9300. The head 9300 comprises a hollow body 9302. The body 9302 (and thus the whole club head 9300) includes a front portion 9304, a rear portion 9306, a toe portion 9308, a heel portion 9310, a hosel 9312, a crown 9314 and a sole 9316. The front portion 9304 forms an opening that receives a face plate 9318, which can be a variable thickness, composite, and/or metal face plate, as described above. The illustrated club head 9300 can also comprise an adjustable shaft connection system for coupling a shaft to the hosel 9312, such as the adjustable shaft connection systems described above, the details of which are not repeated here and not shown in FIGS. 93A-D for clarity. For example, a passageway 9370 to provide passage of an attachment screw (not shown) is included in the embodiments shown. The adjustable shaft connection system may include various components, such as (without limitation) a sleeve and a ferrule (more detail regarding the hosel and the adjustable shaft connection system can be found, for example, in U.S. Pat. No. 7,887,431 and U.S. patent application Ser. Nos. 13/077,825, 12/986,030, 12,687,003, 12/474,973, which are incorporated herein by reference in their entirety). The shaft connection system, in conjunction with the hosel 9312, can be used to adjust the orientation of the club head 9300 with respect to the shaft, as described in detail above. The illustrated club head 9300 may also include an adjustable sole piece at a sole port or pocket, as also described in detail above.

In the embodiments shown in FIGS. 93A-D, the club head 9302 is provided with an elongated channel 9320 on the sole 9316 that extends generally from a heel end 9322 oriented toward the heel portion 9310 to a toe end 9324 oriented toward the toe portion 9308. A front ledge 9330 and a rear ledge 9332 are located within the channel 9320, and a weight assembly 9440 is retained on the front and rear ledges 9330, 9332 within the channel 9320. In the embodiment shown, the channel 9320 is merged with the hosel opening 340 that forms a part of the head-shaft connection assembly discussed above.

Turning next to FIGS. 94A-B and 95A-B, additional details relating to the channel 9320 and front and rear ledges 9330, 9332 are shown in the illustrated embodiments in which the weight assembly 9340 is not included for clarity. In the embodiments shown, the channel 9320 includes a front channel wall 9326, a rear channel wall 9327, and a bottom channel wall 9328. The front, rear, and bottom channel walls 9326, 9327, 9328 collectively define an interior channel volume within which the weight assembly 9340 is retained. The front ledge 9330 extends rearward from the front channel wall 9326 into the interior channel volume, and the rear ledge 9332 extends forward from the rear channel wall 9327 into the interior channel volume.

In some embodiments, a plurality of locking projections 9334 are formed on a surface of one or more of the front and rear ledges 9330, 9332. In the embodiments shown, the locking projections 9334 are located on an outward-facing surface of the rear ledge 9332. As described more fully below, each of the locking projections 9334 has a size and shape adapted to engage one of a plurality of locking notches formed on the weight assembly 9340 to thereby retain the weight assembly 9340 in a desired location within the channel 9320. In the embodiment shown, each locking projection 9334 has a generally hemispherical shape.

In alternative embodiments, the locking projections 9334 may be located on one or more other surfaces defined by the front ledge 9330 and/or rear ledge 9332. For example, in some embodiments, locking projections are located on an outward facing surface of the front ledge 9330, while in other embodiments the locking projections are located on an inward-facing surface of one or both of the front ledge 9330 and rear ledge 9332. In further embodiments, the weight assembly 9340 is retained on the front and rear ledges 9330, 9332 without the use of locking projections. In still further embodiments, a plurality of locking notches (not shown in the Figures) are located on one or more surfaces of the front and rear ledges 9330, 9332 and are adapted to engage locking projections that are located on engaging portions of the weight assembly 9340. All such combinations, as well as others, may be suitable for retaining the weight assembly 9340 at selected locations within the channel 9320.

Figure 93A:
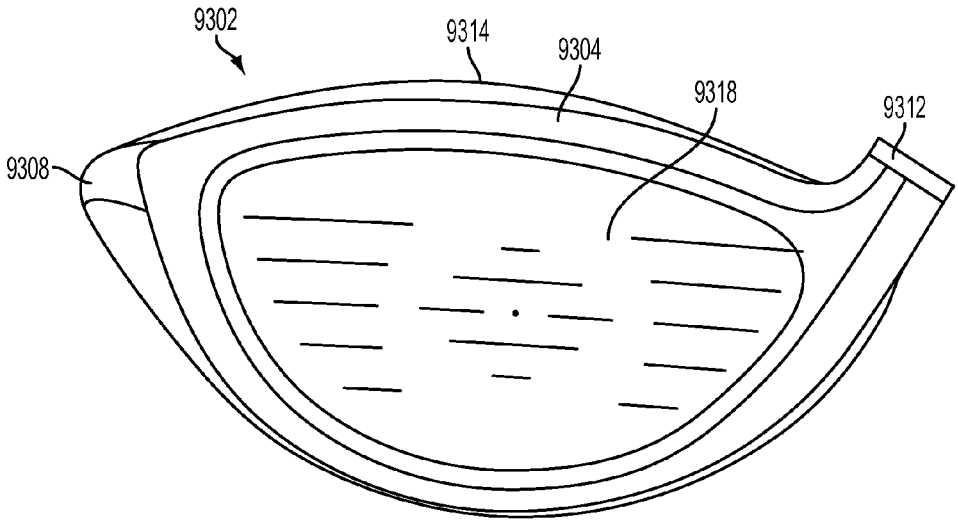
FIGS. 93A-D are front, bottom, toe side, and heel side views, respectively, of a golf club head, according to yet another embodiment.
Figure 93B:
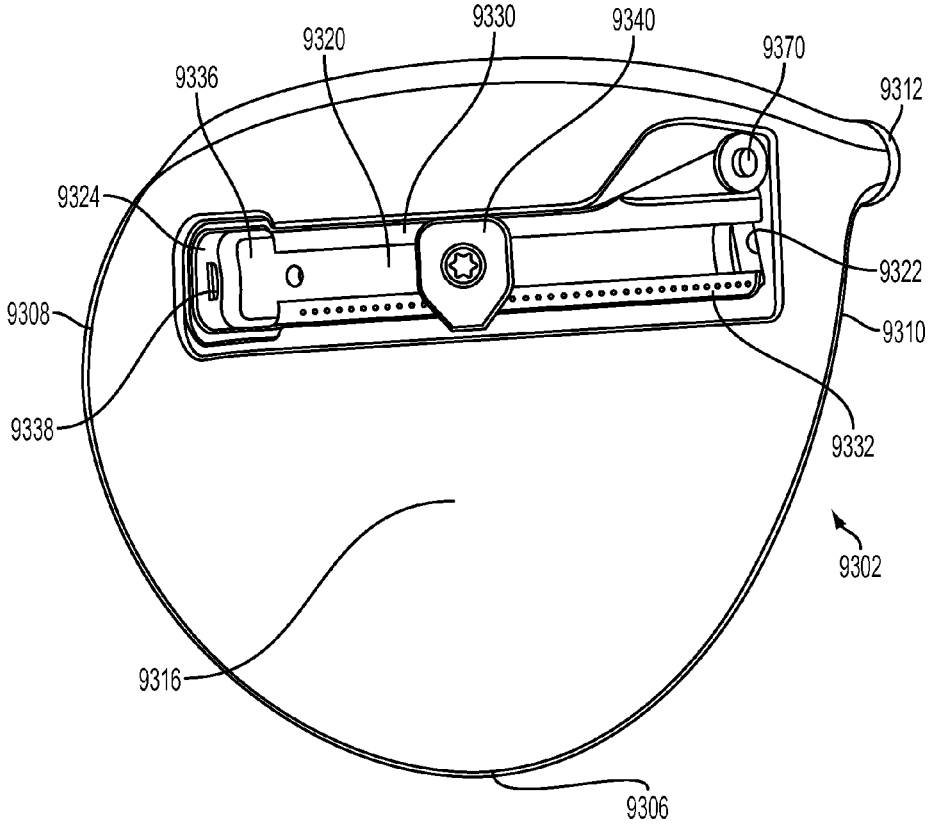
Figure 93C:
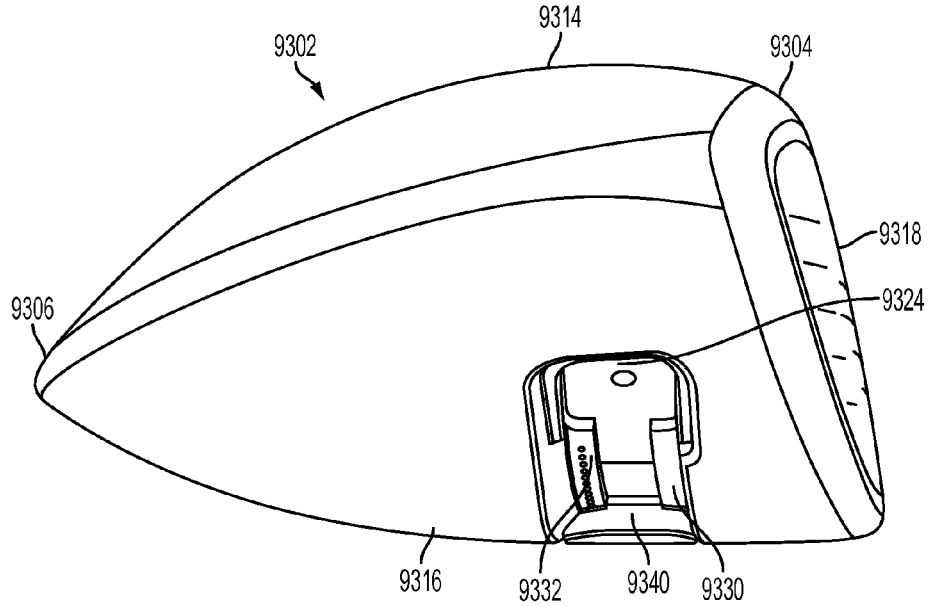
Figure 93D:
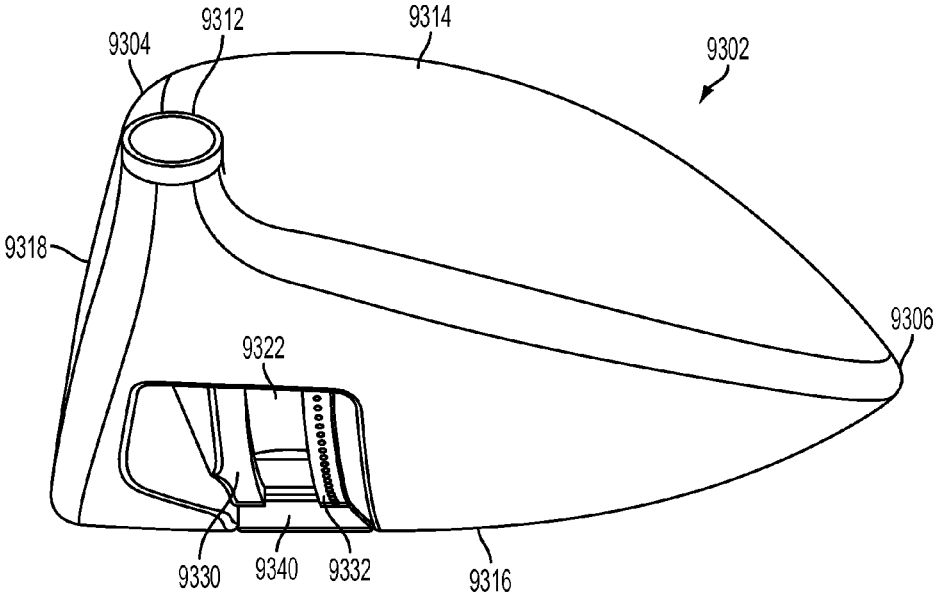
Figure 94A:
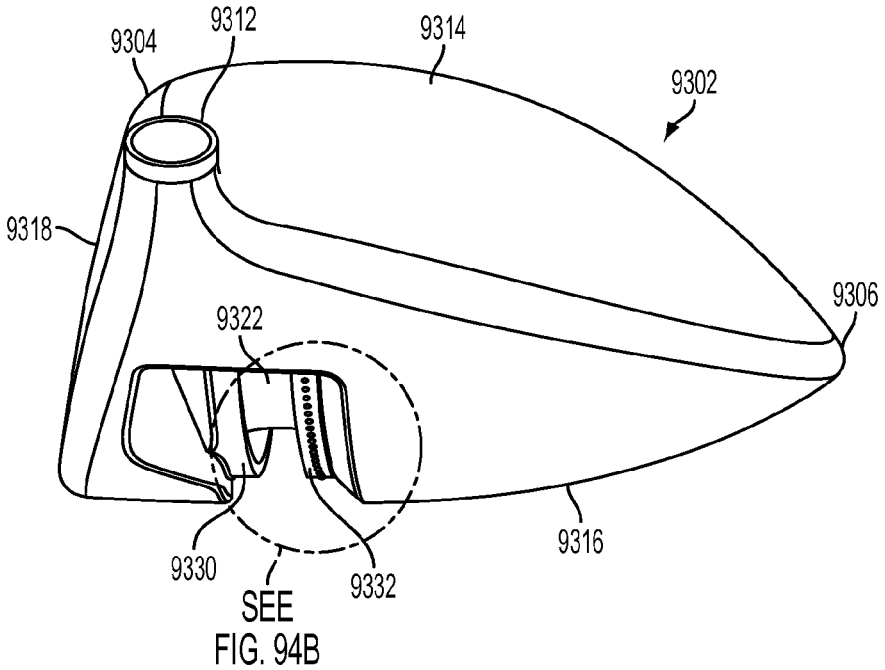
FIG. 94A is a heel side view of the golf club head of FIGS. 93A-D, with the weight assembly removed for clarity.
Figure 94B:
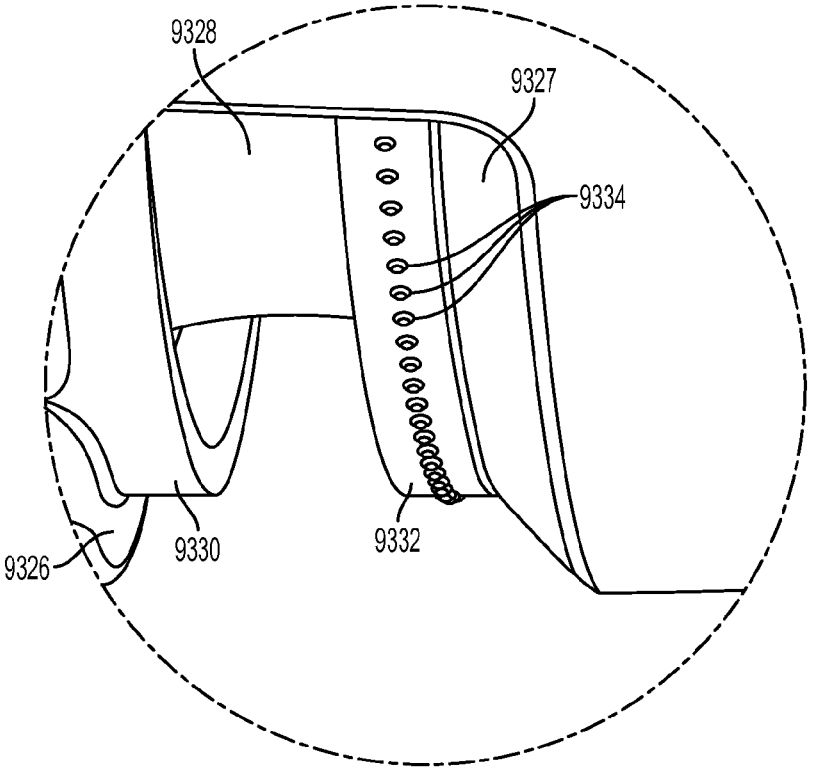
FIG. 94B is a close up view taken along inset line "B" in FIG. 94A.
Figure 95A:
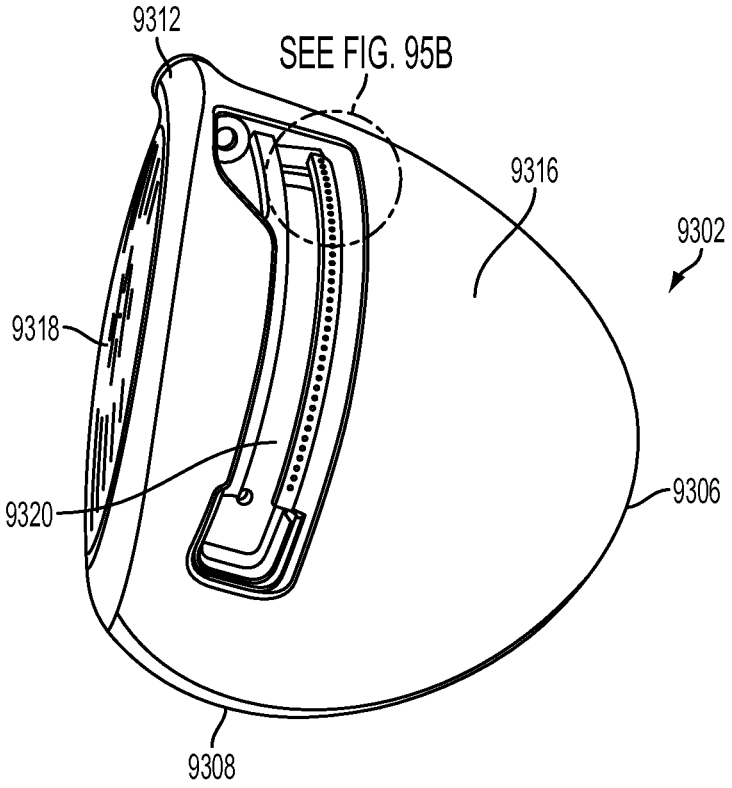
FIG. 95A is a bottom view of the golf club head of FIGS. 93A-D, with the weight assembly removed for clarity.
Figure 95B:
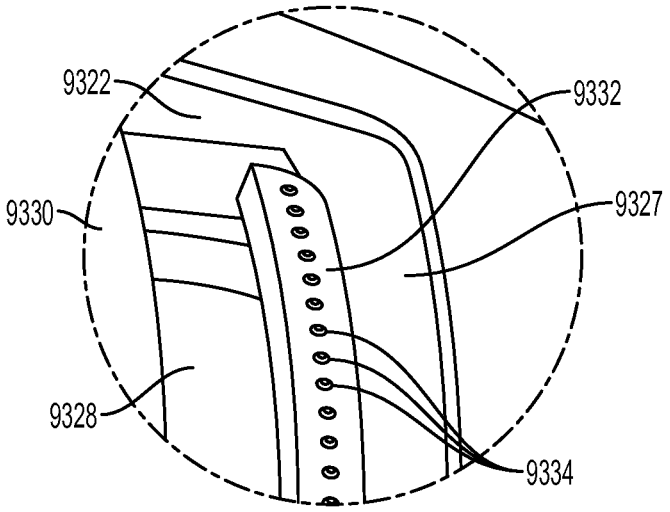
FIG. 95B is a close up view taken along inset line "B" in FIG. 95A.

In the embodiments shown in the Figures, the channel 9320 is substantially straight within the X-Y plane (see, e.g., FIG. 93B), and generally tracks the curvature of the sole 9316 within the X-Z and Y-Z planes (see, e.g., FIGS. 93C-D). The channel 9320 is located in a forward region of the sole 9316, i.e., toward the front portion 9304 of the club head. For example, in some embodiments, the entire channel 9320 is located in a forward 50% region of the sole 9316, such as in a forward 40% region of the sole 9316, such as in a forward 30% region of the sole 9316. The referenced forward regions of the sole are defined in relation to an imaginary vertical plane that intersects an imaginary line extending between the center of the face plate 9318 and the rearward-most point on the rear portion 9306 of the club head. The imaginary vertical plane is also parallel to a vertical plane which contains the shaft longitudinal axis when the shaft 50 is in the correct lie (i.e., typically 60 degrees±5 degrees) and the sole 9316 is resting on the playing surface 70 (the club is in the grounded address position). The imaginary line is assigned a length, L. Accordingly, the forward 50% region of the sole is the region of the sole 9316 located toward the front portion 9304 of the club head relative to the imaginary vertical plane where the imaginary vertical plane is located at a distance of 0.5*L from the center of the face plate 9318. The forward 40% region of the sole is the region of the sole 9316 located toward the front portion 9304 of the club head relative to the imaginary vertical plane where the imaginary vertical plane is located at a distance of 0.4*L from the center of the face plate 9318. The forward 30% region of the sole is the region of the sole 9316 located toward the front portion 9304 of the club head relative to the imaginary vertical plane where the imaginary vertical plane is located at a distance of 0.3*L from the center of the face plate 9318.

In the embodiments shown, the distance between a first vertical plane passing through the center of the face plate 9318 and a second vertical plane that bisects the channel 9320 at the same x-coordinate as the center of the face plate 9318 is between about 15 mm and about 50 mm, such as between about 20 mm and about 40 mm, such as between about 25 mm and about 30 mm. In the embodiments shown, the width of the channel (i.e., the horizontal distance between the front channel wall 9326 and rear channel wall 9327 adjacent to the locations of front ledge 9330 and rear ledge 9332) may be between about 8 mm and about 20 mm, such as between about 10 mm and about 18 mm, such as between about 12 mm and about 16 mm. In the embodiments shown, the depth of the channel (i.e., the vertical distance between the bottom channel wall 9328 and an imaginary plane containing the regions of the sole 9316 adjacent the front and rear edges of the channel 9320) may be between about 6 mm and about 20 mm, such as between about 8 mm and about 18 mm, such as between about 10 mm and about 16 mm. In the embodiments shown, the length of the channel (i.e., the horizontal distance between the heel end 9322 of the channel and the toe end 9324 of the channel) may be between about 30 mm and about 120 mm, such as between about 50 mm and about 100 mm, such as between about 60 mm and about 90 mm.

Turning next to FIGS. 98A-C, another embodiment of a club head 9302 includes several of the structures and features of the previous embodiments, including the channel 9320 and front and rear ledges 9330, 9332. Once again, the weight assembly 9340 is not included for clarity. In the embodiment shown, the channel 9320 includes a bridge 9382 that extends across the channel 9320 at a location between an installation cavity 9336 (described below) and the remainder of the channel 9320. The bridge 9382 is a rigid member that, in the embodiment shown, is connected to the front channel wall 9326 and rear channel wall 9327 where the channel walls intersect with the sole 9316 of the club head. The bridge 9382 provides structural support and stiffens the channel 9320, thereby counteracting any change in the sound the club makes during impact with a ball that may be attributable to the presence of the channel 9320. With the addition of the bridge 9382 extending across a region of the channel 9320, the club head can produce higher sound frequencies when striking a golf ball on the face, as discussed above in relation to the ribs associated with the adjustable sole plate port.

Also shown in FIG. 98A is a recessed region 9384 located on the sole 9316 adjacent to and rearward of the channel 9320. In the embodiment shown, the recessed region 9384 has a trapezoidal shape, though other shapes and sizes are also contemplated. In some embodiments, a damper or damping member (not shown in the Figures) may be attached to the sole 9316 at the recessed region 9384 to further enhance the sound and feel of the club head when striking a golf ball. The damping member may comprise a badge or other member, and may comprise materials known to those skilled in the art for the purpose of damping vibration and thereby enhancing the club head sound and feel.

The weight assembly 9340 and the manner in which the weight assembly 9340 is retained on the front and rear ledges 9330, 9332 within the channel 9320 are shown in more detail in FIGS. 96A-B and 97A-C. In the embodiments shown, the weight assembly 9340 includes three components: a washer 9342, a mass member 9344, and a fastening bolt 9346. The washer 9342 is located within an outer portion of the interior channel volume, engaging the outward-facing surfaces of the front ledge 9330 and rear ledge 9332. The mass member 9344 is located within an inner portion of the interior channel volume, engaging the inward-facing surfaces of the front ledge 9330 and rear ledge 9332. The fastening bolt 9346 has a threaded shaft that extends through a center aperture 9353 of the washer 9342 and engages mating threads located in a center aperture 9361 of the mass member 9344.

In the embodiment shown in FIG. 97B, the washer 9342 includes an inward-facing surface 9350 and an outward-facing surface 9352. A plurality of locking notches 9348 are located along the inward-facing surface 9350 of the washer such that the locking notches 9348 are adapted to engage the locking projections 9334 located on the rear ledge 9332 when the weight assembly 9340 is retained within the channel 9320. The locking notches 9348 may extend completely through the full height of the washer 9342 or, as shown in FIG. 97B, the locking notches 9348 may extend only a portion of the height of the washer 9342, provided that the locking notches 9348 have a suitable size and shape to engage the locking projections 9334. Moreover, in the embodiment shown in FIG. 97B, the locking notches 9348 are formed as separate, discrete notches regularly spaced along an edge of the washer 9342. In an alternative embodiment shown in FIG. 97C, the locking notches 9348' are connected by channels to provide a continuous path for accommodating the locking projections 9334.

The washer 9342 also includes a raised center ridge 9352 on the inward-facing surface 9350. The raised center ridge 9352 has a width dimension that is slightly smaller than the separation distance between the front ledge 9330 and rear ledge 9332, such that the center ridge 9352 is able to slide in the heel-to-toe direction within the channel 9320 while being laterally restrained by the front and rear ledges 9330, 9332.

An embodiment of the mass member 9344 is shown in FIG. 97A. The mass member 9344 includes an inward-facing surface 9356, and outward-facing surface 9358, and a center ridge 9360 extending through the outward-facing surface 9358. The raised center ridge 9360 has a width dimension that is slightly smaller than the separation distance between the front ledge 9330 and rear ledge 9332, such that the center ridge 9360 is able to slide in the heel-to-toe direction within the channel 9320 while being laterally restrained by the front and rear ledges 9330, 9332. The mass member 9344 also has a threaded central aperture 9361 through which the threaded shaft of the fastening bolt 9346 is located.

Figure 96A:
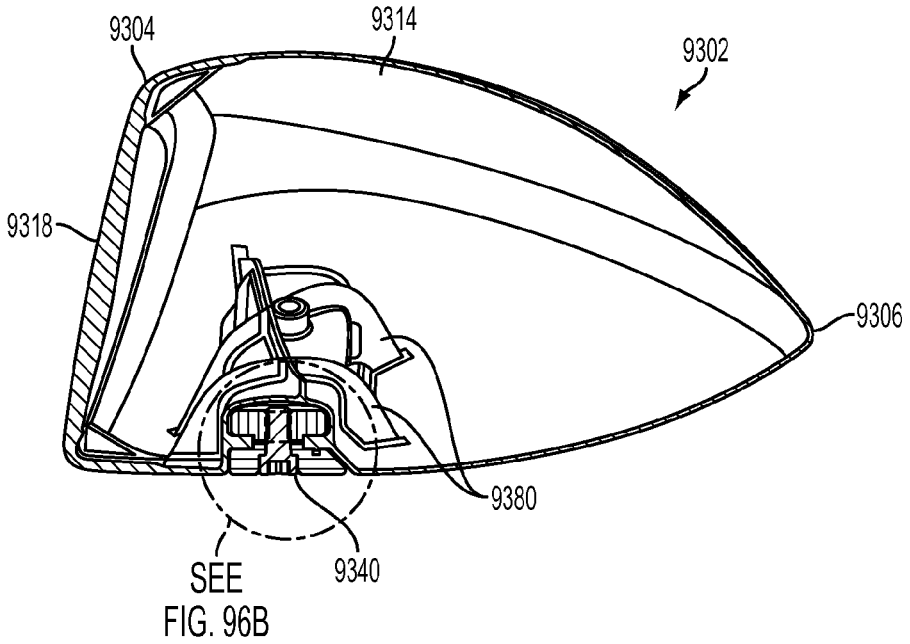
FIG. 96A is a cross-sectional view of the golf club head of FIGS. 93A-D.
Figure 96B:
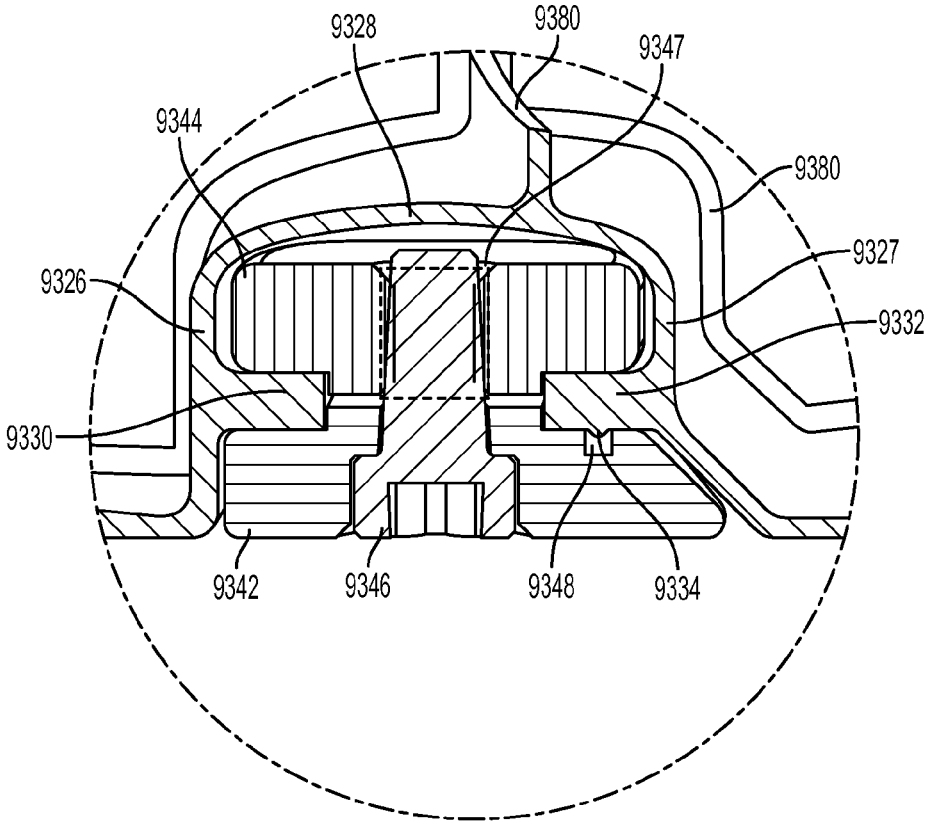
FIG. 96B is a close up view taken along inset line "B" in FIG. 96A.

As shown in FIGS. 96A-B, in some embodiments, the distal end 9347 of the fastening bolt 9346 is enlarged, such as by a swaging process, in order to prevent the mass member 9344 from being completely released from the bolt 9346. The center aperture 9361 of the mass member also includes a counterbore 9362 region to accommodate the enlarged distal end 9347 of the fastening bolt. The fastening bolt 9346 is thereby able to be advanced and retracted within the center aperture 9361 via the threaded engagement with the mass member 9344, but the mass member 9344 may not be removed from the fastening bolt 9346. In this way, the weight assembly 9340 may be more securely retained on the front and rear ledges 9330, 9332 within the channel 9320 while still retaining the capability of being continuously adjusted in the heel-to-toe direction within the channel 9320. In addition, in the embodiments shown, the center aperture 9353 of the washer 9342 includes a counterbore 9355 having a size and shape to accommodate the head portion of the fastening bolt 9346.

In some embodiments, the mass of the weight assembly is between about 5 g and about 25 g, such as between about 7 g and about 20 g, such as between about 9 g and about 15 g. In some alternative embodiments, the mass of the weight assembly may be between about 5 g and about 45 g, such as between about 9 g and about 35 g, such as between about 9 g and about 30 g, such as between about 9 g and about 25 g. Each of the washer 9342 and the mass member 9344 may be formed of materials such as aluminum, titanium, stainless steel, tungsten, metal alloys containing these materials, or combinations of these materials. The fastening bolt 9346 is preferably formed of titanium alloy or stainless steel. In the embodiments shown, each of the washer 9342 and mass element 9344 has a length and width that ranges from about 8 mm to about 20 mm, such as from about 10 mm to about 18 mm, such as from about 12 mm to about 16 mm. The height of the washer 9342 and mass element 9344 embodiments shown in the Figures is from about 2 mm to about 8 mm, such as from about 3 mm to about 7 mm, such as from about 4 mm to about 6 mm.

The addition of the channel 9320 and an attached adjustable weight assembly 9340 can undesirably change the sound the club makes during impact with a ball. Accordingly, one or more ribs 9380 are provided on the internal surface of the sole (i.e., within the internal cavity of the club head 9300). The ribs 9380 on the internal surface of the sole can be oriented in several different directions and can tie the channel 9320 to other strong structures of the club head body, such as the sole of the body and/or the skirt region between the sole and the crown. One or more ribs can also be tied to the hosel to further stabilize the sole. With the addition of such ribs on the internal surface of the sole, the club head can produce higher sound frequencies when striking a golf ball on the face, as discussed above in relation to the ribs associated with the adjustable sole plate port.

In some embodiments, the weight assembly 9340 is installed into the channel 9320 by placing the weight assembly 9340 into an installation cavity 9336 located adjacent to the toe end 9324 of the channel The installation cavity 9336 is a portion of the channel 9320 in which the front ledge 9330 and rear ledge 9332 do not extend, thereby facilitating placement of the assembled weight assembly 9340 into the channel 9320. Once placed into the installation cavity 9336, the weight assembly 9340 is shifted toward the heel end 9322 and into engagement with the front ledge 9330 and rear ledge 9332. After the weight assembly 9340 is shifted completely out of the installation cavity 9336, an optional cap or plug (see, e.g., FIG. 99) may be installed into the installation cavity 9336 to prevent removal of the weight assembly 9340 from the channel 9320. In some embodiments, one or more slots 9338 are provided on the sidewall(s) of the installation cavity 9336 to provide an area to which a cap or plug may be attached, such as via one or more resilient tabs or detents that may be provided on the cap or plug.

As noted above, in the embodiment shown in FIG. 99, the club head 9300 includes a cap 9372 that is installed into the installation cavity 9336 where it is retained by a cap screw 9374. In the embodiment shown, the cap 9372 includes a shaft portion 9376 that extends into the installation cavity and a broad upper surface 9378 that serves to cover the installation cavity opening after the weight assembly is installed. The cap screw 9374 extends through a hole in the upper surface 9378 and through the shaft 9376 to be inserted into a threaded opening (not shown) on the bottom surface of the installation cavity 9336. Other caps, seals, fillers, or other devices suitable for covering or protecting the installation cavity 9336 after installation of the weight assembly are also contemplated.

The embodiment shown in FIG. 99 also includes an adjustable shaft attachment system for coupling a shaft to the hosel 9312, the system including various components, such as a sleeve 9920, a washer 9922, a hosel insert 9924, and a screw 9926 (more detail regarding the hosel and the adjustable shaft connection system can be found, for example, in U.S. Pat. No. 7,887,431 and U.S. patent application Ser. Nos. 13/077,825, 12/986,030, 12,687,003, 12/474,973, which are incorporated herein by reference in their entirety). The shaft connection system, in conjunction with the hosel 9312, can be used to adjust the orientation of the club head 9302 with respect to the shaft, as described in detail above and in the patents and applications incorporated by reference.

FIG. 100 shows an exploded view of an exemplary golf club head. The head comprises a hollow body 9302 having a hosel 9312 and a sole 9316. The front portion 9304 forms an opening that receives a face plate 9318 which, in the embodiment shown, comprises a composite face plate as described above. Further details concerning the construction and manufacturing processes for the composite face plate are described in U.S. Pat. No. 7,871,340 and U.S. Published Patent Application Nos. 2011/0275451, 2012/0083361, and 2012/0199282. The composite face plate is attached to an insert support structure located at the opening at the front portion 9304 of the club head.

Further details concerning the insert support structure are described in U.S. Pat. No. RE43,801. The illustrated club head also includes an adjustable shaft attachment system for coupling a shaft to the hosel 9312, the system including various components, such as a sleeve 9920, a washer 9922, a hosel insert 9924, and a screw 9926. The shaft connection system 9020, in conjunction with the hosel 9012, can be used to adjust the orientation of the club head 9000 with respect to the shaft, as described in detail above.

To use the adjustable weight system shown in FIGS. 93 through 100, a user will use an engagement end of a tool (such as the torque wrench 6600 described above) to loosen the fastening bolt 9346 of the weight assembly 9340. Once the fastening bolt 9346 is loosened, the weight assembly 9340 may be adjusted toward the toe portion 9308 or the heel portion 9310 by sliding the weight assembly 9340 in the desired direction within the channel 9320. Once the weight assembly 9340 is in the desired location, the fastening bolt 9346 is tightened until the clamping force between the washer 9342 and the mass member 9344 upon the front ledge 9330 and/or rear ledge 9332 is sufficient to restrain the weight assembly 9340 in place. In the embodiments shown, the interaction of the locking projections 9334 and locking notches 9348 cooperate to increase the locking force provided by the washer 9342 and the mass member 9344.

In some embodiments of the golf clubs described herein, the location, position or orientation of features of the golf club head, such as the golf club head 9302, can be referenced in relation to fixed reference points, e.g., a golf club head origin, other feature locations or feature angular orientations. The location or position of a weight or weight assembly, such as the weight assembly 9340, is typically defined with respect to the location or position of the weight's or weight assembly's center of gravity. When a weight or weight assembly is used as a reference point from which a distance, i.e., a vectorial distance (defined as the length of a straight line extending from a reference or feature point to another reference or feature point) to another weight or weight assembly location is determined, the reference point is typically the center of gravity of the weight or weight assembly.

The location of the weight assembly on a golf club head can be approximated by its coordinates on the head origin coordinate system. The head origin coordinate system includes an origin at the ideal impact location 312 of the golf club head, which is disposed at the geometric center of the striking surface 310 (see FIG. 1A). As described above, the head origin coordinate system includes an x-axis and a y-axis. The origin x-axis extends tangential to the face plate at the origin and generally parallel to the ground when the head is ideally positioned with the positive x-axis extending from the origin towards a heel of the golf club head and the negative x-axis extending from the origin to the toe of the golf club head. The origin y-axis extends generally perpendicular to the origin x-axis and parallel to the ground when the head is ideally positioned with the positive y-axis extending from the head origin towards the rear portion of the golf club. The head origin can also include an origin z-axis extending perpendicular to the origin x-axis and the origin y-axis and having a positive z-axis that extends from the origin towards the top portion of the golf club head and negative z-axis that extends from the origin towards the bottom portion of the golf club head.

As described above, in some of the embodiments of the golf club head 9302 described herein, the channel 9320 extends generally from a heel end 9322 oriented toward the heel portion 9310 to a toe end 9324 oriented toward the toe portion 9308, with both the heel end 9322 and toe end 9324 being at or near the same distance from the front portion of the club head. As a result, in these embodiments, the weight assembly 9340 that is slidably retained within the channel 9320 is capable of a relatively large amount of adjustment in the direction of the x-axis, while having a relatively small amount of adjustment in the direction of the y-axis. In some alternative embodiments, the heel end 9322 and toe end 9324 may be located at varying distances from the front portion, such as having the heel end 9322 further rearward than the toe end 9324, or having the toe end 9322 further rearward than the heel end 9322. In these alternative embodiments, the weight assembly 9340 that is slidably retained within the channel 9320 is capable of a relatively large amount of adjustment in the direction of the x-axis, while also having from a small amount to a larger amount of adjustment in the direction of the y-axis.

For example, in some embodiments of a golf club head 9302 having a weight assembly 9340 that is adjustably positioned within a channel 9320, the weight assembly 9340 can have an origin x-axis coordinate between about −50 mm and about 65 mm, depending upon the location of the weight assembly within the channel 9320. In specific embodiments, the weight assembly 9340 can have an origin x-axis coordinate between about −45 mm and about 60 mm, or between about −40 mm and about 55 mm, or between about −35 mm and about 50 mm, or between about −30 mm and about 45 mm, or between about −25 mm and about 40 mm, or between about −20 mm and about 35 mm. Thus, in some embodiments, the weight assembly 9340 is provided with a maximum x-axis adjustment range (Max Δx) that is greater than 50 mm, such as greater than 60 mm, such as greater than 70 mm, such as greater than 80 mm, such as greater than 90 mm, such as greater than 100 mm, such as greater than 110 mm.

On the other hand, in some embodiments of the golf club head 9302 having a weight assembly 9340 that is adjustably positioned within a channel 9320, the weight assembly 9340 can have an origin y-axis coordinate between about 20 mm and about 60 mm. More specifically, in certain embodiments, the weight assembly 9340 can have an origin y-axis coordinate between about 20 mm and about 50 mm, between about 20 mm and about 45 mm, or between about 25 mm and about 45 mm, or between about 20 mm and about 40 mm, or between about 25 mm and about 40 mm, or between about 25 mm and about 35 mm. Thus, in some embodiments, the weight assembly 9340 is provided with a maximum y-axis adjustment range (Max Δy) that is less than 40 mm, such as less than 30 mm, such as less than 20 mm, such as less than 10 mm, such as less than 5 mm, such as less than 3 mm.

In some embodiments, a golf club head can be configured to have a constraint relating to the relative distances that the weight assembly can be adjusted in the origin x-direction and origin y-direction. Such a constraint can be defined as the maximum y-axis adjustment range (Max Δy) divided by the maximum x-axis adjustment range (Max Δx). According to some embodiments, the value of the ratio of (Max Δy)/(Max Δx) is between 0 and about 0.8. In specific embodiments, the value of the ratio of (Max Δy)/(Max Δx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

As discussed above, in some embodiments, the mass of the weight assembly 9340 is between about 5 g and about 25 g, such as between about 7 g and about 20 g, such as between about 9 g and about 15 g. In some alternative embodiments, the mass of the weight assembly 9340 is between about 5 g and about 45 g, such as between about 9 g and about 35 g, such as between about 9 g and about 30 g, such as between about 9 g and about 25g.

In some embodiments, a golf club head can be configured to have constraints relating to the product of the mass of the weight assembly and the relative distances that the weight assembly can be adjusted in the origin x-direction and/or origin y-direction.

One such constraint can be defined as the mass of the weight assembly ($M_{WA}$) multiplied by the maximum x-axis adjustment range (Max Δx). According to some embodiments, the value of the product of $M_{WA}$ x (Max Δx) is between about 250 g·mm and about 4950 g·mm. In specific embodiments, the value of the product of $M_{WA}$.x(Max Δx) is between about 500 g·mm m and about 4950 g·mm, or between about 1000 g·mm and about 4950 g·mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g·mm, or between about 4000 g·mm and about 4950 g·mm.

Another constraint relating to the product of the mass of the weight assembly and the relative distances that the weight assembly can be adjusted in the origin x-direction and/or origin y-direction can be defined as the mass of the weight assembly ($M_{WA}$) multiplied by the maximum y-axis adjustment range (Max Δy). According to some embodiments, the value of the product of $M_{WA}$ x (Max Δy) is between about 0 g·mm and about 1800 g·mm. In specific embodiments, the value of the product of $M_{WA}$ x(Max Δy) is between about 0 g·mm and about 1500 g·mm, or between about 0 g·mm and about 1000 g·mm, or between about 0 g·mm and about 500 g·mm, or between about 0 g·mm and about 250 g·mm, or between about 0 g·mm and about 150 g·mm, or between about 0 g·mm and about 100 g·mm, or between about 0 g·mm m and about 50 g·mm, or between about 0 g·mm and about 25 g·mm.

As noted above, one advantage obtained with a golf club head having a slidably repositionable weight assembly, such as the golf club head 9302 having the weight assembly 9340, is in providing the end user of the golf club with the capability to adjust the location of the CG of the club head over a range of locations relating to the position of the repositionable weight. In particular, the present inventors have found that there is a distance advantage to providing a center of gravity of the club head that is lower and more forward relative to comparable golf clubs that do not include a weight assembly such as the weight assembly 9340 described herein.

In some embodiments, the golf club head 9302 has a CG with a head origin x-axis coordinate (CGx) between about −10 mm and about 10 mm, such as between about −4 mm and about 9 mm, such as between about −3 mm and about 8 mm, such as between about −2 mm to about 5 mm. In some embodiments, the golf club head 9302 has a CG with a head origin y-axis coordinate (CGy) greater than about 15 mm and less than about 50 mm, such as between about 22 mm and about 43 mm, such as between about 24 mm and about 40 mm, such as between about 26 mm and about 35 mm. In some embodiments, the golf club head 9302 has a CG with a head origin z-axis coordinate (CGz) greater than about −8 mm and less than about 3 mm, such as between about −6 mm and about 0 mm. In some embodiments, the golf club head 9302 has a CG with a head origin z-axis coordinate (CGz) that is less than 0 mm, such as less than −2 mm, such as less than −4 mm, such as less than −5 mm, such as less than −6 mm.

As described herein, by repositioning the slidable weight assembly 9340 within the channel 9320 of the golf club head 9302, the location of the CG of the club head is adjusted. For example, in some embodiments of a golf club head 9302 having a weight assembly 9340 that is adjustably positioned within a channel 9320, the club head is provided with a maximum CGx adjustment range (Max ΔCGx) attributable to the repositioning of the weight assembly 9340 that is greater than 1 mm, such as greater than 2 mm, such as greater than 4 mm, such as greater than 6 mm, such as greater than 8 mm, such as greater than 10 mm, such as greater than 11 mm.

Moreover, in some embodiments of the golf club head 9302 having a weight assembly 9340 that is adjustably positioned within a channel 9320, the club head is provided with a CGy adjustment range (Max ΔCGy) that is less than 6 mm, such as less than 3 mm, such as less than 1 mm, such as less than 0.5 mm, such as less than 0.25 mm, such as less than 0.1 mm.

In some embodiments, a golf club head can be configured to have a constraint relating to the relative amounts that the CG is able to be adjusted in the origin x-direction and origin y-direction. Such a constraint can be defined as the maximum CGy adjustment range (Max ΔCGy) divided by the maximum CGx adjustment range (Max ΔCGx). According to some embodiments, the value of the ratio of (Max ΔCGy)/(Max ΔCGx) is between 0 and about 0.8. In specific embodiments, the value of the ratio of (Max ΔCGy)/(Max ΔCGx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

In some embodiments, a golf club head can be configured such that only one of the above constraints apply. In other embodiments, a golf club head can be configured such that more than one of the above constraints apply. In still other embodiments, a golf club head can be configured such that all of the above constraints apply.

Table 13 below lists various properties of one particular embodiment of the golf club head 9302 having a weight assembly 9340 retained within a channel 9320.

TABLE 13

| | | | |
|---|---|---|---|
| Address Area | 11824 $mm^2$ | Bulge Radius | 304.8 mm |
| Square Loft | 9.7° | Roll Radius | 304.8 mm |
| Lie | 57° | Face Height | 60.8 mm |
| Face Angle | 3° | Face Width | 89.5 mm |
| Ixx (axis heel/toe) | 217 $kg \cdot mm^2$ | Face Area | 4189 $mm^2$ |
| Iyy (axis front/back) | 263 $kg \cdot mm^2$ | Head Height | 66.5 mm |
| Izz (axis normal to grnd) | 357 $kg \cdot mm^2$ | Head Length | 117.5 mm |
| Mass | 207.1 g | Volume | 439 cc |
| Body Density | 4.5 g/cc | | |

In addition, FIG. 101 illustrates the x-axis and z-axis movement of the CG as the weight assembly is adjusted through twenty-one separate positions within the channel 9320 of the club head embodiment described in relation to Table 13. As shown there, the range of adjustment for CGx is from 4.9 mm near the heel, to 1.7 mm at the center, to −0.5 mm near the toe, providing a Max ΔCGx of 5.4 mm, and an average CG step of 0.27 mm for each position. In addition, the range of adjustment for CGz is from −1.7 mm near the heel, to −2.8 mm at the center, to −2.4 mm near the toe, providing a Max ΔCGz of 1.1 mm, and a CG step of 0 to 0.16 mm. In the embodiment, the range of adjustment for CGy is from 29.3 mm to 29.4 mm, providing a Max ΔCGy of 0.1 mm.

Whereas the invention has been described in connection with representative embodiments, it will be understood that the invention is not limited to those embodiments. On the contrary, the invention is intended to encompass all modifications, alternatives, and equivalents as may fall within the scope of the invention, as defined by the following claims.

We claim:

1. A golf club comprising:

a club head having a hosel defining an upper opening, and a sole defining a lower opening;

a shaft having a lower end portion;

a shaft sleeve mounted on the lower end portion of the shaft and adapted to be received in the upper opening of the club head and having a shaft sleeve volume and a shaft sleeve mass, wherein majority of the shaft sleeve volume is received in the club head and is composed of a primary portion having a primary portion proximal end, a primary portion distal end, a primary portion axis, a primary portion shaft bore for receiving and mounting the shaft, and a primary portion volume, wherein the primary portion is formed of a primary portion non-metallic material having a primary portion density of less than 2 grams per cubic centimeter, a primary portion tensile strength of at least 150 megapascal, and a primary portion percent elongation to break;

a screw, wherein the shaft sleeve is releasably securable to the club head by inserting the screw through the lower opening and tightening the screw into the shaft sleeve and placing a tensile load on a portion of the primary portion within the club head, and wherein the screw is formed of a screw material having a screw material density, a screw material tensile strength, and a screw material percent elongation to break; and wherein the primary portion percent elongation to break is at least four percent, and the primary portion percent elongation to break is 25-99% of the screw material percent elongation to break.

2. The golf club of claim 1, wherein a primary portion product is the product of the primary portion percent elongation to break and the primary portion tensile strength in megapascal, and the primary portion product is greater than 800.

3. The golf club of claim 2, wherein the primary portion percent elongation to break is at least fifty percent of the screw material percent elongation to break, and the primary portion volume is at least ⅚ of the shaft sleeve volume.

4. The golf club of claim 3, wherein the primary portion volume is least 3.0 cubic centimeters and at least 15/16 of the shaft sleeve volume, the primary portion density is less than 1.75 grams per cubic centimeter, and the shaft sleeve mass is less than 6 grams.

5. The golf club of claim 2, wherein the screw material tensile strength is at least 3.75 times the primary portion tensile strength.

6. The golf club of claim 2, wherein the primary portion percent elongation to break is at least six percent, and the primary portion product is 1250-2000.

7. The golf club of claim 1, wherein the primary portion includes an integral upper annular thrust surface preventing a portion of the primary portion from entering the club head and thereby defining a ferrule that is integral to the primary portion and has a ferrule volume and a ferrule mass, wherein the ferrule volume is at least 15% of the primary portion volume and the ferrule mass is less than 20% of the shaft sleeve mass, and wherein a primary portion length, from the primary portion proximal end to the primary portion distal end, is at least 40 millimeters and includes the ferrule.

8. The golf club of claim 1, wherein the hosel has a hosel longitudinal axis, the primary portion has a primary portion wall thickness, and the primary portion includes a plurality of splines that engage a portion of the hosel, wherein the primary portion axis is not parallel to the hosel longitudinal axis, and the primary portion wall thickness varies circumferentially about the primary portion.

9. The golf club of claim 1, further including a secondary portion having a secondary portion proximal end, a secondary portion distal end, a secondary portion length, a secondary portion axis, a secondary portion bore establishing a secondary portion bore wall thickness having a minimum secondary portion bore wall thickness and a maximum secondary portion bore wall thickness, and a secondary portion volume, wherein the secondary portion is formed of a secondary portion material having a secondary portion density that is greater than the primary portion density, a secondary portion tensile strength that is greater than the primary portion tensile strength, and a secondary portion percent elongation to break, wherein the primary portion percent elongation to break is 25-99% of the secondary portion percent elongation to break, and wherein the secondary portion bore is releasably securable to the club head by inserting the screw through the lower opening and tightening the screw into the secondary portion bore to place a tensile load on the portion of the primary portion within the club head.

10. The golf club of claim 9, wherein a secondary portion product is the product of the secondary portion percent elongation to break and the secondary portion tensile strength in megapascal, wherein the secondary portion product is greater than 1500 and is greater than the primary portion product, and the primary portion volume is at least five times the secondary portion volume.

11. The golf club of claim 10, wherein the secondary portion percent elongation to break is less than the screw material percent elongation to break, and the secondary portion product is at least twice the primary portion product.

12. The golf club of claim 9, wherein the secondary portion material is metallic and the secondary portion density is at least 2 grams per cubic centimeter, the secondary portion tensile strength is at least 250 megapascal, and the primary portion tensile strength is at least forty percent of secondary portion tensile strength.

13. The golf club of claim 9, wherein the screw material tensile strength is at least fifty percent greater than secondary portion tensile strength, and the primary portion percent elongation to break is 50-80% of the secondary portion percent elongation to break.

14. A golf club comprising:

a club head having a hosel defining an upper opening, and a sole defining a lower opening;

a shaft having a lower end portion;

a shaft sleeve mounted on the lower end portion of the shaft and adapted to be received in the upper opening of the club head and having a shaft sleeve volume and a shaft sleeve mass, wherein majority of the shaft sleeve volume is received in the club head and is composed of a primary portion having a primary portion proximal end, a primary portion distal end, a primary portion axis, a primary portion shaft bore for receiving and mounting the shaft, and a primary portion volume, wherein the primary portion is formed of a primary portion non-metallic material having a primary portion density of less than 2 grams per cubic centimeter, a primary portion tensile strength of at least 150 megapascal, and a primary portion percent elongation to break;

a screw, wherein the shaft sleeve is releasably securable to the club head by inserting the screw through the lower opening and tightening the screw into the shaft sleeve and placing a tensile load on a portion of the primary portion within the club head, and wherein the screw is formed of a screw material having a screw material density, a screw material tensile strength, and a screw material percent elongation to break; and wherein the primary portion percent elongation to break is at least four percent, a primary portion product is the product of the primary portion percent elongation to break and the primary portion tensile strength in megapascal, and the primary portion product is greater than 800, and the primary portion volume is at least ⅚ of the shaft sleeve volume.

15. The golf club of claim 14, wherein the primary portion volume is least 3.0 cubic centimeters and at least 15/16 of the shaft sleeve volume, the primary portion density is less than 1.75 grams per cubic centimeter, and the shaft sleeve mass is less than 6 grams.

16. The golf club of claim 14, wherein the primary portion percent elongation to break is at least six percent, and the primary portion product is 1250-2000.

17. The golf club of claim 14, wherein the primary portion includes an integral upper annular thrust surface preventing a portion of the primary portion from entering the club head and thereby defining a ferrule that is integral to the primary portion and has a ferrule volume and a ferrule mass, wherein the ferrule volume is at least 15% of the primary portion volume and the ferrule mass is less than 20% of the shaft sleeve mass, a primary portion length, from the primary portion proximal end to the primary portion distal end, is at least 40 millimeters and includes the ferrule, and the hosel has a hosel longitudinal axis, the primary portion has a primary portion wall thickness, and the primary portion includes a plurality of splines that engage a portion of the hosel, wherein the primary portion axis is not parallel to the hosel longitudinal axis and is configured to allow a loft change of at least about 0.5 degrees, and the primary portion wall thickness varies circumferentially about the primary portion.

18. The golf club of claim 14, the primary portion percent elongation to break is 25-99% of the screw material percent elongation to break, and the screw material tensile strength is at least 3.75 times the primary portion tensile strength.

19. The golf club of claim 14, wherein the club head includes at least one movable weight.

20. The golf club of claim 14, further including at least one weight port formed in the club head, and at least one weight configured to be at least partially retained within the at least one weight port.

* * * * *